US008871413B2

(12) United States Patent
Kaneko et al.

(10) Patent No.: US 8,871,413 B2
(45) Date of Patent: Oct. 28, 2014

(54) TONERS FOR ELECTROSTATIC-IMAGE DEVELOPMENT, CARTRIDGE EMPLOYING TONER FOR ELECTROSTATIC-IMAGE DEVELOPMENT, AND IMAGE-FORMING APPARATUS

(75) Inventors: Yuzo Kaneko, Niigata (JP); Masaya Oota, Mie (JP); Shiho Sano, Niigata (JP); Masakazu Sugihara, Niigata (JP); Teruki Senokuchi, Mie (JP); Shiro Yasutomi, Niigata (JP); Takeshi Owada, Chesapeake, VA (US); Yumi Hirabaru, Niigata (JP); Takuya Nishikiori, Niigata (JP); Teruyuki Mitsumori, Tokyo (JP); Kozo Ishio, Kanagawa (JP); Hiroaki Takamura, Kanagawa (JP)

(73) Assignee: Mitsubishi Chemical Corporation, Tokyo (JP)

( * ) Notice: Subject to any disclaimer, the term of this patent is extended or adjusted under 35 U.S.C. 154(b) by 989 days.

(21) Appl. No.: 12/679,233

(22) PCT Filed: Sep. 19, 2008

(86) PCT No.: PCT/JP2008/067046

§ 371 (c)(1),
(2), (4) Date: Oct. 18, 2010

(87) PCT Pub. No.: WO2009/038202

PCT Pub. Date: Mar. 26, 2009

(65) Prior Publication Data

US 2011/0038650 A1 Feb. 17, 2011

(30) Foreign Application Priority Data

Sep. 20, 2007 (JP) ..... P. 2007-244285
Sep. 26, 2007 (JP) ..... P. 2007-249894
Sep. 27, 2007 (JP) ..... P. 2007-252620
Sep. 27, 2007 (JP) ..... P. 2007-252621
Oct. 3, 2007 (JP) ..... P. 2007-259495
Oct. 3, 2007 (JP) ..... P. 2007-259539
Oct. 3, 2007 (JP) ..... P. 2007-259620

(51) Int. Cl.
*G03G 9/08* (2006.01)
*G03G 9/093* (2006.01)
*G03G 9/087* (2006.01)

(52) U.S. Cl.
CPC ..... *G03G 9/0827* (2013.01); *G03G 9/0823* (2013.01); *G03G 9/0806* (2013.01); *G03G 9/09392* (2013.01); *G03G 9/0819* (2013.01); *G03G 2215/0614* (2013.01); *G03G 2221/0005* (2013.01); *G03G 9/0821* (2013.01); *G03G 9/08782* (2013.01)
USPC ..... 430/108.1; 430/108.2; 430/110.3

(58) Field of Classification Search
USPC ..... 430/108.1–108.24, 110.3
See application file for complete search history.

(56) References Cited

U.S. PATENT DOCUMENTS 5,547,791 A * 8/1996 Ishio et al. ..... 430/58.45
5,677,094 A 10/1997 Umeda et al.
5,932,384 A 8/1999 Mitsumori et al.
5,985,502 A 11/1999 Ayaki et al.
6,170,935 B1 * 1/2001 Wakahara et al. ..... 347/55
6,291,120 B1 9/2001 Nishigaki et al.
2001/0019804 A1 * 9/2001 Kurihara et al. ..... 430/60
2003/0198881 A1 * 10/2003 Kawamura et al. ..... 430/59.6
2005/0084787 A1 * 4/2005 Kobayashi et al. ..... 430/125
2005/0089778 A1 * 4/2005 Nagase et al. ..... 430/45
2005/0100803 A1 * 5/2005 Suzuki ..... 430/65
2006/0105254 A1 5/2006 Wu et al.
2007/0020549 A1 * 1/2007 Koyama et al. ..... 430/109.3
2007/0031748 A1 2/2007 Kotsugai et al.
2007/0077507 A1 4/2007 Otsubo et al.
2007/0190445 A1 * 8/2007 Yoshida et al. ..... 430/108.21
2007/0224532 A1 * 9/2007 Vanbesien et al. ..... 430/108.22
2007/0292780 A1 * 12/2007 Nagai et al. ..... 430/58.2
2008/0008945 A1 * 1/2008 Onaka et al. ..... 430/48
2008/0014527 A1 1/2008 Kotsugai et al.
2008/0032223 A1 * 2/2008 Yamamoto et al. ..... 430/108.1
2009/0041500 A1 2/2009 Mitsumori et al.

| | | | |
|---|---|---|---|
| 2009/0053634 | A1 | 2/2009 | Mitsumori et al. |
| 2009/0117487 | A1 | 5/2009 | Ishiyama et al. |
| 2009/0123186 | A1 | 5/2009 | Sugiura et al. |
| 2009/0180807 | A1 | 7/2009 | Mitsumori et al. |
| 2009/0291379 | A1 | 11/2009 | Oota et al. |
| 2011/0038650 | A1 | 2/2011 | Kaneko et al. |

FOREIGN PATENT DOCUMENTS

| | | | |
|---|---|---|---|
| JP | 2-43225 | | 2/1990 |
| JP | 5-34938 | A | 2/1993 |
| JP | 8-101524 | A | 4/1996 |
| JP | 8-262762 | | 10/1996 |
| JP | 9-179351 | | 7/1997 |
| JP | 10-232509 | | 9/1998 |
| JP | 10-312071 | A | 11/1998 |
| JP | 11 65170 | | 3/1999 |
| JP | 11-212412 | | 8/1999 |
| JP | 2000-7933 | A | 1/2000 |
| JP | 2000-242016 | A | 9/2000 |
| JP | 2000-330307 | A | 11/2000 |
| JP | 2001-83741 | | 3/2001 |
| JP | 2001-166662 | | 6/2001 |
| JP | 2001-226379 | A | 8/2001 |
| JP | 2001-242645 | | 9/2001 |
| JP | 2001-305756 | A | 11/2001 |
| JP | 2001-356508 | A | 12/2001 |
| JP | 2002-31903 | | 1/2002 |
| JP | 2002 62685 | | 2/2002 |
| JP | 2002-62686 | A | 2/2002 |
| JP | 2002-169335 | | 6/2002 |
| JP | 2002-258532 | | 9/2002 |
| JP | 2002-268490 | | 9/2002 |
| JP | 2002-278153 | | 9/2002 |
| JP | 2002 296829 | | 10/2002 |
| JP | 2002-296829 | | 10/2002 |
| JP | 2002-357913 | A | 12/2002 |
| JP | 2003-195541 | A | 7/2003 |
| JP | 2003-231757 | | 8/2003 |
| JP | 2003-255567 | | 9/2003 |
| JP | 2003-255585 | | 9/2003 |
| JP | 2003-307988 | | 10/2003 |
| JP | 2004-78097 | | 3/2004 |
| JP | 2004-198784 | A | 7/2004 |
| JP | 2004-220005 | A | 8/2004 |
| JP | 2004-287427 | | 10/2004 |
| JP | 2004-294751 | | 10/2004 |
| JP | 2005-77461 | | 3/2005 |
| JP | 2005-99582 | | 4/2005 |
| JP | 2005-208620 | | 8/2005 |
| JP | 2005-227524 | | 8/2005 |
| JP | 2005 250456 | | 9/2005 |
| JP | 2005-331925 | A | 12/2005 |
| JP | 2005-345861 | A | 12/2005 |
| JP | 2006 23351 | | 1/2006 |
| JP | 2006 30730 | | 2/2006 |
| JP | 2006-126327 | A | 5/2006 |
| JP | 2006-144016 | A | 6/2006 |
| JP | 2006-171703 | | 6/2006 |
| JP | 2006-267199 | A | 10/2006 |
| JP | 2006-301594 | | 11/2006 |
| JP | 2006 330131 | | 12/2006 |
| JP | 2006-337416 | | 12/2006 |
| JP | 2007-17962 | | 1/2007 |
| JP | 2007-86759 | A | 4/2007 |
| JP | 2007 94226 | | 4/2007 |
| JP | 2007-121662 | | 5/2007 |
| JP | 2007-127776 | | 5/2007 |
| JP | 2009-93160 | A | 4/2009 |
| JP | 2009-98677 | A | 5/2009 |
| WO | WO 2004/088431 | A1 | 10/2004 |

OTHER PUBLICATIONS

Chinese Office Action issued Aug. 31, 2011, in Patent Application No. 200880108082.4 (with English-language translation).
Presentation of Publication and the like submitted on Jul. 21, 2012 in Japanese Application No. 2008-237557 (With English Translation).
Presentation of Publication and the like submitted on Jul. 21, 2012 in Japanese Application No. 2008-247806 (With English Translation).
Presentation of Publication and the like submitted on Jul. 21, 2012 in Japanese Application No. 2008-247807 (With English Translation).
Presentation of Publication and the like submitted on Jul. 21, 2012 in Japanese Application No. 2008-247808 (With English Translation).
Office Action issued Mar. 5, 2013 in Japanese Patent Application No. 2008-247807 (with English-language translation).
Office Action issued Mar. 12, 2013 in Japanese Patent Application No. 2008-237557 (with English-language translation).
Office Action issued Mar. 26, 2013 in Japanese Patent Application No. 2008-248994 (with English-language translation).
Office Action issued Apr. 2, 2013 in Japanese Patent Application No. 2008- 247534 (with English-language translation).
Office Action issued Apr. 2, 2013 in Japanese Patent Application No. 2008- 248790 (with English-language translation).
Office Action issued Apr. 2, 2013 in Japanese Patent Application No. 2008- 248446 (with English-language translation).
Office Action issued Nov. 6, 2012 in Japanese Application No. 2008-237557 (With English Translation).
Office Action issued Nov. 20, 2012 in Japanese Application No. 2008-247807 (With English Translation).
Japanese Information Offer Form issued Oct. 20, 2012, in Patent Application No. 2008-248446 (with English-language translation).
Japanese Information Offer Form issued Oct. 20, 2012, in Patent Application No. 2008-248790 (with English-language translation).
Japanese Information Offer Form issued Oct. 20, 2012, in Patent Application No. 2008-248994 (with English-language translation).
Japanese Office Action issued Jul. 2, 2013 in Patent Application No. 2008-237557 with English Translation.
Office Action issued Aug. 6, 2013 in Japanese Patent Application No. 2008-248446 (with English-language translation).
Office Action issued Aug. 6, 2013 in Japanese Patent Application No. 2008-248790 (with English-language translation).
Office Action issued on Nov. 26, 2013 in the corresponding Japanese Patent Application No. 2008-248994 (with English Translation).
Office Action issued Mar. 11, 2014 in Japanese Patent Application No. 2008-248994 (with English language translation).

* cited by examiner

*Primary Examiner* — Mark F Huff
*Assistant Examiner* — Rashid Alam
(74) *Attorney, Agent, or Firm* — Oblon, Spivak, McClelland, Maier & Neustadt, L.L.P.

(57) ABSTRACT

An object of the invention is to provide a toner which is effective in improving image quality while inhibiting white-background fouling, residual-image phenomenon (ghost), blurring (suitability for solid printing), and the like that occur depending on the proportion of a fine powder having a particle diameter not larger than a specific value, and which has satisfactory removability in cleaning, mitigates problems concerning fouling, etc. in long-term use even on a high-speed printer, and attains excellent image stability. Another object is to provide an image-forming apparatus and a toner cartridge each employing the toner. The invention provides a toner for electrostatic-image development satisfying all of the following (1) to (4) or a toner for electrostatic-image development which is a toner containing a charge control agent and satisfying all of the following (5) to (7). The invention further provides an image-forming apparatus and a toner cartridge each employing the toner.

(1) To have a volume-median diameter (Dv50) of from 4.0 μm to 7.5 μm.

(2) To have an average degree of circularity of 0.93 or higher.

(3) A volume-median diameter (Dv50) of the toner and population number % of toner particles having a particle diameter of from 2.00 μm to 3.56 μm (Dns) in the toner satisfy the relationship Dns≤0.233 EXP(17.3/Dv50).

(4) To have a coefficient of variation in number of 24.0% or lower.

(5) To have a volume-median diameter (Dv50) of from 4.0 μm to 7.5 μm.

(6) A volume-median diameter (Dv50) of the toner and population number % of toner particles having a particle diameter of from 2.00 μm to 3.56 μm (Dns) in the toner satisfy the relationship Dns≤0.233 EXP(17.3/Dv50).

(7) When the charge control agent on the toner surface is cleaned, the resultant depressions have an average diameter of 500 nm or smaller.

16 Claims, 8 Drawing Sheets

TONERS FOR ELECTROSTATIC-IMAGE DEVELOPMENT, CARTRIDGE EMPLOYING TONER FOR ELECTROSTATIC-IMAGE DEVELOPMENT, AND IMAGE-FORMING APPARATUS

TECHNICAL FIELD

The present invention relates to toners for electrostatic-image development, an image-forming apparatus, and a cartridge which are used in electrophotography, electrostatic photography, or the like.

BACKGROUND ART

The range of applications of image-forming apparatus such as electrophotographic copiers is increasing in recent years, and the market is coming to demand a higher level of image quality. In particular, in the production of business documents or the like, the image-inputting technique and the technique of forming a latent image have been developed and a richer variety of character types and a higher degree of character fineness have come to be used or attained in output. In addition, the spread and development of presentation software have led to a desire for the reproducibility of latent images of extremely high quality which give printed images having few defects and little blurring. Especially in the case where an electrostatic latent image on the latent-image carrier as a component of an image-forming apparatus is an image made up of lines of 100 μm or thinner (about 300 dpi or higher), use of conventional toners having a large particle diameter as a developer generally results in poor thin-line reproducibility. Such conventional toners are still insufficient in the clearness of line images.

In particular, in image-forming apparatus employing digital image signals, such as electrophotographic printers, a latent image is constituted of an arrangement of given dot units, and a solid-image area, half-tone area, and light area are expressed by changing dot density. However, when a toner is not disposed faithfully on the dot units and the position of the dot units does not coincide with the position of the actually disposed toner, the result is a problem that the toner image does not have the gradation corresponding to a dot density ratio between black and white areas of the digital latent image. Furthermore, in the case where resolution is to be improved by dot size reduction in order to improve image quality, it becomes more difficult to faithfully develop a latent image constituted of microdots. There surely is a tendency in this case that an image which has high resolution and poor gradation and lacks sharpness is obtained.

Moreover, because of the advent of a blue laser, dot sizes in electrostatic latent images are expected to further decrease in future. There is a desire for an image formation technique applicable to such trend.

Under these circumstances, developers intended to improve image quality have been proposed which have a regulated particle size distribution so as to attain improved reproducibility of microdots. Patent document 1 proposes a toner having an average particle diameter of 6-8 μm. It was attempted therein to develop a latent microdot image with satisfactory reproducibility by reducing particle diameter. Patent document 2 discloses a toner having a weight-average particle diameter of 4-8 μm and comprising toner base particles which include 17-60% by number toner base particles having a particle diameter of 5 μm or smaller. Patent document 3 discloses a magnetic toner including 17-60% by number magnetic toner base particles having a particle diameter of 5 μm or smaller. Patent document 4 discloses toner base particles having a toner particle size distribution in which the content of toner base particles having a particle diameter of 2.0-4.0 μm is 15-40% by number. Patent document 5 describes a toner in which particles of 5 μm or smaller account for about 15-65% by number. Patent document 6 and patent document 7 disclose toners of the same kind. Patent document 8 describes a toner which includes 17-60% by number toner base particles having a particle diameter of 5 μm or smaller, 1-30% by number toner base particles having a particle diameter of 8-12.7 μm, and up to 2.0% by volume toner base particles having a particle diameter of 16 μm or larger, and which has a volume-average particle diameter of 4-10 μm and has a specific particle size distribution with respect to the toner particles of 5 μm or smaller. Furthermore, patent document 9 describes toner particles which have a 50%-volume particle diameter of 2-8 μm and in which toner particles having a particle diameter of 0.7×(50%–number particle diameter) or smaller account for 10% by number or less.

However, those toners each contain particles of 3.56 μm or smaller in a large amount in terms of % by number exceeding the upper limit which is the right side of the expression (4) according to the invention. This means that with respect to relationship between particle diameter and fine powder, the proposed toners each are a toner in which a fine powder remains in a relatively large amount in toner particles having a given particle diameter. Because of the proportion of a fine powder which is still high, such toners have had the following unsolved problems. When such a toner is used in development techniques which require a toner having the ability to be quickly electrified, such as the ability to be instantaneously charged by friction, as in, in particular, nonmagnetic one-component development, then some particles remain insufficiently charged. Because of this, troubles arise such as toner particle falling or toner particle scattering from the developing roller, the residual-image phenomenon (ghost) in which a printing history in the first cycle is reflected in the developing roller in the second and succeeding cycles to selectively increase/reduce image density, and the fouling of printed images due to a drum cleaning failure or improper toner layer formation on the developing roller.

In recent years, there is a desire for life prolongation and high-speed printing besides the market demand for image quality. However, the conventional toners do not fully satisfy these requirements. Toners having a high fine-powder content like the conventional toners further have had the following problem. With the progress of continuous printing, the fine powder fouls members to reduce, e.g., toner-charging ability, resulting in poor image reproduction. When such a toner is used in a high-speed printer, there also has been a problem that toner dusting occurs considerably.

For providing high-image-quality printing, it is necessary that a toner should have a narrow particle diameter distribution. This is because when a toner contains coarse particles, this toner has a broad charge amount distribution and this results in the phenomenon called "selective development". The "selective development" is a phenomenon in which when a toner having a broad charge amount distribution is used, only the toner particles having a charge amount necessary for development are used and consumed for development in copying. Consequently, satisfactory images are obtained in the initial stage of copying. However, with the progress of continuous copying, the density gradually decreases or toner particles having a larger diameter come to be used to give grained images. A toner which undergoes such a phenomenon is regarded as a toner having poor unsusceptibility to selective development. Furthermore, coarse particles having a small charge amount tend to considerably reduce a guaranteed life in terms of number of prints. Patent document 10 discloses a toner containing a large amount of coarse particles, i.e., having a coefficient of variation in number of 24.2%. Such a toner is unsuitable for stably providing high-resolution images. Patent document 11 does not indicate a narrow particle size distribution.

For providing high-image-quality printing, it is necessary to give attention to the transferability of toners. A toner having high transferability is such a toner that toner particles disposed on a latent image on a photoreceptor are transferred highly efficiently to an intermediate transfer drum or paper or that toner particles are transferred highly efficiently from an intermediate transfer drum to paper. Patent documents 12 to 14 disclose pulverization toners, which are thought not to have a high degree of circularity because of the production steps. These pulverization toners are unsatisfactory from the standpoint of providing high-image-quality printing.

In an electrophotographic apparatus, a toner which has developed an electrostatic latent image formed on the electrostatic-image holding member is transferred to a receiving material, e.g., paper. There are cases where the toner is transferred from the electrostatic-image holding member to a sheet of paper not directly but indirectly through an intermediate transfer material. In this transfer part, the toner is not wholly transferred from the electrostatic-image holding member and a small proportion thereof remains as an untransferred toner on the electrostatic-image holding member. Consequently, a cleaning part is necessary in which the untransferred toner is removed from the electrostatic-image holding member after transfer.

In this cleaning part, the cleaning blade method has been frequently employed hitherto. Namely, in this method, a cleaning blade made of a material having a relatively low modulus, such as, e.g., a urethane rubber, is brought into contact with the electrostatic-image holding member to wipe off the untransferred toner based on the movement of the cleaning blade relative to the electrostatic-image holding member. Although a tip ridgeline of the cleaning blade is in contact with the electrostatic-image holding member to dam up the untransferred toner, the ridgeline is finely vibrating when viewed microscopically. The tip ridgeline elastically deforms, in the state of adhering to the electrostatic-image holding member, with the movement of the electrostatic-image holding member due to the force of resistance of static friction with the electrostatic-image holding member, and is released to recover the original shape when elastic repulsion exceeds the force of resistance of static friction. This tip ridgeline which has recovered the original shape adheres to the electrostatic-image holding member and elastically deforms again. The tip ridgeline repeatedly undergoes the microscopic vibration, which includes those steps. This phenomenon is called "stick-and-slip".

Even when stick-and-slip occurs in conducting cleaning for toner removal, the untransferred toner dammed up and collected is usually prevented from leaking out through the gap between the cleaning blade and the electrostatic-image holding member. However, it is difficult in some cases to completely dam up slippy particles such as small particles or particles having a high average degree of circularity.

Completely removing small particles necessitates strict control regarding component position accuracy, etc. When particles which are small as compared with the average particle diameter are contained in a large amount, there is a higher possibility that an untransferred toner might pass through the cleaning blade. Although toners are shifting from pulverization toners to wet-process toners in recent years, wet-process toners have a smoother surface and a higher average degree of circularity than pulverization toners and are hence more apt to pass through. Even among pulverization toners, there recently are many toners to which a high average degree of circularity has been imparted by smoothing the surface with heat or through mechanical processing. Such pulverization toners also are apt to pass through. Consequently, there currently is an increasing desire for an image-forming apparatus in which toner particles are less apt to pass through.

In the stick-and-slip phenomenon, the width and period of the vibration depend on the force of resistance of static friction between the cleaning blade and the electrostatic-image holding member and on the force of resistance of dynamic friction therebetween (which relates to the rate at which the cleaning blade recovers the original shape thereof). There are even cases where at a given vibration width and a given vibration period, toner particles having a specific particle diameter, specific shape, or specific degree of slippiness are especially apt to pass through. Such phenomenon in which specific particles are especially apt to pass through is exceedingly difficult to deal with theoretically, and a sufficient knowledge has not yet been obtained on what combination of a toner, an electrostatic-image holding member, and a cleaning blade attains the state in which toner particles are less apt to pass through.

Meanwhile, in view of the market demand for toner particle diameter reduction for higher resolution, it is necessary to provide a technique which attains stable cleaning performance. Although the necessity of this technique is becoming higher because of the advent of wet-process toners and pulverization toners having a smooth surface as stated above, there has been no satisfactory technique.

Among evaluation items for printed images is gloss. Gloss reflects the degree of glossiness of an image. In some cases, higher values of gloss such as those required of photograph image quality are preferred. However, it is desirable to avoid excessively high gloss because too high gloss values result in image glittering.

For stably providing high-resolution images, it is necessary to use a toner having excellent electrification characteristics. Although a technique for incorporating a charge control agent into a toner is known, it has been difficult to incorporate a charge control agent into a toner having a small particle diameter.

Patent Document 1: JP-A-2-284158
Patent Document 2: JP-A-5-119530
Patent Document 3: JP-A-1-221755
Patent Document 4: JP-A-6-289648
Patent Document 5: JP-A-2001-134005
Patent Document 6: JP-A-11-174731
Patent Document 7: JP-A-2001-175024
Patent Document 8: JP-A-2-000877
Patent Document 9: JP-A-2004-045948
Patent Document 10: JP-A-2003-255567
Patent Document 11: WO 2004-088431
Patent Document 12: JP-A-7-98521
Patent Document 13: JP-A-2006-91175
Patent Document 14: JP-A-2006-119616

DISCLOSURE OF THE INVENTION

Problems that the Invention is to Solve

The invention has been achieved in view of the prior-art techniques described above. An object thereof is to provide a toner which is effective in improving image quality while inhibiting white-background fouling, residual-image phenomenon (ghost), blurring (suitability for solid printing), and the like that occur depending on the proportion of a fine powder having a particle diameter not larger than a specific value, and which has satisfactory removability in cleaning, mitigates problems concerning fouling, etc. in long-term use even on a high-speed printer, and attains excellent image stability. Another object is to provide a toner which has a small particle diameter and, despite this, is reduced in gloss.

Still another object of the invention is to provide a toner which is prevented from suffering "selective development" and is capable of stably forming high-resolution images.

A further object of the invention is to provide an image-forming apparatus which has stable cleaning performance and is inhibited from arousing the troubles caused by a cleaning failure, such as fouling of interior parts of the apparatus and image failures, and which is less apt to arouse those problems even when used over long and attains satisfactory image quality and excellent image stability.

Still a further object is to provide an image-forming apparatus and a toner cartridge each employing any of these toners.

Means for Solving the Problems

The present inventors diligently made investigations in order to overcome the problems described above. As a result, they have found that those problems can be eliminated with a toner satisfying a specific relational expression. The invention has been thus completed.

Namely, essential points of the invention are as follows.

[1] A toner for electrostatic-image development satisfying all of the following (1) to (4):

(1) a volume-median diameter (Dv50) is from 4.0 μm to 7.5 μm;

(2) an average degree of circularity is 0.93 or higher;

(3) a volume-median diameter (Dv50) of the toner and population number % of toner particles having a particle diameter of from 2.00 μm to 3.56 μm (Dns) in the toner satisfy the relationship Dns≤0.233EXP(17.3/Dv50); and (4) a coefficient of variation in number is 24.0% or lower.

[2] A toner for electrostatic-image development comprising a charge control agent, and satisfying all of the following (5) to (7):

(5) a volume-median diameter (Dv50) is from 4.0 μm to 7.5 μm;

(6) a volume-median diameter (Dv50) of the toner and population number % of toner particles having a particle diameter of from 2.00 μm to 3.56 μm (Dns) in the toner satisfy the relationship Dns≤0.233EXP(17.3/Dv50); and (7) when the charge control agent on the toner surface is removed, the resultant depressions have an average diameter of 500 nm or smaller.

[3] The toner for electrostatic-image development according to [2], wherein the charge control agent is present near the surface.

[4] The toner for electrostatic-image development according to [2], wherein when the average diameter of depressions which are to be formed upon removal of the charge control agent is expressed by R, the charge control agent is present in the range of ±R centering on the toner surface.

[5] The toner for electrostatic-image development according to [2], wherein the charge control agent to be incorporated has an average dispersed diameter of 500 nm or smaller.

[6] The toner for electrostatic-image development according to [1] or [2], wherein the volume-median diameter (Dv50) of the toner and population number % of toner particles having a particle diameter of from 2.00 μm to 3.56 μm (Dns) in the toner satisfy the relationship Dns≤0.11EXP(19.9/Dv50).

[7] The toner for electrostatic-image development according to [1] or [2], wherein the volume-median diameter (Dv50) of the toner and population number % of toner particles having a particle diameter of from 2.00 μm to 3.56 μm (Dns) in the toner satisfy the relationship 0.0517EXP(22.4/Dv50) ≤Dns.

[8] The toner for electrostatic-image development according to [1] or [2], wherein the volume-median diameter (Dv50) of the toner is from 5.0 μm to 7.5 μm.

[9] The toner for electrostatic-image development according to [1] or [2], wherein the population number % of toner particles having a particle diameter of from 2.00 μm to 3.56 μm (Dns) is 6% by number or lower.

[10] The toner for electrostatic-image development according to [1] or [2], which is a toner obtained by forming particles in an aqueous medium.

[11] The toner for electrostatic-image development according to [1] or [2], which is a toner produced by an emulsion polymerization agglutination method.

[12] The toner for electrostatic-image development according to [1] or [2], which comprises core particles and fine resin particles bonded or adhered to the core particles.

[13] The toner for electrostatic-image development according to [12], wherein the fine resin particles contain a wax.

[14] The toner for electrostatic-image development according to [12] or [13], wherein the core particles each are constituted at least of primary polymer particles, and the total proportion of polar monomers in 100% by mass of all polymerizable monomers constituting a binder resin as the fine resin particles is lower than the total proportion of polar monomers in 100% by mass of all polymerizable monomers constituting a binder resin as the primary polymer particles constituting the core particles.

[15] The toner for electrostatic-image development according to [1] or [2], which comprises a wax in an amount of 4 to 20 parts by weight per 100 parts by weight of the toner for electrostatic-image development.

[16] The toner for electrostatic-image development according to [1] or [2], which is a color toner.

[17] The toner for electrostatic-image development according to [16], which has a surface potential of −30 V or lower.

[18] The toner for electrostatic-image development according to [16] or

[17], where a solid print image has a gloss value of 32 or lower.

[19] The toner for electrostatic-image development according to [1] or [2], which is for use in an image-forming apparatus in which a process speed of development on a latent-image carrier is 100 mm/sec or higher.

[20] The toner for electrostatic-image development according to [1] or [2], which is for use in an image-forming apparatus satisfying the following expression (8):

$$[\text{guaranteed life in number of prints of the developing device to be packed with developer (sheets)}]\times(\text{coverage rate})\geq 400\ (\text{sheets}). \quad (8)$$

[21] The toner for electrostatic-image development according to [1] or [2], which is for use in an image-forming apparatus where a resolution on a latent-image carrier is 600 dpi or higher.

[22] The toner for electrostatic-image development according to [1] or [2], which is obtained without via a step for removing particles not larger than the volume-median diameter (Dv50) of the toner.

[23] The toner for electrostatic-image development according to [1] or [2], which has a standard deviation of charge amount of from 1.0 to 2.0.

[24] A toner for electrostatic-image development, which is for use in an image-forming apparatus comprising: an electrophotographic photoreceptor comprising a conductive substrate and a photosensitive layer formed thereover; a toner for electrostatic-image development; a charging part where the electrophotographic photoreceptor is charged; an electrostatic-latent-image part where the surface of the electrophotographic photoreceptor is exposed to light to form an electrostatic latent image; a developing part where the toner for electrostatic-image development is adhered to the electrostatic latent image formed in the surface of the electrophotographic photoreceptor; a transfer part where the toner for electrostatic-image development on the electrophotographic photoreceptor is transferred to a receiving material; and a cleaning part where the toner for electrostatic-image development remaining on the electrophotographic photoreceptor after the transfer is cleaned with a cleaning blade which hs a material having a rubber hardness of 50-90 and is in contact with the electrophotographic photoreceptor, in which the toner for electrostatic-image development satisfies all of the following (1) to (4):

(1) a volume-median diameter (Dv50) is from 4.0 μm to 7.5 μm;

(2) an average degree of circularity is 0.93 or higher;

(3) a volume-median diameter (Dv50) of the toner and population number % of toner particles having a particle diameter of from 2.00 μm to 3.56 μm (Dns) in the toner satisfy the relationship Dns≤0.233EXP(17.3/Dv50);

(4) a coefficient of variation in number is 24.0% or lower.

[25] An image-forming apparatus which comprises: an electrophotographic photoreceptor comprising a conductive substrate and a photosensitive layer formed thereover; a toner for electrostatic-image development; a charging part where the electrophotographic photoreceptor is charged; an electrostatic-latent-image part where the surface of the electrophotographic photoreceptor is exposed to light to form an electrostatic latent image; a developing part where the toner for electrostatic-image development is adhered to the electrostatic latent image formed in the surface of the electrophotographic photoreceptor; and a transfer part where the toner for electrostatic-image development on the electrophotographic photoreceptor is transferred to a receiving material, wherein the toner for electrostatic-image development used in the developing part is the toner for electrostatic-image development according to [1] or [2].

[26] The image-forming apparatus according to [25], which further comprises a cleaning part where the toner for electrostatic-image development remaining on the electrophotographic photoreceptor after the transfer is cleaned with a cleaning blade which has a material having a rubber hardness of 50-90 and is in contact with the electrophotographic photoreceptor.

[27] The image-forming apparatus according to [25], wherein a contact-type charging member is used in the charging part.

[28] The image-forming apparatus according to [25], wherein the photosensitive layer of the electrophotographic photoreceptor contains an azo compound.

[29] The image-forming apparatus according to [25], wherein the light used for exposure in the electrostatic part is monochromatic light having a wavelength 300-500 nm.

[30] The image-forming apparatus according to [25], wherein the photosensitive layer of the electrophotographic photoreceptor has an undercoat layer.

[31] The image-forming apparatus according to [30], wherein the undercoat layer comprises a polyamide resin.

[32] The image-forming apparatus according to [30], wherein the undercoat layer contains metal oxide particles.

[33] The image-forming apparatus according to [30], wherein the undercoat layer comprises a binder resin and metal oxide particles having a refractive index of 3.0 or lower, in which when the undercoat layer is dispersed in a solvent prepared by mixing methanol and 1-propanol in a weight ratio of 7:3, the resultant liquid contains secondary particles of the metal oxide aggregate, the secondary particles have a volume-average particle diameter of 0.1 μm or smaller, and the undercoat layer has a 90%-cumulative particle diameter of 0.3 μm or smaller.

[34] The image-forming apparatus according to [25], which has no cleaning part where the toner for electrostatic-image development remaining on the electrophotographic photoreceptor after the transfer is cleaned.

[35] The image-forming apparatus according to [25], wherein the photosensitive layer of the electrophotographic photoreceptor contains a resin having a structural unit represented by the following formula (A):

[Chem. 1]

(A)

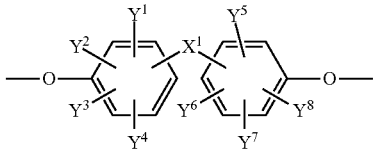

[where $X^1$ represents a single bond or a bivalent connecting group; and $Y^1$ to $Y^8$ each independently represent a hydrogen atom or a substituent having 20 or less atoms].

[36] The image-forming apparatus according to [35], wherein the resin having a structural unit represented by formula (A) is a polyarylate resin or a polycarbonate resin.

[37] The image-forming apparatus according to [25], wherein the photosensitive layer of the electrophotographic photoreceptor contains a charge-transporting substance having an ionization potential of from 4.8 eV to 5.8 eV.

[38] The image-forming apparatus according to [25], wherein the photosensitive layer of the electrophotographic photoreceptor contains a hindered phenol compound.

[39] The image-forming apparatus according to [25], wherein the photosensitive layer of the electrophotographic photoreceptor contains a phthalocyanine.

[40] A cartridge comprising: an electrophotographic photoreceptor comprising a conductive substrate and a photosensitive layer formed thereover; and a toner for electrostatic-image development, wherein the toner for electrostatic-image development is the toner for electrostatic-image development according to [1] or [2].

[41] The cartridge according to [40], wherein the photosensitive layer of the electrophotographic photoreceptor contains an azo compound.

[42] The cartridge according to [40], wherein the photosensitive layer of the electrophotographic photoreceptor has an undercoat layer.

[43] The cartridge according to [42], wherein the undercoat layer comprises a polyamide resin.

[44] The cartridge according to [42], wherein the undercoat layer contains metal oxide particles.

[45] The cartridge according to [42], wherein the undercoat layer comprises a binder resin and metal oxide particles having a refractive index of 3.0 or lower, in which when the undercoat layer is dispersed in a solvent prepared by mixing methanol and 1-propanol in a weight ratio of 7:3, the resultant liquid contains secondary particles of the metal oxide aggregate, the secondary particles have a volume-average particle diameter of 0.1 μm or smaller, and the undercoat layer has a 90%-cumulative particle diameter of 0.3 μm or smaller.

[46] The cartridge according to [40], which has no cleaning part where the toner for electrostatic-image development remaining on the electrophotographic photoreceptor after the transfer is cleaned.

[47] The cartridge according to [40], wherein the photosensitive layer of the electrophotographic photoreceptor contains a resin having a structural unit represented by the following formula (A):

[Chem. 2]

(A)

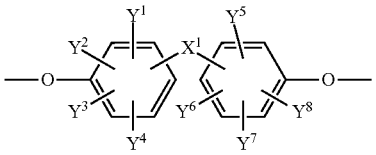

[where $X^1$ represents a single bond or a bivalent connecting group; and $Y^1$ to $Y^8$ each independently represent a hydrogen atom or a substituent having 20 or less atoms].

[48] The cartridge according to [47], wherein the resin having a structural unit represented by formula (A) is a polyarylate resin or a polycarbonate resin.

[49] The cartridge according to [40], wherein the photosensitive layer of the electrophotographic photoreceptor contains a charge-transporting substance having an ionization potential of from 4.8 eV to 5.8 eV.

[50] The cartridge according to [40], wherein the photosensitive layer of the electrophotographic photoreceptor contains a hindered phenol compound.

Advantages of the Invention

According to the invention, a toner excellent in the ability to be quickly electrified and the improvement of surface potential on a developing roller can be provided which is inhibited from causing white-background fouling, residual-image phenomenon (ghost), blurring (suitability for solid printing), excessive gloss, etc., has satisfactory removability in cleaning, is less apt to arouse those problems even when used over long, and attains excellent image stability. This toner has a narrow particle diameter distribution and has a low fine-powder content even when reduced in particle diameter. Because of this, even when used in image formation with the technique of high-speed printing which has been developed recently, the toner attains an improvement in the degree of toner particle packing, i.e., bulk density. This results in a decrease in the content of air present in the interstices among toner base particles and, hence, in a decrease in the heat-insulating effect of the air. It is presumed that the toner image hence has improved thermal conductivity and improved thermal fixability.

A toner reduced in gloss can also be provided.

Furthermore, "selective development" can be prevented, and high-resolution images can be stably provided even in long-term printing. The toner further has excellent transferability and is effective in preventing the internal fouling of the printer.

The invention can further provide an image-forming apparatus which is inhibited from arousing the troubles caused by a cleaning failure, such as fouling of interior parts of the apparatus and image failures, and which is less apt to arouse those problems even when used over long and attains excellent image stability.

Moreover, an image-forming apparatus reduced in image defects such as fogging, color spots, and leakage can be provided due to the synergistic effect of the toner and an electrophotographic photoreceptor having a photosensitive layer containing a specific substance. In addition, an image-forming apparatus which is excellent in those performances and reduced in fogging, is free from dot skipping even at low densities, and attains satisfactory thin-line reproducibility can be provided due to a synergistic effect produced by the toner, the electrophotographic photoreceptor, and a specific undercoat layer of the photoreceptor.

DESCRIPTION OF THE REFERENCE NUMERALS AND SIGNS

Figure 1:
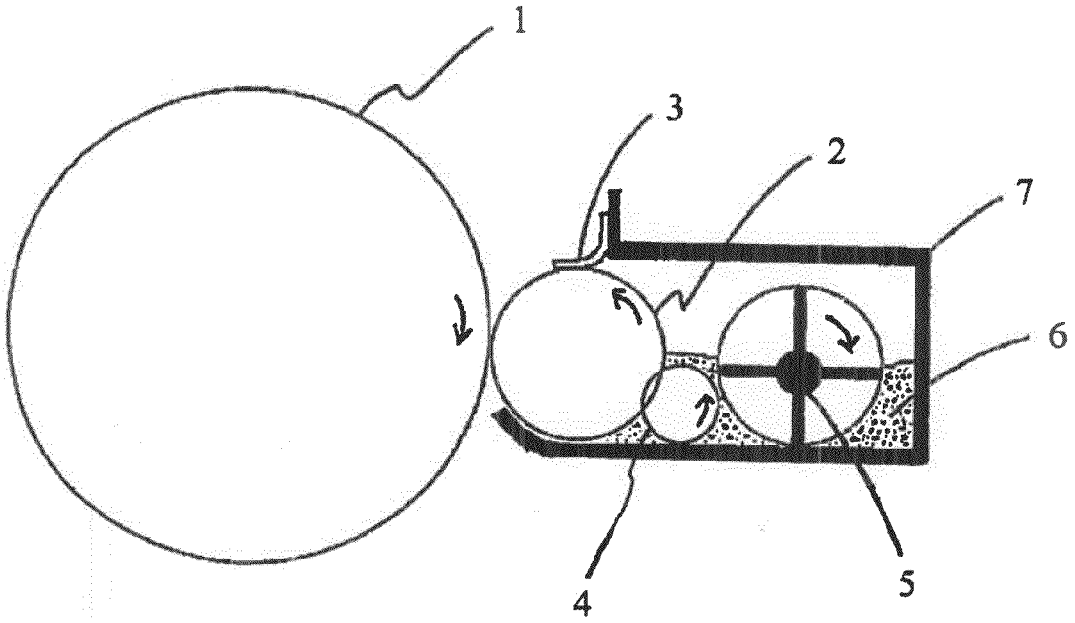
FIG. 1 is a diagrammatic view illustrating one example of nonmagnetic one-component toner developing devices employing a toner of the invention.

1 Electrostatic-latent-image carrier
2 Developing roller (toner-conveying member)
3 Elastic blade (doctor blade; toner layer thickness control member)
4 Sponge roller (toner supply aid member)
6 Agitating blade (agitator)
6 Toner
7 Toner hopper (toner storage chamber)

8 Conveying belt
9 Pressure roller
10 Laser
11 Toner cartridge
12 Fixing belt
13 Heat source
14 Cleaning blade
21 Photoreceptor (electrophotographic photoreceptor)
22 Charging device (charging roller; charging part)
23 Exposure device (exposure part)
24 Developing device (developing part)
25 Transfer device
26 Cleaner (cleaning part)
27 Fixing device
41 Developing vessel
42 Agitator
43 Feed roller
44 Developing roller
45 Control member
71 Upper fixing member (pressure roller)
72 Lower fixing member (fixing roller)
73 Heater
114 Separator
115 Shaft
116 Jacket
117 Stator
119 Discharge passage
121 Rotor
124 Pulley
125 Rotary joint
126 Feed opening
127 Screen support
128 Screen
129 Product slurry discharge opening
131 Disk
132 Blade
135 Valve plug
136 Cylinder
T Toner
P Recording paper (paper, medium)

BEST MODE FOR CARRYING OUT THE INVENTION

The invention will be explained below. However, the invention should not be construed as being limited to the following embodiments, and can be modified at will.

A toner for electrostatic-image development (hereinafter often abbreviated to "toner") of the invention satisfies all of the following (1) to (4):

(1) to have a volume-median diameter (Dv50) of from 4 μm to 7 μm;

(2) to have an average degree of circularity of 0.93 or higher;

(3) the volume-median diameter (Dv50) of the toner and the population number % of toner particles having a particle diameter of from 2 μm to 3.56 μm (Dns) in the toner satisfy the relationship Dns≤0.233EXP(17.3/Dv50);

(4) to have a coefficient of variation in number of 24.0% or lower.

Another toner for electrostatic-image development (hereinafter often abbreviated to "toner") of the invention satisfies all of the following (5) to (7):

(5) to have a volume-median diameter (Dv50) of from 4 μm to 7 μm;

(6) the volume-median diameter (Dv50) of the toner and the population number % of toner particles having a particle diameter of from 2.00 μm to 3.56 μm (Dns) in the toner satisfy the relationship Dns≤0.233EXP(17.3/Dv50);

(7) when the charge control agent on the toner surface is removed, the resultant depressions have an average diameter of 500 nm or smaller.

With Respect to (1) and (5):

The volume-median diameter (Dv50) of a toner is defined as the diameter determined in the following manner.

The volume-median diameter (Dv50) of particles is determined with Multisizer III (aperture diameter, 100 μm) (hereinafter abbreviated to "Multisizer"), manufactured by Beckman Coulter, Inc. As a dispersion medium, use is made of Isoton II, manufactured by the same company. A "toner dispersion" or "slurry" is diluted so as to result in a dispersed-phase concentration of 0.03% by mass, and this dilution is examined with a Multisizer III analysis software (ver using a PD value of 118.5. The range of particle diameters to be examined is set at 2.00 to 64.00 μm, and this range is discretely divided into 256 sections having the same width on the logarithmic scale. A median value is calculated from the statistical values for these sections on a volume basis, and this value is taken as the volume-median diameter (Dv50).

In the case where a toner of the invention is one which is composed of toner base particles and an external additive bonded or adhered to the surface thereof, this toner is examined as a specimen. Also with respect to the average degree of circularity, population number % of toner particles having a particle diameter of from 2.00 μm to 3.56 μm (Dns), and coefficient of variation in number which will be described later, the toner composed of toner base particles and an external additive bonded or adhered to the surface thereof is examined as it is as a specimen when this toner is a toner of the invention.

The toners of the invention have a Dv50 of from 4.0 μm to 7.5 μm. So long as the Dv50 thereof is within this range, images of high quality can be sufficiently provided. The effect of providing high-quality images is more remarkable when the Dv50 of the toners is 6.8 μm or smaller. From the standpoint of reducing the generation of fine particles, the Dv50 of the toners is preferably 4.5 μm or larger, more preferably 5.0 μm or larger, especially preferably 5.3 μm or larger.

With Respect to (2):

The average degree of circularity of a toner is determined and defined in the following manner. The toner base particles are dispersed in a dispersion medium (Isoton II, manufactured by Beckman Coulter Inc.) so as to result in a concentration thereof in the range of 5,720-7,140 particles per μL. This dispersion is examined with a flow-type particle image analyzer (FPIA 2100, manufactured by Sysmex Corp. (former name, TOA Medical Electronics Co., Ltd.)) under the following apparatus conditions. An average of the measured values is defined as the "average degree of circularity". In the invention, the same measurement is conducted thrice, and the arithmetical mean of the three "average degrees of circularity" is taken as the "average degree of circularity".

Mode: HPF

HPF analysis amount: 0.35 μL

Number of HPF-detected particles: 2,000-2,500

The subsequent examination is made within the apparatus, and the average degree of circularity is automatically calculated by the apparatus and displayed. "Degree of circularity" is defined by the following equation.

[Degree of circularity]=[periphery length of circle having the same area as projected particle area]/[periphery length of projected particle image]

In the apparatus, 2,000-2,500 particles, i.e., particles in an HPF detection number, are examined and the arithmetical mean of the degrees of circularity of the individual particles is displayed as the "average degree of circularity" on the apparatus.

One of the toners of the invention has an average degree of circularity of 0.93 or higher, preferably 0.94 or higher. In general, toners having a high degree of circularity are efficiently transferred. A spherical toner having a high degree of circularity is less apt to be caught by itself or by various members and, hence, receives a lower degree of mechanical shear on the charging roller to undergo little change in surface shape. Furthermore, since the toner base itself has high flowability, this toner is less apt to considerably change in flowability even when the amount of an inorganic powder to be externally added changes. Namely, spherical toners have a shape factor which brings about diminished toner deterioration. In addition, spherical toners have excellent releasability from the photoreceptor drum and, hence, attain excellent transfer efficiency, whereby a sufficient image density can be ensured and untransferred toner can be diminished. For these reasons, it is desirable that a toner having a high degree of circularity should be used in high-speed printers.

However, toners having a high average degree of circularity tend to have an increased value of the proportion of weakly statically charged toner particles WST [%], as measured with E-SPART analyzer, and may cause enhanced toner dusting. Furthermore, when untransferred toner particles are wiped off with a cleaning blade, such toner particles are apt to pass through the cleaning blade to form a cause of image fouling. In high-speed printing, this effect is more conspicuous. Consequently, the average degree of circularity of the toner of the invention is preferably 0.98 or lower, more preferably 0.96 or lower.

In the case of toners having a small particle diameter and a high degree of circularity, such toners are difficult to wipe off with a cleaning blade and are apt to pass through the cleaning blade. It is therefore important that the particle diameter distribution of such a toner should be regulated according especially to the degree of circularity.

With Respect to (3) and (6):

The population number % of toner particles having a particle diameter of from 2.00 μm to 3.56 μm (Dns) in a toner is determined and defined in the following manner. The content thereof is determined with Multisizer (aperture diameter, 100 μm) using Isoton II, manufactured by the same company, as a dispersion medium. A "toner dispersion" or "slurry" is diluted so as to result in a dispersed-phase concentration of 0.03% by mass, and this dilution is examined with a Multisizer III analysis software using a PD value of 118.5.

The lower-limit particle diameter of 2.00 μm is a detection limit for this analyzer, Multisizer, while the upper-limit particle diameter of 3.56 μm is the specified value for a channel of this analyzer, Multisizer. In the invention, this particle diameter region of from 2.00 μm to 3.56 μm was taken as a fine-powder region.

The range of particle diameters to be examined is set at 2.00 μm to 64.00 μm, and this range is discretely divided into 256 sections having the same width on the logarithmic scale. The proportion by number of the component ranging in particle diameter from 2.00 μm to 3.56 μm is calculated from the statistical values for these sections on a number basis, and this value is taken as "Dns".

In each of the toners of the invention, the volume-median diameter (Dv50) of the toner and the population number % of toner particles having a particle diameter of from 2.00 μm to 3.56 μm (Dns) in the toner satisfy the relationship $Dns \leq 0.233EXP(17.3/Dv50)$. In the invention, "EXP" represents "exponential". Namely, the EXP is the base of a natural logarithm, and the right side thereof is an exponent.

That relational expression is intended to indicate that as the volume-median diameter (Dv) of a toner becomes small, the proportion of a fine powder increases. When the value of Dv decreases to or below 4.5 μm, the value of Dns increases exponentially because such value of Dv is close to the particle-diameter region of from 2.00 μm to 3.56 μm. This region of from 2.00 μm to 3.56 μm is expressed with a regular channel of Multisizer III, manufactured by Coulter Counter.

The particles included in the particle diameter range of from 2.00 μm to 3.56 μm are particles which, in the invention, should be especially removed from the toner particles having a volume-median diameter in the range of 4.0-7.5 mm. This is based on experimental results. The toners of the invention, which satisfy the requirement (3) or (6) regarding particle diameter distribution, not only attain high image quality but also cause little fouling, are inhibited from causing residual-image phenomenon (ghost) or blurring (suitability for solid printing), and have excellent removability in cleaning, even when used in high-speed printers. Furthermore, because of the narrow particle diameter distribution, the toners of the invention have an exceedingly narrow charge amount distribution. Consequently, these toners are free from the trouble that particles having a small charge amount cause white-background fouling or fly off to foul the inside of the apparatus or that particles having a large charge amount are not used for development and adhere to members such as the layer control blade or a roller to cause image defects such as streaks or blurring.

Figure 4:
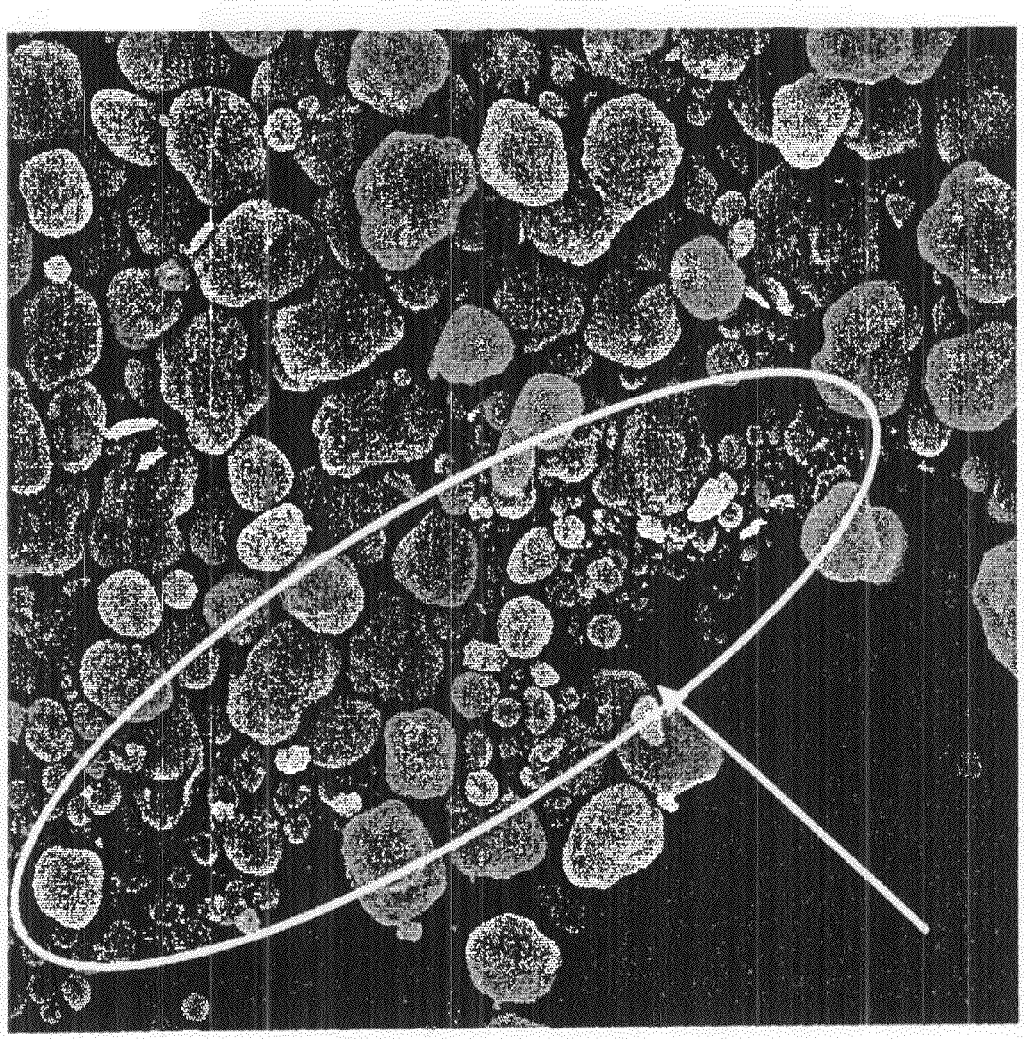
FIG. 4 is an SEM photograph having a magnification of 1,000 diameters which shows a toner adherent to the cleaning blade after actual printing evaluation of the toner of Comparative Example 2-1.

Namely, that relational expression is the borderline of the influence of a fine-powder amount on images. In case where the value of Dns exceeds the right side, the fine powder causes defects to images. For example, a fine powder accumulates on the cleaning blade as shown in FIG. 4 to cause image defects such as a residual image, blurring, and fouling.

An image-forming apparatus has been designed to transfer particles having a specific charge amount. Because of this, in electrostatic development, particles having the specific charge amount are preferentially transferred to the OPC. Particles charged in an amount exceeding the specific amount adhere to and foul members, etc. or impair flowability. On the other hand, particles charged in an amount smaller than the specific amount accumulate in the cartridge to foul members, etc.

Charge amount in a toner correlates with the diameters of the toner particles when the particles have the same toner composition. In general, the smaller the particle diameter, the larger the charge amount per unit weight; and the larger the particle diameter, the smaller the charge amount per unit weight. Namely, when there are a large amount of toner particles having a small particle diameter, this toner comes to have too large a charge amount and, hence, adheres to members, etc. or impairs flowability. In the invention, toner particles not larger than 3.56 μm were taken as such toner particles. Incidentally, 3.56 μm is the specified value for a channel of the analyzer. Meanwhile, the lower limit was set at 2.00 μm in view of an examination limit for the analyzer.

A toner in which Dv50 and Dns satisfy the relationship $Dns \leq 0.110EXP(19.9/Dv50)$ is preferred. Meanwhile, from the standpoint of producing a toner with satisfactory yield, it is preferred that Dv50 and Dns satisfy the relationship $0.0517EXP(22.4/Dv50) \leq Dns$.

Furthermore, a toner in which Dns is 6% by number or lower is preferred because this toner gives images of higher quality and is less apt to foul the image-forming apparatus. It is more preferred that a preferred range of the particle diameter Dv50, e.g., "Dv50 is 4.5 μm or larger", and the requirement "Dns is 6% by number or lower" should be satisfied in combination. So long as Dv50 and Dns are within these ranges, a toner which gives high-quality images and is less apt to foul image-forming apparatus can be provided without lowering yield in production.

With Respect to (4):

The coefficient of variation in number (%) is expressed by (standard deviation of particle distribution on number basis)× 100/(number-average particle diameter). Particle size distribution and the like in the invention are determined in the following manner.

The coefficient of variation in number of particles is determined with Multisizer III (aperture diameter, 100 μm) (hereinafter abbreviated to "Multisizer"), manufactured by Beckman Coulter, Inc. As a dispersion medium, use is made of Isoton II, manufactured by the same company. A "toner dispersion" or "slurry" is diluted so as to result in a dispersed-phase concentration of 0.03% by mass, and this dilution is examined with a Multisizer III analysis software (V3.51) using a PD value of 118.5. The range of particle diameters to be examined is set at 2.00 to 64.00 μm, and this range is discretely divided into 256 sections having the same width on the logarithmic scale. The coefficient of variation in number is calculated from the statistical values for these sections on a number basis.

One of the toners of the invention has a coefficient of variation in number of 24.0% or lower, preferably 22% or lower, more preferably 20% or lower, even more preferably 19% or lower. In case where the coefficient of variation in number is a high value, this toner has a broad charge amount distribution and suffers a charging failure, which results in image defects. In addition, high values of the coefficient of variation in number induce fouling due to toner adhesion to members, etc. and fouling due to dusting. It is therefore preferred that the coefficient of variation in number should be low. From an industrial standpoint, on the other hand, the coefficient of variation in number is preferably 0% or higher, more preferably 5% or higher.

With Respect to (7):

One of the toners of the invention contains a charge control agent. The average dispersed-state diameter of the charge control agent contained in a toner can be determined in the following manners. For example, in the case of a pulverization toner obtained by mixing a charge control agent with a resin and pulverizing the mixture, the average dispersed-state diameter of the charge control agent can be determined through the image analysis of a TEM photograph of the toner finally obtained.

In the case of a toner obtained by forming particles in an aqueous medium, such as, e.g., a polymerization toner, the average dispersed-state diameter of the charge control agent contained in a dispersion thereof to be added before, during, or after the polymerization of constituent monomers may be regarded as the average dispersed-state diameter of the charge control agent contained in the toner.

As the charge control agent to be incorporated into the toner of the invention, conventionally known compounds may be used. Examples thereof include metal complexes of hydroxycarboxylic acids, metal complexes of azo compounds, naphthol compounds, metal compounds of naphthol compounds, Nigrosine dyes, quaternary ammonium salts, and mixtures thereof. In the case of a toner obtained by forming particles in an aqueous medium, a charge control agent which does not dissolve in the aqueous medium is preferred. This is because when a toner into which a water-soluble charge control agent has been incorporated is used in a high-humidity environment, the charge control agent dissolves in the water condensed on the toner surface and is released from the surface to lessen the effect of improving toner charging. Examples of the charge control agent which does not dissolve in aqueous media include E-81, E-84, E-88, E-108, S-28, and S-34, manufactured by Orient Chemical Industries Ltd., TN-105 and T-77, manufactured by Hodogaya Chemical Co., Ltd., and N4P and N5P, manufactured by Clariant Japan K.K. Other examples of known charge control agents include charge control agents including a resin as a main component. Examples of the resin include styrene/acrylic polymers and condensation polymers. However, these resins have a high affinity for the binder resins constituting toners, and it is highly probable that the resins are distributed in inner parts during toner production. As a result, such resins are less apt to be exposed on the toner surface. Namely, there is a high possibility that as compared with the charge control agents shown above, such resin-based charge control agents might less contribute to charging. It is therefore preferred that a charge control agent, rather than a charge control resin, should be used for charging a toner.

The content of the charge control agent is preferably in the range of 0.1-5 parts by weight, more preferably 0.1-3 parts by weight, even more preferably 0.2-1 part by weight, per 100 parts by weight of the resin. So long as the content thereof is within that range, the toner has the excellent ability to be quickly charged and image defects such as image fouling and residual-image phenomenon can be more effectively controlled.

In this toner of the invention, the charge control agent contained therein has an average dispersed-state diameter of 500 nm or smaller. In case where the dispersed-state diameter thereof exceeds that range, the amount of this charge control agent which can be contained in the toner is limited and electrification characteristics are not expected to be improved by this charge control agent. Furthermore, such a charge control agent has a reduced surface area per unit volume thereof and hence exerts a limited influence on charging. Charge control agents having such a large particle diameter are hence undesirable. These influences are enhanced especially in toners having a small particle diameter. The upper limit of the average dispersed-state diameter of the charge control agent contained is preferably 400 nm or smaller, more preferably 300 nm or smaller, most preferably 200 nm or smaller. On the other hand, the lower limit thereof is preferably 50 nm or larger from an industrial standpoint.

Incidentally, in the case where a charge control agent is to be incorporated into a toner in an ordinary manner in obtaining the toner by, for example, the pulverization method, it is difficult to finely disperse the charge control agent because of the nature of the production steps. Consequently, the particle size thereof is usually 500 nm or larger.

In the case of obtaining a toner by the method in which particles are formed in an aqueous medium, it is necessary to incorporate additives essential to the toner, such as a colorant. In this case, a charge control agent usually is not incorporated because to incorporate a charge control agent besides the essential additives renders the production steps complicated and toner particle diameter regulation difficult. In the case of a toner which satisfies the requirements (5) and (6), there is no particular need of positively incorporating a charge control agent because the amount of a fine powder is minimized in such toner.

In this toner of the invention, it is preferred that the charge control agent should be present near the toner surface. When the charge control agent is removed from the toner surface, the resultant depressions in the toner surface where the charge control agent was present preferably have a size of 500 nm or smaller in terms of average diameter, although the size thereof depends on the diameter of the charge control agent contained. In case where the size thereof exceeds that range, the amount of the charge control agent which can be incorporated in the toner is limited and electrification characteristics are not expected to be improved by the charge control agent.

The depressions resulting from the removal of the charge control agent from the toner surface can be regarded as directly reflecting the average diameter of the charge control agent which was in the state of being fixed to the toner surface. Namely, when a solvent in which the charge control agent only dissolves and which is not compatible with the resin and causes scarcely any swelling of the resin is used to remove the charge control agent, then the diameter of the resultant depressions is thought to be approximately close to the average diameter of the charge control agent incorporated. This average diameter is not always the same as the dispersed-state diameter of the charge control agent present in a dispersion medium. This is because there is a possibility that the dispersed charge control agent might aggregate depending on the conditions used for incorporation into a toner, such as the state of being stirred, salt concentration, and temperature, and be incorporated in the aggregated state into the toner. However, in case where the charge control agent has aggregated excessively, adhesion thereof to the toner surface is inhibited and the amount of this charge control agent which can be incorporated into the toner is limited. Electrification characteristics are hence not expected to be improved by this charge control agent. Furthermore, such a charge control agent has a reduced surface area per unit volume thereof and hence exerts a limited influence on charging. Such excessively aggregated charge control agents are hence undesirable. These influences are enhanced especially in toners having a small particle diameter.

The "depressions" in the invention are measured in the following manner and defined as shown below.

An alcohol (ethanol) is stirred together with toner powder base particles, and this mixture is then separated into the toner and a solution by suction filtration. The toner remaining on the filter paper is dried at room temperature and an SEM image of the toner surface is obtained. This image is analyzed with respect to depressions formed in the toner surface as a result of the dissolution of the charge control agent to calculate equivalent-circle diameters. These equivalent-circle diameters are defined as the diameters of the depressions, and an average of these values is defined as the "average diameter of depressions" in the invention.

It is essential that one of the toners of the invention should satisfy all of the requirements (1) to (4). None of the conventional toners satisfies all of (1) to (4). The reasons for this are as follows. When the content of a fine powder is minimized ((3) is satisfied), this results in the generation of a coarse powder and in an increased coefficient of variation in number ((4) is not satisfied). When physical impacts are used in order to round a toner (satisfy (2)), this is causative of the enhanced generation of a fine powder ((3) is not satisfied). When a toner is rounded by thermal fusion (to satisfy (2)), the particles are fusion-bonded to one another, resulting in the generation of a coarse powder ((4) is not satisfied).

This toner of the invention not only attains high image quality but also causes little fouling, is inhibited from causing residual-image phenomenon (ghost) or blurring (suitability for solid printing), and has excellent removability in cleaning, even when used in high-speed printers. Furthermore, because of the narrow particle diameter distribution, this toner of the invention has an exceedingly narrow charge amount distribution. Consequently, the toner is free from the trouble that particles having a small charge amount cause white-background fouling or fly off to foul the inside of the apparatus or that particles having a large charge amount are not used for development and adhere to members such as the layer control blade or a roller to cause image defects such as streaks or blurring.

It is essential that the other toner of the invention should satisfy all of the requirements (5) to (7). None of the conventional toners satisfies all of (5) to (7). The reason for this is as follows. To reduce the diameter of toner particles (satisfy (5)) not only makes it difficult to minimize the content of a fine powder (satisfy (6)) but also makes it more difficult to incorporate a charge control agent. This toner of the invention is a toner which satisfies (5) and (6) and into which a charge control agent has been effectively incorporated. This toner has been rendered possible by causing a charge control agent to be present on the surface of a toner.

This toner of the invention not only attains high image quality but also causes little fouling and is inhibited from causing residual-image phenomenon (ghost), even when used in high-speed printers. Furthermore, because of the narrow particle diameter distribution, this toner of the invention has an exceedingly narrow charge amount distribution. Consequently, the toner is free from the trouble that particles having a small charge amount cause white-background fouling or fly off to foul the inside of the apparatus or that particles having a large charge amount are not used for development and adhere to members such as the layer control blade or a roller to cause image defects such as streaks or blurring.

Toners which contain a large amount of a fine powder (do not satisfy (3) or (6)) tend to result in an increased gloss. As the particle size of a toner decreases, the gloss increases. Because of this, toners having a small particle diameter tend to result in too high a gloss due to the presence of a fine powder. However, by diminishing the fine powder (to satisfy (3) or (6)), gloss can be reduced.

Compared to conventional toners, the toners of the invention have an exceedingly narrow charge amount distribution. The charge amount distribution of a toner correlates with the particle size distribution thereof. In the case of toners having a broad particle size distribution like conventional toners, these toners have a broad charge amount distribution. When a toner has a broad charge amount distribution, the proportion of lowly charged particles or highly charged particles is increased to such a degree that these particles are uncontrollable under the development conditions employed in the apparatus for the toner, and such particles are causative of various image defects. For example, particles having a small charge amount cause fouling of the white background or fly off within the apparatus to cause fouling. Particles having a large charge amount remain without being used for development and accumulate on members such as the layer control blade or a roller within the developing chamber. These accumulated particles may be fusion-bonded to become causative of image defects such as streaks and blurring.

In the invention, the toners have a surface potential of preferably −30 V or lower, more preferably −32 V or lower, even more preferably −34 or lower. These values of surface potential are ones measured by the method which will be described later, and mean the surface potential of the toners present on a developing roller. So long as the toners have a surface potential within that range, the toners can be quickly charged and can hence provide higher-resolution images while inhibiting white-background fogging and residual-image phenomenon (ghost).

Gloss value depends on the smoothness of the printed toner image. In general, images having higher surface smoothness have a higher value of gloss because light scattering is inhibited. It is thought that in the case of a toner having a broad particle size distribution, this toner contains an increased amount of a fine powder and, hence, the interstices among large particles are filled with particles of a smaller particle diameter, whereby the resultant surface has improved smoothness and enhanced gloss value. Consequently, a narrow particle size distribution is thought to result in slightly reduced smoothness and is advantageous for inhibiting the toner from giving images having an excessively high value of gloss. In the invention, the gloss value of a solid print image is preferably 32 or lower, more preferably 30 or lower.

The reasons for this are as follows. In designing a development process for use in an image-forming apparatus, the conditions for the development process are designed so as to be suitable for an average toner charge amount. In case where a toner having a charge amount considerably different from that average value is used in this image-forming apparatus, this toner causes dusting and image defects such as streaks and blurring. Namely, this toner poorly matches with the apparatus. On the other hand, in the case of a toner having a narrow charge amount distribution as in the invention, developing properties can be controlled by bias regulation, etc., and clear images can be obtained without fouling the members of the image-forming apparatus.

It is desirable in this invention that a charge control agent should be present near the surface. This is because the electrification characteristics of a toner are influenced by the composition, shape, etc. of the surface. For causing a charge control agent to be present near the surface, use may be made of a method in which a charge control agent is struck against the surface of toner particles and thereby fixed thereto. However, it is preferred to fix a charge control agent to the surface of toner particles in an aqueous medium because this method is capable of causing the charge control agent to be evenly present near the surface. In particular, the emulsion polymerization agglutination method is a preferred method for use in a process for producing a toner of the invention because due to the nature of the production steps, a charge control agent can be easily caused to be evenly present near the surface.

It is also preferred in this invention that when the average diameter of depressions which are to be formed upon removal of the charge control agent is expressed by R, then the charge control agent should be present in the range of ±R centering the toner surface. The exposure of the charge control agent on the toner surface enables the charge control agent to perform the function thereof. With respect to the mechanism of toner charging, an electron transfer model, ion transfer model, water crosslinking model, and the like have been proposed and are known. The former two are known to be a phenomenon in which electrons or a substance is transferred upon contact between a toner and another substance, while the latter is known to be a phenomenon in which water on the toner surface participates. In either case, the toner surface is the field where charging occurs. It is therefore extremely important to distribute/expose a charge control agent on the surface of a toner. That production method in which a charge control agent is actually distributed to an area near the surface is more advantageous than other methods.

Namely, when a charge control agent is present in inner parts of a toner at a depth larger than R from the toner surface, this means that the charge control agent is not exposed on the toner surface. The charge control agent in this state makes no contribution to toner charge control and is undesirable from the standpoint of toner structure.

The average degree of circularity of a toner is determined by the method described in Examples and is defined as the value determined by the method. The average degree of circularity of this toner of the invention is preferably 0.93 or higher, more preferably 0.94 or higher. In general, toners having a high degree of circularity are efficiently transferred. A spherical toner having a high degree of circularity is less apt to be caught by itself or by various members and, hence, receives a lower degree of mechanical shear on the charging roller to undergo little change in surface shape. Furthermore, since the toner base itself has high flowability, this toner is less apt to considerably change in flowability even when the amount of an inorganic powder to be externally added changes. Namely, spherical toners have a shape factor which brings about diminished toner deterioration. In addition, spherical toners have excellent releasability from the photoreceptor drum and, hence, attain excellent transfer efficiency, whereby a sufficient image density can be ensured and untransferred toner can be diminished. For these reasons, it is desirable that a toner having a high degree of circularity should be used in high-speed printers.

However, toners having a high average degree of circularity tend to have an increased value of the proportion of weakly statically charged toner particles WST [%], as measured with E-SPART analyzer, and may show enhanced toner dusting. Furthermore, when untransferred toner particles are wiped off with a cleaning blade, such toner particles are apt to pass through the cleaning blade to form a cause of image fouling. In high-speed printing, this effect is more conspicuous. Consequently, the average degree of circularity of this toner of the invention is preferably 0.98 or lower, more preferably 0.96 or lower.

In the case of toners having a small particle diameter and a high degree of circularity, such toners are difficult to wipe off with a cleaning blade and are apt to pass through the cleaning blade. It is therefore important that the particle diameter distribution of such a toner should be regulated according especially to the degree of circularity.

The coefficient of variation in number is determined by the method described in Examples and is defined as the value determined by the method. This toner of the invention has a coefficient of variation in number of 24.0% or lower, more preferably 22% or lower, even more preferably 20% or lower, most preferably 19% or lower. In case where the coefficient of variation in number is a high value, this toner has a broad charge amount distribution and suffers a charging failure, which results in image defects. In addition, high values of the coefficient of variation in number induce fouling due to toner adhesion to members, etc. and fouling due to dusting. It is therefore preferred that the coefficient of variation in number should be low. From an industrial standpoint, on the other hand, the coefficient of variation in number is preferably 0% or higher, more preferably 5% or higher.

The "standard deviation of charge amount", which is one measure of "charge amount distribution", of the toners of the invention is preferably from 1.0 to 2.0, more preferably from 1.0 to 1.8, even more preferably from 1.0 to 1.5. When the standard deviation of charge amount thereof exceeds the upper limit, there are undesirable cases where toner particles adhere to the layer control blade and become difficult to convey and the adherent toner particles block other toner particles being conveyed to cause fouling of members within the image-forming apparatus. When the standard deviation of charge amount thereof is lower than the lower limit, there are cases where such toners are undesirable from an industrial standpoint. The lower limit preferably is 1.3 or higher.

The toners of the invention have a narrow charge amount distribution and, hence, the internal fouling of an image-forming apparatus which is caused by insufficiently charged toner particles (toner dusting) is exceedingly slight. This effect is remarkably produced especially in a high-speed image-forming apparatus in which development on the electrostatic-latent-image carrier is conducted at a process speed of 100 mm/sec or higher.

Furthermore, since the toners of the invention have a narrow charge amount distribution, the toners have highly satisfactory developing properties and the amount of toner particles which accumulate without being used for development is exceedingly small. This effect is produced especially in an image-forming apparatus in which the rate of toner consumption is high. Specifically, it is preferred, from the standpoint of sufficiently producing the effect of the invention, that the toners should be ones for use in an image-forming apparatus satisfying the following expression (8). More preferably, the right side of the expression is 500 sheets or more.

$$[\text{Guaranteed life in number of prints of the developing device to be packed with developer (sheets)}]\times(\text{coverage rate})\geq 400\ (\text{sheets}) \quad (8)$$

In expression (8), "coverage rate" is expressed in terms of a value obtained by dividing the sum of the areas of printed parts by the overall area of the receiving medium in each printed matter for determining a guaranteed life in number of prints as a performance of the image-forming apparatus. For example, the "coverage rate" in "5%" printing is "0.05".

In addition, since the toners of the invention have an exceedingly narrow particle diameter distribution, latent-image reproducibility is highly satisfactory. Consequently, the effect of the invention is sufficiently produced especially when the toners are used in an image-forming apparatus in which a latent image is formed on the electrostatic-latent-image carrier at a resolution of 600 dpi or higher.

The image-forming apparatus and cartridge of the invention are characterized by employing either the toner which satisfies all of the requirements (1) to (4) or the toner which satisfies all of the requirements (5) to (7). Use of such toner enables high-resolution images to be provided.

<Constitution of the Toners>

The toners of the invention are constituted of suitably selected ingredients such as a binder resin, colorant, wax, and external additive.

The binder resin to be used as a component of the toners of the invention may be suitably selected from binder resins known to be for use in toners. Examples thereof include styrene resins, vinyl chloride resins, rosin-modified maleic acid resins, phenolic resins, epoxy resins, saturated or unsaturated polyester resins, polyethylene resins, polypropylene resins, ionomer resins, polyurethane resins, silicone resins, ketone resins, ethylene/acrylate copolymers, xylene resins, poly(vinyl butyral) resins, styrene/alkyl acrylate copolymers, styrene/alkyl methacrylate copolymers, styrene/acrylonitrile copolymers, styrene/butadiene copolymers, and styrene/maleic anhydride copolymers. These resins may be used alone, or some of these may be used in combination.

The colorant to be used as a component of the toners of the invention may be suitably selected from colorants known to be for use in toners. Examples thereof include the yellow pigments, magenta pigments, and cyan pigments which will be shown later. As a black pigment, use may be made of a carbon black or a pigment prepared by mixing a yellow pigment, magenta pigment, and cyan pigment shown later so as to have a black color.

Among such colorants, carbon blacks as a black pigment are present as aggregates of exceedingly fine primary particles. When used as a pigment dispersion and dispersed, the carbon black is apt to reaggregate to undergo particle enlargement. The degree of reaggregation of carbon black particles correlates with the amount of impurities contained in the carbon black (amount of organic substances remaining undecomposed). Carbon black particles having a large impurity amount tended to undergo considerable particle enlargement through reaggregation after dispersion. A carbon black having a toluene-extractable ultraviolet absorbance, which is a quantitative evaluation measure of impurity amount and is determined by the following method, of 0.05 or lower is preferred. More preferred is a carbon black in which the absorbance is 0.03 or lower. In general, channel-process carbon blacks tend to contain a large amount of impurities. Consequently, the carbon black in the invention preferably is one produced by the furnace process.

The ultraviolet absorbance ($\lambda c$) for a carbon black is determined by the following method. First, 3 g of the carbon black is sufficiently disposed in and mixed with 30 mL of toluene. The resultant liquid mixture is filtered through No. 5 filter paper. Thereafter, the filtrate is introduced into a quartz cell having a 1-cm-square absorption part. This filtrate is examined for absorbance at a wavelength of 336 nm with a commercial ultraviolet spectrophotometer to obtain a value ($\lambda s$). Toluene alone as a reference is examined for absorbance by the same method to obtain a value ($\lambda o$). From the values $\lambda s$ and $\lambda o$, the ultraviolet absorbance is determined using $\lambda c=\lambda s-\lambda o$. Examples of the commercial spectrophotometer include an ultraviolet/visible spectrophotometer (UV-3100PC) manufactured by Shimadzu Corp.

As the yellow pigments, use may be made of compounds represented by condensation azo compounds and isoindolinone compounds. Specifically, C.I. Pigment Yellow 12, 13, 14, 15, 17, 62, 74, 83, 93, 94, 95, 109, 110, 111, 128, 129, 147, 150, 155, 168, 180, and 194 are suitable.

As the magenta pigments, use may be made of condensation azo compounds, diketopyrrolopyrrole compounds, anthraquinone, quinacridone compounds, basic dye lake compounds, naphthol compounds, benzimidazolone compounds, thioindigo compounds, and perillene compounds. Specifically, C.I. Pigment Red 2, 3, 5, 6, 7, 23, 48:2, 48:3, 48:4, 57:1, 81:1, 122, 144, 146, 166, 169, 17.3, 184, 185, 202, 206, 207, 209, 220, 221, 238, and 254 and C.I. Pigment Violet 19 are suitable. Especially preferred of these are quinacridone pigments represented by C.I. Pigment Red 122, 202, 207, and 209 and C.I. Pigment Violet 19. Especially preferred of such quinacridone pigments is the compound represented by C.I. Pigment Red 122.

As the cyan pigments, use can be made of copper phthalocyanine compounds and derivatives thereof, anthraquinone compounds, basic dye lake compounds, and the like. Specifically, pigments such as C.I. Pigment Blue 1, 15, 15:1, 15:2, 15:3, 15:4, 60, 62, and 66 and C.I. Pigment Green 7 and 36 are suitable.

It is preferred to incorporate a wax into the toners of the invention in order to impart releasability. The wax is not particularly limited, and any wax having releasing properties is usable. Examples thereof include olefin waxes such as low-molecular polyethylene, low-molecular polypropylene, and polyethylene copolymers; paraffin waxes; ester waxes having one or more long-chain aliphatic groups, such as behenyl behenate, montanic esters, and stearyl stearate; vegetable waxes such as hydrogenated castor oil and carnauba wax; ketones having one or more long-chain alkyl groups, such as distearyl ketone; silicones having an alkyl group; higher fatty acids such as stearic acid; higher aliphatic alcohols such as eicosanol; carboxylic acid esters or partial esters with polyhydric alcohols, such as those obtained from polyhydric alcohols, e.g., glycerol and pentaerythritol, and higher fatty acids; higher fatty acid amides such as oleamide and stearamide; and low-molecular polyesters.

Preferred of these waxes from the standpoint of improving fixability are waxes having a melting point of preferably 30° C. or higher, more preferably 40° C. or higher, especially preferably 50° C. or higher. The melting point thereof is preferably 100° C. or lower, more preferably 90° C. or lower, especially preferably 80° C. or lower. Waxes having too low a melting point are apt to migrate to the surface upon fixing to cause tackiness. Waxes having too high a melting point result in poor low-temperature fixability. With respect to the kind of wax compounds, ester waxes obtained from an aliphatic carboxylic acid and a mono- or polyhydric alcohol are preferred. Preferred of such ester waxes are ones having 20-100 carbon atoms.

Those waxes may be used alone or as a mixture thereof. According to a fixing temperature for fixing the toners, a wax compound can be suitably selected with respect to melting point. The amount of the wax to be used is preferably 4-20 parts by weight, especially preferably 6-18 parts by weight, even more preferably 8-15 parts by weight, per 100 parts by weight of each toner. In the case of toners having a volume-median diameter (Dv50) of 7 μm or smaller, i.e., in the case of toners having a small particle diameter, wax migration to the toner surface becomes exceedingly severe and toner storage stability becomes poor, as the amount of the wax used increases. The toners of the invention are small-particle-diameter toners having such a narrow particle size distribution that the toners are less apt to have impaired toner characteristics than conventional toners even when a wax is used in a large amount as in that range.

The toners of the invention may be ones constituted of toner base particles and a known external additive added to the surface thereof in order to regulate flowability or developing properties. Examples of the external additive include metal oxides and hydroxides, such as alumina, silica, titania, zinc oxide, zirconium oxide, cerium oxide, talc, and hydrotalcite, metal titanates such as calcium titanate, strontium titanate, and barium titanate, nitrides such as titanium nitride and silicon nitride, carbides such as titanium carbide and silicon carbide, and organic particles such as acrylic resins and melamine resins. Two or more of these external additives may be used in combination. Preferred of these are silica, titania, and alumina. More preferred are ones which have undergone a surface treatment with, e.g., a silane coupling agent or silicone oil. Such external additives each desirably have an average primary-particle diameter preferably in the range of 1-500 nm, more preferably in the range of 5-100 nm. It is also preferred to use a combination of external additives respectively having a small particle diameter and a large particle diameter which both are within that particle diameter range. The total amount of the external additives to be incorporated is preferably in the range of 0.05-10 parts by weight, more preferably 0.1-5 parts by weight, per 100 parts by weight of the toner base particles.

<Processes for Producing the Toners>

Processes for producing the toners of the invention are not particularly limited. Namely, the toners can be produced by a pulverization method or a polymerization method. In the case of producing a toner by a pulverization method, a classification step is generally necessary because a fine powder is apt to generate. However, since an excessive classification operation results in a considerably reduced yield, such an operation is not performed from an industrial standpoint. On the other hand, from the standpoint of avoiding the generation of a fine powder, it is preferred to produce the toners of the invention by forming particles in an aqueous medium.

An explanation is given below on processes for producing particles by conducting polymerization in an aqueous medium, among methods for forming particles in an aqueous medium, because these processes are less apt to yield a fine powder. Furthermore, a process for particle production by the emulsion polymerization agglutination method will be explained.

When a toner which satisfies the expression (3) or (6) is to be obtained, it is preferred to employ an aggregation step conducted by an operation in which the rate of aggregation is not high as compared with that in ordinary operations. Examples of the operation in which the rate of aggregation is not high include the following techniques: to use a dispersion which has been cooled beforehand; to add a dispersion or the like over a prolonged time period; to employ an electrolyte or the like which is not high in aggregating ability; to add an electrolyte continuously or intermittently; to heat at a reduced rate; and to aggregate over a prolonged time period. With respect to an aging step, it is preferred to employ an operation which is less apt to disperse the aggregated particles again. Examples of the operation which is less apt to finely disperse the aggregated particles include the following techniques: to stir at a reduced rotation speed; to add a dispersion stabilizer continuously or intermittently; and to mix beforehand a dispersion stabilizer and water. The toner satisfying the expression (3) or (6) preferably is one in which the toner or toner base particles should be finally obtained without through a step in which particles smaller than the volume-median diameter (Dv50) of the final product are removed by an operation such as, e.g., classification.

Suitable production processes in which a toner is obtained in an aqueous medium include methods in which radical polymerization is conducted in an aqueous medium, such as the suspension polymerization method and the emulsion polymerization agglutination method (hereinafter referred to as "polymerization methods"; the resultant toner is referred to as "polymerization toner"), and chemical pulverization methods represented by the melt suspension method. Techniques for regulating a toner so as to have particles diameters within the specific range according to the invention are not particularly limited. Examples thereof in the case of the suspension polymerization method, for example, include a technique in which in the step of producing a polymerization toner, a high shear force is applied or a dispersion stabilizer or the like is added in an increased amount, when droplets of polymerizable monomers are formed.

For obtaining a toner having particle diameters within the specific range according to the invention, use can be made of any of production processes such as polymerization methods, e.g., the suspension polymerization method and the emulsion polymerization agglutination method, and chemical pulverization methods represented by the melt suspension method. However, the "suspension polymerization method" and the "chemical pulverization methods represented by the melt suspension method" each have a drawback that since a size larger than a toner particle diameter is regulated to a small size, any operation for obtaining a small average particle diameter tends to increase the proportion of particles having smaller particle diameters, resulting in an excessive burden on a classification step or the like. In contrast, the emulsion polymerization agglutination method attains a relatively narrow particle diameter distribution and further has an advantage that since a size smaller than a toner particle diameter is regulated to a large size, a toner having a satisfactory particle diameter distribution is obtained without through a classification step or the like. For these reasons, it is especially preferred that a toner to be incorporated into the toners of the invention should be produced by the emulsion polymerization agglutination method.

The toner produced by the emulsion polymerization agglutination method is explained below in detail. Toner production by the emulsion polymerization agglutination method usually includes a polymerization step, mixing step, aggregation step, aging step, and washing/drying step. Namely, a general procedure is as follows. A dispersion obtained by emulsion polymerization and containing primary polymer particles is mixed with dispersions of a colorant, charge control agent, wax, etc. to aggregate the primary particles contained in the dispersion and obtain core particles. Fine resin particles or the like is bonded or adhered to the core particles according to need. Therefore, the particles obtained by fusion bonding are washed and dried to thereby obtain toner base particles.

The binder resin constituting the primary polymer particles for use in the emulsion polymerization agglutination method may be obtained by suitably using one or more polymerizable monomers which are polymerizable by emulsion polymerization. As the raw-material polymerizable monomers, it is preferred to use, for example, a "polymerizable monomer having a polar group" (hereinafter sometimes referred to simply as "polar monomer") sometimes referred to as), such as a "polymerizable monomer having an acidic group" (hereinafter sometimes referred to simply as "acidic monomer") or a "polymerizable monomer having a basic group" (hereinafter simply as "basic monomer", and a "polymerizable monomer having neither an acidic group nor a basic group" (hereinafter sometimes referred to as "other monomer"). In this case, these polymerizable monomers may be separately added, or two or more polymerizable monomers may be mixed together beforehand and added simultaneously. It is also possible to change a composition of polymerizable monomers in the course of addition of the polymerizable monomers. Furthermore, each polymerizable monomer may be added as it is, or may be added as an emulsion prepared beforehand by mixing with water, an emulsifying agent, etc.

Examples of the "acidic monomer" include polymerizable monomers having one or more carboxyl groups, such as acrylic acid, methacrylic acid, itaconic acid, maleic acid, fumaric acid, and cinnamic acid, polymerizable monomers having one or more sulfo groups, such as sulfonated styrenes, and polymerizable monomers having a sulfonamide group, such as vinylbenzenesulfonamide. Examples of the "basic monomer" include aromatic vinyl compounds having an amino group, such as aminostyrene, and polymerizable monomers containing a nitrogen-containing heterocycle, such as vinylpyridine and vinylpyrrolidone.

These polar monomers may be used alone or as a mixture of two or more thereof. The polar monomers may be present as salts including counter ions. Of these monomers, it is preferred to use acidic monomers. More preferred is (meth) acrylic acid. The total proportion of polar monomers in 100% by mass all polymerizable monomers constituting the binder resin as primary polymer particles is preferably 0.05% by mass or higher, more preferably 0.3% by mass or higher, especially preferably 0.5% by mass or higher, even more preferably 1% by mass or higher. It is desirable that the upper limit thereof should be preferably 10% by mass or lower, more preferably 5% by mass or lower, especially preferably 2% by mass or lower. When the proportion of polar monomers is within that range, the resultant primary polymer particles have improved dispersion stability to facilitate the regulation of particle shape and particle diameter in the aggregation step.

Examples of the "other monomer" include styrene compounds such as styrene, methylstyrene, chlorostyrene, dichlorostyrene, p-tert-butylstyrene, p-n-butylstyrene, and p-n-nonylstyrene, acrylic esters such as methyl acrylate, ethyl acrylate, propyl acrylate, n-butyl acrylate, isobutyl acrylate, hydroxyethyl acrylate, and ethylhexyl acrylate, methacrylic esters such as methyl methacrylate, ethyl methacrylate, propyl methacrylate, n-butyl methacrylate, isobutyl methacrylate, hydroxyethyl methacrylate, and ethylhexyl methacrylate, acrylamide, N-propylacrylamide, N,N-dimethylacrylamide, N,N-dipropylacrylamide, N,N-dibutylacrylamide, and acrylic acid amide. Such polymerizable monomers may be used alone or in combination of two or more thereof.

Although two or more of those and other polymerizable monomers may be used in combination in the invention, a preferred embodiment is one in which an acidic monomer is used in combination with one or more other monomers. It is more preferred to use (meth)acrylic acid as the acidic monomer and to use, as the other monomers, one or more polymerizable monomers selected from styrene compounds and (meth)acrylic esters. It is even more preferred to use (meth) acrylic acid as the acidic monomer and to use, as the other monomers, a combination of styrene and one or more (meth) acrylic esters. It is especially preferred to use (meth)acrylic acid as the acidic monomer and to use, as the other monomers, a combination of styrene and n-butyl acrylate.

It is also preferred to use a crosslinked resin as the binder resin constituting primary polymer particles. In this case, a polyfunctional monomer having radical polymerizability is used as a crosslinking agent together with the polymerizable monomers described above. Examples of the polyfunctional monomer include divinylbenzene, hexanediol diacrylate, ethylene glycol dimethacrylate, diethylene glycol dimethacrylate, diethylene glycol diacrylate, triethylene glycol diacrylate, neopentyl glycol dimethacrylate, neopentyl glycol acrylate, and diallyl phthalate. As the crosslinking agent, use can also be made of a polymerizable monomer having a pendant group including a reactive group, such as, for example, glycidyl methacrylate, methylolacrylamide, or acrolein. Preferred of these are radical-polymerizable bifunctional monomers. Especially preferred are divinylbenzene and hexanediol diacrylate.

Those crosslinking agents including polyfunctional monomers may be used alone or as a mixture of two or more thereof. In the case where a crosslinked resin is used as the binder resin constituting primary polymer particles, it is desirable that the proportion of a crosslinking agent, e.g., a polyfunctional monomer, in all polymerizable monomers constituting the resin should be preferably 0.005% by mass or higher, more preferably 0.1% by mass or higher, even more preferably 0.3% by mass or higher, and be preferably 5% by mass or lower, more preferably 3% by mass or lower, even more preferably 1% by mass or lower.

Known emulsifying agents can be used for the emulsion polymerization. However, one emulsifying agent selected from cationic surfactants, anionic surfactants, and nonionic surfactants or a combination of two or more emulsifying agents selected from these can be used.

Examples of the cationic surfactants include dodecylammonium chloride, dodecylammonium bromide, dodecyltrimethylammonium bromide, dodecylpyridinium chloride, dodecylpyridinium bromide, and hexadecyltrimethylammonium bromide.

Examples of the anionic surfactants include fatty acid soaps such as sodium stearate and sodium dodecanoate, dodecyl sodium sulfate, sodium dodecylbenzenesulfonte, and sodium lauryl sulfate.

Examples of the nonionic surfactants include polyoxyethylene dodecyl ether, polyoxyethylene hexadecyl ether, polyoxyethylene nonylphenyl ether, polyoxyethylene lauryl ether, polyoxyethylene sorbitan monooleate ether, and monodecanoylsucrose.

An emulsifying agent may be used generally in an amount of 1-10 parts by weight per 100 parts by weight of the polymerizable monomers. Those emulsifying agents can be used in combination with a protective colloid which, for example, is one or more members selected from poly(vinyl alcohol)s, such as partly or wholly saponified poly(vinyl alcohol)s, and cellulose derivatives such as hydroxyethyl cellulose.

As a polymerization initiator, use may be made, for example, of hydrogen peroxide; persulfates such as potassium persulfate; organic peroxides such as benzoyl peroxide and lauroyl peroxide; azo compounds such as 2,2'-azobisisobutyronitrile and 2,2'-azobis(2,4-dimethylvaleronitrile); and redox initiators. One or more of these may be used generally in an amount of about 0.1-3 parts by weight per 100 parts by weight of the polymerizable monomers. Of these, a polymerization initiator of which at least part or the whole is accounted for by hydrogen peroxide or by one or more organic peroxides is preferred.

Those polymerization initiators each may be added to the polymerization system before, during, or after the addition of the polymerizable monomers. A combination of these addition modes may be used according to need.

A known chain transfer agent may be used in the emulsion polymerization according to need. Examples of such chain transfer agents include t-dodecylmercaptan, 2-mercaptoethanol, diisopropylxanthogene, carbon tetrachloride, and trichlorobromomethane. Such chain transfer agents may be used alone or in combination of two or more thereof generally in an amount of 5% by mass or smaller based on all polymerizable monomers. Furthermore, a pH regulator, polymerization degree regulator, antifoamer, etc. can be suitably incorporated into the polymerization system.

In the emulsion polymerization, the polymerizable monomers are polymerized in the presence of a polymerization initiator. This polymerization is conducted at a temperature of generally 50-120° C., preferably 60-100° C., more preferably 70-90° C.

It is desirable that the volume-average diameter (Mv) of the primary polymer particles obtained by the emulsion polymerization should be generally 0.02 μm or larger, preferably 0.05 μm or larger, more preferably 0.1 μm or larger, and be generally 3 μm or smaller, preferably 2 μm or smaller, more preferably 1 μm or smaller. When the particle diameter thereof is smaller than that range, there are cases where the control of aggregation rate is difficult. When the diameter thereof exceeds that range, aggregation is apt to give a toner having too large a particle diameter and there are cases where it is difficult to obtain a toner having a desired particle diameter.

The binder resin as primary polymer particles in the invention has a Tg, as measured by the DSC method, of preferably 40-80° C., more preferably 55-65° C. So long as the Tg thereof is within that range, the primary polymer particles have satisfactory storability and retains intact suitability for aggregation. In case where the Tg thereof is too high, such primary polymer particles have poor suitability for aggregation and it is necessary to excessively add a coagulant or to use an excessively elevated aggregation temperature. As a result, there are cases where a fine powder is apt to generate. When the Tg of a binder resin cannot be clearly determined because the calorific change thereof overlaps that attributable to another component, e.g., the melting peak of a polylactone or wax, then the Tg of the resin in a toner produced without using that component is taken as that Tg.

The binder resin constituting the primary polymer particles in the invention has an acid value of preferably 3-50 mg-POH/g, more preferably 5-30 mg-POH/g, in terms of the value determined by the JIS P-0070 method.

With respect to the concentration of primary polymer particles on a solid basis in the "dispersion of primary polymer particles" used in the invention, the lower limit thereof is preferably 14% by mass or higher, more preferably 21% by mass or higher, while the upper limit thereof is preferably 30% by mass or lower, more preferably 25% by mass or lower. When the concentration thereof is within that range, it is easy to regulate the rate of aggregation of the primary polymer particles in a rule-of-thumb manner in the aggregation step. As a result, it is easy to regulate the particle diameter, particle shape, and particle diameter distribution of the core particles so as to be in any desired ranges.

In the invention, it is preferred to obtain toner base particles by mixing the dispersion containing primary polymer particles which has been obtained by emulsion polymerization with dispersions of a colorant, charge control agent, wax, etc. to aggregate the primary particles contained in that dispersion and thereby obtain core particles, bonding or adhering fine resin particles to the core particles, thereafter fusing the primary particles, and washing and drying the resultant particles.

The fine resin particles may be produced by the same method as the primary polymer particles. The constitution thereof is not particularly limited. However, the total proportion of polar monomers in 100% by mass all polymerizable monomers for constituting a binder resin as the fine resin particles is preferably 0.05% by mass or higher, more preferably 0.1% by mass or higher, more preferably 0.2% by mass or higher. It is desirable that the upper limit thereof should be preferably 3% by mass or lower, more preferably 1.5% by mass or lower. When the proportion thereof is within that range, the resultant fine resin particles have improved dispersion stability to facilitate the regulation of particle shape and particle diameter in the aggregation step.

It is preferred that the total proportion of polar monomers in 100% by mass all polymerizable monomers for constituting the binder resin as fine resin powders should be lower than the total proportion of polar monomers in 100% by mass all polymerizable monomers for constituting the binder resin as primary polymer particles, because this facilitates the regulation of particle shape and particle diameter in the aggregation step, is effective in inhibiting the generation of a fine powder, and gives a toner having excellent electrification characteristics.

From the standpoints of storage stability, etc., it is preferred that the Tg of the binder resin as fine resin particles should be higher than the Tg of the binder resin as primary polymer particles.

The colorant is not particularly limited, and may be any of colorants in ordinary use. Examples thereof include the pigments enumerated above, carbon blacks such as furnace black and lamp black, and magnetic colorants. The content of the colorant is not limited so long as the amount of the colorant is sufficient for the resultant toner to form a visible image in development. For example, the content thereof in the toner is preferably in the range of 1-25 parts by weight, more preferably 1-15 parts by weight, especially preferably 3-12 parts by weight.

The colorant may have magnetism. Examples of magnetic colorants include ferromagnetic substances showing ferrimagnetism or ferromagnetism at around 0-60° C., which are use environment temperatures for printers, copiers, and the like. Specific examples thereof include magnetite ($Fe_3O_4$), maghematite ($\gamma$-$Fe_2O_3$), intermediates between or mixtures of magnetite and maghematite, spinel ferrites of the formula $M_xFe_{3-x}O_4$, wherein M is Mg, Mn, Fe, Co, Ni, Cu, Zn, Cd, etc., hexagonal ferrites such as $BaO.6Fe_2O_3$ and $SrO.6Fe_2O_3$, garnet-form oxides such as $Y_3Fe_5O_{12}$ and $Sm_3Fe_5O_{12}$, rutile-form oxides such as $CrO_2$, and the metals, such as Cr, Mn, Fe, Co, and Ni, and ferromagnetic alloys of such metals which show magnetism at around 0-60° C. Preferred of these is magnetite, maghematite, or an intermediate between magnetite and maghematite.

In the case where such a magnetic powder is incorporated from the standpoints of dusting prevention, charge control, etc. while enabling the toner to retain the properties of a nonmagnetic toner, the content of the magnetic powder may be 0.2-10% by mass, preferably 0.5-8% by mass, more preferably 1-5% by mass. In the case of using the toner as a magnetic toner, it is desirable that the content of the magnetic powder in the toner should be generally 15% by mass or higher, preferably 20% by mass or higher, and be generally 70% by mass or lower, preferably 60% by mass or lower. When the content of the magnetic powder is lower than that range, there are cases where a magnetic force required of a magnetic toner is not obtained. When the content thereof exceeds that range, there are cases where this is causative of poor fixability.

In a general method for incorporating a colorant in the emulsion polymerization agglutination method, the dispersion of primary polymer particles is mixed with a colorant dispersion to obtain a mixed dispersion, which is then subjected to aggregation to obtain particle aggregates. It is preferred that the colorant should be emulsified in water by a mechanical means such as a sand mill or bead mill in the presence of an emulsifying agent and be used in the emulsified state. In thus preparing the colorant dispersion, it is preferred to add 10-30 parts by weight of the colorant and 1-15 parts by weight of the emulsifying agent to 100 parts by weight of the water. It is preferred that the dispersing operation should be conducted while monitoring the particle diameter of the colorant present in the dispersion so that the volume-average diameter (Mv) thereof is finally regulated to 0.01-3 μm, more preferably to a value in the range of 0.05-0.5 μm. In incorporating the colorant dispersion during the emulsion aggregation, the dispersion is used in such a calculated amount that the finished toner base particles to be obtained through aggregation have a colorant content of 2-10% by mass.

A wax may be incorporated into either the primary polymer particles or the fine resin particles. It is, however, noted that as the amount of the wax used increases, aggregation control generally tends to become poor, resulting in a broad particle diameter distribution.

Consequently, when a wax is added in the emulsion polymerization agglutination method, it is preferred to use a method in which a wax dispersion prepared beforehand by emulsifying/dispersing a wax in water to a volume-average diameter (Mv) of 0.01-2.0 μm, more preferably 0.01-0.5 μm, is added during emulsion polymerization or in the aggregation step. From the standpoint of dispersing a wax in a toner so as to have a suitable dispersed-state particle diameter, it is preferred to add the wax as seeds during emulsion polymerization. By adding a wax as seeds, primary polymer particles containing the wax enclosed therein are obtained. In these primary particles, the wax does not present on the toner surface in a large amount. The resultant toner can hence be inhibited from being impaired in electrification characteristics or heat resistance. The wax is used in such a calculated amount that the primary polymer particles have a wax content of preferably 4-30% by mass, more preferably 5-20% by mass, especially preferably 7-15% by mass.

A wax may be incorporated into fine resin particles. In this case also, it is preferred to add a wax as seeds during emulsion polymerization as in the case of obtaining primary polymer particles. It is preferred that the wax content in the whole fine resin particles should be lower than the wax content in the whole primary polymer particles. In general, the incorporation of a wax into the fine resin particles tends to result in the enhanced generation of a fine powder, although effective in improving fixability. The reasons for this are thought to be as follows. Fixability is improved because the wax moves to the toner surface at an increased rate when heated. However, the fine resin particles have a widened particle size distribution because of the wax incorporation therein and, hence, aggregation control is difficult, resulting in an increased amount of a fine powder.

A charge control agent may be incorporated into one of the toners of the invention in order to impart charge amount and charge stability.

In the case where a charge control agent is incorporated into a toner in the emulsion polymerization agglutination method, use can be made of, for example, a method in which a charge control agent is added together with polymerizable monomers, etc. during emulsion polymerization, a method in which a charge control agent is added together with primary polymer particles, a colorant, etc. in an aggregation step, or a method in which a charge control agent is added after primary polymer particles, a colorant, etc. are aggregated to a particle diameter approximately suitable for a toner. Preferred of these methods are ones in which a charge control agent is used as an emulsion/dispersion having a volume-average diameter (Mv) of from 0.01 μm to 3 μm prepared by emulsifying/dispersing the charge control agent in water with the aid of an emulsifying agent. It is preferred that during the emulsion aggregation, the dispersion of a charge control agent should be added in such a calculated amount that the finished toner base particles to be obtained through aggregation have a charge control agent content of 0.1-5% by mass.

For producing an emulsion/dispersion of the charge control agent, various wet disperser mills can be used besides homomixers and Disper which are capable of high-speed agitation/mixing, homogenizers capable of high-pressure emulsification, ultrasonic propagators, and the like. Examples of the mills include a ball mill, attritor, sand mill, and bead mill. In these mills, point contacts between beads apply energy to the material to be ground. Other mills are also usable, such as a roll mill, in which energy is applied by a linear contact between rotating rollers, and a rotary flat-plate-type bead-less disperser in which energy is applied by an areal contact between flat plates.

A dispersion medium in the invention is a liquid having the function of dispersing particles of a charge control agent and holding the particles therein. The dispersion medium is suitably selected from known materials according to the intended use of the charge control agent dispersion to be obtained. Examples thereof include water; alcohols such as methanol, ethanol, propanol, and butanol; organic solvents such as acetone, methyl ethyl ketone, tetrahydrofuran, toluene, and xylene; and monomers such as styrene, butyl acrylate, 2-ethylhexyl acrylate, and acrylic acid. These may be used alone or in combination. With respect to applications to aqueous-medium toners, a colorant is dispersed in an oil phase, i.e., a monomer phase, in the case of, for example, a suspension polymerization toner. Consequently, a monomer may be selected as the dispersion medium in this case. In the case of an emulsion aggregation polymerization toner, water may be selected as the dispersion medium because an aggregation step is conducted in an aqueous system. In particular, since a charge control agent dispersion according to the invention is used for an emulsion polymerization aggregation toner, water is suitable as the dispersion medium. Incidentally, water quality affects the reaggregation and resultant enlargement of the charge control agent particles present in the charge control agent dispersion. When the water has a high conductivity, dispersion stability tends to deteriorate with the lapse of time. It is therefore preferred to employ ion-exchanged water or distilled water which has been desalted so as to have a conductivity of preferably 10 μS/cm or lower, more preferably 5 μS/cm or lower. Conductivity was measured with a conductivity meter (Personal SC Meter Model SC72 and detector SC72SN-11, manufactured by Yokogawa Electric Corp.).

In the case of using water as the dispersion medium, it is preferred to add a surfactant to the water for the purposes of wetting and dispersing colorant particles and stably keeping the dispersed state. Examples of usable surfactants include anionic surfactants such as sulfuric ester salts, sulfonic salts, phosphoric esters, and soaps, cationic surfactants such as amine salts and quaternary ammonium salts, and nonionic surfactants such as polyethylene glycols, alkylphenol ethylene oxide adducts, and polyhydric alcohols. Preferred of these are ionic surfactants, i.e., anionic surfactants and cationic surfactants. In the case of using any of those nonionic surfactants, it is preferred to use this surfactant in combination with any of those anionic surfactants or cationic surfactants. Those surfactants may be used alone or in combination of two or more thereof.

The volume-average diameter (Mv) of the primary polymer particles, fine resin particles, colorant particles, wax particles, charge control agent particles, or the like in the dispersion is measured with Nanotrac by the method described in Examples, and is defined as the measured value.

In the aggregation step in the emulsion polymerization agglutination method, the primary polymer particles, fine resin particles, and colorant particles described above and optional ingredients such as a charge control agent and a wax are mixed simultaneously or successively. However, from the standpoints of compositional evenness and particle-diameter evenness, it is preferred to produce beforehand dispersions of the respective ingredients, i.e., a dispersion of the primary polymer particles, dispersion of the fine resin particles, dispersion of the colorant particles, dispersion of the charge control agent, and dispersion of fine particles of the wax.

When these different kinds of dispersions are mixed, it is preferred to add and mix the dispersions continuously or intermittently over some degree of time period in order to evenly aggregate the particles because the ingredients contained in the respective dispersions differ in aggregation rate. The time period suitable for addition varies depending on the amount and solid concentration of each dispersion to be mixed, etc., and it is therefore preferred to suitably regulate the time period in mixing the dispersions. For example, in the case where a colorant particle dispersion is mixed with a dispersion of the primary polymer particles, it is preferred to add the former dispersion over 3 minutes or more. Also in the case where a dispersion of fine resin particles is mixed with core particles, it is preferred to add the dispersion over 3 minutes or more.

For conducting the aggregation treatment, there generally are: a method in which the dispersion is heated in a stirring vessel; a method in which an electrolyte is added; a method in which the concentration of an emulsifying agent in the system is reduced; a method in which a combination of these is employed; and the like. In the case where primary particles are aggregated with stirring to obtain particle aggregates having a size approximately the same as a toner size, the particle diameter of the particle aggregates is governed by a balance between interparticulate cohesive force and the shear force caused by the stirring. The cohesive force can be enhanced by those methods.

In the case of the method in which an electrolyte is added for aggregation, the electrolyte may be either an organic salt or an inorganic salt. Examples thereof include inorganic salts having one or more monovalent metal cations, such as NaCl, PCl, LiCl, $Na_2SO_4$, $P_2SO_4$, $Li_2SO_4$, $CH_3COONa$, and $C_6H_5SO_3Na$; inorganic salts having a divalent metal cation, such as $MgCl_2$, $CaCl_2$, $MgSO_4$, $CaSO_4$, and $ZnSO_4$; and inorganic salts having trivalent metal cations, such as $Al_2(SO_4)_3$ and $Fe_2(SO_4)_3$. When the inorganic salts having one or more polyvalent metal cations having a valence of 2 or higher, among those electrolytes, are used, a higher rate of aggregation is obtained and this is preferred from the standpoint of productivity. However, use of such inorganic salts, on the other hand, increases the amount of primary polymer particles and other particles which remain unincorporated into the core particles. As a result, fine particles smaller than a desired toner particle diameter are apt to generate. It is therefore preferred to use an inorganic salt having one or more monovalent metal cations, which is not so high in aggregating ability, from the standpoint of inhibiting the generation of those fine particles.

The amount of the electrolyte to be used varies depending on the kind of the electrolyte, a desired particle diameter, etc. However, the amount thereof is generally 0.05-25 parts by weight, preferably 0.1-15 parts by weight, more preferably 0.1-10 parts by weight, per 100 parts by weight of the solid components of the mixed dispersion. When the amount of the electrolyte used is smaller than that range, there are cases where the progress of aggregation reaction becomes slow to pose a problem, for example, that fine particles of 1 μm or smaller remain after the aggregation reaction or the resultant particle aggregates have an average particle diameter smaller than the desired particle diameter. When the amount thereof exceeds that range, there are cases where aggregation is apt to proceed too quickly and it is difficult to control particle diameter, resulting in a problem, for example, that the resultant core particles include coarse particles or particles of indefinite shapes.

With respect to methods for adding the electrolyte, it is preferred to add the electrolyte intermittently or continuously over some degree of time period without adding the additive at a time. This time period of addition varies depending on the amount to be added, etc. It is, however, more preferred to add over a period of 0.5 minutes or longer. Usually, when an electrolyte is added, aggregation initiates abruptly just at that moment. There is hence a tendency that a large amount of primary polymer particles and colorant particles remain unaggregated or aggregates of these particles and the like remain in a large amount. These are thought to be one cause of the generation of fine particles. According to the operation described above, even aggregation is possible while preventing abrupt aggregation and, hence, the generation of fine particles can be prevented.

In the case where an electrolyte is added to conduct aggregation, the final temperature in the aggregation step is preferably 20-70° C., more preferably 30-60° C. To regulate temperature before the aggregation step is also one method for regulating the particle diameter to a value within the specific range according to the invention. Some colorants which may be added in the aggregation step induce aggregation like the electrolytes, and there are cases where aggregation occurs even when no electrolyte is added. Such aggregation can be prevented by lowering the temperature of the dispersion of primary polymer particles before a colorant dispersion is mixed therewith. This aggregation is causative of the generation of fine particles. It is preferred in the invention that the primary polymer particles should be cooled beforehand to a temperature in the range of preferably 0-15° C., more preferably 0-12° C., even more preferably 2-10° C. This technique not only is effective in the case of conducting aggregation by adding an electrolyte, but also is usable in methods for conducting aggregation without adding an electrolyte, such as a method in which aggregation is conducted by pH control or by the addition of a polar organic solvent, e.g., an alcohol. That technique is not especially limited in aggregation method.

In the case where aggregation is conducted by heating, the final temperature in the aggregation step is generally in the temperature range of from (Tg-20° C.) to the Tg of the primary polymer particles, preferably in the range of (Tg-10° C.) to (Tg-5° C.).

Among methods for preventing abrupt aggregation in order to prevent the generation of fine particles, there is a method in which desalted water or the like is added. The method in which desalted water or the like is added is not so high in aggregating ability as compared with the method in which an electrolyte is added. Consequently, that method is not positively employed from the standpoint of production efficiency, and there are even cases where the method is undesirable because later steps such as, e.g., a filtration step undesirably yield a large amount of a filtrate. However, that method is exceedingly effective when delicate control of aggregation is required as in the invention. It is preferred in the invention to employ that method in combination with the method involving heating, the method in which an electrolyte is added, or the like. In this case, it is especially preferred to use a method in which desalted water is added after the addition of an electrolyte, from the standpoint of ease of aggregation control.

The time period required for aggregation is optimized while taking account of apparatus shape and treatment scale. However, from the standpoint of obtaining toner base particles having a particle diameter reaching a desired particle diameter, the time period from the temperature lower by 8° C. than the temperature at the time of an operation for terminating the aggregation step, e.g., than the temperature at the time of an operation for terminating the growth of core particles by adding an emulsifying agent or by pH control, etc. (hereinafter referred to as final aggregation temperature), to the final aggregation temperature is preferably 30 minutes or longer, more preferably 1 hour or longer. By regulating the time period so as to be long, residual primary polymer particles, colorant particles, or aggregates of these are incorporated into desired core particles or aggregated into desired core particles, without being left.

In the invention, the surface of core particles can be coated with fine resin particles (fine resin particles can be adhered or bonded to the surface) according to need to form toner base particles. The fine resin particles have a volume-average diameter (Mv) of preferably from 0.02 μm to 3 μm, more preferably from 0.05 μm to 1.5 μm. In general, use of the fine resin particles promotes the generation of fine particles smaller than a given toner particle diameter. Because of this, conventional toners coated with fine resin particles have a large amount of fine particles smaller than a given toner particle diameter.

In the invention, when a wax is incorporated in an increased amount, there are cases where electrification characteristics and heat resistance deteriorate because the wax is apt to be exposed on the toner surface, although high-temperature fixability improves. However, by coating the surface of core particles with fine resin particles containing no wax, such performance deterioration can be prevented.

It is, however, noted that when a wax is incorporated also into the fine resin particles for the purpose of improving high-temperature fixability, the fine resin particles which have adhered to the surface of the core particles are apt to shed off. The reason for this is that the fine resin particles have a widened particle diameter distribution and, hence, there are fine resin particles having a large particle diameter, which have low adhesion force. It is therefore preferred that in order to diminish the shedding, a liquid containing dispersed therein particles having fine resin particles adherent to the surface thereof should be heated while adding thereto an aqueous solution prepared beforehand by mixing a dispersion stabilizer with water.

When the "step of initiating heating after addition of an emulsifying agent", which is a conventional technique, is employed, i.e., when an aging step is conducted after cohesive force is abruptly lowered, then there are cases where the fine resin particles which have adhered are apt to shed off because of the abrupt decrease in cohesive force. It is therefore preferred that toner base particles should be fused after adhesion of fine resin particles, without considerably lowering cohesive force and while inhibiting particle enlargement.

It is preferred that the emulsion polymerization agglutination method should include an aging step for enhancing the stability of particle aggregates obtained by aggregation. In the aging step, an emulsifying agent or a pH regulator is added as a dispersion stabilizer to reduce interparticulate cohesive force and thereby terminate the growth of the toner base particles, and the particles which have aggregated are then fused to each other.

When an emulsifying agent is added, the amount of the emulsifying agent to be added is not limited. However, the amount thereof is preferably 0.1 part by weight or larger, more preferably 1 part by weight or larger, even more preferably 3 parts by weight or larger, and is preferably 20 parts by weight or smaller, more preferably 15 parts by weight or smaller, even more preferably 10 parts by weight or smaller, per 100 parts by weight of the solid components of the mixed dispersion. During the period from the aggregation step to completion of the aging step, an emulsifying agent is added or the pH of the aggregate dispersion is increased, whereby the particle aggregates formed by aggregation in the aggregation step can be inhibited from undergoing aggregation or the like. As a result, the toner obtained through the aging step can be inhibited from including coarse particles.

Examples of methods for regulating a small-particle-diameter toner of the invention so as to have a particle diameter within a specific range which indicates a narrow particle size distribution include a method in which the stirrer rotation speed is lowered, i.e., the shear force caused by stirring is reduced, before the step of adding an emulsifying agent or a pH regulator. It is preferred that this method should be employed in a system having a low aggregation tendency, for example, in the case where the aggregate dispersion is abruptly shifted to a stable (dispersion) system by adding an emulsifying agent or a pH regulator at a time. In case where the method described above in which the system is heated while adding thereto an aqueous solution prepared beforehand by mixing a dispersion stabilizer with water is employed, a reduction in stirrer rotation speed results in too high a tendency for the system to aggregate and this may lead to particle enlargement.

A toner having the specific particle diameter distribution according to the invention can be obtained by the method described above as an example. In this connection, the content of fine particles can be regulated by controlling the degree in which the rotation speed is lowered. For example, when the stirrer rotation speed is lowered from 250 rpm to 150 rpm, a small-particle-diameter toner having a narrower particle size distribution than known toners can be obtained and a toner having the specific particle diameter distribution according to the invention can be obtained. However, those values, of course, vary depending on conditions including (a) the diameter of the stirring vessel (regarded as the so-called cylindrical vessel) and the maximum diameter of the stirring blades (and relative ratio therebetween), (b) the height of the stirring vessel, (c) the peripheral speed of the stirring blade tips, (d) the shape of the stirring blades, and (e) the position of the blades in the stirring vessel.

With respect to (c), in particular, the peripheral speed thereof is preferably 1.0-2.5 msec, more preferably 1.2-2.3 msec, especially preferably 1.5-2.2 msec. This is because so long as the peripheral speed is within that range, shearing at a suitable rate which causes neither shedding nor enlargement is applied to the particles.

The temperature in the aging step is preferably not lower than the Tg of the binder resin as the primary polymer particles, more preferably not lower than the temperature higher than the Tg by 5° C., and is preferably not higher than the temperature higher than the Tg by 80° C., more preferably not higher than the temperature higher than the Tg by 50° C. The time period required for the aging step varies depending on a desired toner shape. However, it is desirable that after the system has been heated to or above the glass transition temperature of the polymer constituting the primary polymer particles, the system should be held for generally 0.1-5 hours, preferably 1-3 hours.

Through the heat treatment described above, the primary polymer particles in each aggregate are fused and united with each other, and the toner base particles as aggregates also come to have a shape close to sphere. The particle aggregates before the aging step each are thought to be a mass of primary polymer particles gathered by electrostatic or physical aggregation. After the aging step, however, the primary polymer particles constituting each particle aggregate have been fused to each other and the toner base particles also can have an approximately spherical shape. According to such aging step, toners of various shapes suitable for purposes, such as, e.g., the grape cluster type having a shape formed by aggregating primary polymer particles, the potato type in which fusion has proceeded, and the spherical shape in which fusion has proceeded further, can be produced by regulating the temperature, time period, etc. in the aging step.

The particle aggregates obtained through the steps described above are subjected to solid/liquid separation by a known technique to recover the particle aggregates. Subsequently, the particle aggregates are washed according to need and then dried, whereby the desired toner base particles can be obtained.

Furthermore, an outer layer including a polymer as a main component may be formed preferably in a thickness of 0.01-0.5 μm on the surface of the particles obtained by the emulsion polymerization agglutination method, by a method such as, e.g., the spray drying method, in-situ method, or in-liquid particle coating method. As a result, encapsulated toner base particles are obtained.

The emulsion polymerization aggregation toner has an average degree of circularity, as determined with flow type particle image analyzer FPIA-2100, of preferably 0.90 or higher, more preferably 0.92 or higher, even more preferably 0.94 or higher. It is thought that the closer to sphere the shape of toner particles, the less the charge amount localization occurs in each particle and the more the developing properties tend to become even. However, to produce a perfectly spherical toner results in impaired removability in cleaning. Consequently, the average degree of circularity is preferably 0.98 or lower, more preferably 0.97 or lower.

It is desirable that the tetrahydrofuran (THF)-soluble components of the toner, when examined by gel permeation chromatography (hereinafter sometimes abbreviated to "GPC"), should have peak molecular weights, at least one of which is preferably 30,000 or higher, more preferably 40,000 or higher, even more preferably 50,000 or higher, and is preferably 200,000 or lower, more preferably 150,000 or lower, even more preferably 100,000 or lower. When all the peak molecular weights are lower than that range, there are cases where this toner has impaired mechanical durability in the nonmagnetic one-component development mode. When all the peak molecular weights are higher than that range, there are cases where low-temperature fixability and fixing strength are impaired.

The electrification characteristics of the emulsion polymerization aggregation toner may be either positive electrification or negative electrification. However, it is preferred to use the toner as a toner of the negative electrification type. Toner electrification characteristics can be regulated based on the selection and content of a charge control agent, selection and incorporation amount of an external additive, etc.

From the standpoint of obtaining a toner satisfying the expressions (3) and (6), it is preferred to employ an operation for the aggregation step which is not high in the rate of aggregation as compared with ordinary operations. Examples of the operation which is not high in the rate of aggregation include the following techniques: to cool beforehand a dispersion to be used; to add a dispersion or the like over a prolonged time period: to employ an electrolyte or the like which does not have high aggregating ability; to add an electrolyte continuously or intermittently; to heat at a reduced rate; and to prolong the time period of aggregation. It is also preferred that an operation which is less apt to disperse the aggregated particles again should be employed for the aging step. Examples of the operation which is less apt to finely disperse the aggregated particles include the following techniques: to stir at a reduced rotation speed; to add a dispersion stabilizer continuously or intermittently; and to mix beforehand a dispersion stabilizer and water. The toner satisfying the expressions (3) and (6) preferably is one in which the toner or toner base particles should be finally obtained without through a step in which particles smaller than the volume-median diameter (Dv50) of the final product are removed by an operation such as, e.g., classification.

The toners for electrostatic-image development of the invention may be used for any of: a magnetic two-component developer in which a carrier for magnetically conveying the toner to an electrostatic-latent-image part coexists; a magnetic one-component developer in which a magnetic powder has been incorporated in the toner; and a nonmagnetic one-component developer in which no magnetic powder is used. However, from the standpoint of remarkably producing the effects of the invention, it is preferred to use the toners of the invention especially as developers for the nonmagnetic one-component development mode.

In the case of use as the magnetic two-component developer, the carrier to be mixed with each toner to constitute the developer can be a known magnetic substance, e.g., an iron-powder, ferritic, or magnetitic carrier, a carrier obtained by coating the surface of such a magnetic substance with a resin, or a magnetic resin carrier. As the carrier-coating resin, use can be made of generally known resins such as styrene resins, acrylic resins, styrene/acrylic copolymer resins, silicone resins, modified silicone resins, and fluororesins. However, the carrier-coating resin should not be construed as being limited to these. Although such carriers are not particularly limited in average particle diameter, carriers having an average particle diameter of 10-200 μm are preferred. It is preferred that those carriers should be used in an amount of 5-100 parts by weight per part by weight of the toner.

A method of image formation according to the invention is explained in more detail by reference to drawings.

FIG. 1 is a view illustrating an example of developing devices which employ a nonmagnetic one-component toner and are usable for carrying out a method of image formation with a toner of the invention. In FIG. 1, a toner 6 of the invention housed in a toner hopper 7 is forcedly brought near a roller-form sponge roller (toner supply aid member) 4 with agitating blades 5, whereby the toner is fed to the sponge roller 4. The toner caught by the sponge roller 4 is conveyed to a toner-conveying member 2 by the rotation of the sponge roller 4 in the direction indicated by the arrow, and the toner undergoes friction and is electrostatically or physically adsorbed. The toner-conveying member 2 is forcibly rotated in the direction of the arrow, and an even thin toner layer is formed with an elastic steel blade (toner layer thickness control member) 3. Simultaneously therewith, the toner is frictionally charged. Thereafter, the toner is conveyed to the surface of an electrostatic-latent-image carrier 1 which is in contact with the toner-conveying member 2, whereby a latent image is developed. The electrostatic latent image is obtained, for example, by charging an organic photoreceptor with a 500-V DC and then exposing the photoreceptor to a light.

Figure 6:
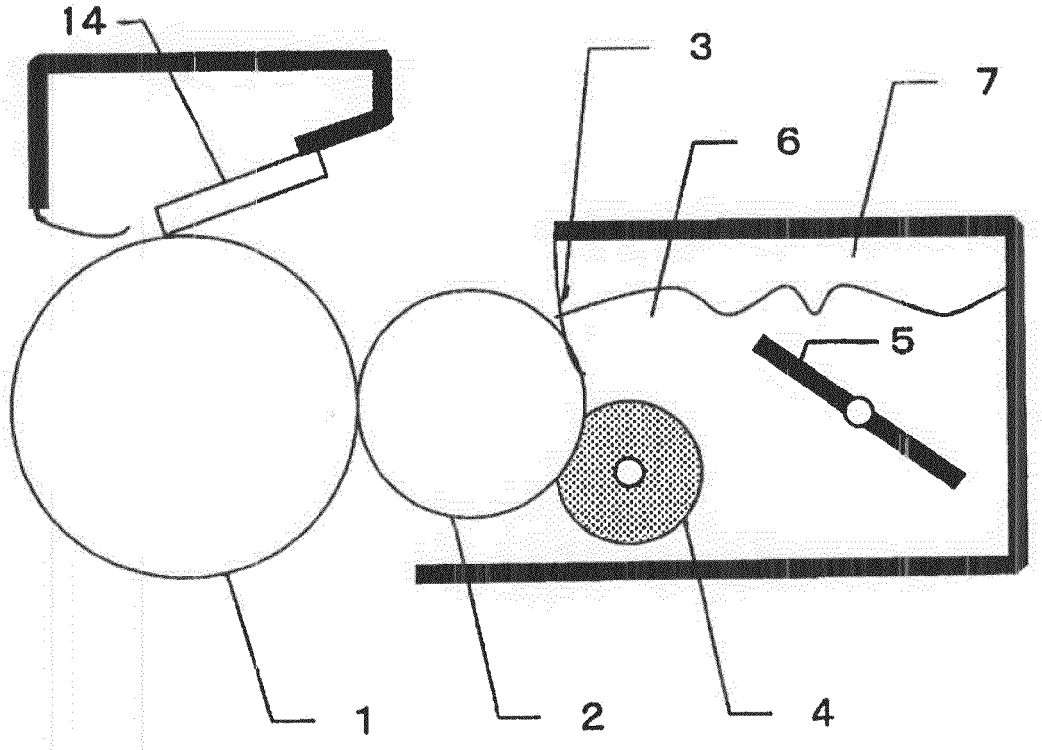
FIG. 6 is a diagrammatic view illustrating one example of nonmagnetic one-component toner developing devices for use in the image-forming apparatus of the invention.

In FIG. 6 is also shown one embodiment of the image-forming apparatus of the invention. An electrostatic latent image is formed on the electrostatic-image holding member 1 of FIG. 6, and toner particles having electrostatic charges are adhered to the electrostatic latent image pattern to develop the image. Subsequently, in a transfer step, the toner is transferred from the electrostatic-image holding member 1 to a receiving material, such as paper or an intermediate transfer material. The untransferred toner remaining on the electrostatic-image holding member 1, in a subsequent cleaning step, is wiped off and recovered with a cleaning blade 14 which is in contact with the member 1. The electrostatic-image holding member from which the untransferred toner has been removed returns to the step of forming an electrostatic latent image.

The formation of an electrostatic latent image is explained. First, in a charging step, the electrostatic-image holding member 1 is charged. In the case where an electrophotographic photoreceptor is used as the electrostatic-image holding member 1, charges are evenly imparted to the surface of the photoreceptor by, e.g., discharge from a charging roller, charging brush, or corona wire. The amount of charges is generally in the range of from 300 V to 1 PV in terms of the absolute value of the surface potential of the photoreceptor. In the charging part, it is preferred to use a contact-type charging member such as, e.g., a charging roller or a charging brush. The reason for this is as follows. In contrast to the non-contact charging techniques in which charges are poured, such as corona charging, the contact-type charging technique charges a photoreceptor using a potential balance in microregions on the basis of Paschen's law. Because of this, contact-type charging is less influenced by a residual image or transfer potential and is suitable for the formation of high-quality images with a small-particle-diameter toner.

Subsequently, charges on the surface of the photoreceptor are released by exposure to a light reflected from an original or to a laser light to thereby form an electrostatic latent image pattern. For forming an electrostatic latent image pattern on the electrostatic-image holding member 1, a technique other than that based on charging a photoreceptor and exposing the photoreceptor to light may be used.

In the developing part, use is generally made of the two-component development mode, nonmagnetic one-component development mode, or magnetic one-component mode described above or the like. The toner 6 which has been charged by, e.g., frictional charging is brought into contact with or brought near the electrostatic-image holding member 1, whereby the toner 6 is transferred to the electrostatic latent image pattern.

The general case of the nonmagnetic one-component development mode is explained below. A toner 6 is fed from a toner storage chamber 7 to a developing roller 2. Examples of feeding methods include: self-adhesion based on the weight of the toner itself; a method in which the toner 6 is brought near the developing roller 2 by agitation with an agitator 5 or the like to promote adhesion; a method in which the toner 6 is held in a toner supply aid member 4, such as a sponge roller, and this member 4 is slidingly rubbed against the developing roller 2 to transfer the toner thereto; and combinations of these. The toner 6 which has adhered to the developing roller 2 is regulated so as to be in an evenly adherent state with a toner layer thickness control member 3 such as, e.g., a doctor blade, elastic blade, and trimmer roller.

For charging the toner 6, use may be made of: a method in which the toner 6 is charged by friction of the toner 6 with the developing roller 2, doctor blade 3, sponge roller 4, etc.; a method in which a voltage is applied between the developing roller 2 and the doctor blade 3 and between the developing roller 2 and the sponge roller 4 to promote the charging of the toner 6; and the like.

As the developing roller 2, use may be made of a general roller such as a conductive rubber roller or a metallic cylinder. Although the material of the surface of the developing roller 2 may be as it is, the surface may be subjected to coating with a resin or another substance, blasting, or a chemical surface treatment such as, e.g., oxidation in order to attain stable charge control. This applies to the material of the doctor blade 3. In some cases, a resinous elastic member such as, e.g., a urethane rubber is used. In other cases, a blade-spring member such as, e.g., a stainless-steel sheet or a square-bar member is pushed against the developing roller 2. The doctor blade 3 may be subjected to a surface treatment like the developing roller 2.

The developing roller 2 to which the toner has been evenly adhered is brought into contact with or brought near an electrostatic-image holding member 1 to transfer the toner from the developing roller 2 to the electrostatic-image holding member 1 and thereby develop an electrostatic latent image pattern. For the purposes of promoting the transfer and preventing toner adhesion to the areas which will give a white background, a developing bias voltage is generally applied between the electrostatic-image holding member 1 and the developing roller 2. In general, the developing bias potential is intermediate between the potentials of the white background areas and the image areas of the latent image pattern. However, an alternating-current voltage may be superimposed to promote development, or a jumping technique may be used in which toner particles are shuttled between the developing roller 2 and the electrostatic-image holding member 1 to finally develop the electrostatic latent image faithfully to the pattern thereof In a transfer part, the toner which adhered to the electrostatic-image holding member 1 in the developing part and is held thereon is mostly transferred to a receiving material (not shown), such as paper or an intermediate transfer material. The receiving material is brought into contact with the electrostatic-image holding member 1 and a voltage or charges are applied to the receiving material from the back side thereof, whereby the toner is transferred. Examples of methods for applying a voltage from the back side include a method in which a voltage is applied to a conductive transfer roller or the like and a method in which a corona wire or the like is disposed on the back side to transfer the toner with charges deposited by discharge.

In a cleaning part, the untransferred toner, i.e., the toner remaining untransferred to the receiving material, is wiped off and recovered with a cleaning blade 14. It is preferred that the cleaning blade 14 is made of a material having a rubber hardness of 50-90, more preferably 60-80. When the rubber hardness thereof is within that range, the following effects are apt to be exhibited and the effects of the invention are apt to be produced. Rubber hardness is measured by the method in accordance with JIS P6301 (spring type, Type A); the "rubber hardness" is defined as the value thus measured.

The material of the cleaning blade 14 is not particularly limited. However, urethane rubbers, silicone rubbers, and the like are preferred. One end of the cleaning blade 14 has been fixed, and the ridgeline of the other end, which is a free end, is in the state of being pushed against the electrostatic-image holding member 1. The untransferred toner accumulates in this contact part. The untransferred toner which has accumulated in a large amount is moved from the cleaning blade 14 to a recovery chamber and stored therein. The movement to the recovery chamber occurs by a mechanism in which the toner which has accumulated earlier is pushed out by the toner being successively wiped off and is thereby moved toward the fixed end of the cleaning blade 14. In many cases, the movement toward the recovery chamber is helped by an agitator or the like in order to prevent excessive accumulation. There are cases where the untransferred toner recovered is returned to the toner storage chamber 7 of the developing part and reused.

In the cleaning part, the cleaning blade 14 is microscopically vibrating due to the stick-and-slip phenomenon described above. In the case of a toner including a large amount of toner particles having a diameter of from 2.00 μm to 3.56 μm, a cleaning failure is apt to occur. Consequently, the proportion of such toner particles must be minimized.

Furthermore, relationship with volume-median diameter was investigated in detail. As a result, it is thought that the stick-and-slip phenomenon is accompanied by the following phenomenon. In the microvibration, toner particles are temporarily and microscopically caught by the contact part between the electrostatic-image holding member and the ridgeline of a cleaning blade end part to lift up the cleaning blade and thereby form a slight gap between the cleaning blade and the electrostatic-image holding member. It is thought that the size of the gap relates to the volume-median diameter (Dv50) of the toner. A toner having a larger volume-median diameter (Dv50) is thought to render the gap wider and form the gap in higher probability.

Because of this, among toners having a volume-median diameter (Dv50) in the range of from 4.0 μm to 7.5 μm, the toners having a relatively large volume-median diameter (Dv50) are required to be further reduced in the proportion of toner particles having a diameter of from 2.00 μm to 3.56 μm. On the other hand, in the toners having a relatively small volume-median diameter (Dv50), among toners having a volume-median diameter (Dv50) in the range of from 4.0 μm to 7.5 μm, a relatively high proportion of toner particles having a diameter of from 2.00 μm to 3.56 μm is permitted although low. This relationship is expressed by the relational expression (3) or (6) as will be demonstrated by Examples and Comparative Examples.

Meanwhile, the cleaning failure which results in the adhesion of a coarse particle to the cleaning blade continuously occurs in the same position and, hence, a linear image failure continuously occurs in the same position. In contrast, the cleaning failure which was especially desired to be eliminated and was able to be eliminated in the invention is not the long linear image failure but a cleaning failure which occurs temporarily. This cleaning failure hence is thought to be attributable to the phenomenon in which toner particles are caught temporarily.

With respect to the removability in cleaning of toners having a volume-median diameter (Dv50) larger than 7.5 μm, which have been used frequently, there has been no such need of taking account of the proportion of toner particles having a diameter of from 2.00 μm to 3.56 μm. This is thought to be because the phenomenon in which toner particles are temporarily caught due to the vibration rate and vibration width peculiar to the stick-and-slip phenomenon has been less apt to occur with toners larger than 7.5 μm.

In recent years, toners having a small volume-median diameter (Dv50) have come to be used. In addition, even the recent polymerization toners and pulverization toners in which the surface has been smoothed by, e.g., a surface treatment have become more apt to undergo the phenomenon in which toner particles are caught temporarily. Such toners have been satisfactorily improved in that kind of removability in cleaning only by the method of image formation according to the invention.

When the method of image formation according to the invention is used, not only that kind of cleaning failure is especially mitigated but also the "cleaning failure resulting in the accumulation and adhesion of toner particles on the cleaning blade" which has been known can also be mitigated.

After the cleaning, the electrostatic-image holding member 1 in which the toner has been removed from the surface returns to the electrostatic-latent-image formation part (developing part). In the case where a photoreceptor is used as the electrostatic-image holding part 1, the electrostatic latent image pattern formed in the previous cycle may be erased with an erase light before charges are evenly imparted.

By using the toner in such an electrophotographic apparatus, an electrophotographic apparatus especially having excellent cleaning performance can be constructed.

<Constitution of Electrophotographic Photoreceptor>

The image-forming apparatus of the invention has an electrophotographic photoreceptor which includes a conductive substrate and a specific interlayer (e.g., an undercoat layer or an anodized coating film) formed thereon or which includes a conductive substrate having a specific surface state.

Furthermore, the image-forming apparatus and cartridge of the invention have an electrophotographic photoreceptor which includes a conductive substrate and a specific photosensitive layer formed thereover.

<Conductive Substrate>

As the conductive substrate to be used in the photoreceptor, use may be mainly made of a metallic material such as aluminum, an aluminum alloy, stainless steel, copper, or nickel, a resinous material to which conductivity has been imparted by adding a conductive powder such as a metal, carbon, tin oxide, or the like, or a resin, glass, paper, or the like having a surface on which a conductive material such as aluminum, nickel, or ITO (indium oxide/tin oxide) has been deposited by vapor deposition or coating fluid application. The shape thereof may be a drum, sheet, or belt form or another form. Also usable is a conductive substrate which is made of a metallic material and which has been coated with a conductive material having an appropriate resistivity for the purpose of regulating conductivity, surface properties, etc. or of covering defects.

In the case where a metallic material such as an aluminum alloy is used as the conductive substrate, it is preferred to form an anodized coating film thereon before the substrate is used. In the case where an anodized coating film has been formed, it is desirable to conduct a pore-filling treatment by a known method.

An anodized coating film is formed by conducting anodization in an acidic bath containing, for example, chromic acid, sulfuric acid, oxalic acid, boric acid, or a sulfamic acid. However, anodization in sulfuric acid gives more satisfactory results. In the case of anodization in sulfuric acid, it is preferred to regulate the following conditions so as to be within the following ranges: a sulfuric acid concentration of 100-300 g/L, dissolved-aluminum concentration of 2-15 g/L, liquid temperature of 15-30° C., electrolysis voltage of 10-20 V, and current density of 0.5-2 A/dm$^2$. However, anodization conditions should not be construed as being limited to these.

It is preferred that the anodized coating film thus formed should be subjected to a pore-filling treatment. The pore-filling treatment may be conducted by a known method. For example, it is preferred to conduct a low-temperature pore-filling treatment in which the substrate is immersed in an aqueous solution containing nickel fluoride as a main component or a high-temperature pore-filling treatment in which the substrate is immersed in an aqueous solution containing nickel acetate as a main component.

The aqueous nickel fluoride solution to be used in the low-temperature pore-filling treatment can have a suitably selected concentration. However, more preferred results are obtained when the solution having a concentration in the range of 3-6 g/L is used. From the standpoint of enabling the pore-filling treatment to proceed smoothly, it is preferred to conduct the treatment at a temperature of 25-40° C., preferably 30-35° C., and a pH of the aqueous nickel fluoride solution in the range of 4.5-6.5, preferably 5.5-6.0. As a pH regulator, use can be made of oxalic acid, boric acid, formic acid, acetic acid, sodium hydroxide, sodium acetate, ammonia water, or the like. With respect to treatment period, it is preferred to conduct the treatment for a period in the range of 1-3 minutes per μm of the thickness of the coating film. In order to further improve coating-film properties, cobalt fluoride, cobalt acetate, nickel sulfate, a surfactant, or the like may be added to the aqueous solution of nickel fluoride beforehand. The substrate is subsequently washed with water and dried to complete the low-temperature pore-filling treatment.

As a pore-filling agent for the high-temperature pore-filling treatment, use can be made of an aqueous solution of a metal salt such as nickel acetate, cobalt acetate, lead acetate, nickel cobalt acetate, or barium nitrate. However, it is especially preferred to use nickel acetate. In the case of using an aqueous solution of nickel acetate, the concentration thereof is preferably in the range of 5-20 g/L. It is preferred to conduct the treatment at a temperature of 80-100° C., preferably 90-98° C., and a pH of the aqueous nickel acetate solution in the range of 5.0-6.0. In this treatment, ammonia water, sodium acetate, or the like can be used as a pH regulator. With respect to treatment period, it is preferred to conduct the treatment for 10 minutes or longer, preferably 20 minutes or longer. In this case also, sodium acetate, an organic carboxylic acid, an anionic surfactant, a nonionic surfactant, or the like may be added to the aqueous solution of nickel acetate in order to improve coating-film properties. The substrate is subsequently washed with water and dried to complete the high-temperature pore-filling treatment.

In the case of a large average film thickness, it is necessary to employ intense pore-filling conditions by using a pore-filling liquid having an increased concentration or conducting the treatment at an elevated temperature for a longer time period. Consequently, not only productivity becomes poor but also the coating film surface is apt to have surface defects such as spots, fouling, or powdering. From such standpoints, it is preferred to form an anodized coating film in an average film thickness of generally 20 μm or smaller, especially 7 μm or smaller.

The surface of the substrate may be smooth, or may have been roughened by using a special cutting technique or by conducting grinding. The substrate may have a roughened surface obtained by incorporating particles having an appropriate particle diameter into the material constituting the substrate. From the standpoint of cost reduction, a drawn tube can be used as it is without being subjected to cutting. Especially when an aluminum substrate which has not undergone cutting, such as an aluminum substrate obtained by drawing, impact drawing, or squeezing, is used, adherent substances present on the surface, such as fouling substances and foreign matter, and small mars and the like are eliminated by the treatment and an even and clean substrate is obtained. Use of such an aluminum substrate is therefore preferred.

Specifically, the conductive substrate preferably has a surface roughness Ra of from 0.01 μm to 0.3 μm. When the Ra thereof is lower than 0.01 μm, there are cases where bondability is poor. When the Ra thereof exceeds 0.3 μm, there are cases where image defects such as black spots generate. The Ra thereof is more preferably from 0.02 μm to 0.2 μm, especially preferably from 0.03 μm to 0.18 μm, even more preferably from 0.05 μm to 0.17 μm.

[Method of Determining Surface Roughness Ra and Definition Thereof]

Surface roughness Ra means arithmetic mean roughness and indicates an average of deviations of absolute value from a mean line. Specifically, from a roughness curve, a section having a reference length in the direction of a mean line for the roughness curve is extracted. The absolute values of deviations of the measured curve from a mean line for the extracted section are summed up and averaged to determine the surface roughness Ra. Those values of Ra are ones measured with a surface roughness meter (Surfcom 570A, manufactured by Tokyo Seimitsu Co., Ltd.). However, another measuring device which gives the same results within an allowance range may be used.

For processing the surface of a conductive substrate to regulate the surface roughness thereof to a value within that range, use may be made of: a method in which the substrate surface is cut with a cutting tool or the like to roughen the surface; a method based on sandblasting in which fine particles are blown against the substrate surface to roughen the surface; the method based on processing with a device for cleaning with ice particles as described in JP-A-4-204538; and the method based on honing processing described in JP-A-9-236937. Examples thereof further include anodization or alumite-forming treatment, buffing, the method based on laser ablation described in JP-A-4-233546, the method using an abrasive tape described in JP-A-8-1502, and the method based on roller burnishing described in JP-A-8-1510. However, methods for roughening the surface of a substrate should not be construed as being limited to these.

As a conductive material, use can be made of a metal drum made of aluminum, nickel, etc., a plastic drum coated by vapor deposition with aluminum, tin oxide, indium oxide, or the like, or a paper or plastic drum coated with a conductive substance. Such a raw material for the conductive substrate preferably is one having a resistivity at ordinary temperature of $10^3$ Ωcm or lower.

<Undercoat Layer>

The photoreceptor to be used in the image-forming apparatus of the invention has an undercoat layer including a binder resin. It is preferred that this undercoat layer should contain metal oxide particles.

<Metal Oxide Particles>

It is preferred in the invention that metal oxide particles should be incorporated into the undercoat layer.

[Particle Diameter of Metal Oxide Particles]

The metal oxide particles preferably satisfy the following requirements. It is preferred that when the undercoat layer is dispersed in a solvent prepared by mixing methanol and 1-propanol in a weight ratio of 7:3, then the volume-average particle diameter of the metal oxide aggregate secondary particles in the resultant liquid (hereinafter sometimes referred to simply as "volume-average particle diameter") should be 0.1 μm or smaller, and that the 90%-cumulative particle diameter thereof should be 0.3 μm or smaller. The volume-average particle diameter of the metal oxide aggregate secondary particles measured in the manner shown above is especially preferably 0.09 μm or smaller. Furthermore, the 90%-cumulative particle diameter thereof is especially preferably 0.2 μm or smaller. On the other hand, the lower limit of the volume-average particle diameter thereof is preferably 0.01 μm or larger, especially preferably 0.03 μm or larger. The lower limit of the 90%-cumulative particle diameter is preferably 0.05 μm or larger, especially preferably 0.07 μm or larger.

When the volume-average particle diameter of the metal oxide aggregate secondary particles measured in the manner shown above is too large, there are cases where charge leakage occurs and the undercoat layer induces photosensitive-layer unevenness to cause image defects. When the volume-average diameter thereof is too small, there is a possibility that this undercoat layer might cause a cleaning failure and apparatus fouling.

The "volume-average particle diameter of the metal oxide aggregate secondary particles" is determined in the following manner and defined as the value thus determined.

[Method of Determining Volume-Average Particle Diameter]

The volume-average particle diameter of the metal oxide particles according to the invention is a value obtained by directly examining, by the dynamic light-scattering method, the metal oxide particles present in a coating fluid for forming the undercoat layer according to the invention. Regardless of the state in which the metal oxide particles are present, the value obtained by the dynamic light-scattering method is used.

The dynamic light-scattering method is a technique in which the speed of Brownian movement of particles which have been finely dispersed is determined by irradiating the particles with a laser light and detecting the scattering of lights differing in phase according to the speed (Doppler shift) to determine the particle size distribution. The value of each of various particle diameters of the metal oxide particles in the coating fluid for forming the undercoat layer according to the invention is a value for the metal oxide particles which are in the state of being stably dispersed in the coating fluid for forming the undercoat layer, and does not mean the particle diameter of the metal oxide particles in the form of a powder to be dispersed or the particle diameter of a wet cake. Specifically, an actual examination is made with a particle size analyzer (MICROTRAC UPA model:9340-UPA, manufactured by Nikkiso Co., Ltd.; hereinafter abbreviated to UPA), which operates by the dynamic light-scattering method, under the following set conditions. A specific examination operation is performed based on the instruction manual (Document No. T15-490A00, Revision No. E; made by Nikkiso Co., Ltd.) for the particle size analyzer.

Setting of the Particle Size Analyzer Operating by Dynamic Light-Scattering Method:

Upper limit of measurement: 5.9978 μm
Lower limit of measurement: 0.0035 μm
Number of channels: 44
Examination period: 300 sec
Examination temperature: 25° C.
Particle transparency: absorption
Refractive index of particle: N/A (not applied)
Particle shape: non-spherical
Density: 4.20 g/cm$^3$ (*)
Kind of dispersion medium: solvent used in the coating fluid for forming undercoat layer
Refractive index of the dispersion medium: refractive index of solvent used in the coating fluid for forming undercoat layer (*) The value of density is for titanium dioxide particles. In the case of other particulate materials, the numerical data given in the instruction manual are used.

In the invention, a methanol/l-propanol mixed solvent (weight ratio, methanol/l-propanol=7/3; refractive index, 1.35) is used as a dispersion medium unless otherwise indicated.

In the case where the coating fluid for undercoat layer formation is too thick in the examination and has a concentration outside the measurable range for an examination apparatus, use is made of a method in which the coating fluid for undercoat layer formation is diluted with a methanol/l-propanol mixed solvent (weight ratio, methanol/l-propanol=7/3; refractive index, 1.35) to regulate the concentration of the coating fluid for undercoat layer formation so as to be in the measurable range for the examination apparatus. In the case of the UPA, for example, the coating fluid for undercoat layer formation is diluted with the methanol/l-propanol mixed solvent so as to result in a sample concentration index (signal level) of 0.6-0.8, which is suitable for the examination.

It is thought that even after such dilution, the volume-average particle diameter of the metal oxide particles in the coating fluid for undercoat layer formation remains unchanged. Consequently, the volume-average particle diameter determined after the dilution is regarded as the volume-average particle diameter of metal oxide particles to be determined by examining, by the dynamic light-scattering method, the coating fluid for forming an undercoat layer according to the invention.

The volume-average particle diameter is the value obtained from the results concerning the particle size distribution of metal oxide particles obtained by the examination, through calculation using the following equation (a).

[Su − 1]

$$Mv = \frac{\sum (n \cdot v \cdot d)}{\sum (n \cdot v)} \quad \text{equation (a)}$$

In equation (a), n represents the number of particles, v represents particle volume, and d represents particle diameter.

When the volume-average particle diameter of the metal oxide aggregate secondary particles determined by the method described above is too large, there are cases where the undercoat layer might cause image defects such as black spots or color spots.

[Composition of Metal Oxide Particles]

As the metal oxide particles, any metal oxide particles usually usable in electrophotographic photoreceptors can be employed. More specifically, preferred examples of the metal oxide particles include particles of metal oxides containing one metallic element, such as titanium oxide, aluminum oxide, silicon oxide, zirconium oxide, zinc oxide, and iron oxide, and particles of metal oxides containing a plurality of metallic elements, such as calcium titanate, strontium titanate, and barium titanate. Preferred of these are metal oxide particles having a band gap of from 2 eV to 4 eV. Metal oxide particles of one kind only may be used, or a mixture of multiple kinds of particles may be used. More preferred of these particulate metal oxides is titanium oxide, aluminum oxide, silicon oxide, or zinc oxide. Especially preferred is titanium oxide or aluminum oxide. Even more preferred is titanium oxide.

With respect to the crystal form of titanium oxide particles, any of rutile, anatase, brookite, and amorphous ones can be used. Furthermore, the particles may include ones having a plurality of crystal states among those different crystal states.

The surface of the metal oxide particles may be subjected to various surface treatments. For example, the surface may have undergone a treatment with an inorganic substance such as tin oxide, aluminum oxide, antimony oxide, zirconium oxide, or silicon oxide or an organic substance such as stearic acid, a polyol, or an organosilicon compound. Especially when titanium oxide particles are used, it is preferred that the titanium oxide particles should have undergone a surface treatment with an organosilicon compound. General examples of the organosilicon compound include silicone oils such as dimethylpolysiloxane and methylhydrogenpolysiloxane, organosilanes such as methyldimethoxysilane and diphenyldidimethoxysilane, silazanes such as hexamethyldisilazane, and silane coupling agents such as vinyltrimethoxysilane, γ-mercaptopropyltrimethoxysilane, and γ-aminopropyltriethoxysilane. However, a silane treating agent represented by the structure of the following general formula (1) has satisfactory reactivity with the metal oxide particles and is a most satisfactory treating agent.

[Chem. 3]

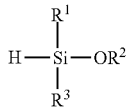

(1)

In the formula, $R^1$ and $R^2$ each independently represent an alkyl group, and more specifically represent methyl or ethyl. $R^3$ is an alkyl group or an alkoxy group, and more specifically represents a group selected from the group consisting of methyl, ethyl, methoxy, and ethoxy. Although the outermost surface of the particles which have undergone any of those surface treatments has been treated with such a treating agent, the particles may be one which underwent a treatment with a treating agent such as, e.g., aluminum oxide, silicon oxide, or zirconium oxide before that treatment. Titanium oxide particles of one kind only may be used, or a mixture of multiple kinds of titanium oxide particles may be used.

The metal oxide particles to be used have an average primary-particle diameter of generally 500 nm or smaller, preferably from 1 nm to 100 nm, more preferably 5-50 nm. This average primary-particle diameter can be determined by calculating the arithmetic average of the diameters of particles directly observed with a transmission electron microscope (hereinafter sometimes referred to as "TEM").

As the metal oxide particles to be used, particulate metal oxides having various refractive indexes can be utilized. Any particulate metal oxide usually usable in electrophotographic photoreceptors can be employed. It is preferred to use metal oxide particles having a refractive index of from 1.4 to 3.0. The refractive indexes of particulate metal oxides are given in various publications. For example, according to *Firā Katsuyō Jiten* (edited by Filler Society of Japan, Taiseisha LTD., 1994), the refractive indexes of particulate metal oxides are as shown in the following Table 1.

As the metal oxide particles to be used, particulate metal oxides having various refractive indexes can be utilized. Any particulate metal oxide usually usable in electrophotographic photoreceptors can be employed. It is preferred to use metal oxide particles having a refractive index of from 1.4 to 3.0.

The refractive indexes of particulate metal oxides are given in various publications. For example, according to *Firā Katsuyō Jiten* (edited by Filler Society of Japan, Taiseisha LTD., 1994), the refractive indexes of particulate metal oxides are as shown in the following Table 1.

TABLE 1

| | Refractive index |
|---|---|
| Titanium oxide (rutile) | 2.76 |
| Lead titanate | 2.70 |
| Potassium titanate | 2.68 |
| Titanium oxide (anatase) | 2.52 |
| Zirconium oxide | 2.40 |
| Zinc sulfate | 2.37-2.43 |
| Zinc oxide | 2.01-2.03 |
| Magnesium oxide | 1.64-1.74 |
| Barium sulfate (precipitated) | 1.65 |
| Calcium sulfate | 1.57-1.61 |
| Aluminum oxide | 1.56 |
| Magnesium hydroxide | 1.54 |
| Calcium carbonate | 1.57-1.60 |
| Quartz glass | 1.46 |

Specific examples of trade names of titanium oxide particles among those particulate metal oxides include titanium oxide such as "TTO-55(N)", which is ultrafine titanium oxide having undergone no surface treatment, "TTO-55(A)" and "TTO-55(B)", which are ultrafine titanium oxide coated with $Al_2O_3$, "TTO-55(C)", which is ultrafine titanium oxide having undergone surface treatment with stearic acid, "TTO-55(S)", which is ultrafine titanium oxide having undergone surface treatment with $Al_2O_3$ and an organosiloxane, high-purity titanium oxide "CR-EL", sulfate-process titanium oxide "R-550", "R-580", "R-630", "R-670", "R-680", "R-780", "A-100", "A-220", and "W-10", chloride-process titanium oxide "CR-50", "CR-58", "CR-60", "CR-60-2", and "CR-67", conductive titanium oxide "SN-100P", "SN-100D", and "ET-300 W" (all manufactured by Ishihara Sangyo Kaisha, Ltd.), and "R-60", "A-110", and "A-150". Examples thereof further include: "SR-1", "R-GL", "R-5N", "R-5N-2", "R-52N", "RK-1", and "A-SP", which have been coated with $Al_2O_3$, "R-GX" and "R-7E", which have been coated with $SiO_2$ and $Al_2O_3$, "R-650", which has been coated with ZnO, $SiO_2$, and $Al_2O_3$, and "R-61N", which has been coated with $ZrO_2$ and $Al_2O_3$, (all manufactured by Sakai Chemical Industry Co., Ltd.); "TR-700", which has undergone surface treatment with $SiO_2$ and $Al_2O_3$, "TR-840" and "TA-500", which have undergone surface treatment with ZnO, $SiO_2$, and $Al_2O_3$, "TA-100", "TA-200", and "TA-300", which are titanium oxide having undergone no surface treatment, and "TA-400", which has undergone surface treatment with $Al_2O_3$, (all manufactured by Fuji Titanium Industry Co., Ltd.); and "MT-150 W" and "MT-500B", which have undergone no surface treatment, "MT-100SA" and "MT-500SA", which have undergone surface treatment with $SiO_2$ and $Al_2O_3$, and "MT-100SAS" and "MT-500SAS", which have undergone surface treatment with $SiO_2$, $Al_2O_3$, and an organosiloxane, (manufactured by Tayca Corp.).

Specific examples of trade names of aluminum oxide particles include "Aluminum Oxide C" (manufactured by Nippon Aerosil Co., Ltd.).

Specific examples of trade names of silicon oxide particles include "200CF" and "R972" (manufactured by Nippon Aerosil Co, Ltd.) and "KEP-30" (manufactured by Nippon Shokubai Co, Ltd.).

Specific examples of trade names of tin oxide particles include "SN-100P" (manufactured by Ishihara Sangyo Kaisha, Ltd.).

Furthermore, specific examples of trade names of zinc oxide particles include "MZ-305S" (manufactured by Tayca Corp.).

Metal oxide particles of each kind usable in the invention should not be construed as being limited to those specific trade names.

In the coating fluid for forming the undercoat layer of the electrophotographic photoreceptor in the invention, it is preferred to use the metal oxide particles in an amount in the range of from 0.5 parts by weigh to 4 parts by weight per part by weight of the binder resin.

<Binder Resin>

As the binder resin to be used in the undercoat layer, any binder resin for general use in coating fluids for forming the undercoat layers of electrophotographic photoreceptors may be used without particular limitations so long as the binder resin is soluble in organic solvents and gives an undercoat layer which is insoluble or lowly soluble in the organic solvent to be used in a coating fluid for photosensitive-layer formation and does not substantially mingle with the solvent.

Examples of such a binder resin include phenoxies, epoxies, polyvinylpyrrolidone, poly(vinyl alcohol), casein, poly(acrylic acid), cellulose derivatives, gelatin, starch, polyurethanes, polyimides, and polyamides. Such resins can be used in a cured form obtained without or with a curing agent. Of those resins, polyamide resins, in particular, polyamide resins such as alcohol-soluble copolyamides and modified polyamides, are preferred because these resins have satisfactory dispersing properties and applicability.

<Binder Resin>

[Polyamide Resin]

The binder resin to be used in the undercoat layer preferably is a polyamide resin. The polyamide resin is not particularly limited so long as the resin is soluble in organic solvents and gives an undercoat layer which is insoluble or lowly soluble in the organic solvent to be used in a coating fluid for photosensitive-layer formation and does not substantially mingle with the solvent. In particular, polyamide resins such as alcohol-soluble copolyamides and modified polyamides are preferred because these polyamides have satisfactory dispersing properties and applicability.

Examples of the polyamide resin include so-called copolymer nylons obtained by copolymerization with nylon-6, nylon-66, nylon-610, nylon-11, nylon-12, or the like; and alcohol-soluble nylon resins, e.g., nylons of the chemically modified type such as N-alkoxymethyl-modified nylons and N-alkoxyethyl-modified nylons. Specific examples of trade names include "CM4000", "CM8000" (these are manufactured by Toray Industries, Inc.), "F-30K", "MF-30", and "EF-30T" (these are manufactured by Nagase ChemteX Corp.).

Especially preferred of these polyamide resins is a copolyamide resin containing a diamine represented by the following general formula (2) as a component.

[Chem. 4]

(2)

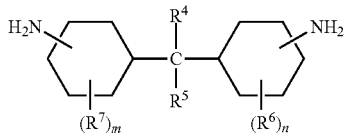

In formula (2), $R^4$ to $R^7$ represent a hydrogen atom or an organic substituent. Symbols m and n each independently represent an integer of 0-4; when there are a plurality of substituents, these substituents may differ from each other. The organic substituents represented by $R^4$ to $R^7$ preferably are hydrocarbon groups which have 20 or less carbon atoms and may include a heteroatom. More preferred examples thereof include alkyl groups such as methyl, ethyl, n-propyl, and isopropyl; alkoxy groups such as methoxy, ethoxy, n-propoxy, and isopropoxy; and aryl groups such as phenyl, naphthyl, anthryl, and pyrenyl. Even more preferred are alkyl groups or alkoxy groups. Especially preferred is methyl or ethyl.

Examples of the copolyamide resin containing a diamine represented by formula (2) as a component include copolyamides obtained by copolymerizing two, three, four, or more monomers which are a combination of that diamine and other monomer(s) selected from lactams such as γ-butyrolactam, ϵ-caprolactam, and lauryl lactam; dicarboxylic acids such as 1,4-butanedicarboxlyic acid, 1,12-dodecanedicarboxylic acid, and 1,20-eicosanedicarboxylic acid; diamines such as 1,4-butanediamine, 1,6-hexamethylenediamine, 1,8-octamethylenediamine, and 1,12-dodecanediamine; piperazine; and the like. Although monomer proportions in the copolymerization are not particularly limited, the proportion of the diamine ingredient represented by the formula is generally 5-40 mol %, preferably 5-30 mol %.

The number-average molecular weight of the copolyamide is preferably 10,000-50,000, especially preferably 15,000-35,000. Too low or too high number-average molecular weights are apt to result in difficulties in maintaining film evenness. Processes for producing the copolyamide are not particularly limited, and methods of polycondensation for ordinary polyamides may be suitably applied. Use may be made of melt polymerization, solution polymerization, interfacial polymerization, or the like. During the polymerization, a monobasic acid, e.g., acetic acid or benzoic acid, or a monoacidic base, e.g., hexylamine or aniline, may be added as a molecular weight regulator without particular limitations.

It is also possible to add a heat stabilizer represented by sodium phosphite, sodium hypophosphite, phosphorous acid, hypophosphorous acid, or a hindered phenol and other additives for polymerization. Specific examples of the copolyamide suitable for use in the invention are shown below. In the examples, the monomer proportions indicate the proportions of the monomers fed (molar proportions).

<<Examples of polyamide>>

①

[Chem. 5]

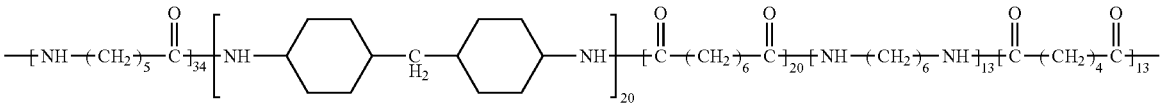

②

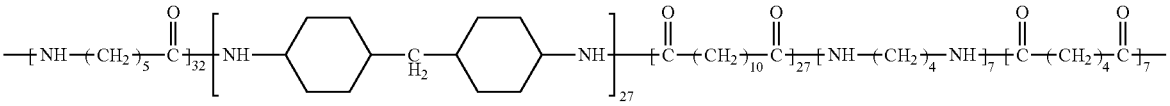

③

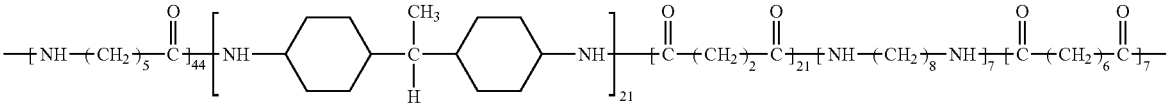

④

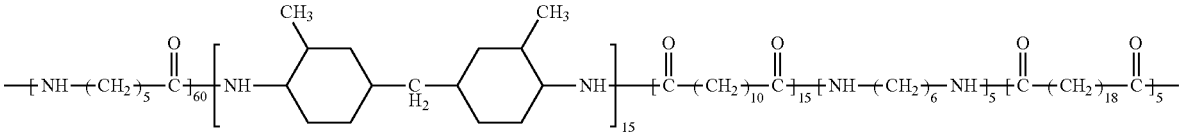

⑤

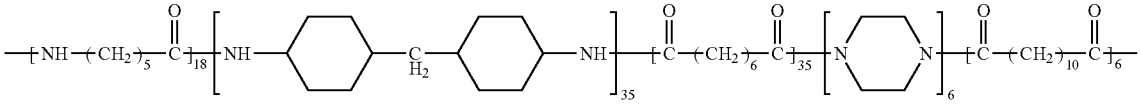

⑥

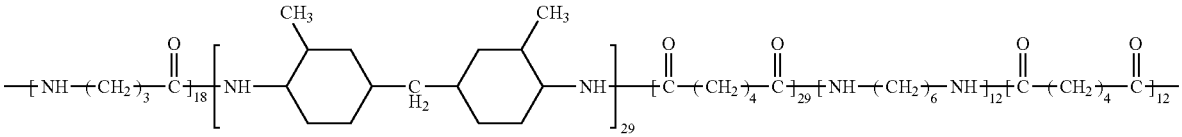

⑦

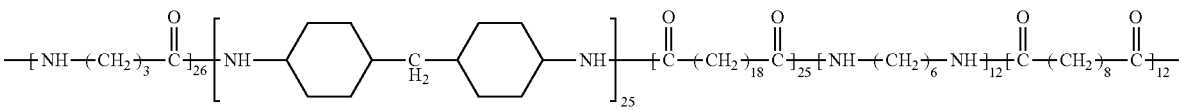

Such a binder resin may include the polyamide resin in combination with a phenoxy resin, epoxy resin, polyvinylpyrrolidone, poly(vinyl alcohol), casein, poly(acrylic acid) (copolymer), cellulose derivative, gelatin, starch, polyurethane, polyimide, etc. so long as compatibility is maintained. Such resins other than the polyamide resin may be in an uncured form or in a cured form obtained without or with a curing agent.

In the case where such resins are used in combination with a polyamide resin, the proportion of the polyamide resin in the whole binder resin of the undercoat layer is preferably 50% by mass or higher, especially preferably 70% by mass or higher.

[Curable Resin]

It is preferred that the undercoat layer of the electrophotographic photoreceptor to be used in the image-forming apparatus of the invention should contain one or more curable resins. The curable resins to be used preferably are thermosetting resins, photocurable resins, electron beam (EB)-curable resins, or the like. In each case, reaction occurs between polymers or the like after application and the polymer thus crosslinks and cures.

An explanation is given on examples of the curable resins. "Thermosetting resin" is a general term for resins of the type which thermally undergoes a chemical reaction and thereby cures. Examples thereof include phenolic resins, urea resins, melamine resins, cured epoxy resins, urethane resins, and unsaturated polyester resins. It is also possible to impart curability to ordinary thermoplastic polymers by introducing a curable substituent thereinto. In general, such polymers are sometimes called condensation-type bridged polymers, addition-type pendant-bridged polymers, or the like, and are polymers having a three-dimensional crosslink structure. Usually, the reaction of a curable resin, during production, proceeds with the lapse of time and the conversion and molecular weight thereof increase. As a result, the resin increases in modulus, decreases in specific volume, and considerably decreases in solubility in solvents.

General thermosetting resins are then explained. A phenolic resin is a synthetic resin produced from a phenol and formaldehyde, and has the advantage of being capable of inexpensively forming a beautiful shape. In general, the reaction of a phenol (P) with formaldehyde (F) under acidic conditions gives a resin having an F/P molar ratio of about 0.6-1, while the reaction conducted in the presence of a basic catalyst yields a resin having an F/P ratio of about 1-3.

A urea resin is a synthetic resin produced by reacting urea with formalin. This resin is a colorless and transparent solid and has the advantage of being capable of being freely colored. In general, the reaction of urea with formaldehyde yields a polymethyleneurea with no methylol group under acidic conditions, and gives a mixture of methylolureas under basic conditions.

A melamine resin is a thermosetting resin obtained by reacting a melamine derivative with formaldehyde. Although more expensive than the urea resin, the melamine resin is superior in hardness, water resistance, and heat resistance and further has the advantage of being colorless, transparent, and capable of being freely colored. This resin is superior in laminating and bonding applications.

Furthermore, "epoxy resin" is a general term for the thermosetting resins which are polymers having residual epoxy groups and can be cured by causing graft polymerization to occur at the epoxy groups. When the prepolymer which has not undergone graft polymerization is mixed with a hardener and this mixture is subjected to a thermosetting treatment, then a product is completed. However, both the prepolymer and the product resin are called an epoxy resin. The prepolymer is a mostly liquid compound having two or more epoxy groups per molecule. Reaction (mainly polyaddition) between this polymer and any of various hardeners yields a three-dimensional polymer as a cured epoxy resin. The cured epoxy resin has satisfactory adhesiveness and adhesion and is excellent in heat resistance, chemical resistance, and electrical stability. General-purpose epoxy resins are epoxy resins of the bisphenol A diglycidyl ether type. Other epoxy resins include resins of the glycidyl ester type and the glycidylamine type and alicyclic epoxy resins. Typical examples of the hardeners are aliphatic or aromatic polyamines, acid anhydrides, polyphenols, and the like. These hardeners react with epoxy groups through polyaddition to heighten the molecular weight of the prepolymer and impart a three-dimensional structure thereto. Other hardeners include tertiary amines, Lewis acids, and the like.

A urethane resin is a polymeric compound obtained by copolymerizing monomers usually through urethane bonds formed by the condensation of an isocyanate group with an alcohol group. Usually, a urethane resin is composed of two separate ingredients, i.e., a main ingredient and a hardener which are liquid at ordinary temperature. The two liquids are mixed together by stirring to thereby polymerize the ingredients to obtain a solid.

An unsaturated polyester resin is composed of two separate ingredients, i.e., a resin and a hardener which are liquid at ordinary temperature. The two liquids are mixed together by stirring to thereby polymerize the ingredients to obtain a solid. This resin has the merit of having high transparency. However, the resin shows a large cure shrinkage upon polymerization and has a problem concerning dimensional stability, etc. Products of this resin on the market often contain a volatile solvent and, hence, the resin gradually deforms with solvent volatilization even after curing.

A photocurable resin is constituted of a mixture of an oligomer (low polymer) of an epoxy acrylate, urethane acrylate, or the like, a reactive diluent (monomer), and a photopolymerization initiator (e.g., a benzoin-based or acetophenone-based initiator).

Other examples include addition-type pendant-bridged polymers based on a system in which a polyfunctional monomer such as divinylbenzene or ethylene glycol dimethacrylate is copolymerized.

It is also preferred to further use a polymer which is not a curable resin. Examples of such polymers include polyamide resins such as alcohol-soluble copolyamides and the modified polyamides, phenoxy resins, polyvinylpyrrolidone, poly(vinyl alcohol), casein, poly(acrylic acid) (copolymers), cellulose derivatives, gelatin, starch, polyurethanes, and polyimides. In particular, polyamide resins such as alcohol-soluble copolyamides and the modified polyamides are preferred because these resins have satisfactory dispersing properties and applicability.

[Coating Fluid for Undercoat Layer Formation]

As the organic solvent for use in the coating fluid for undercoat layer formation, any organic solvent can be employed so long as the binder resin for use in the undercoat layer can dissolve therein. Examples thereof include alcohols having 5 or less carbon atoms, such as methanol, ethanol, isopropyl alcohol, or n-propyl alcohol; halogenated hydrocarbons such as chloroform, 1,2-dichloroethane, dichloromethane, trichlene, carbon tetrachloride, and 1,2-dichloropropane; nitrogen-containing organic solvents such as dimethylformamide; and aromatic hydrocarbons such as toluene and xylene. However, any desired combination of two or more thereof may be used as a mixed solvent in any desired proportion. Furthermore, even an organic solvent in which the binder resin for the undercoat resin does not dissolve when the solvent is used alone can be employed so long as this solvent is used as a mixed solvent which includes, e.g., any of the organic solvents shown above and in which the binder resin is soluble. In general, use of a mixed solvent is more effective in diminishing coating unevenness.

The ratio of the amount of the organic solvent to be used in the coating fluid for undercoat layer formation to the amount of the solid ingredients including the binder resin and titanium oxide particles or the like varies depending on methods for applying the coating fluid for undercoat layer formation. The ratio thereof may be suitably changed so that an even coating film is formed by the coating method to be used.

Although the coating fluid for layer formation preferably contains metal oxide particles, the metal oxide particles in this case are present in the state of being dispersed in the coating fluid. Such a coating fluid containing metal oxide particles dispersed therein can be produced by dispersing the metal oxide particles in an organic solvent by a wet process with a known mechanical grinding apparatus such as, e.g., a ball mill, sand grinding mill, planetary mill, or roll mill. It is, however, preferred to disperse the particles using a dispersing medium.

[Disperser]

For dispersing particles with a dispersing medium, any known disperser may be used. Examples thereof include a pebble mill, ball mill, sand mill, screen mill, gap mill, oscillating mill, paint shaker, and attritor. Preferred of these are the dispersers in which the particles can be dispersed while circulating the coating fluid. From the standpoints of dispersing efficiency, fineness of attainable particle diameter, ease of continuous operation, etc., use is made of a wet-type stirring ball mill, e.g., a san mill, screen mill, or gap mill. These mills may be either vertical or horizontal. With respect to the disk shape of such a mill, any desired one can be used, such as, e.g., the flat plate type, vertical pin type, or horizontal pin type. It is preferred to use a sand mill of the liquid circulating type.

The wet-type stirring ball mill especially preferably is a wet-type stirring ball mill including: a cylindrical stator; a slurry feed opening formed at one end of the stator; a slurry discharge opening formed at the other end of the stator; a rotor of the pin, disk, or annular type which stirs and mixes a dispersing medium to be packed into the stator with a slurry to be fed through the feed opening; and a separator of the impeller type which has been connected to the discharge opening and which rotates while interlocking with the rotor or rotates independently of the rotor to centrifugally separate the contents into the medium and the slurry and discharge the slurry through the discharge opening. In this ball mill, the shaft rotating and driving the separator has a center hollow and this hollow is used as a discharge opening connected to that discharge opening.

In such a wet-type stirring ball mill, the slurry separated from the dispersing medium with the separator is discharged through the center hollow of the shaft. Since no centrifugal force is applied in the center hollow, the slurry is discharged in the state of having no kinetic energy. Because of this, kinetic energy is not released as a waste and power is prevented from being wasted.

Such a wet-type stirring ball mill may be disposed horizontally. However, the mill is preferably installed vertically in order to heighten the degree of dispersing-medium packing, and a discharge opening is formed at the upper end of the mill. It is desirable that the separator also should be disposed above the medium packing level. In the case where a discharge opening is formed at the upper end of the mill, a feed opening is formed at the bottom of the mill. In a preferred embodiment, the feed opening is constituted of a valve seat and a V-shaped, trapezoidal, or conical valve plug which fits into the valve seat in an ascendable/descendable manner and is capable of coming into line contact with the edge of the valve seat. An annular slit of a size which does not permit the medium to pass therethrough is formed between the edge of the seat valve and the V-shaped, trapezoidal, or conical valve plug, whereby medium falling can be prevented while allowing a raw slurry to be fed. When the valve plug is raised to widen the slit, the medium can be discharged. When the valve plug is lowered to close the slit, the mill can be closed. Furthermore, since the slit is formed by the valve plug and the edge of the valve seat, coarse particles contained in the raw slurry are less apt to be caught in the slit. Even when coarse particles are caught, the particles readily go out of the slit upward or downward and clogging is less apt to occur.

The valve plug may be constituted so as to be vertically vibrated by a vibrating device, whereby not only coarse particles which have caught in the slit can be released from the slit but also catching itself rarely occurs. In addition, a shear force is applied to the raw slurry due to the vibrations of the valve plug to reduce the viscosity thereof. As a result, the amount of the raw slurry which passes through the slit, i.e., the feed amount, can be increased. As the vibrating device for vibrating the valve plug, use can be made of a mechanical device, e.g., a vibrator, or a device which fluctuates the pressure of compressed air that acts on a piston united with the valve plug, such as, e.g., a reciprocating compressor or an electromagnetic selector valve which performs switching between the intake and exhaust of compressed air.

It is desirable that such a wet-type stirring ball mill should be further provided in a bottom part thereof with a screen for separating the medium and with a takeout opening for a product slurry so that the product slurry remaining in the mill after completion of pulverization can be taken out.

The ball mill may be a vertical wet-type stirring ball mill including: a cylindrical vertical stator; a product slurry feed opening disposed in a bottom part of the stator; a slurry discharge opening disposed at the upper end of the stator; a shaft rotatably supported by the upper end of the stator and rotated/driven by a driving means, e.g., a motor; a rotor of the pin, disk, or annular type which has been fixed to the shaft and stirs and mixes a dispersing medium to be packed into the stator with a slurry to be fed through the feed opening; a separator which has been disposed near the discharge opening and separates the medium from the slurry; and a mechanical seal disposed in the bearing part which movably supports the shaft at the upper end of the stator. In this ball mill, the annular groove into which the O-ring in contact with a mating ring of the mechanical seal is fitted has, formed in a lower part thereof, a tapered incision expanding downward.

In the wet-type stirring ball mill, use of which is suitable for producing a photoreceptor for the image-forming apparatus of the invention, the mechanical seal has been disposed in the shaft center part, where the medium and the slurry have almost no kinetic energy, and at the upper stator end, which is located above the liquid level of these. Because of this, inclusion of the medium or slurry into the space between the mating ring of the mechanical seal and the lower part of the O-ring fitting groove can be considerably diminished.

In addition, because the lower part of the annular groove into which the O-ring fits expands downward due to the incision and has an increased clearance, the slurry and dispersing medium which have come into the groove are less apt to be caught or solidify therein to cause clogging. The mating ring smoothly conforms to the seal ring, and the function of the mechanical seal is maintained. Incidentally, the lower part of the fitting groove into which the O-ring fits has a V-shaped section and this fitting part as a whole does not have a reduced thickness. The fitting part hence neither has impaired strength nor is impaired in the function of holding the O-ring.

The ball mill may also be a wet-type stirring ball mill including: a cylindrical stator; a slurry feed opening disposed at one end of the stator; a slurry discharge opening disposed at the other end of the stator; a rotor of the pin, disk, or annular type which stirs and mixes a dispersing medium to be packed into the stator with a slurry to be fed through the feed opening; and a separator of the impeller type which has been connected to the discharge opening and which rotates while interlocking with the rotor or rotates independently of the rotor to centrifugally separate the contents into the medium and the slurry and discharge the slurry through the discharge opening. In this ball mill, the separator is constituted of: two disks having blade-fitting grooves on the opposed inner sides thereof; blades interposed between the disks and fitted into the fitting grooves; and a supporting means which holds from both sides the disks having the blades interposed therebetween. In a preferred embodiment, the supporting means is constituted of a step of the shaft as a stepped shaft and a cylindrical presser which has been fitted on the shaft and presses the disks. Namely, the disks having the blades interposed therebetween are sandwiched from both sides between and supported by the step of the shaft and the presser.

Figure 8:
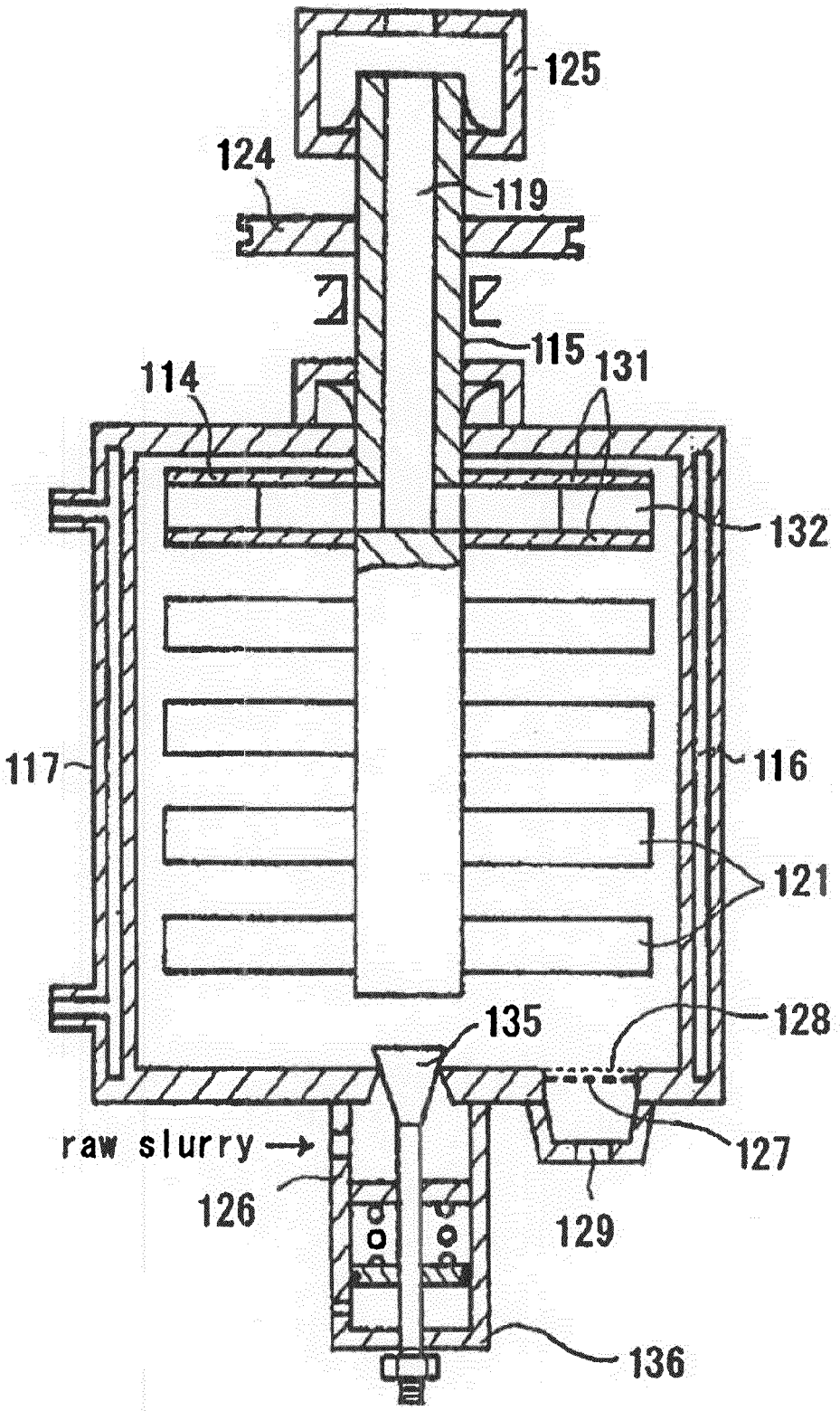
FIG. 8 is a sectional view of a vertical wet stirring ball mill for use in producing the photoreceptor of an image-forming apparatus of the invention.

In FIG. 8, a raw slurry is fed to the vertical wet-type stirring ball mill and is stirred together with a dispersing medium to thereby pulverize the particles. Thereafter, the medium is separated with a separator 114, and the slurry is discharged through the center hollow of the shaft 115, follows a return passage, and is circulated for pulverization.

As shown in FIG. 8 in detail, this vertical wet-type stirring ball mill includes: a stator 117 which has a vertical cylindrical shape and is equipped with a jacket 116 for passing cooling water for cooling the mill; a shaft 115 which is located at the axial center of the stator 117, is rotatably supported with a bearing in an upper part of the stator, and has a mechanical seal in the bearing part and in which an upper axial central part thereof constitutes a hollow discharge passage 119; pin- or disk-form rotors 121 projecting in radical directions from a lower end part of the shaft; a pulley 124 fixed to an upper part of the shaft and transferring a driving force; a rotary joint 125 attached to the open upper end of the shaft; a separator 114 for dispersing-medium separation which has been fixed to the shaft 115 in an area near an upper part of the inside of the stator; a raw-slurry feed opening 126 disposed in the stator bottom so as to face the end of the shaft 115; and a screen 128 for dispersing-medium separation which has been attached to the upper side of a lattice-form screen support 127 disposed at a product slurry takeout opening 129 formed in an eccentric position in the stator bottom. The separator 114 is composed of: a pair of disks 131 fixed to the shaft 115 so as to be apart from each other at a given distance; and blades 132 which connect the two disks 131 to each other. The separator 114 thus constitutes an impeller. The separator 114 rotates together with the shaft 115 and applies a centrifugal force to the dispersing medium and slurry which have come into the space between the disks. As a result, the medium is driven outward in radial directions based on a difference in specific gravity between the medium and the slurry, while the slurry is discharged through the central discharge passage 119 of the shaft 115. The raw-slurry feed opening 126 includes: a valve plug 135 of an inverted-trapezoid shape which fits into a valve seat formed in the stator bottom, in an ascendable/descendable manner; and a bottomed cylindrical body 136 projecting downward from the stator bottom. The valve plug 135 is pushed up by feeding a raw slurry and an annular slit is hence formed between the valve plug 135 and the valve seat, whereby the raw slurry comes to be fed into the mill.

When a raw slurry is fed, the valve plug 135 ascends due to the feeding pressure which is being applied to the raw slurry sent into the cylindrical body 136, while opposing the internal pressure of the mill, to form a slit between the valve plug 135 and the valve seat. For the purpose of avoiding slit clogging, the valve plug 135 has been constituted so as to repeat a vertical motion in which the valve plug 135 ascends to an upper limit position at a short period. Such vertical vibrations can eliminate particle catching. The vibrations of the valve plug 135 may be always conducted, or may be conducted when the raw slurry contains coarse particles in a large amount. Furthermore, the vibrations may be conducted synchronously with the occurrence of an increase in raw-slurry feeding pressure due to clogging.

Specific examples of the wet-type stirring ball mill having such a structure include Ultra Apex Mill, manufactured by Kotobuki Industries Co, Ltd.

An explanation is then given on a method of pulverizing a raw slurry. A dispersing medium is packed into the stator 117 of the ball mill, and the rotors 121 and the separator 114 are rotated/driven by an external power. On the other hand, a raw slurry is sent in a given amount to the feed opening 126, whereby the raw slurry is fed into the mill through a slit formed between the edge of the valve seat and the valve plug 135.

The rotation of the rotors 121 stirs/mixes the raw slurry and dispersing medium present in the mill, whereby the slurry is pulverized. Furthermore, due to the rotation of the separator 114, the medium and slurry which have come into the separator are separated from each other based on a difference in specific gravity. The medium, which has a higher specific gravity, is driven out in radial directions, while the slurry, which has a lower specific gravity, is discharged through the discharge passage 119 formed in the center of the shaft 115 and is returned to a feedstock tank. In a stage in which pulverization has proceeded to some degree, the slurry is suitably examined for particle size. At the time when a desired particle size has been reached, the feed pump is temporarily stopped and the operation of the mill is then stopped to complete the pulverization.

In the case where such a vertical wet-type stirring ball mill is used to disperse metal oxide particles, the degree of packing of the dispersing medium in the mill during the pulverization is preferably 50-100%, more preferably 70-95%, especially preferably 80-90%.

Wet-type stirring ball mills suitable for use in a dispersion process for preparing a coating fluid for undercoat layer formation in the invention may be ones in which the separator is a screen or a slit mechanism. However, an impeller-type separator is desirable, and the mills preferably are vertical. Although it is desirable to vertically dispose a wet-type stirring ball mill and dispose the separator in an upper part of the mill, to set the degree of packing of a dispersing medium especially at 80-90% not only enables pulverization to be conducted most efficiently but also produces the following effect. The separator can be disposed in a position above the packing level of the medium, whereby the medium can be prevented from coming onto the separator and being discharged.

Operating conditions for a wet-type stirring ball mill suitable for use in a dispersion process for preparing a coating fluid for undercoat layer formation in the invention exert influences on the volume-average particle diameter of the metal oxide aggregate secondary particles contained in the coating fluid for undercoat layer formation, stability of the coating fluid for undercoat layer formation, surface shape of an undercoat layer to be formed by applying the coating fluid, and properties of an electrophotographic photoreceptor having the undercoat layer formed from the coating fluid. Examples of factors which are especially highly influential include the rate of feeding the coating fluid for undercoat layer formation and the rotation speed of the rotors.

The rate of feeding the coating fluid for undercoat layer formation is influenced by the capacity and shape of the mill because the rate thereof relates to the time period over which the coating fluid for undercoat layer formation resides in the mill. In the case where the stator is of a type in common use, the rate of feeding is preferably in the range of from 20 kg/hr to 80 kg/hr per liter (hereinafter often abbreviated to L) of the mill capacity, more preferably in the range of from 30 kg/hr to 70 kg/hr per L of the mill capacity.

On the other hand, the rotation speed of the rotors is influenced by parameters such as the shape of the rotors and the distance between each rotor and the stator. However, in the case where the stator and rotors are of types in common use, the peripheral speed of the rotor peripheries is preferably in the range of from 5 m/sec to 20 m/sec, more preferably in the range of from 8 m/sec to 15 m/sec, especially from 10 m/sec to 12 m/sec.

The dispersing medium is used generally in an amount of from 0.5 to 5 times by volume the amount of the coating fluid for undercoat layer formation. Besides the dispersing medium, a dispersing agent which can be easily removed after the dispersion process may be used in combination therewith. Examples of the dispersing agent include common salt and Glauber's salt.

It is preferred that the metal oxide should be dispersed by a wet process in the presence of a dispersion solvent. However, a binder resin and various additives may be mixed simultaneously therewith. Although the solvent is not particularly limited, use of the same organic solvent as that for use in the coating fluid for undercoat layer formation is preferred because this eliminates the necessity of conducting the step of, e.g., solvent exchange after the dispersion process. The solvent to be used may consist of a single compound, or a combination of two or more compounds may be used as a mixed solvent.

From the standpoint of productivity, the amount of the solvent to be used per part by weight of the metal oxide to be dispersed is generally 0.1 part by weight or larger, preferably 1 part by weight or larger, and is generally 500 parts by weight or smaller, preferably 100 parts by weight or smaller. With respect to temperature during the mechanical dispersion process, the metal oxide can be dispersed at a temperature which is not lower than the solidifying point of the solvent (or mixed solvent) and not higher than the boiling point thereof. However, the dispersion process is generally conducted at a temperature in the range of from 10° C. to 200° C. from the standpoint of safety in production.

After the dispersing treatment with a dispersing medium, the dispersing medium is separated/removed and the coating fluid is preferably further subjected to an ultrasonic treatment. In the ultrasonic treatment, in which ultrasonic vibrations are applied to the coating fluid for undercoat layer formation, there are no particular limitations on vibration frequency, etc. Ultrasonic vibrations may be applied with an oscillator having a frequency of generally from 10 kHz to 40 kHz, preferably from 15 kHz to 35 kHz.

The output of the ultrasonic oscillator is not particularly limited. However, an oscillator of from 100 W to 5 kW is generally used. In general, the ultrasonic treatment of a small amount of a coating fluid with a low-output ultrasonic oscillator is superior in dispersion efficiency to the ultrasonic treatment of a large amount of the coating fluid with a high-output ultrasonic oscillator. Because of this, the amount of the coating fluid for undercoat layer formation to be treated at a time is preferably 1-50 L, more preferably 5-30 L, especially preferably 10-20 L. In this case, the output of the ultrasonic oscillator is preferably from 200 W to 3 kW, more preferably from 300 W to 2 kW, especially preferably from 500 W to 1.5 kW.

Methods for applying ultrasonic vibrations to the coating fluid for undercoat layer formation are not particularly limited. Examples thereof include: a method in which an ultrasonic oscillator is directly immersed in a container containing the coating fluid for undercoat layer formation; a method in which an ultrasonic oscillator is brought into contact with the outer wall of a container containing the coating fluid for undercoat layer formation; and a method in which a solution containing the coating fluid for undercoat layer formation is immersed in a liquid which is being vibrated with an ultrasonic oscillator. Preferred of these methods is the method in which a solution containing the coating fluid for undercoat layer formation is immersed in a liquid which is being vibrated with an ultrasonic oscillator. In this case, examples of the liquid to be vibrated with an ultrasonic oscillator include water; alcohols such as methanol; aromatic hydrocarbons such as toluene; and fats and oils such as silicone oils. However, it is preferred to use water when safety in production, cost, cleanability, etc. are taken into account. In the method in which a solution containing the coating fluid for undercoat layer formation is immersed in a liquid which is being vibrated with an ultrasonic oscillator, the efficiency of ultrasonic treatment varies with the temperature of the liquid. It is therefore preferred to keep the temperature of the liquid constant. There are cases where the temperature of the liquid being vibrated increases due to the ultrasonic vibrations applied. The temperature of the liquid in conducting the ultrasonic treatment preferably is in the range of generally 5-60° C., preferably 10-50° C., more preferably 15-40° C.

The container for containing the coating fluid for undercoat layer formation in conducting the ultrasonic treatment may be any container so long as it is in common use for containing a coating fluid for undercoat layer formation which is to be used for forming the photosensitive layer of an electrophotographic photoreceptor. Examples thereof include containers made of a resin such as polyethylene or polypropylene, containers made of a glass, and metallic cans. Preferred of these are metallic cans. Especially preferred is an 18-L metallic can as provided for in JIS Z 1602. This is because the metallic can is less apt to be attacked by organic solvents and has high impact strength.

According to need, the coating fluid for undercoat layer formation is used after having been filtered in order to remove coarse particles. In this case, the filtering medium to be used may be any of filtering materials in common use for filtration, such as cellulose fibers, resin fibers, and glass fibers. With respect to the form of the filtering medium, it preferably is a so-called wound filter comprising a core material and fibers of any of various kinds wound around the core material, for example, because this filter has a large filtration area to attain a satisfactory efficiency. The core material to be used can be any of known core materials. Examples thereof include stainless-steel core materials and core materials made of a resin which does not dissolve in the coating fluid for undercoat layer formation, such as, e.g., polypropylene.

The coating fluid for undercoat layer formation thus produced is used for forming an undercoat layer optionally after a binder, various aids, etc. are further added thereto.

For dispersing metal oxide particles, e.g., titanium oxide particles, in the coating fluid for undercoat layer formation, it is preferred to use a dispersing medium having an average particle diameter of from 5 μm to 200 μm.

Dispersing media usually have a shape close to true sphere. The average particle diameter of a dispersing medium can hence be determined by a method in which the medium is sieved with sieves as described, e.g., in JIS Z 8801:2000 or by image analysis. The density thereof can be determined by Archimedes' method. Specifically, average particle diameter and sphericity can be determined with an image analyzer represented by, e.g., LUZEX50, manufactured by Nireco Corp. A dispersing medium having an average particle diameter of from 5 μm to 200 μm is generally used. Especially preferably, the average particle diameter thereof is from 10 μm to 100 μm. In general, dispersing media having a smaller particle diameter have a higher tendency to give a homogeneous dispersion in a short time period. However, a dispersing medium having an excessively small particle diameter has too small a mass, making it impossible to conduct an efficient dispersion process.

With respect to the density of dispersing media, a dispersing medium having a density of generally 5.5 g/cm$^3$ or higher, preferably 5.9 g/cm$^3$ or higher, more preferably 6.0 g/cm$^3$ or higher is used. In general, use of dispersing media with a higher density in a dispersion process has a higher tendency to give a homogeneous dispersion in a short time period. With respect to the sphericity of dispersing media, a dispersing medium having a sphericity of preferably 1.08 or lower, more preferably 1.07 or lower, is used.

With respect to the material of dispersing media, any known dispersing medium can be used so long as the medium is insoluble in the coating fluid for undercoat layer formation, has a higher specific gravity than the coating fluid for undercoat layer formation, and neither reacts with the coating fluid for undercoat layer formation nor alters the coating fluid for undercoat layer formation. Examples thereof include steel balls such as chrome steel balls (steel balls for ball bearings) and carbon steel balls; stainless-steel balls; ceramic balls such as silicon nitride balls, silicon carbide, zirconia, and alumina; and balls coated with a film of titanium nitride, titanium carbonitride, or the like. Preferred of these are ceramic balls. Especially preferred are sintered zirconia balls. More specifically, it is preferred to use the sintered zirconia beads described in Japanese patent No. 3400836.

<Method of Forming Undercoat Layer>

An undercoat layer suitable for the invention may be formed by applying the coating fluid for undercoat layer formation to a substrate by a known coating technique, such as, e.g., dip coating, spray coating, nozzle coating, spiral coating, ring coating, bar coating, roll coating, or blade coating, and drying the coating fluid applied.

Examples of the spray coating include air spraying, airless spraying, electrostatic air spraying, electrostatic airless spraying, rotary atomization type electrostatic spraying, hot spraying, and hot airless spraying. However, when the degree of reduction into fine particles for obtaining an even film thickness, the efficiency of adhesion, etc. are taken into account, it is preferred to use rotary atomization type electrostatic spraying in which use is made of the conveyance method disclosed in Domestic Re-publication of PCT Patent Application No. 1-805198, i.e., a method in which cylindrical works are successively conveyed while rotating the works without spacing them in the axial direction. Thus, an electrophotographic photoreceptor having excellent evenness in film thickness can be obtained while attaining a comprehensively high efficiency of adhesion.

Examples of the spiral coating include: the method employing a cast coater or curtain coater disclosed in JP-A-52-119651; the method in which a coating material is caused to continuously fly in a streak form through a minute opening as disclosed in JP-A-1-231966; and the method employing a multinozzle head as disclosed in JP-A-3-193161. In the case of dip coating, the coating fluid for undercoat layer formation is usually regulated so as to have a total solid concentration in the range of from generally 1% by weight, preferably 10% by weight, to generally 50% by weight, preferably 35% by weight, and to have a viscosity in the range of from preferably 0.1 cps to preferably 100 cps.

Thereafter, the coating film is dried. Drying temperature and drying period are regulated so as to conduct necessary and sufficient drying. The drying temperature is in the range of generally 100-250° C., preferably 110-170° C., more preferably 115-140° C. For the drying, use can be made of a hot-air drying oven, steam dryer, infrared dryer, and far-infrared dryer.

When the toner of the invention which satisfies all of the requirements (1) to (4) is used together with an electrophotographic photoreceptor having the undercoat layer containing a polyamide resin according to the invention, the "selective development" can be prevented even in long-term use and troubles such as white-background fouling, toner dusting in the apparatus, streaks, residual-image phenomenon (ghost), blurring (suitability for solid printing) can be inhibited from occurring. In addition, this toner has satisfactory removability in cleaning, is reduced in fogging, does not cause dot skipping even at low densities, and attains satisfactory thin-line reproducibility. In particular, due to the synergistic effect of the electrophotographic photoreceptor having the undercoat layer containing a polyamide resin and the toner satisfying all of the requirements (1) to (4), images are obtained which are reduced in fogging, do not have dot skipping even at low densities, and have excellent thin-line reproducibility. Consequently, the image-forming apparatus employing a combination of these has excellent performances due to the synergistic effect.

<Charge-Generating Substance>

The photosensitive layer formed over the conductive substrate may be either a photosensitive layer having a single-layer structure in which a charge-generating substance and a charge-transporting substance are present in the same layer and have been dispersed in a binder resin or a photosensitive layer having a multilayer structure in which functions are allotted to a charge-generating layer containing a charge-generating substance dispersed in a binder resin and a charge-transporting layer containing a charge-transporting substance dispersed in a binder resin.

In the invention, it is preferred to use a charge-generating substance or a dye/pigment according to need. Various photoconductive materials can be used as the charge-generating substance or dye/pigment. Examples thereof include selenium and alloys thereof, cadmium sulfide, other inorganic photoconductive materials, and organic pigments such as phthalocyanine pigments, azo pigments, dithioketopyrrolopyrrole pigments, squalene (squarylium) pigments, quinacridone pigments, indigo pigments, perylene pigments, polycyclic quinone pigments, anthanthrone pigments, and benzimidazole pigments. In the invention, it is especially preferred that an organic pigment, in particular a phthalocyanine pigment or an azo pigment, should be used.

Usable phthalocyanines include phthalocyanines having various crystal forms such as, for example, metal-free phthalocyanines and phthalocyanine compounds to which a metal, e.g., copper, indium, gallium, tin, titanium, zinc, vanadium, silicon, or germanium, or an oxide, halide, hydroxide, alkoxide, or another form of the metal has coordinated. Preferred are X-form and τ-form metal-free phthalocyanines, which are crystal forms having high sensitivity, A-form (also called β-form), B-form (also called α-form), D-form (also called Y-form), and other titanyl phthalocyanines (another name: oxytitanium phthalocyanines), vanadyl phthalocyanines, chloroindium phthalocyanines, II-form and other chlorogallium phthalocyanines, V-form and other hydroxygallium phthalocyanines, G-form, I-form, and other μ-oxogallium phthalocyanine dimers, and II-form and other μ-oxoaluminum phthalocyanine dimers. Especially preferred of these phthalocyanines are A-form (β-form), B-form (α-form), and D-form (Y-form) oxytitanium phthalocyanines, II-form chlorogallium phthalocyanine, V-form hydroxygallium phthalocyanine, G-form μ-oxogallium phthalocyanine dimer, and the like.

It is preferred to use a phthalocyanine which has been obtained through an acid-pasting step. The acid-pasting step (method) is a technique in which the phthalocyanine to be used is dissolved, suspended, or dispersed in a strong acid to prepare a solution and the solution prepared is discharged into a medium which evenly mingles with the strong acid and in which the pigment scarcely dissolves (in the case of, e.g., an oxytitanium phthalocyanine, the medium is, for example, water, an alcohol such as methanol, ethanol, or propanol, ethylene glycol, or an ether such as ethylene glycol monomethyl ether, ethylene glycol diethyl ether, or tetrahydrofuran) to reproduce a pigment and thereby modify the original pigment.

The phthalocyanine obtained by the acid-pasting method may be used as it is. However, it is generally preferred that the phthalocyanine should be brought into contact with an organic solvent before being used. This contact with an organic solvent is usually conducted in the presence of water. This water may be the water contained in a hydrous cake resulting from the acid-pasting method. Alternatively, use may be made of a method in which a cake resulting from the acid-pasting method is temporarily dried and water is newly added at the time of crystal transformation. However, since drying reduces the affinity of the pigment for water, it is preferred to use the water contained in the hydrous cake resulting from the acid-pasting method, without drying the cake.

The solvent to be used in the crystal conversion can be either a solvent compatible with water or a solvent incompatible with water. Preferred examples of the solvent compatible with water include cyclic ethers such as tetrahydrofuran, 1,4-dioxane, and 1,3-dioxolane. Preferred examples of the solvent incompatible with water include aromatic hydrocarbon solvents such as toluene, naphthalene, and methylnaphthalene, halogenated solvents such as chlorotoluene, o-dichlorotoluene, dichlorofluorobenzene, and 1,2-dichloroethane, and substituted aromatic solvents such as nitrobenzene, 1,2-methylenedioxybenzene, and acetophenone. Of these, cyclic ethers, halogenated hydrocarbon solvents including chlorotoluene, and aromatic hydrocarbon solvents are preferred because the crystals obtained therewith have satisfactory electrophotographic properties. More preferred are tetrahydrofuran, o-dichlorobenzene, 1,2-dichlorotoluene, dichlorofluorobenzene, toluene, and naphthalene from the standpoint of dispersion stability of the crystals to be obtained therewith.

The crystals obtained through the crystal conversion are subjected to a drying step. This drying can be conducted by a known technique such as, e.g., air blast drying, heat drying, vacuum drying, or freeze drying.

As the strong acid, use is made of a strong acid such as concentrated sulfuric acid, an organic sulfonic acid, an organic phosphonic acid, a trihalogenated acetic acid, or the like. One of these strong acids may be used alone, or a mixture of strong acids, a combination of a strong acid and an organic solvent, or the like can be used. With respect to the kind of strong acid, a trihalogenated acetic acid or concentrated sulfuric acid is preferred when solubility of the phthalocyanine is taken into account. From the standpoint of production cost, concentrated sulfuric acid is preferred. With respect to the content of concentrated sulfuric acid, it is preferred to use concentrated sulfuric acid having a concentration of 90% or higher when the solubility of the phthalocyanine precursor is taken into account. It is more preferred to use concentrated sulfuric acid having a concentration of 95% or higher because low contents of the concentrated sulfuric acid result in a decrease in production efficiency.

With respect to the temperature at which the phthalocyanine is dissolved in a strong acid, the phthalocyanine can be dissolved under the temperature conditions shown in a known document. However, at too high temperatures, the phthalocyanine ring of the precursor is opened and the precursor is decomposed. Because of this, the temperature is preferably 5° C. or lower. When an influence on the electrophotographic photoreceptor to be obtained is taken into account, the temperature is more preferably 0° C. or lower.

The strong acid may be used in any desired amount. However, too small amounts thereof result in poor dissolution of the phthalocyanine. The amount of the strong acid is hence 5 parts by weight or larger per part by weight of the phthalocyanine precursor. The amount thereof is preferably 15 parts by weight or larger, more preferably 20 parts by weight or larger, because too high solid concentrations of the solution result in a decrease in stirring efficiency. Meanwhile, when the strong acid is used in too large an amount, the amount of the acid to be discarded increases. Consequently, the amount of the strong acid to be used is preferably 100 parts by weight or smaller. From the standpoint of production efficiency, the amount thereof is more preferably 50 parts by weight or smaller.

With respect to the kind of the medium into which the resultant acid solution of the phthalocyanine is discharged, examples of the medium include water, alcohols such as methanol, ethanol, 1-propanol, and 2-propanol, polyhydric alcohols such as ethylene glycol and glycerol, cyclic ethers such as tetrahydrofuran, dioxane, dioxolane, and tetrahydropyran, and chain ethers such as ethylene glycol monomethyl ether and ethylene glycol diethyl ether. As in known methods, one of such receiving media may be used alone or a mixture of two or more thereof may be used. The particle shape, crystal state, etc. of the pigment to be reproduced vary depending on the kind of medium to be employed, and this history influences the electrophotographic photoreceptor properties of the final crystals to be obtained later. Preferred from this standpoint are water and lower alcohols such as methanol, ethanol, 1-propanol, and 2-propanol. From the standpoints of productivity and cost, water is more preferred.

The phthalocyanine obtained as a reproduced pigment by discharging a concentrated-sulfuric-acid solution of a phthalocyanine into a receiving medium is recovered as a wet cake by filtration. However, this wet cake contains a large amount of impurities, e.g., sulfate ions derived from the concentrated sulfuric acid, which were present in the receiving medium.

Because of this, the phthalocyanine obtained as a reproduced pigment is washed with a cleaning medium. Examples of the medium for cleaning include alkaline aqueous solutions such as aqueous sodium hydroxide solutions, aqueous potassium hydroxide solutions, aqueous sodium hydrogen carbonate solutions, aqueous sodium carbonate solutions, aqueous potassium carbonate solutions, aqueous sodium acetate solutions, and aqueous ammonia solutions, acidic aqueous solutions such as diluted hydrochloric acid, diluted nitric acid, and diluted acetic acid, and water such as ion-exchanged water. However, water from which ionic substances have been removed, such as ion-exchanged water, is preferred because ionic substances which remain in the pigment frequently exert an adverse influence on electrophotographic photoreceptor characteristics.

The phthalocyanine to be used is preferably an oxytitanium phthalocyanine. Usually, the oxytitanium phthalocyanine obtained by the acid-pasting step is either an amorphous one which does not have any distinct diffraction peak or a lowly crystalline one which has a peak that has a considerably low intensity and an exceedingly large half-value width.

The amorphous oxytitanium phthalocyanine or lowly crystalline oxytitanium phthalocyanine obtained by the acid-pasting step is brought into contact with an organic solvent, whereby an oxytitanium phthalocyanine suitable for the invention can be obtained.

Oxytitanium phthalocyanines suitable for use in the invention, when examined with a CuKα characteristic X-ray, give an X-ray powder diffraction spectrum having a distinct diffraction peak at a Bragg angle)(2θ±0.2°) of 27.3°. More preferred are ones which further have a distinct diffraction peak at 9.0°-9.8°. Especially preferred are ones which have a peak at 9.0° or at 9.6° or at 9.5°, 9.7°, etc.

With respect to other diffraction peaks, crystals having a peak around 26.2° are inferior in dispersed-state crystal stability. Crystals having no peak around 26.2° are therefore preferred. Of these, crystals having main diffraction peaks at 7.3°, 9.6°, 11.6°, 14.2°, 18.0°, 24.1°, and 27.2° or at 7.3°, 9.5°, 9.7°, 11.6°, 14.2°, 18.0°, 24.2°, and 27.2° are more preferred from the standpoint of the dark decay and residual potential of an electrophotographic photoreceptor employing the crystals.

In particular, an oxytitanium phthalocyanine which, when examined with a CuKα characteristic X-ray, gives an X-ray powder diffraction spectrum having a main distinct diffraction peak at a Bragg angle)(2θ±0.2°) of 27.3° is preferred. It is preferred that this oxytitanium phthalocyanine, when examined with a CuKα characteristic X-ray, should give an X-ray powder diffraction spectrum having a distinct diffraction peak at a Bragg angle)(2θ±0.2°) of 9.0°-9.7°. In particular, this oxytitanium phthalocyanine preferably is one which has no distinct diffraction peak at a Bragg angle)(2θ±0.2°) of 26.3°.

It is preferred that this oxytitanium phthalocyanine should be one in which the content of chlorine in the crystals is 1.5 wt % or lower. The chlorine content is determined by elemental analysis. This oxytitanium phthalocyanine is one in which the proportion of the chlorinated oxytitanium phthalocyanine represented by the following formula (3) to the unsubstituted oxytitanium phthalocyanine represented by the following formula (4) in the crystals thereof is 0.070 or lower in terms of mass spectrum intensity ratio. The mass spectrum intensity ratio thereof is preferably 0.060 or lower, more preferably 0.055 or lower. In the case where dry grinding is used for making an oxytitanium phthalocyanine amorphous in production, the mass spectrum intensity ratio is preferably 0.02 or higher. In the case where the acid-pasting method is used for making the phthalocyanine amorphous, the ratio is preferably 0.03 or higher. The amount of chlorine substitution is determined by the technique described in JP-A-2001-115054.

[Chem. 6]

(3)

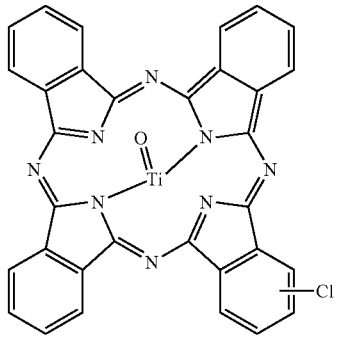

m/z: 610

(4)

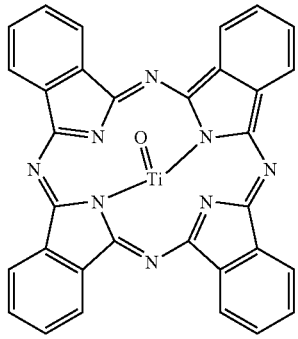

m/z: 576

The particle diameter of those oxytitanyl phthalocyanines varies considerably depending on production process and the method of crystal transformation. However, when dispersibility is taken into account, the primary-particle diameter thereof is preferably 500 nm or smaller. From the standpoints of applicability and film formation properties, the primary-particle diameter thereof is preferably 300 nm or smaller.

Besides being chlorinated oxytitanium phthalocyanines, those oxytitanium phthalocyanines may be oxytitanium phthalocyanines substituted with, for example, a fluorine atom, nitro group, cyano, etc. Alternatively, those oxytitanium phthalocyaines may contain various oxytitanium phthalocyanine derivatives substituted with substituents, e.g., a sulfo group.

An oxytitanium phthalocyanine which is suitable for use in the invention can be produced, for example, by synthesizing dichlorotitanium phthalocyanine from phthalonitrile and a halogenated titanium as raw materials, subsequently hydrolyzing and purifying the dichlorotitanium phthalocyanine to produce an oxytitanium phthalocyanine composition intermediate, making the resultant oxytitanium phthalocyanine composition intermediate amorphous, and crystallizing the resultant amorphous oxytitanium phthalocyanine composition in a solvent.

The halogenated titanium preferably is a titanium chloride. Examples of the titanium chloride include titanium tetrachloride and titanium trichloride. Especially preferred is titanium tetrachloride. When titanium tetrachloride is used, the content of a chlorinated oxytitanium phthalocyanine in the oxytitanium phthalocyanine composition to be obtained can be easily regulated.

The reaction is conducted at a temperature of generally 150° C. or higher, preferably 180° C. or higher, and is conducted more preferably at 190° C. or higher in order to regulate the content of a chlorinated oxytitanium phthalocyanine. The temperature is generally 300° C. or lower, preferably 250° C. or lower, more preferably 230° C. or lower. Usually, the titanium chloride is added to a mixture of phthalonitrile and a reaction solvent. In this operation, the titanium chloride may be directly added so long as the temperature is not higher than the boiling point thereof, or may be added as a mixture thereof with any of the high-boiling solvents shown above.

For example, when a diarylalkane is used as a reaction solvent to produce an oxytitanium phthalocyanine from phthalonitrile and titanium tetrachloride, the titanium tetrachloride is added in portions at a low temperature of 100° C. or lower and at a high temperature of 180° C. or higher. As a result, an oxytitanium phthalocyanine suitable for use in the invention can be produced.

The dichlorotitanium phthalocyanine obtained is hydrolyzed with heating. Thereafter, this phthalocyanine is made amorphous either by pulverization with a known mechanical pulverizer such as, e.g., a paint shaker, ball mill, or sand grinding mill or by the so-called acid-pasting method (described above), in which the phthalocyanine is dissolved in concentrated sulfuric acid and then recovered as a solid in cold water, etc., or a similar method. From the standpoints of sensitivity, dependency on environment, etc., the acid-pasting method is preferred.

The amorphous oxytitanium phthalocyanine composition obtained is crystallized with a known solvent to thereby obtain an oxytitanium phthalocyanine composition suitable for use in the invention. Specifically, suitable solvents are: halogenated aromatic hydrocarbon solvents such as o-dichlorobenzene, chlorobenzene, and chloronaphthalene; halogenated hydrocarbon solvents such as chloroform and dichloroethane; aromatic hydrocarbon solvents such as methylnaphthalene, toluene, and xylene; ester solvents such as ethyl acetate and butyl acetate; ketone solvents such as methyl ethyl ketone and acetone; alcohols such as methanol, ethanol, butanol, and propanol; ether solvents such as ethyl ether, propyl ether, butyl ether, and ethylene glycol; monoterpene hydrocarbon solvents such as terpinolene and pinene; liquid paraffins; and the like. Preferred of these are o-dichlorobenzene, toluene, methylnaphthalene, ethyl acetate, butyl ether, pinene, and the like.

Oxytitanium phthalocyanines can be examined for X-ray powder diffraction spectrum with a CuKα characteristic X-ray by a method in general use for X-ray powder diffractometry for solids.

A phthalocyanine compound in a mixed-crystal state may be used. With respect to the mixed state in the phthalocyanine compound or in the crystal state thereof, the constituent elements may be mixed together later and used. Alternatively, the phthalocyanine compound may be one which came to have the mixed state through phthalocyanine compound production/treatment steps such as synthesis, pigment formation, crystallization, etc. Known as such treatments are an acid-pasting treatment, grinding treatment, solvent treatment, and the like. Examples of methods for obtaining a mixed-crystal state include a method in which two kinds of crystals are mixed together and the resultant mixture is mechanically ground to make the compound amorphous and is then treated with a solvent to convert the amorphous state into a specific crystal state, as described in JP-A-10-48859.

In the case where an azo pigment is further used, a bisazo pigment, trisazo pigment, or the like is suitable. Preferred examples of the azo pigment are shown below. In the following general formulae, $Cp^1$ to $Cp^3$ represent couplers.

[Chem. 7]

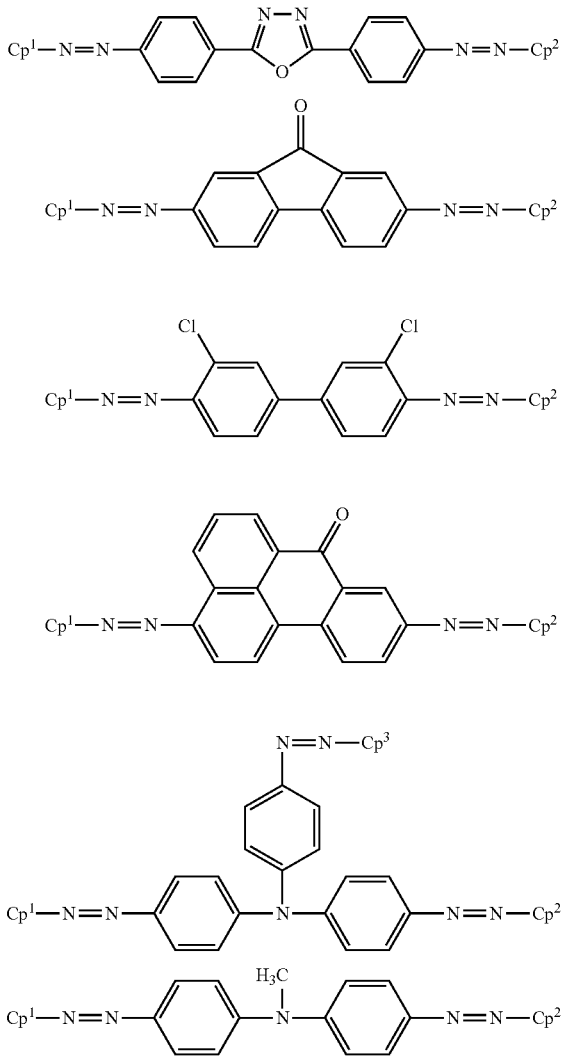

The couplers $Cp^1$ to $Cp^3$ preferably are those having the following structures.

[Chem. 8]

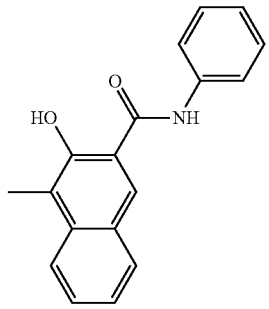

-continued

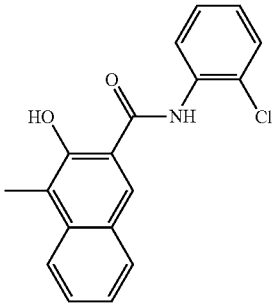

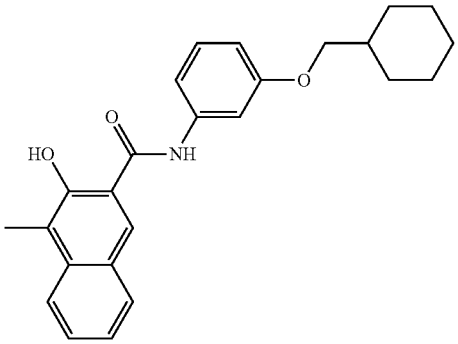

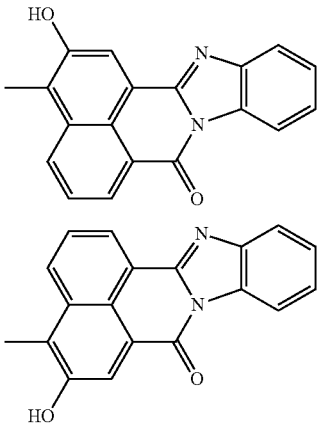

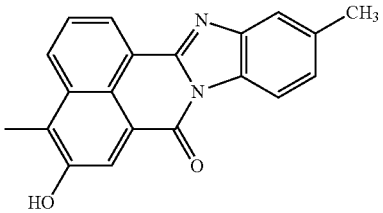

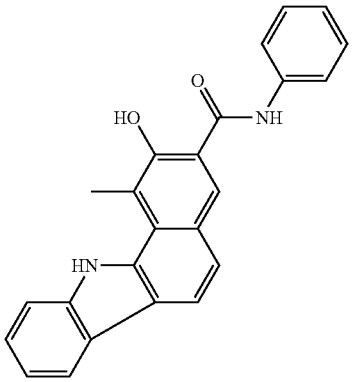

-continued

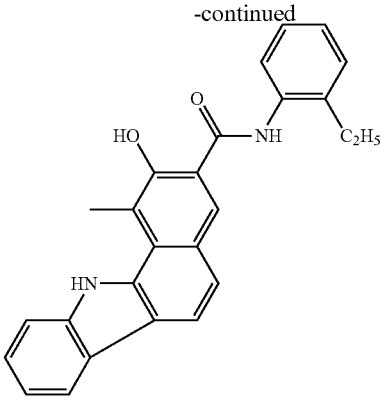

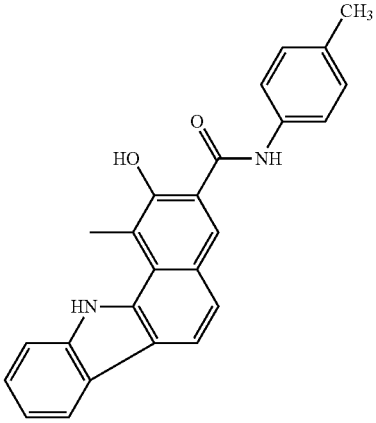

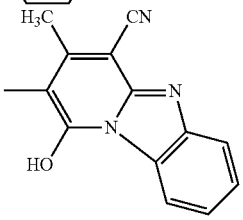

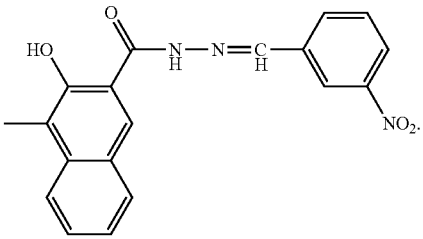

Examples of the binder resin for use in the charge-generated layer of a multilayer-type photoreceptor include insulating resins such as poly(vinyl acetal) resins, e.g., poly(vinyl butyral) resins, poly(vinyl formal) resins, and partly acetalized poly(vinyl butyral) resins in which the butyral moieties have been partly modified with formal, acetal, or the like, polyarylate resins, polycarbonate resins, polyester resins, modified ether-type polyester resins, phenoxy resins, poly (vinyl chloride) resins, poly(vinylidene chloride) resins, poly (vinyl acetate) resins, polystyrene resins, acrylic resins, methacrylic resins, polyacrylamide resins, polyamide resins, polyvinylpyridine resins, cellulosic resins, polyurethane resins, epoxy resins, silicone resins, poly(vinyl alcohol) resins, poly(vinyl pyrrolidone) resins, casein, copolymers based on vinyl chloride and vinyl acetate, e.g., vinyl chloride/vinyl acetate copolymers, hydroxy-modified vinyl chloride/vinyl acetate copolymers, carboxyl-modified vinyl chloride/vinyl acetate copolymers, and vinyl chloride/vinyl acetate/maleic anhydride copolymers, styrene/butadiene copolymers, vinylidene chloride/acrylonitrile copolymers, styrene-alkyd resins, silicone-alkyd resins, and phenol-formaldehyde resins and organic photoconductive polymers such as poly-N-vinylcarbazole, polyvinylanthracene, and polyvinylperylene. Although a binder resin selected from these can be used, the resin should not be construed as being limited to these polymers. These binder resins may be used alone or as a mixture of two or more thereof. Preferred of those are poly(vinyl acetal) resins such as poly(vinyl butyral) resins, poly(vinyl formal) resins, and partly acetalized poly(vinyl butyral) resins in which the butyral moieties have been partly modified with formal or, especially preferably, with acetal or the like.

Examples of solvents or dispersion media usable for dissolving the binder resin therein to produce a coating fluid include saturated aliphatic solvents such as pentane, hexane, octane, and nonane, aromatic solvents such as toluene, xylene, and anisole, halogenated aromatic solvents such as chlorobenzene, dichlorobenzene, and chloronaphthalene, amide solvents such as dimethylformamide and N-methyl-2-pyrrolidone, alcohol solvents such as methanol, ethanol, isopropanol, n-butanol, and benzyl alcohol, aliphatic polyhydric alcohols such as glycerol and polyethylene glycol, chain, branched, and cyclic ketone solvents such as acetone, cyclohexanone, methyl ethyl ketone, and 4-methoxy-4-methyl-2-pentanone, ester solvents such as methyl formate, ethyl acetate, and n-butyl acetate, halogenated hydrocarbon solvents such as methylene chloride, chloroform, and 1,2-dichloroethane, chain and cyclic ether solvents such as diethyl ether, dimethoxyethane, tetrahydrofuran, 1,4-dioxane, methyl Cellosolve, and ethyl Cellosolve, aprotic polar solvents such as acetonitrile, dimethyl sulfoxide, sulfolane, and hexamethylphosphoric triamide, nitrogen-containing compounds such as n-butylamine, isopropanolamine, diethylamine, triethanolamine, ethylenediamine, triethylenediamine, and triethylamine, mineral oils such as ligroin, and water. It is preferred to use a solvent or dispersion medium in which the undercoat layer described later does not dissolve. Those solvents or media can be used alone or in combination of two or more thereof.

In the charge-generating layer of the multilayer-type photoreceptor, the proportion (by weight) of the charge-generating substance to the binder resin may be in the range of from 10 to 1,000 parts by weight, preferably from 30 to 500 parts by weight, per 100 parts by weight of the binder resin. The film thickness thereof is generally from 0.1 μm to 4 μm, preferably from 0.15 μm to 0.6 μm. In case where the proportion of the charge-generating substance is too high, the coating fluid has reduced stability due to problems such as aggregation of the charge-generating substance. On the other hand, too low proportions thereof result in a decrease in photoreceptor sensitivity. It is therefore preferred to use the charge-generating substance in an amount within that range. For dispersing the charge-generating substance, known dispersing techniques can be used, such as ball mill dispersion, attritor dispersion, and sand mill dispersion. In this case, it is effective to finely reduce the particles to a particle size of 0.5 μm or smaller, preferably 0.3 μm or smaller, more preferably 0.15 μm or smaller.

Although the charge-generating layer in the multilayer type contains the charge-generating agent, it is preferred from the standpoint of thin-line reproducibility that the layer should contain the charge-transporting agent which will be described later. The proportion of the charge-transporting agent is preferably from 0.1 mol to 5 mol per mol of the charge-generating agent. The proportion thereof is more preferably 0.2 mol or higher, even more preferably 0.5 mol or higher. The upper limit thereof is preferably 3 mol or lower, more preferably 2 mol or lower, because too high proportions thereof may result in a decrease in sensitivity.

<Charge-Transporting Substance>

The photosensitive layer formed over the conductive substrate may be either a photosensitive layer having a single-layer structure in which a charge-generating substance and a charge-transporting substance are present in the same layer and have been dispersed in a binder resin or a photosensitive layer having a multilayer structure in which functions are allotted to a charge-generating layer containing a charge-generating substance dispersed in a binder resin and a charge-transporting layer containing a charge-transporting substance dispersed in a binder resin. Usually, however, the photosensitive layer includes a binder resin and other ingredients which are used according to need. Specifically, the charge-transporting layer can be obtained, for example, by dissolving or dispersing a charge-transporting substance and other ingredients in a solvent together with a binder resin to produce a coating fluid, applying this coating fluid on a charge-generating layer in the case of a normal superposition type photosensitive layer or on a conductive substrate in the case of a reverse superposition type photosensitive layer (or on an interlayer when the interlayer has been disposed), and drying the coating fluid applied.

It is preferred that the photoreceptor in the invention should contain a charge-transporting substance having an ionization potential of from 4.8 eV to 5.8 eV. Ionization potential can be easily measured with AC-1 (manufactured by Riken) in the air using a powder or a film. The ionization potential thereof is preferably 4.9 eV or higher, more preferably 5.0 eV or higher, because too small values thereof result in poor resistance to ozone, etc. In case where the value of ionization potential is too large, the efficiency of charge injection from the charge-generating substance becomes poor. Consequently, the ionization potential thereof is preferably 5.7 eV or lower, more preferably 5.6 eV or lower, even more preferably 5.5 eV or lower.

Specifically, it is preferred that the photoreceptor in the invention should contain a compound represented by general formula (5).

[Chem. 9]

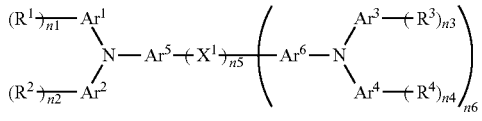

(5)

[In general formula (5), $Ar^1$ to $Ar^6$ each independently represent an aromatic residue which may have one or more substituents or an aliphatic residue which may have one or more substituents; $X^1$ represents an organic residue; $R^1$ to $R^4$ each independently represent an organic group; and n1 to n6 each independently represent an integer of 0 to 2.]

In general formula (5), $Ar^1$ to $Ar^6$ each independently represent an aromatic residue which may have one or more substituents or an aliphatic residue which may have one or more substituents. Examples of the aromatic compound include aromatic hydrocarbons such as benzene, naphthalene, anthracene, pyrene, perylene, phenanthrene, and fluorene and aromatic heterocycles such as thiophene, pyrrole, carbazole, and imidazole. The number of carbon atoms thereof is preferably from 5 to 20, and is more preferably 16 or smaller, even more preferably 10 or smaller. The lower limit thereof is preferably 6 or larger from the standpoint of electrical properties. Aromatic hydrocarbon residues are preferred, and a benzene residue is especially preferred.

Examples of the aliphatic compound include ones in which the number of carbon atoms is preferably 1 to 20 and is more preferably 16 or smaller, even more preferably 10 or smaller. In the case of a saturated aliphatic compound, the number of carbon atoms is preferably 6 or smaller. In the case of an unsaturated aliphatic compound, the number of carbon atoms is preferably 2 or larger. Examples of the saturated aliphatic compound include branched or linear alkyls such as methane, ethane, propane, isopropane, and isobutane. Examples of the unsaturated aliphatic compound include alkenes such as ethylene and butylene.

The substituents with which residues of such compounds may be substituted are not particularly limited. Examples thereof include alkyl groups such as methyl, ethyl, propyl, and isopropyl; alkenyl groups such as allyl; alkoxy groups such as methoxy, ethoxy, and propoxy; aryl groups such as phenyl, indenyl, naphthyl, acenaphthyl, phenanthryl, and pyrenyl; and heterocyclic groups such as indolyl, quinolyl, and carbazolyl. These substituents may be bonded through a connecting group or directly to form a ring.

Introduction of these substituents has the effects of regulating intramolecular charges and heightening charge mobility. However, in case where the introduction thereof results in excessive bulkiness, this lowers, rather than heightens, charge mobility due to the deformation of an intramolecular conjugation plane and intermolecular steric repulsion. Because of this, the number of carbon atoms is preferably 1 or larger and is preferably 6 or smaller, more preferably 4 or smaller, especially 2 or smaller.

When $Ar^1$ to $Ar^6$ have one or more substituents, it is preferred that a plurality of substituents should be possessed because this prevents crystal precipitation. However, too many substituents lower, rather than heighten, charge mobility due to the deformation of an intramolecular conjugation plane and intermolecular steric repulsion. Because of this, the number of substituents is preferably 2 or smaller per ring. From the standpoints of improving the stability of the compound contained in the photosensitive layer and improving electrical properties, substituents which are not sterically bulky are preferred. More specifically, methyl, ethyl, butyl, isopropyl, or methoxy is preferred.

Especially when $Ar^1$ to $Ar^4$ are benzene residues, it is preferred that the benzene residues should have a substituent. In this case, preferred substituents are alkyl groups. Preferred of these is methyl. When $Ar^5$ and $Ar^6$ are benzene residues, a preferred substituent is methyl or methoxy. It is especially preferred that $Ar^1$ in general formula (5) should have a fluorene structure.

In general formula (5), $X^1$ is an organic residue. Examples thereof include the following residues which may have one or more substituents: aromatic residues, saturated aliphatic residues, heterocyclic residues, organic residues having an ether structure, and organic residues having a divinyl structure. Especially preferred are organic residues having 1 to 15 carbon atoms. Of these, aromatic residues and saturated aliphatic residues are preferred. In the case of an aromatic residue, the number of carbon atoms thereof is preferably 6 to 14, more preferably up to 10. In the case of a saturated aliphatic residue, the number of carbon atoms thereof is preferably from 1 to 10, more preferably up to 8.

This organic residue $X^1$ may be any of the structures enumerated above which have one or more substituents. The substituents with which those structures may be substituted are not particularly limited. Examples thereof include alkyl groups such as methyl, ethyl, propyl, and isopropyl; alkenyl groups such as allyl; alkoxy groups such as methoxy, ethoxy, and propoxy; aryl groups such as phenyl, indenyl, naphthyl, acenaphthyl, phenanthryl, and pyrenyl; and heterocyclic groups such as indolyl, quinolyl, and carbazolyl. These substituents may be bonded through a connecting group or directly to form a ring. These substituents are ones in which the number of carbon atoms is preferably 1 or larger and is preferably 10 or smaller, more preferably 6 or smaller, especially 3 or smaller. More specifically, methyl, ethyl, butyl, isopropyl, methoxy, and the like are preferred.

When $X^1$ has one or more substituents, it is preferred that a plurality of substituents should be possessed because this prevents crystal precipitation. However, too many substituents lower, rather than heighten, charge mobility due to the deformation of an intramolecular conjugation plane and intermolecular steric repulsion. Because of this, the number of substituents is preferably 2 or smaller per $X^1$.

Symbols n1 to n4 each independently represent an integer of 0 to 2. Symbol n1 preferably is 1, and n2 preferably is 0 or 1. Especially preferably, n2 is L $R^1$ to $R^4$ each independently are an organic group, preferably an organic group having 30 or less carbon atoms, more preferably an organic group having 20 or less carbon atoms. Preferred are ones which have a hydrazone structure in which the nitrogen atoms of the hydrazone have no hydrogen atom directly bonded thereto through a conjugated bond and ones which have a stilbene structure. Preferred are ones including a nitrogen atom to which a carbon atom has been bonded.

Symbols n5 and n6 each independently represent 0 to 2. When n5 is 0, this indicates a direct bond. When n6 is 0, n5 preferably is 0. When both n5 and n6 are 1, it is preferred that $X^1$ should be an alkylidene or arylene group or have an ether structure. Preferred structures of the alkylidene are phenylmethylidene, 2-methylpropylidene, 2-methylbutylidene, cyclohexylidene, and the like. Preferred structures of the arylene are phenylene, naphthylene, and the like. Preferred groups having an ether structure include —O—$CH_2$—O— and the like.

When both n5 and n6 are 0, $Ar^5$ preferably is a benzene residue or a fluorene residue. In the case of a benzene residue, this residue preferably is substituted with an alkyl group or an alkoxy group. This substituent more preferably is methyl or methoxy, and is bonded preferably in the para position with respect to the nitrogen atom. When n6 is 2, $X^1$ preferably is a benzene residue.

Specific examples of combinations of n1 to n6 include the following.

| n1 | n2 | n3 | n4 | n5 | n6 |
|---|---|---|---|---|---|
| 1 | 0 | 0 | 0 | 0 | 0 |
| 1 | 1 | 0 | 0 | 0 | 0 |
| 1 | 0 | 1 | 0 | 0 | 1 |
| 1 | 1 | 1 | 1 | 0 | 1 |
| 2 | 2 | 0 | 0 | 0 | 0 |
| 1 | 0 | 0 | 0 | 0 | 0 |
| 2 | 2 | 2 | 2 | 1 | 1 |
| 1 | 1 | 1 | 0 | 2 | 1 |
| 1 | 1 | 1 | 1 | 1 | 2 |

Preferred examples of the structure of the charge-transporting substance in the invention are shown below.

[Chem. 10]
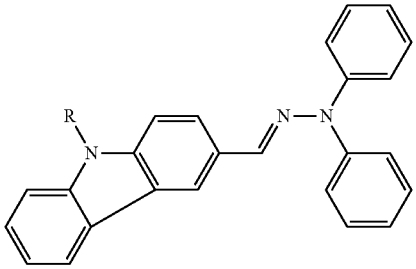
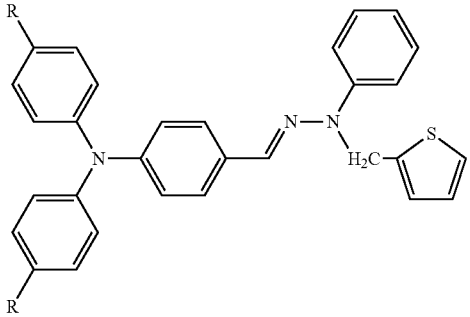
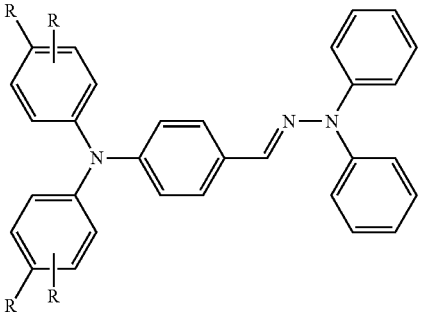
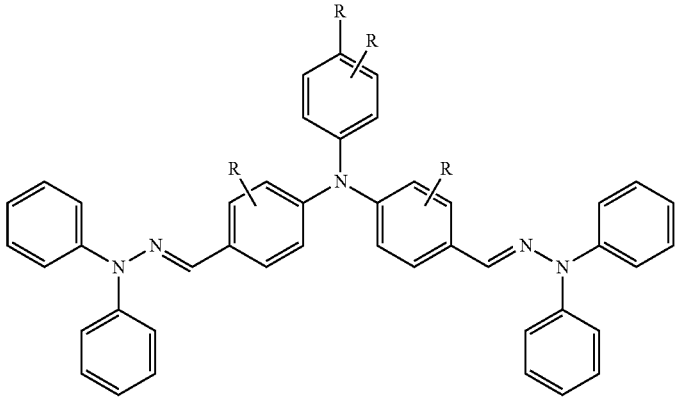
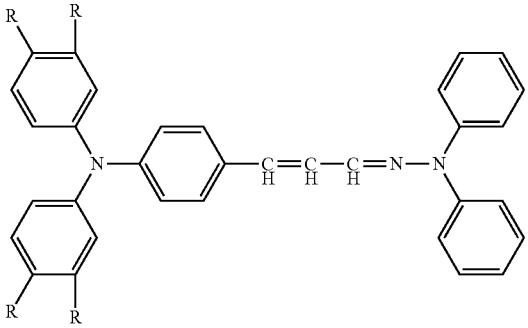
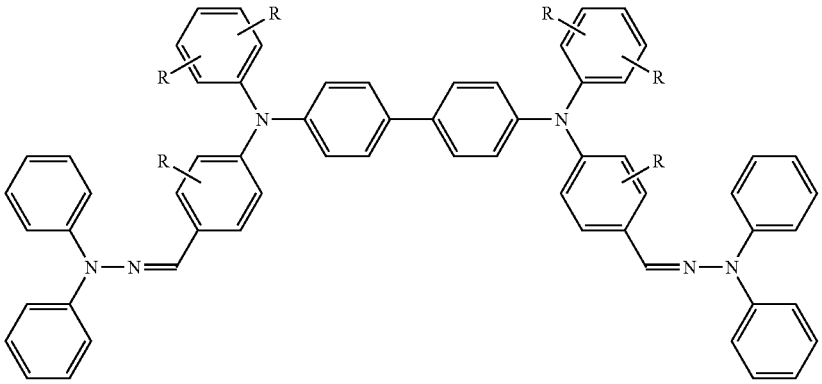

-continued
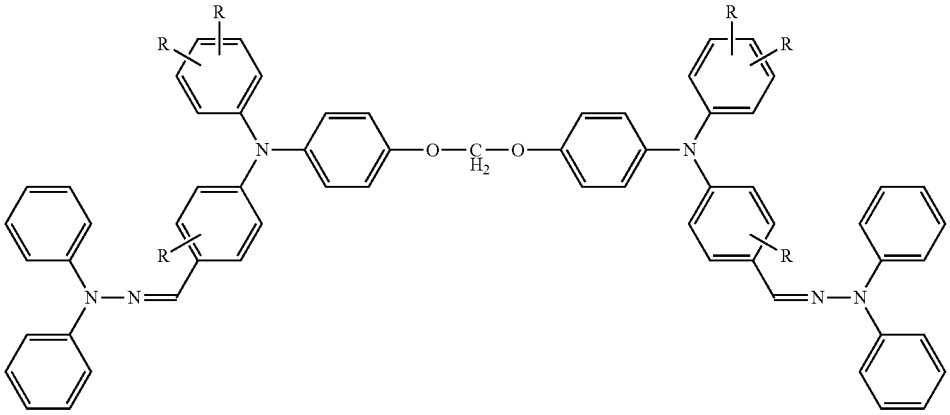
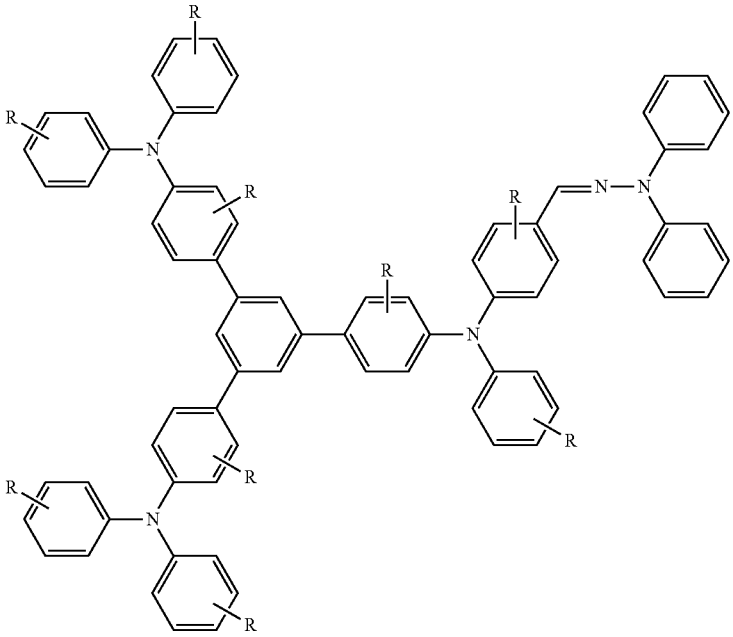
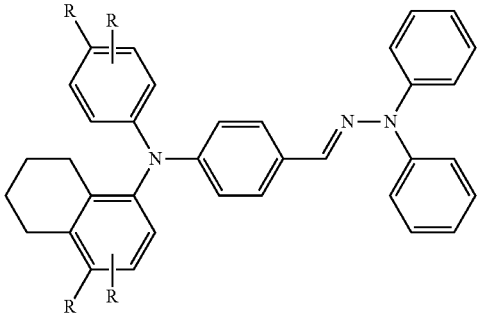
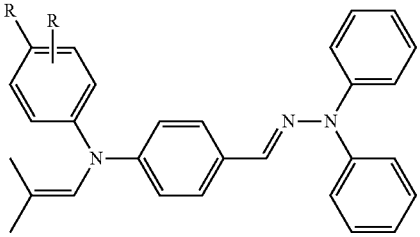

-continued
[Chem. 11]
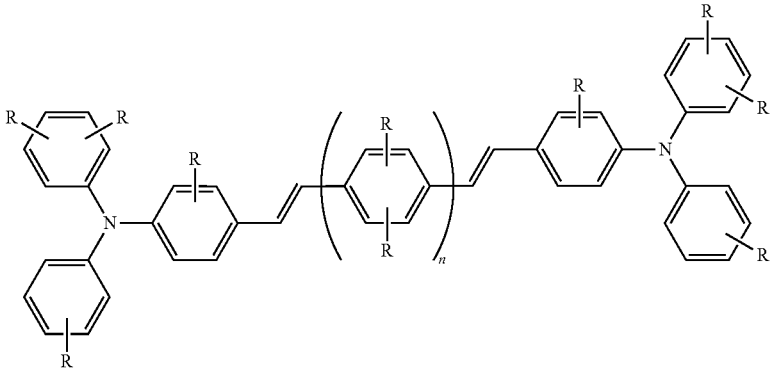
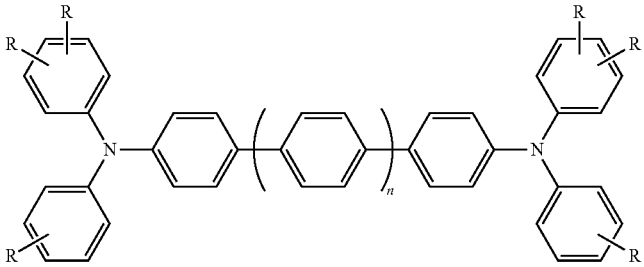
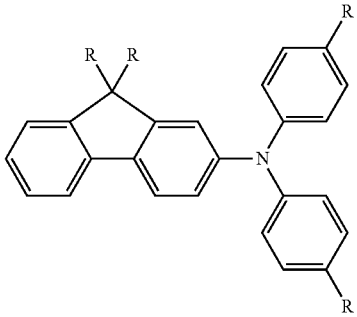
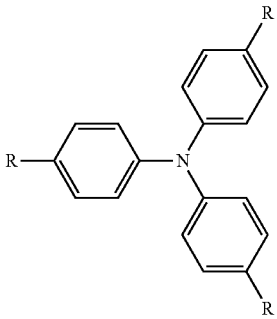
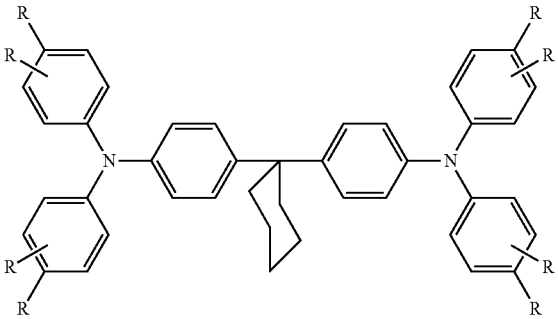
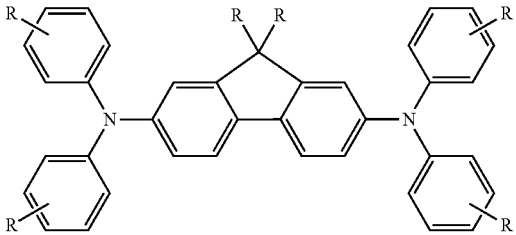
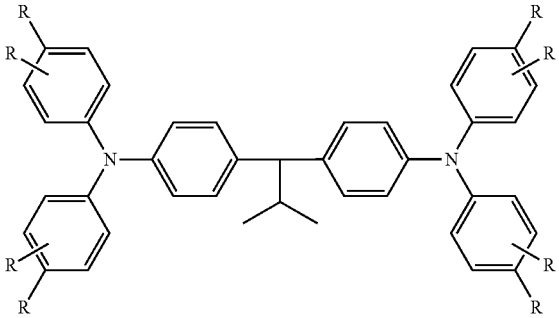
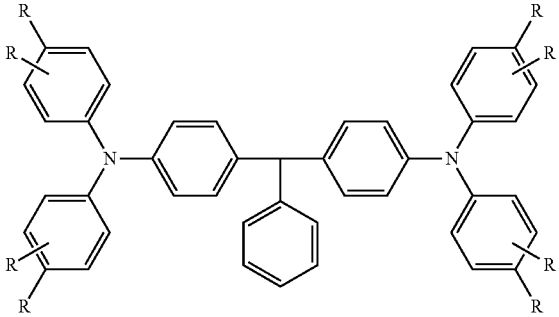
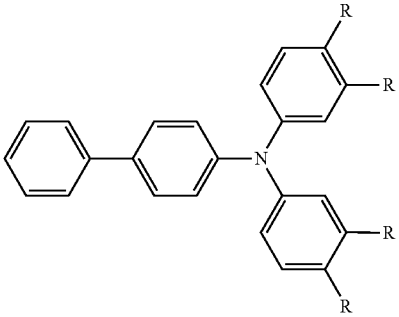

-continued
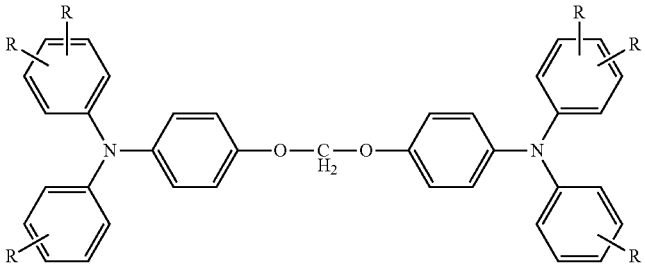
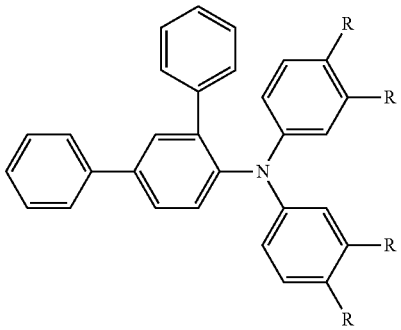
[Chem. 12]
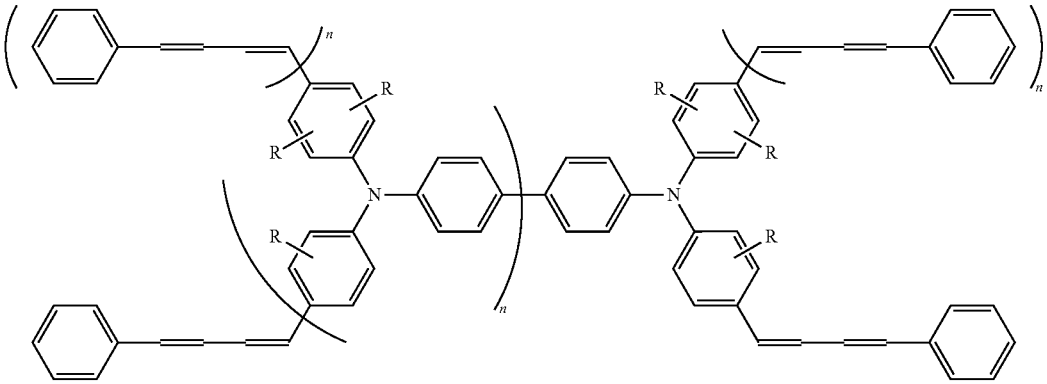
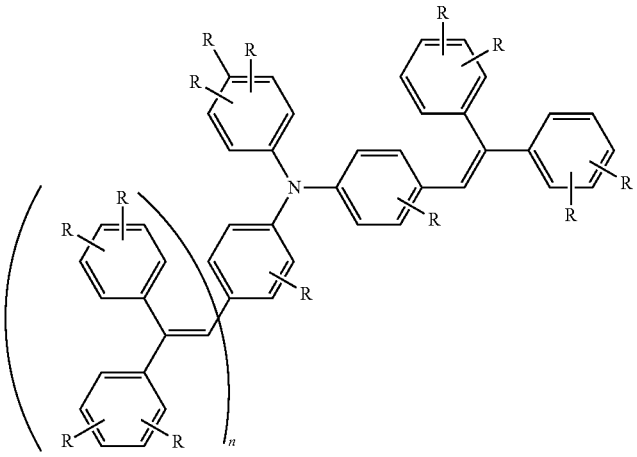
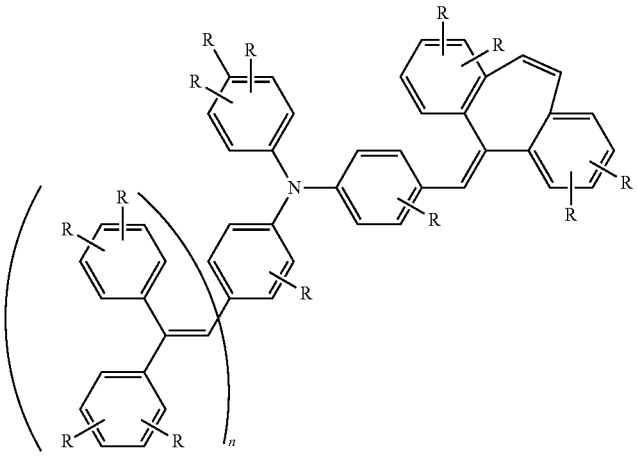

In the formulae given above, R's may be the same or different. Specifically, R is a hydrogen atom or a substituent, and the substituent preferably is an alkyl group, alkoxy group, aryl group, or the like. Especially preferred is methyl or phenyl. Symbol n is an integer of 0 to 2.

It is preferred that the charge-transporting substance should satisfy the expression 200 ($Å^3$)>α>55 ($Å^3$) regarding polarizability αcal, which is determined through a structure optimization calculation employing a semi-empirical molecular orbital calculation using AM1 parameters for the organic charge-transporting substance (hereinafter referred to simply as "determined through semi-empirical molecular orbital calculation (AM1)"), and further satisfy the expression 0.2 (D)<P<2.1 (D) regarding dipole moment Pcal, which is determined through semi-empirical molecular orbital calculation.

In the past, there was a report in which PM3 was used in a calculation for a charge-transporting substance. In the invention, however, AM1 was used. The reasons for this include the following.

Reason 1: Many charge-transporting substances are constituted of carbon, hydrogen, oxygen, and nitrogen, and use of AM1, in which parameters for these have been fixed, is expected to be suitable for structure optimization.

Reason 2: In charge distribution calculations necessary for calculating a dipole moment, AM1 is more reliable than PM3, etc.

The polarizability αcal is preferably 70 or larger, more preferably 90 or larger, when thin-line reproducibility is taken into account. Furthermore, when an effect of repeated use on image changes is taken into account, the polarizability is desirably 180 or smaller, preferably 150 or smaller, more preferably 130 or smaller. The dipole moment Pcal is preferably 0.4 (D) or larger, more preferably 0.6 (D) or larger, when memory through transfer is taken into account. Furthermore, when mobility is taken into account, the dipole moment is desirably 2.0 (D) or smaller, preferably 1.7 (D) or smaller, more preferably 1.5 (D) or smaller, even more preferably 1.3 (D) or smaller.

The compound of general formula (5) may be used in combination with any desired known charge-transporting substance. Examples of known charge-transporting substances include electron-attracting substances such as aromatic nitro compounds, e.g., 2,4,7-trinitrofluorenone, cyano compounds, e.g., tetracyanoquinodimethane, and quinone compounds, e.g., diphenoquinone, and electron-donating substances such as heterocyclic compounds, e.g., carbazole derivatives, indole derivatives, imidazole derivatives, oxazole derivatives, pyrazole derivatives, thiadiazole derivatives, and benzofuran derivatives, aniline derivatives, hydrazone derivatives, aromatic amine derivatives, stilbene derivatives, butadiene derivatives, enamine derivatives, compounds constituted of two or more of these compounds bonded to each other, and polymers having a group derived from any of those compounds in the main chain or a side chain thereof. Preferred of these are carbazole derivatives, aromatic amine derivatives, stilbene derivatives, butadiene derivatives, enamine derivatives, and compounds constituted of two or more of these compounds bonded to each other. Any one of these charge-transporting substances may be used alone, or any desired combination of two or more of these may be used.

In the image-forming apparatus of the invention, it is preferred that the photoreceptor should be a multilayer type photoreceptor including a charge-generating layer and a charge-transporting layer and that the proportion by weight of the charge-transporting agent to the binder resin which are contained in the charge-transporting layer, i.e., the value of "charge-transporting agent/binder resin", should be in the range of 0.3-1.0. When the value thereof is smaller than 0.3, there are cases where electrical properties decrease and cases where mobility, in particular, decreases. On the other hand, when the value thereof is larger than 1.0, there are cases where the photosensitive layer has reduced mechanical strength and cases where wearing resistance, in particular, decreases. The value of "charge-transporting agent/binder resin" is more preferably 0.35 or larger. The value thereof is more preferably 0.8 or smaller, even more preferably 0.6 or smaller.

<Binder Resin>

In forming the charge-transporting layer of a function allocation type photoreceptor having a charge-generating layer and a charge-transporting layer and in forming the photosensitive layer of a single-layer type photoreceptor, a binder resin is used in order to ensure film strength and disperse compounds. The charge-transporting layer of a function allocation type photoreceptor can be obtained by applying and drying a coating fluid obtained by dissolving or dispersing a charge-transporting substance and any of various binder resins in a solvent. In the case of a single-layer type photoreceptor, the photosensitive layer can be obtained by applying and drying a coating fluid obtained by dissolving or dispersing a charge-generating substance, a charge-transporting substance, and any of various binder resins in a solvent. Examples of the binder resins include butadiene resins, styrene resins, vinyl acetate resins, vinyl chloride resins, acrylic ester resins, methacrylic ester resins, vinyl alcohol resins, polymers and copolymers of vinyl compounds, e.g., ethyl vinyl ether, poly(vinyl butyral) resins, poly(vinyl formal) resins, partly modified poly(vinyl acetal)s, polycarbonate resins, polyester resins, polyarylate resins, polyamide resins, polyurethane resins, cellulose ester resins, phenoxy resins, silicone resins, silicone-alkyd resins, and poly-N-vinylcarbazole resins. These resins may have been modified with a silicon reagent or the like.

It is especially preferred in the invention that one or more polymers obtained by interfacial polymerization should be contained. Interfacial polymerization is a method of polymerization in which polycondensation reaction proceeding at the interface between two or more solvents which do not mingle with each other (mostly an organic solvent/water system) is utilized. For example, a dicarboxylic acid chloride and a glycol ingredient are dissolved respectively in an organic solvent and alkaline water or the like, and the two solutions are mixed together at ordinary temperature. This mixture is allowed to separate into two phases, and polycondensation reaction is caused to proceed at the resultant interface to yield a polymer. Other examples of the two ingredients include phosgene and an aqueous glycol solution or the like. There also are cases where an interface is utilized as a field for polymerization without separating two ingredients into respective two phases, as in the case where a polycarbonate oligomer is condensed by interfacial polymerization.

As reaction solvents, it is preferred to use two layers which are an organic phase and an aqueous phase. The organic phase preferably is methylene chloride, and the aqueous phase preferably is an alkaline aqueous solution. It is preferred to use a catalyst in the reaction. The addition amount of the condensation catalyst to be used in the reaction may be about 0.005-0.1 mol %, preferably 0.03-0.08 mol %, based on the diol as a glycol ingredient. When the amount thereof exceeds 0.1 mol %, there are cases where much labor is required for extracting and removing the catalyst in a cleaning step after the polycondensation.

It is preferred that the reaction temperature should be 80° C. or lower, preferably 60° C. or lower, more preferably in the range of 10° C.-50° C. The reaction time is generally from 0.5 minutes to 10 hours, preferably from 1 minute to 2 hours, although it is influenced by reaction temperature. Too high reaction temperatures make it impossible to control side reactions. On the other hand, when the reaction temperature is too low, there are cases where refrigeration load increases and this increases cost accordingly, although such a low-temperature state is preferred from the standpoint of reaction control.

The concentration in the organic phase may be in such a range that the composition to be obtained is soluble. Specifically, the concentration may be about 10-40% by weight. It is preferred that the proportion of the organic phase should be 0.2-1.0 in terms of the volume ratio thereof to an aqueous alkali metal hydroxide solution of a diol, i.e., the aqueous phase.

It is preferred to regulate the amount of the solvent so that the concentration of the resin to be yielded in the organic phase by the polycondensation becomes 5-30% by weight. Thereafter, an aqueous phase including water and an alkali metal hydroxide is newly added, and a condensation catalyst is preferably further added in order to regulate the polycondensation conditions, whereby the desired polycondensation is completed according to the interfacial polycondensation method. The proportion of the organic phase to the aqueous phase during the polycondensation is preferably such that the organic phase/aqueous phase ratio by volume is about 1/(0.2-1).

The polymer to be yielded by the interfacial polymerization especially preferably is a polycarbonate resin or a polyester resin (in particular, a polyarylate resin). The polymer preferably is a polymer obtained using an aromatic diol as a raw material. Preferred aromatic diol structures are represented by the following formula (A).

[Chem. 13]

(A)

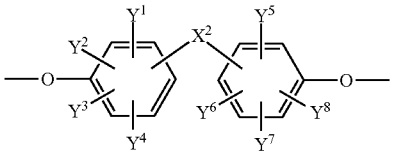

[In formula (A), $X^2$ represents a single bond or a connecting group, and $Y^1$ to $Y^8$ each independently represent a hydrogen atom or a substituent having 20 or less carbon atoms.]

In formula (A), $X^2$ preferably is a single bond or a group represented by any of the following structures. The term "single bond" means the state is which the atom "$X^2$" is not present and the two benzene rings respectively on the right and left sides of formula (A) have been bonded to each other through a single bond alone. In particular, it is preferred that $X^2$ should have no cyclic structure.

[Chem. 14]

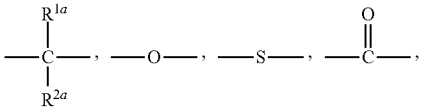

-continued

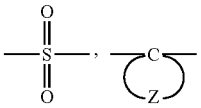

In the structures shown above, $R^{1a}$ and $R^{2a}$ each independently represent a hydrogen atom, an alkyl group having 1-20 carbon atoms, an optionally substituted aryl group, or a halogenated alkyl group, and Z represents an optionally substituted hydrocarbon group having 4-20 carbon atoms.

Especially preferred from the standpoints of sensitivity, residual potential, etc. is a polycarbonate resin or polyarylate resin containing the bisphenol or bisphenol ingredient having any of the following structural formulae. The polycarbonate resin is more preferred of these from the standpoint of mobility.

Examples of bisphenols or bisphenol structures suitable for use in the polycarbonate resin are shown below. These examples are given in order to clearly show the spirit, and usable bisphenol ingredients should not be construed as being limited to the following structures so long as the bisphenol ingredients are not counter to the spirit of the invention.

[Chem. 15]

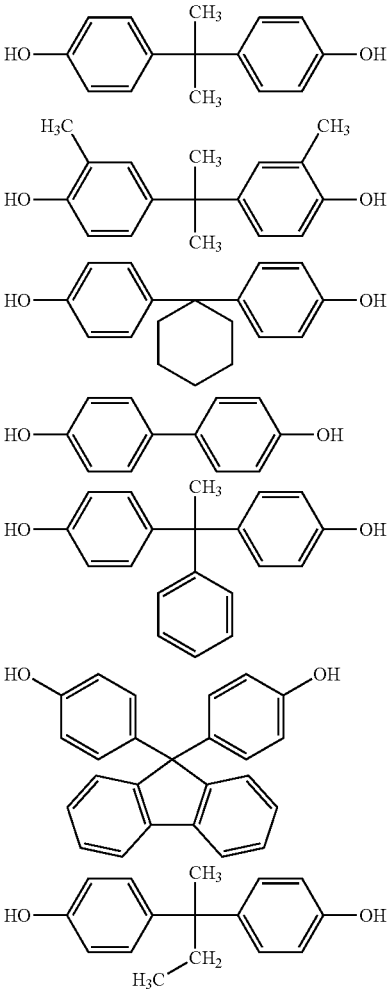

In particular, from the standpoint of producing the effect of the invention to the highest degree, a polycarbonate containing a bisphenol derivative having any of the following structures is preferred.

[Chem. 16]

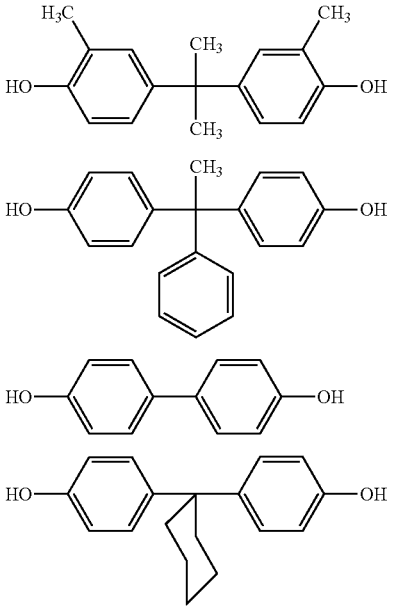

From the standpoint of improving mechanical properties, it is preferred to use a polyester, in particular, a polyarylate. In this case, it is preferred to use any of the following structures as a bisphenol ingredient

[Chem. 17]

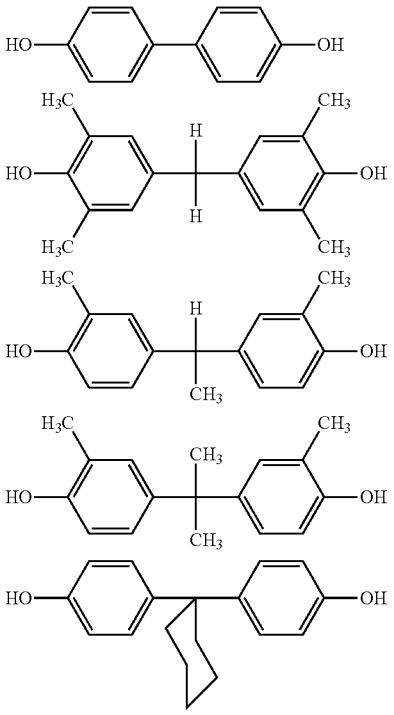

-continued

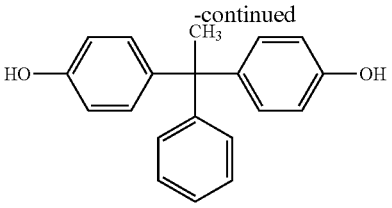

and to use any of the following structures as an acid ingredient.

[Chem. 18]

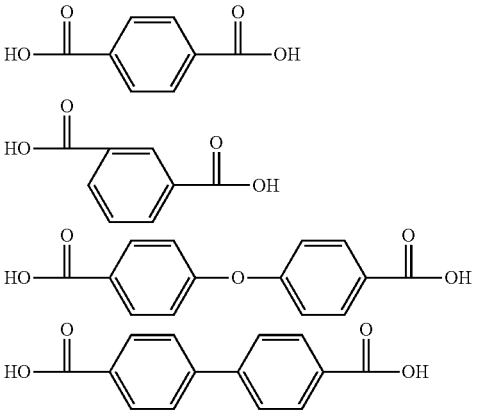

In the case of using terephthalic acid and isophthalic acid, it is preferred to use terephthalic acid in a larger molar proportion.

The proportions of the binder resin and charge-transporting substance to be used in the charge-transporting layer of a multilayer type photoreceptor and in the photosensitive layer of a single-layer type photoreceptor are as follows. In each of the single-layer type and the multilayer type, the amount of the charge-transporting substance per 100 parts by weight of the binder resin is generally 20 parts by weight or larger, is preferably 30 parts by weight or larger from the standpoint of lowering residual potential, and is more preferably 40 parts by weight or larger from the standpoints of stability during repeated use and charge mobility. Meanwhile, the amount thereof is generally 150 parts by weight or smaller from the standpoint of the thermal stability of the photosensitive layer, is preferably 120 parts by weight or smaller from the standpoint of compatibility between the charge-transporting substance and the binder resin, is more preferably 100 parts by weight or smaller from the standpoint of printing durability, and is especially preferably 80 parts by weight or smaller from the standpoint of marring resistance.

In the case of a single-layer type photoreceptor, the charge-generating substance is further dispersed in the charge-transporting medium having the component proportion described above. In this case, it is necessary that the charge-generating substance should have a sufficiently small particle diameter. The particle diameter of the charge-generating substance to be used is preferably 1 μm or smaller, more preferably 0.5 μm or smaller. In case where the amount of the charge-generating substance dispersed in the photosensitive layer is too small, sufficient sensitivity is not obtained. In case where the amount thereof is too large, this adversely influences to result in a decrease in electrification characteristics and a decrease in sensitivity. For example, the charge-generating substance is used in an amount in the range of desirably 0.1-50% by weight, preferably 1-20% by weight.

The thickness of the photosensitive layer of the single-layer type photoreceptor is in the range of generally 5-100 μm, preferably 10-50 μm. The thickness of the charge-transporting layer of the normal superposition type photoreceptor is generally in the range of 5-50 μm. However, the thickness thereof is preferably 10-45 μm from the standpoints of long life and image stability, and is more preferably 10-30 μm from the standpoint of high resolution.

Known additives such as, e.g., an antioxidant, plasticizer, ultraviolet absorber, electron-attracting compound, leveling agent, and visible-light-shielding agent may be incorporated into the photosensitive layer in order to improve film formation properties, flexibility, applicability, nonfouling properties, gas resistance, light resistance, etc. Furthermore, the photosensitive layer may contain various additives such as, e.g., a leveling agent for improving applicability, an antioxidant, and a sensitizer according to need. Examples of the antioxidant include hindered phenol compounds and hindered amine compounds. Examples of the visible-light-shielding agent include various colorant compounds and azo compounds. Examples of the leveling agent include silicone oils and fluorochemical oils.

<Antioxidant>

An antioxidant is a kind of stabilizer which is added in order to prevent members contained in the photoreceptor from being oxidized. The antioxidant has the function of a radical scavenger. Examples thereof include phenol derivatives, amine compounds, phosphonic esters, sulfur compounds, vitamins, and vitamin derivatives. Preferred of these are phenol derivatives, amine compounds, vitamins, and the like. Especially preferred is a hindered phenol having a bulky substituent near the hydroxy group, a trialkylamine derivative, or the like. In particular, an aryl compound derivative having a hydroxy group and having a t-butyl group in an ortho position with respect to the hydroxy group is preferred, and an aryl compound derivative having a hydroxy group and having two t-butyl groups in the ortho positions with respect to the hydroxy group is preferred.

When the antioxidant has too high a molecular weight, there are cases where the oxidation-preventing ability is problematic. It is therefore preferred to use a compound having a molecular weight of 1,500 or lower, especially 1,000 or lower. It is preferred that the lower limit thereof should be 100 or higher, preferably 150 or higher, more preferably 200 or higher.

Antioxidants usable in the invention are shown below. As the antioxidants usable in the invention, all materials known as antioxidants, ultraviolet absorbers, and light stabilizers for plastics, rubbers, petroleum, and fats and oils can be employed. However, one or more materials selected from the following groups of compounds can be especially advantageously used.

(1) The phenol compounds described in JP-A-57-122444, the phenol derivatives described in JP-A-60-188956, and the hindered phenol compounds described in JP-A-63-018356.

(2) The p-phenylenediamine compounds described in JP-A-57-122444, the p-phenylenediamine derivatives described in JP-A-60-188956, and the p-phenylenediamine compounds described in JP-A-63-018356.

(3) The hydroquinone compounds described in JP-A-57-122444, the hydroquinone derivatives described in JP-A-60-188956, and the hydroquinone compounds described in JP-A-63-018356.

(4) The sulfur compounds described in JP-A-57-188956 and the organosulfur compounds described in JP-A-63-018356.

(5) The organophosphorus compounds described in JP-A-57-122444 and the organophosphorus compounds described in JP-A-63-018356.

(6) The hydroxyanisole compounds described in JP-A-57-122444.

(7) The piperidine derivatives and oxopiperazine derivatives having a specific framework structure described in JP-A-63-018355.

(8) The carotenes, amines, tocopherols, nickel(II) complexes, sulfides, and other compounds described in JP-A-60-188956.

Especially preferred are the following hindered phenol compounds (the term hindered phenol means a phenol compound having a bulky substituent near the hydroxy group).

Dibutylhydroxytoluene,
2,2'-methylenebis(6-t-butyl-4-methylphenol),
4,4'-butylidenebis(6-t-butyl-3-methylphenol),
4,4'-thiobis(6-t-butyl-3-methylphenol),
2,2'-butylidenebis(6-t-butyl-4-methylphenol),
α-tocophenol, β-tocophenol, 2,2,4-trimethyl-6-hydroxy-7-t-butylchroman,
pentaerythtyl tetrakis[3-(3,5-di-t-butyl-4-hydroxyphenyl) propionate],
2,2'-thiodiethylene bis[3-(3,5-di-t-butyl-4-hydroxyphenyl) propionate],
1,6-hexanediol bis[3-(3,5-di-t-butyl-4-hydroxyphenyl)propionate], butylhydroxyanisole, dibutylhydroxyanisole,
octadecyl 3,5-di-tert-butyl-4-hydroxyhydrocinnamate,
1,3,5-trimethyl-2,4,6-tris(3,5-di-tert-butyl-4-hydroxybenzyl)benzene.

Especially preferred of those hindered phenol compounds are the following compounds:

octadecyl 3,5-di-tert-butyl-4-hydroxyhydrocinnamate,
1,3,5-trimethyl-2,4,6-tris(3,5-di-tert-butyl-4-hydroxybenzyl)benzene.

Those compounds are known as antioxidants for rubbers, plastics, fats and oils, etc., and some of those are available as commercial products.

In the photoreceptor to be used in the image-forming apparatus of the invention, the amount of the antioxidant to be contained in a surface layer is not particularly limited. However, the amount thereof is preferably from 0.1 part by weight to 20 parts by weight per 100 parts by weight of the binder resin. In case where the amount thereof is outside that range, satisfactory electrical properties are not obtained. Especially preferably, the amount thereof is 1 part by weight or larger. Meanwhile, too large amounts pose a problem concerning not only electrical properties but also printing durability. Consequently, the amount of the antioxidant is preferably 15 parts or smaller, more preferably 10 parts or smaller.

<Electron-Attracting Compound>

It is preferred that the photoreceptor should have a compound having electron-attracting properties. Preferred examples thereof include sulfonic ester compounds, carboxylic ester compounds, organic cyano compounds, nitro compounds, and aromatic halogen derivatives. Especially preferred are sulfonic ester compounds and organic cyano compounds. In particular, sulfonic ester compounds are preferred.

It is thought that electron-attracting ability can be estimated based on the value of LUMO energy level. In particular, compounds having a LUMO energy level value, as determined by structural optimization employing a semi-empirical molecular orbital calculation using PM3 parameters (hereinafter referred to simply as "determined through semi-empirical molecular orbital calculation (PM3)"), of from −1.0 eV to −3.0 eV are preferred. In case where the absolute value of LUMO energy level is lower than 1.0 eV, the effect of electron-attracting properties is not sufficiently expected. When the absolute value thereof exceeds 3.0 eV, there is a fear that electrification may be impaired. The absolute value of LUMO energy level is preferably 1.5 eV or higher, more preferably 1.7 eV or higher, even more preferably 1.9 eV or higher. The upper limit thereof is preferably 2.7 eV or lower, more preferably 2.5 eV or lower.

For calculations for electron-attracting compounds, PM3 was utilized as a Hamiltonian. The reason for this is as follows. Usually, electron-attracting compounds may include heteroatoms such as sulfur and halogens besides carbon, nitrogen, oxygen, and hydrogen. It is therefore thought that PM3, in which parameters of such many kinds of atoms have been determined by the least square method, is suitable for the structural optimization of electron-attracting compounds.

Specific examples of the electron-attracting compound include the following compounds.

[Chem. 19]

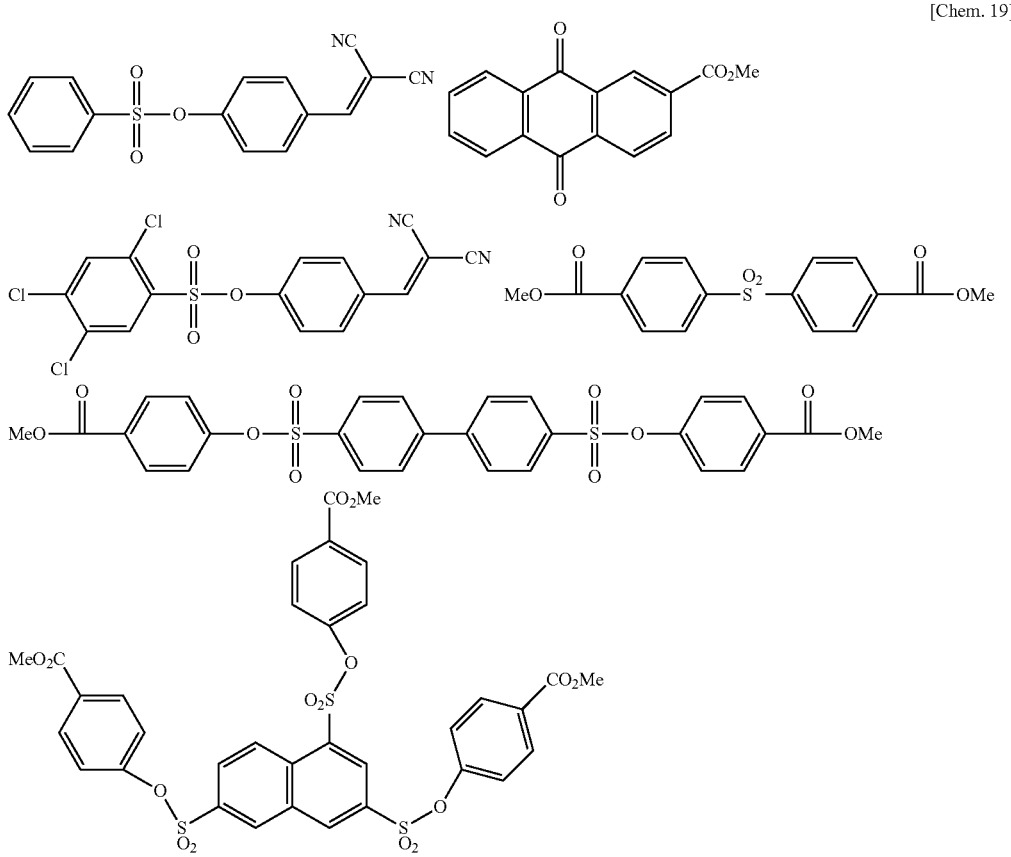

<Outermost Layer>

Although the charge-generating substance and charge-transporting substance may be present in any layer, it is preferred that fluorine atoms or silicon atoms should be present in the outermost layer from the standpoint of improving toner transferability and removability in cleaning. These atoms may be ones contained in any of additives, the charge-generating substance, the charge-transporting substance, and binder resins.

The adhesive properties of the surface of the photoreceptor can be detected as surface free energy (having the same meaning as surface tension). The surface free energy of the outermost layer is preferably in the range of from 35 mN/m to 65 mN/m. When the value thereof is too low, there is a possibility that a toner might flows off. When the value thereof is too high, there is a possibility that such a high surface free energy results in impaired toner transfer efficiency and impaired toner removability in cleaning. The lower limit thereof is preferably 40 mN/m or higher, and the upper limit thereof is preferably 55 mN/m or lower, more preferably 50 mN/m or lower.

[Surface Free Energy]

Surface free energy is described below. Adhesion between the photoreceptor surface and foreign matter, e.g., a residual toner, falls under the category of physical bonding, and is caused by an intermolecular force (van der Waals force). Among the phenomena which are caused by the intermolecular force is surface free energy ($\gamma$). The "wetting" of substances is roughly divided into three kinds; i.e., "adhesion wetting" in which substance 1 adheres to substance 2; "spreading wetting" in which substance 1 spreads on substance 2; and "immersion wetting" in which substance 1 is immersed in or infiltrated into substance 2.

With respect to surface free energy ($\gamma$) and wettability in adhesion wetting, the relationship between substance 1 and substance 2 is expressed by the following equation derived from Young's equation.

[Su-2]

$$\gamma_1=\gamma_2\cdot\cos\theta_{12}+\gamma_{12} \qquad \text{equation (1-1)}$$

$\gamma_1$: surface free energy of surface of substance 1

$\gamma_2$: surface free energy of substance 2

$\gamma_{12}$: substance 1/substance 2 interfacial free energy $\theta_{12}$: substance 1/substance 2 contact angle When adhesion of foreign matter, water, etc. to the surface of the photoreceptor in an image-forming apparatus is dealt with, the substance 1 and substance 2 in equation (1-1) may be taken as the photoreceptor and foreign matter, respectively.

It can be seen from equation (1-1) that to regulate $\gamma_1$, $\gamma_2$, and $\gamma_{12}$ is important for regulating surface properties. It is preferred to render the surface less apt to be wetted. In this case, it is preferred to increase $\theta_{12}$. Namely, it is effective to increase the surface free energy $\gamma_1$ of the photoreceptor surface, which is the "wetting work" of the photoreceptor and the toner, and to reduce $\gamma_2$ and $\gamma_{12}$.

In the cleaning part in electrophotography, when the surface free energy $\gamma_1$ of the photoreceptor is regulated, the right side of equation (1-1), which indicates the state of adhesion, can be regulated as a result. During repeated use, the toner and other foreign matter are successively or newly supplied. Consequently, $\gamma_2$ can be thought to be constant. Meanwhile, the photoreceptor changes in surface free energy $\gamma_1$ with repetitions of use. When $\gamma_1$ changes by $\Delta\gamma_1$, then the right side of equation (1-1) changes accordingly. Namely, the state in which foreign matter is adherent to the photoreceptor surface changes, resulting in a change in removability in cleaning and a change in the burden imposed on the cleaning mechanism. In other words, the suitability for cleaning, i.e., cleanability, of the photoreceptor can be kept constant by specifying $\Delta\gamma_1$.

With respect to the wetting of a solid by a liquid, the contact angle $\theta_{12}$ therebetween can be directly measured. In the case of solid/solid contact, as in contact of a photoreceptor with a toner, the contact angle $\theta_{12}$ cannot be measured. Both the photoreceptor and toner in the invention are usually solids and fall into the latter case.

In *Nihon Setchaku Kyōkai Shi,* 8(3), 131-141 (1972), KITAZAKI Yasuaki, HATA Toshio, et al. proposed that Forkes' theory, which relates to interfacial free energy (having the same meaning as interfacial tension) and deals with nonpolar intermolecular forces, can be extended to components based on an intermolecular force attributable to polarity or hydrogen bonding. Using this extended Forkes' theory, the surface free energy of each substance can be determined from two or three components. The theory involving three components is shown below with respect to the case of adhesion wetting as an example. This theory is based on the following assumption.

1. Additivity rule for surface free energy ($\gamma$)

$$\gamma=\gamma^d+\gamma^p+\gamma^h \quad (1\text{-}2)$$

$\gamma^d$: dispersed component (nonpolar wetting=adhesion)

$\gamma^p$: dipole component (wetting by polarity=adhesion)

$\gamma^h$: hydrogen bonding component (wetting by hydrogen bonding=adhesion)

The additivity rule is applied to ForkeS's theory, whereby the interfacial free energy $\gamma_{12}$ of two substances is expressed by the following.

[Su-3]

$$\gamma_{12}=\gamma_1+\gamma_2-2\cdot(\gamma_1^d\cdot\gamma_2^d)^{1/2}-2\cdot(\gamma_1^p\cdot\gamma_2^p)^{1/2}-2\cdot(\gamma_1^h\cdot\gamma_2^h)^{1/2} \quad \text{equation (1-3)}$$

Furthermore, the following holds.

[Su-4]

$$\gamma_{12}=\{\sqrt{(\gamma_1^d)}-\sqrt{(\gamma_2^d)}\}^2+\{\sqrt{(\gamma_1^p)}-\sqrt{(\gamma_2^p)}\}^2-\{\sqrt{(\gamma_1^h)}-\sqrt{(\gamma_2^h)}\}^2 \quad \text{equation (1-4)}$$

In a method for determining surface free energy, reagents in which the surface free energy components p, d, and h are known are used and examined for adhesion, and the surface free energy can be calculated from the results. Specifically, pure water, methylene iodide, and α-bromonaphthalene were used as the reagents, and automatic contact angle meter Type CA-VP, manufactured by Kyowa Interface Co., Ltd., was used to measure the contact angle between each reagent and a photoreceptor surface. The surface free energy $\gamma$ was calculated using surface free energy analysis software FAMAS, manufactured by the same company. Besides those reagents, reagents providing a suitable combination of the components p, d, and h may be used. With respect to measuring methods, general techniques such as, e.g., the Wilhelmy method (hanging plate method) and the due Noüy method can be used for the measurement besides the method described above.

As described above, there are multiple kinds of "wetting". In the case where a toner is bonded and fused to the surface of a photoreceptor, the toner remaining on the photoreceptor surface adheres to the photoreceptor and, with repetitions of steps including cleaning and charging, the toner spreads to form a coating film on the photoreceptor surface and comes to have high adhesion force, thereby exerting a considerable influence. This case corresponds to the so-called "adhesion wetting".

Also in the case of bonding of foreign matter such as, e.g., paper dust, rosin, and talc, the regions where such foreign substances are in contact with the photoreceptor (hereinafter referred to as "interface") likewise increase in area after adhesion, resulting in tenacious wetting. Furthermore, water may directly affects not only the foreign matter which has adhered to the photoreceptor surface but also the photoreceptor surface to "wet" the foreign matter and the surface, and this is a cause of the so-called "high-humidity blurring", in which images are blurred.

With respect to those foreign substances, various substances including a toner temporarily adhere to the photoreceptor surface because of the nature of electrophotographic steps for image formation. It is necessary that the so-called "residual toner" and other foreign substances which remain untransferred to a receiving material should be removed in a certain time period. The term "certain time period" herein means the time period from the time at which various substances actually adhere temporarily to the photoreceptor surface to the time at which the area of the interface between the adherent substances and the photoreceptor increases due to diffusion and/or further adhesion.

The property concerning cleaning in the state within that range, i.e., the "adhesion wetting" of the foreign matter which has adhered first to the photoreceptor, and "spreading wetting" are major factors in practical cleanability and the life of the cleaning device or photoreceptor. Consequently, the inventors diligently made investigations based on the idea that to specify the surface free energy $\gamma$ of the photoreceptor is effective. As a result, they have found that electrophotographic images having high image quality and high durability can be obtained. In particular, substance 2, i.e., the foreign matter, is thought to include a toner, paper dust, water, silicone oil, and other many kinds of substances.

In the invention, the surface free energy $\gamma_1$ of the surface of the photoreceptor as substance 1, which is the side to which foreign matter adheres, was specified. The substance 2 is supplied according to need during repeated use, whereas the surface of the photoreceptor as substance 1 changes in $\gamma_1$. In investigating the durability of an electrophotographic apparatus for image formation, it is important to regulate the change $\Delta\gamma_1$.

[Regulation]

The cleanability of the photoreceptor, in particular, the burden of cleaning the photoreceptor, is regulated in order to stably obtain high-quality images. The present inventors diligently made investigations and, as a result, have found that satisfactory cleanability is obtained with a light burden by regulating the photoreceptor so as to have a surface free energy $\gamma$ in the range of from 35 to 65 mN/m, more preferably from 40 to 60 mN/m. Furthermore, by using the photoreceptor so that the change Δγ with repeated use is 25 mN/m or smaller, preferably 15 mN/m or smaller, the burden to be imposed on both the photoreceptor and the cleaning device is inhibited from fluctuating. The inventors have thus succeeded in stabilizing cleanability over long.

In particular, a protective layer may be disposed as an outermost layer of the photoreceptor for the purposes of preventing the photosensitive layer from being damaged or worn and preventing or mitigating the deterioration of the photosensitive layer caused by, e.g., substances generated by discharge from the charging device, etc. The protective layer may be formed from a composition constituted of an appropriate binder resin and a conductive material incorporated therein. Alternatively, a copolymer produced using a compound having charge-transporting ability, e.g., one having a triphenylamine framework such as that described in JP-A-9-190004 or W-A-10-252377, can be used. As the conductive material, use can be made of an aromatic amino compound such as TPD (N,N'-diphenyl-N,N'-bis(m-tolyl)benzidine, a metal oxide such as antimony oxide, indium oxide, tin oxide, titanium oxide, tin oxide-antimony oxide, aluminum oxide, or zinc oxide, or the like. However, the conductive material should not be construed as being limited to these.

As the binder resin for the protective layer, a known resin can be used, such as, e.g., a polyamide resin, polyurethane resin, polyester resin, epoxy resin, polyketone resin, polycarbonate resin, poly(vinyl ketone) resin, polystyrene resin, polyacrylamide resin, or siloxane resin. Also usable is a copolymer of any of these resins and a framework having charge-transporting ability, e.g., a triphenylamine framework such as that described in JP-A-9-190004 or JP-A-10-252377.

It is preferred that the protective layer should be constituted so as to have an electrical resistivity of $10^9$-$10^{14}$Ω·cm. In case where the electrical resistivity thereof is higher than $10^{14}$Ω·cm, residual potential increases to give fogged images. On the other hand, electrical resistivities thereof lower than $10^9$Ω·cm result in image fogging and reduced resolution. The protective layer must be constituted so as not to substantially inhibit transmission of the light to be used for imagewise exposure.

For the purposes of reducing the frictional resistance and wear of the photoreceptor surface and heightening the efficiency of toner transfer from the photoreceptor to a transfer belt or paper, the surface layer may contain a fluororesin, silicone resin, polyethylene resin, polystyrene resin, or the like. Furthermore, the surface layer may contain particles made of any of these resins or particles of an inorganic compound.

<Method of Layer Formation>

The layers constituting the photoreceptor are formed from coating fluids each containing materials for constituting the layer by successively applying the coating fluids for the respective layers on a substrate by a known coating technique while repeating coating/drying steps for each layer.

The coating fluid to be used for layer formation in the case of a single-layer photoreceptor or of the charge-transporting layer of a multilayer type photoreceptor may have a solid concentration in the range of 5-40% by weight. However, it is preferred to use the coating fluid having a solid concentration in the range of 10-35% by weight. The viscosity of the coating fluid to be used is generally in the range of 10-500 mPa·s, preferably in the range of 50-400 mPa·s.

In the case of the charge-generating layer of the multilayer type photoreceptor, the coating fluid to be used has a solid concentration generally in the range of 0.1-15% by weight, more preferably in the range of 1-10%. The viscosity of this coating fluid to be used is generally in the range of 0.01-20 mPa·s, more preferably in the range of 0.1-10 mPa·s.

Examples of methods for applying the coating fluids include dip coating, spray coating, spinner coating, bead coating, wire-wound bar coating, blade coating, roller coating, air knife coating, and curtain coating. However, other known coating techniques can be used.

It is preferred that the coating fluids should be dried in such a manner that the coating fluids are allowed to dry to the touch at room temperature and then dried with heating at a temperature in the range of 30-200° C. for a period of from 1 minute to 2 hours with or without air blowing. The heating temperature may be kept constant, or the drying may be conducted while changing the temperature.

<Image-Forming Apparatus>

The method of image formation with the image-forming apparatus of the invention is explained in more detail by reference to drawings. FIG. 1 is a view illustrating an example of developing devices which employ a nonmagnetic one-component toner and are usable for carrying out a method of image formation. In FIG. 1, a toner 6 housed in a toner hopper 7 is forcedly brought near a roller-form sponge roller (toner supply aid member) 4 with agitating blades 5, whereby the toner is fed to the sponge roller 4. The toner caught by the sponge roller 4 is conveyed to a toner-conveying member 2 by the rotation of the sponge roller 4 in the direction indicated by the arrow, and the toner undergoes friction and is electrostatically or physically adsorbed. The toner-conveying member 2 is forcibly rotated in the direction of the arrow, and an even thin toner layer is formed with an elastic steel blade (toner layer thickness control member)3. Simultaneously therewith, the toner is frictionally charged. Thereafter, the toner is conveyed to the surface of an electrostatic-latent-image carrier 1 which is in contact with the toner-conveying member 2, whereby a latent image is developed. The electrostatic latent image is obtained, for example, by charging an organic photoreceptor with a 500-V DC and then exposing the photoreceptor to a light.

The toner used in the image-forming apparatus of the invention has a narrow charge amount distribution and, hence, the internal fouling of the image-forming apparatus which is caused by insufficiently charged toner particles (toner dusting) is exceedingly slight. This effect is remarkably produced especially in a high-speed image-forming apparatus in which development on the electrostatic-latent-image carrier is conducted at a process speed of 100 mm/sec or higher.

Furthermore, since the toner used in the image-forming apparatus of the invention has a narrow charge amount distribution, the toner has highly satisfactory developing properties and the amount of toner particles which accumulate without being used for development is exceedingly small. This effect is produced especially in an image-forming apparatus in which the rate of toner consumption is high. Specifically, it is preferred, from the standpoint of sufficiently producing the effect of the invention, that the toner should be one for use in an image-forming apparatus satisfying the following expression (G).

$$[\text{Guaranteed life in number of prints of the developing device to be packed with developer (sheets)}]\times(\text{coverage rate})>400\ (\text{sheets}) \quad (G)$$

In expression (G), "coverage rate" is expressed in terms of a value obtained by dividing the sum of the areas of printed parts by the overall area of the receiving medium in each printed matter for determining a guaranteed life in number of prints as a performance of the image-forming apparatus. For example, the "coverage rate" in "5%" printing is "0.05".

In addition, since the toner used in the image-forming apparatus of the invention has an exceedingly narrow particle diameter distribution, latent-image reproducibility is highly satisfactory. Consequently, the effect of the invention is sufficiently produced especially when the toner is used in an image-forming apparatus in which the resolution for the electrostatic-latent-image carrier is 600 dpi or higher. Incidentally, the term "resolution for the electrostatic-latent-image carrier" has the same meaning as "resolution of the apparatus".

An embodiment of components disposed around the electrophotographic process in the image-forming apparatus of the invention is explained below by reference to FIG. 7, which illustrates the constitution of important parts of the apparatus. However, embodiments of the apparatus should not be construed as being limited to that explained below, and the apparatus can be modified at will so long as the modifications do not depart from the spirit of the invention.

Figure 7:
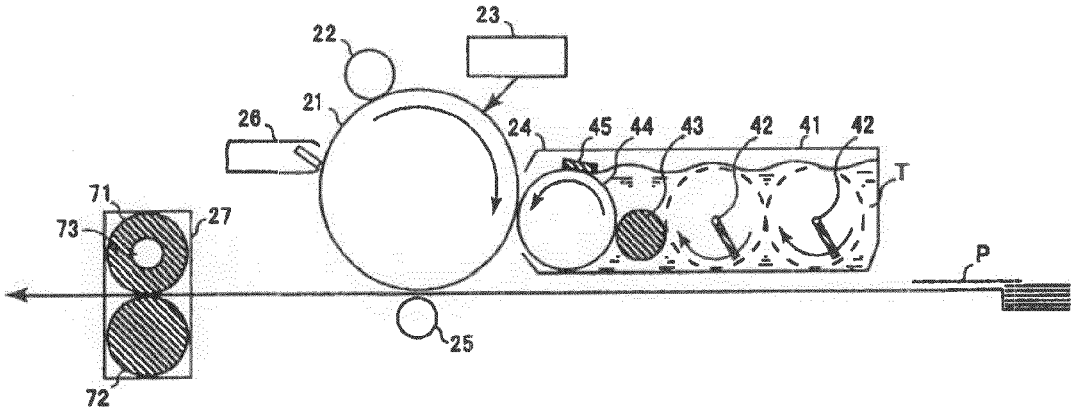
FIG. 7 is a diagrammatic view illustrating the constitution of an important part of one embodiment of the image-forming apparatus of the invention.

As shown in FIG. 7, the image-forming apparatus includes an electrophotographic photoreceptor 21, a charging device 22, an exposure device 23, and a developing device 24. The apparatus is further provided with a transfer device 25, a cleaner 26, and a fixing device 27 according to need.

The electrophotographic photoreceptor 21 is not particularly limited so long as it is the electrophotographic photoreceptor described above for use in the image-forming apparatus of the invention. FIG. 7 shows, as an example thereof, a drum-shaped photoreceptor constituted of a cylindrical conductive substrate and, formed on the surface thereof, the photosensitive layer described above. The charging device 22, exposure device 23, developing device 24, transfer device 25, and cleaner 26 have been disposed along the peripheral surface of this electrophotographic photoreceptor 21.

The charging device 22 serves to charge the electrophotographic photoreceptor 21. It evenly charges the surface of the electrophotographic photoreceptor 21 to a given potential. FIG. 7 shows a roller type charging device (charging roller) as an example of the charging device 21. However, corona charging devices such as corotrons and scorotrons, contact type charging devices such as charging brushes, and the like are frequently used besides the charging rollers.

In many cases, the electrophotographic photoreceptor 21 and the charging device 22 have been designed to constitute a cartridge (hereinafter suitably referred to as "photoreceptor cartridge") which involves these two members and is removable from the main body of the image-forming apparatus. In this constitution, when, for example, the electrophotographic photoreceptor 21 and the charging device 22 have deteriorated, this photoreceptor cartridge can be removed from the main body of the image-forming apparatus and a fresh photoreceptor cartridge can be mounted in the main body of the image-forming apparatus. Also with respect to the toner, which will be described later, the toner in many cases has been designed to be stored in a toner cartridge and be removable from the main body of the image-forming apparatus. In this constitution, when the toner in the toner cartridge in use has run out, this toner cartridge can be removed from the main body of the image-forming apparatus and a fresh toner cartridge can be mounted. Furthermore, there are cases where a cartridge including all of an electrophotographic photoreceptor 21, a charging device 22, and a toner is used.

The exposure device 23 is not particularly limited in kind so long as it can illuminate the electrophotographic photoreceptor 21 and thereby form an electrostatic latent image in the photosensitive surface of the electrophotographic photoreceptor 21. Examples thereof include halogen lamps, fluorescent lamps, lasers such as semiconductor lasers and He—Ne lasers, and LEDs. It is also possible to conduct exposure by the technique of internal photoreceptor exposure. Any desired light can be used for exposure. For example, a monochromatic light having a wavelength of from 700 nm to 850 nm, a monochromatic light having a slightly short wavelength of from 600 nm to 700 nm, a monochromatic light having a short wavelength of from 300 nm to 500 nm, or the like may be used to conduct exposure.

In particular, in the case of an electrophotographic photoreceptor employing a phthalocyanine compound as a charge-generating substance, it is preferred to use a monochromatic light having a wavelength of from 700 nm to 850 nm. In the case of an electrophotographic photoreceptor employing an azo compound, it is preferred to use a monochromatic light having a wavelength of 700 nm or shorter. There are cases where the electrophotographic photoreceptor employing an azo compound has sufficient sensitivity even when a monochromatic light having a wavelength of 500 nm or shorter is used as a light source for light input. In this case, use of a monochromatic light having a wavelength of from 300 nm to 500 nm as a light source for light input is especially suitable.

The developing device 24 is not particularly limited in kind, and any desired device can be used, such as one operated by a dry development technique, e.g., cascade development, development with one-component conductive toner, or two-component magnetic brush development, a wet development technique, etc. In FIG. 7, the developing device 24 includes a developing vessel 41, agitators 42, a feed roller 43, a developing roller 44, and a control member 45. This device has such a constitution that a toner T is stored in the developing vessel 41. According to need, the developing device 24 may be equipped with a replenishing device (not shown) for replenishing the toner T. This replenishing device has such a constitution that the toner T can be supplied from a container such as a bottle or cartridge.

The feed roller 43 is made of an electrically conductive sponge, etc. The developing roller 44 is constituted of, for example, a metallic roll made of iron, stainless steel, aluminum, nickel, or the like or a resinous roll obtained by coating such a metallic roll with a silicone resin, urethane resin, fluororesin, or the like. The surface of this developing roller 44 may be subjected to a surface-smoothing processing or surface-roughening processing according to need.

The developing roller 44 is disposed between the electrophotographic photoreceptor 21 and the feed roller 43 and is in contact with each of the electrophotographic photoreceptor 21 and the feed roller 43. The feed roller 43 and the developing roller 44 are rotated by a rotation driving mechanism (not shown). The feed roller 43 holds the toner T stored and supplies it to the developing roller 44. The developing roller 44 holds the toner T supplied by the feed roller 43 and brings it into contact with the surface of the electrophotographic photoreceptor 21.

The control member 45 is constituted of a resinous blade made of a silicone resin, urethane resin, or the like, a metallic blade made of stainless steel, aluminum, copper, brass, phosphor bronze, or the like, a blade obtained by coating such a metallic blade with a resin, etc. This control member 45 is in contact with the developing roller 44 and is pushed against the developing roller 44 with a spring or the like at a given force (the linear blade pressure is generally 5-500 g/cm). According to need, this control member 45 may have the function of charging the toner T based on electrification by friction with the toner T.

The agitators 42 each are rotated by the rotation driving mechanism. They agitate the toner T and convey the toner T to the feed roller 43 side. Two or more agitators 42 differing in blade shape, size, etc. may be disposed.

The toner T to be used is a small-particle diameter toner having a volume-median diameter (Dv50) of from 4.0 μm to 7.5 μm and having the specific particle diameter distribution described above. The toner to be used can have any of various particle shapes ranging from a shape close to sphere to one which is not spherical, such as a potato shape. Polymerization toners are excellent in evenness of electrification and transferabilty and are suitable for image quality improvement.

The transfer device 25 is not particularly limited in kind, and use can be made of a device operated by any desired technique selected from an electrostatic transfer technique, pressure transfer technique, adhesive transfer technique, and the like, such as corona transfer, roller transfer, and belt transfer. Here, the transfer device 5 is one constituted of a transfer charger, transfer roller, transfer belt, or the like disposed so as to face the electrophotographic photoreceptor 21. A given voltage (transfer voltage) which has the polarity opposite to that of the charge potential of the toner T is applied to the transfer device 25, and this transfer device 25 thus transfers the toner image formed on the electrophotographic photoreceptor 21 to recording paper (paper or medium) P.

The cleaner 26 is not particularly limited, and any desired cleaner can be used, such as a brush cleaner, magnetic brush cleaner, electrostatic brush cleaner, magnetic roller cleaner, or blade cleaner. The cleaner 26 serves to scrape off the residual toner adherent to the photoreceptor 21 with a cleaning member and thus recover the residual toner. However, when there is little or almost no residual toner adherent to the photoreceptor, the cleaner 26 may be omitted.

The fixing device 27 is constituted of an upper fixing member (fixing roller) 71 and a lower fixing member (fixing roller) 72. The fixing member 71 or 72 is equipped with a heater 73 inside. FIG. 7 shows an example in which the upper fixing member 71 is equipped with a heater 73 inside. As the upper and lower fixing members 71 and 72, use can be made of a known heat-fixing member such as a fixing roll obtained by coating a metallic tube made of stainless steel, aluminum, or the like with a silicone rubber, a fixing roll obtained by further coating that fixing roll with a Teflon (registered trademark) resin, or a fixing sheet. Furthermore, the fixing members 71 and 72 each may have a constitution in which a release agent such as a silicone oil is supplied thereto in order to improve release properties, or may have a constitution in which the two members are forcedly pressed against each other with a spring or the like.

The toner which has been transferred to the recording paper P passes through the nip between the upper fixing member 71 heated at a given temperature and the lower fixing member 72, during which the toner is heated to a molten state. After the passing, the toner is cooled and fixed to the recording paper P. The fixing device also is not particularly limited in kind. Fixing devices which can be mounted include ones operated by any desired fixing technique, such as heated-roller fixing, flash fixing, oven fixing, or pressure fixing, besides the device used here.

In the electrophotographic apparatus having the constitution described above, image recording is conducted in the following manner. First, the surface (photosensitive surface) of the photoreceptor 21 is charged to a given potential (e.g., −600 V) by the charging device 22. This charging may be conducted with a direct-current voltage or with a direct-current voltage on which an alternating-current voltage has been superimposed. Subsequently, the charged photosensitive surface of the photoreceptor 21 is exposed by the exposure device 23 according to the image to be recorded. Thus, an electrostatic latent image is formed in the photosensitive surface. This electrostatic latent image formed in the photosensitive surface of the photoreceptor 21 is developed by the developing device 24.

In the developing device 24, the toner T fed by the feed roller 43 is formed into a thin layer with the control member (developing blade) 45 and, simultaneously therewith, frictionally charged so as to have a given polarity (here, the toner is charged so as to have negative polarity, which is the same as the polarity of the charge potential of the photoreceptor 1). This toner T is conveyed while being held by the developing roller 44 and is brought into contact with the surface of the photoreceptor 21. When the charged toner T held on the developing roller 44 comes into contact with the surface of the photoreceptor 21, a toner image corresponding to the electrostatic latent image is formed on the photosensitive surface of the photoreceptor 21. This toner image is transferred to recording paper P by the transfer device 25. Thereafter, the toner which has not been transferred and remains on the photosensitive surface of the photoreceptor 21 is removed by the cleaner 26.

After the transfer of the toner image to the recording paper P, this recording paper P is passed through the fixing device 7 to thermally fix the toner image to the recording paper P. Thus, a finished image is obtained.

Incidentally, the image-forming apparatus may have a constitution which includes, for example, an erase part in addition to the constitution described above. In the erase part, a step is conducted in which the electrophotographic photoreceptor is exposed to a light to thereby erase the residual charges from the electrophotographic photoreceptor. As an eraser may be used a fluorescent lamp, LED, or the like. The light to be used in the erase part, in many cases, is a light having such an intensity that the exposure energy thereof is at least 3 times the energy of the exposure light.

The constitution of the image-forming apparatus may be further modified. For example, the apparatus may have a constitution which includes a pre-exposure part and an auxiliary charging part, or have a constitution in which offset printing is conducted. Furthermore, the apparatus may have a full-color tandem constitution employing a plurality of toners.

By using the photoreceptor, which is excellent in non-blocking properties, etc., for the image-forming apparatus of the invention in combination with either of the toners described hereinabove, an image-forming apparatus system can be constructed which has excellent image characteristics and is reduced in image fouling and image defects.

EXAMPLES

The invention will be explained below in more detail by reference to Examples. However, the invention should not be construed as being limited to the following Examples unless the invention departs from the spirit thereof. In the following Examples, Comparative Examples, and Production Examples, "parts" means "parts by weight".

<Method of Determining Volume-Average Diameter (Mv) and Definition Thereof>

The volume-average diameter (Mv) of particles having a volume-average diameter (Mv) smaller than 1 μm was determined with Type: Microtrac Nanotrac 150 (hereinafter abbreviated to "Nanotrac"), manufactured by Nikkiso Co., Ltd., according to the instruction manual for Nanotrac. Analysis software Microtrac Particle Analyzer Ver 10.1.2.-019EE, manufactured by the same company, was used. Ion-exchanged water having an electrical conductivity of 0.5 μS/cm was used as a dispersion medium. The following particulate materials were examined under the following conditions or using the following input conditions by the method described in the instruction manual.

Wax Dispersion and Dispersion of Primary Polymer Particles:

Refractive index of solvent: 1.333
Examination time: 100 sec
Number of examinations: 1
Refractive index of particles: 1.59
Transparency: transparent
Shape: truly spherical
Density: 1.04

Pigment Premix Liquid and Colorant Dispersion:

Refractive index of solvent: 1.333
Examination time: 100 sec
Number of examinations: 1
Refractive index of particles: 1.59
Transparency: absorptive
Shape: non-spherical
Density: 1.00

<Method of Determining Volume-Median Diameter (Dv50) and Definition Thereof>

A toner finally obtained through an external-additive addition step was subjected to a pretreatment for examination in the following manner. Into a cylindrical polyethylene (PE) beaker having an inner diameter of 47 mm and a height of 51 mm was introduced 0.100 g of the toner with a spatula. Furthermore, 0.15 g of 20% by mass aqueous DBS solution (Neogen S-20A, manufactured by Dai-ichi Kogyo Seiyaku Co., Ltd.) was introduced thereinto with a dropping pipet. In this operation, the toner and the 20% aqueous DBS solution were placed only on the bottom of the beaker while preventing the toner from scattering and adhering to the brim and other portions of the beaker. Subsequently, the contents were stirred with the spatula for 3 minutes until the toner and the 20% aqueous DBS solution became a paste. This operation also was performed while preventing the toner from scattering and adhering to the brim and other portions of the beaker.

Subsequently, 30 g of dispersion medium Isoton II was added, and the contents were stirred with the spatula for 2 minutes to give a solution which was wholly homogeneous when viewed visually. A fluororesin-coated rotator having a length of 31 mm and a diameter of 6 mm was then placed in the beaker, and the particles were dispersed with a stirrer at 400 rpm for 20 minutes. In this operation, macroscopic particles visually observed at the air/liquid interface and on the brim of the beaker were scraped off and returned to the inside of the beaker with a spatula once in every 3 minutes so as to give an even dispersion. Subsequently, the resultant dispersion was filtered through a mesh having an opening size of 63 μm. The filtrate obtained is referred to as "toner dispersion".

With respect to a particle diameter measurement in the step of producing toner base particles, a filtrate obtained by filtrating a slurry containing aggregates through a 63-μm mesh is referred to as "slurry".

The volume-median diameter (Dv50) of particles was determined with Multisizer III (aperture diameter, 100 μm) (hereinafter abbreviated to "Multisizer"), manufactured by Beckman Coulter, Inc. The "toner dispersion" or "slurry" described above was diluted with Isoton II, manufactured by the same company, as a dispersion medium so as to result in a dispersed-phase concentration of 0.03% by mass, and this dilution was examined with a Multisizer III analysis software (ver.) using a PD value of 118.5. The range of particle diameters to be examined was set at 2.00 to 64.00 μm, and this range was discretely divided into 256 sections having the same width on the logarithmic scale. A median value was calculated from the statistical values for these sections on a volume basis, and this value was taken as the volume-median diameter (Dv50).

<Method of Determining Population Number % of Toner Particles having Particle Diameter of from 2.00 μm to 3.56 μm (Dns) and Definition Thereof>

A toner obtained through an external-additive addition step was subjected to a pretreatment for examination in the following manner. Into a cylindrical polyethylene (PE) beaker having an inner diameter of 47 mm and a height of 51 mm was introduced 0.100 g of the toner with a spatula. Furthermore, 0.15 g of 20% by mass aqueous DBS solution (Neogen S-20A, manufactured by Dai-ichi Kogyo Seiyaku Co., Ltd.) was introduced thereinto with a dropping pipet. In this operation, the toner and the 20% aqueous DBS solution were placed only on the bottom of the beaker while preventing the toner from scattering and adhering to the brim and other portions of the beaker. Subsequently, the contents were stirred with the spatula for 3 minutes until the toner and the 20% aqueous DBS solution became a paste. This operation also was performed while preventing the toner from scattering and adhering to the brim and other portions of the beaker.

Subsequently, 30 g of dispersion medium Isoton II was added, and the contents were stirred with the spatula for 2 minutes to give a solution which was wholly homogeneous when viewed visually. A fluororesin-coated rotator having a length of 31 mm and a diameter of 6 mm was then placed in the beaker, and the particles were dispersed with a stirrer at 400 rpm for 20 minutes. In this operation, macroscopic particles visually observed at the air/liquid interface and on the brim of the beaker were scraped off and returned to the inside of the beaker with a spatula once in every 3 minutes so as to give an even dispersion. Subsequently, the resultant dispersion was filtered through a mesh having an opening size of 63 μm. The filtrate obtained is referred to as toner dispersion.

The population number % of toner particles having a particle diameter of from 2.00 μm to 3.56 μm (Dns) was determined with Multisizer (aperture diameter, 100 μm). The "toner dispersion" or "slurry" described above was diluted with Isoton II, manufactured by the same company, as a dispersion medium so as to result in a dispersed-phase concentration of 0.03% by mass, and this dilution was examined with a Multisizer III analysis software using a PD value of 118.5.

The lower-limit particle diameter of 2.00 μm is a detection limit for this analyzer, Multisizer, while the upper-limit particle diameter of 3.56 μm is the specified value for a channel of this analyzer, Multisizer. In the invention, this particle diameter region of from 2.00 μm to 3.56 μm was taken as a fine-powder region.

The range of particle diameters to be examined was set at 2.00-64.00 μm, and this range was discretely divided into 256 sections having the same width on the logarithmic scale. The proportion by number of the component ranging in particle diameter from 2.00 to 3.56 μm was calculated from the statistical values for these sections on a number basis, and this value was taken as "Dns".

<Method of Determining Average Degree of Circularity and Definition Thereof>

"Average degree of circularity" in the invention is determined in the following manner and defined as shown below. Toner base particles are dispersed in a dispersion medium (Isoton II, manufactured by Beckman Coulter Inc.) so as to result in a concentration thereof in the range of 5,720-7,140 particles per μL. This dispersion is examined with a flow-type particle image analyzer (FPIA 2100, manufactured by Sysmex Corp. (former name, TOA Medical Electronics Co., Ltd.)) under the following apparatus conditions. An average of the measured values is defined as the "average degree of circularity". In the invention, the same measurement is conducted thrice, and the arithmetical mean of the three "average degrees of circularity" is taken as the "average degree of circularity".

Mode: HPF

HPF analysis amount: 0.35 μL

Number of HPF-detected particles: 2,000-2,500

The subsequent examination is made within the apparatus, and the average degree of circularity is automatically calculated by the apparatus and displayed. "Degree of circularity" is defined by the following equation.

[Degree of circularity]=[periphery length of circle having the same area as projected particle area]/[periphery length of projected particle image]

In the apparatus, 2,000-2,500 particles, i.e., particles in an HPF detection number, are examined and the arithmetical mean of the degrees of circularity of the individual particles is displayed as the "average degree of circularity" on the apparatus.

<Method of Determining Coefficient of Variation in Number and Definition Thereof>

The coefficient of variation in number is expressed by (standard deviation of particle distribution on number basis)×100/(number-average particle diameter). Particle size distribution and the like in the invention were determined in the following manner.

The coefficient of variation in number of particles was determined with Multisizer III (aperture diameter, 100 μm) (hereinafter abbreviated to "Multisizer"), manufactured by Beckman Coulter, Inc. The "toner dispersion" or "slurry" described above was diluted with Isoton II, manufactured by the same company, as a dispersion medium so as to result in a dispersed-phase concentration of 0.03% by mass, and this dilution was examined with a Multisizer III analysis software (V3.51) using a PD value of 118.5. The range of particle diameters to be examined was set at 2.00-64.00 μm, and this range was discretely divided into 256 sections having the same width on the logarithmic scale. The coefficient of variation in number was calculated from the statistical values for these sections on a number basis.

<Method of Measuring Electrical Conductivity>

Electrical conductivity was measured with a conductivity meter (Personal SC Meter Model SC72 and detector SC72SN-11, manufactured by Yokogawa Electric Corp.) in an ordinary manner according to the instruction manual.

<Method of Determining Melting Point Peak Temperature, Melting Peak Half-Value Width, Crystallization Temperature, and Crystallization Peak Half-Value Width>

Using Type SSC5200, manufactured by Seiko Instruments Inc., a sample was heated from 10° C. to 110° C. at a rate of 10° C./min by the method described in the instruction manual of the same company to obtain an endothermic curve. From the endothermic curve, a melting point peak temperature and a melting peak half-value width were determined. Subsequently, the sample was cooled from 110° C. to 10° C. at a rate of 10° C./min to obtain an exothermic curve, from which a crystallization temperature and a crystallization peak half-value width were determined.

<Method of Determining Solid Concentration>

Solid concentration meter INFRARED MOISTURE DETERMINATIONBALANCE Type FD-100, manufactured by Kett Electric Laboratory, was used. A 1.00-g portion of a sample containing a solid component was precisely weighed out on the balance and examined for solid concentration under the conditions of a heater temperature of 300° C. and a heating time of 90 minutes.

<Method of Determining Charge Amount Distribution (Standard Deviation of Charge Amount)>

Into a sample bottle made of glass were introduced 0.8 g of a toner and 19.2 g of a carrier (ferrite carrier F150, manufactured by Powdertech Co., Ltd.). The contents were stirred at 250 rpm for 30 minutes with reciprocating shaker NR-1 (manufactured by TAITEC Co., Ltd.). The resultant toner/carrier mixture was examined for charge amount distribution with charge amount distribution analyzer E-Spart (manufactured by Hosokawa Micron Corp.). From the data obtained, a value was obtained by dividing the charge amount by the particle diameter with respect to each of individual particles. From the resultant quotients (the range of from −16.197 C/μm to +16.197 C/μm was discretely divided into 128 sections each having a width of 0.2551 C/μm), the standard deviation of the results of examination of 3,000 particles was determined. This deviation was taken as the standard deviation of charge amount.

<Method of Evaluating Quick Electrification>

A sample obtained by mixing 0.4 g of a toner with 9.6 g of a magnetic carrier (ferrite carrier F150, manufactured by Powdertech Co., Ltd.) was introduced into a sample bottle made of glass. This bottle was shaken with a reciprocating shaker (NR-1, manufactured by TAITEC Co., Ltd.). At 1 minute after initiation of the shaking, a 0.1-g portion of the sample was weighed out from the sample bottle and put in a mesh case. This mesh case was set in a given position within a blow-off powder charge amount analyzer (TYPE TB-200, manufactured by Toshiba Chemical Corp.) and examined for the charge amount of the toner. Based on the resultant value for 1-minute sample shaking, the quick-electrification characteristics of the toner were evaluated.

<Method of Measuring Toner Surface Depressions Attributable to Charge Control Agent and Definition Thereof>

"Depressions" in the invention are measured in the following manner and defined as shown below.

One gram of toner powder base particles were added to 10 g of an alcohol (ethanol), and this mixture was stirred with a magnetic stirrer for 1 hour. Thereafter, the mixture was separated into the toner and a solution by suction filtration. The toner remaining on the filter paper was dried at room temperature. The surface of this toner was then examined with an SEM, and images thereof were photographed. The images obtained were analyzed with respect to a depression formed in the toner surface by dissolving the charge control agent. An equivalent-circle diameter was calculated. This equivalent-circle diameter was defined as the diameter of the depression. Ten points were examined for this value, and an average of these values is defined as the "average diameter of depressions" according to the invention.

<Methods of Actual-Printing Evaluation>

Actual-Printing Evaluation 1

Eighty grams of a toner was packed into a cartridge for a 600-dpi machine which was of the nonmagnetic one-component type (employing an organic photoreceptor), roller charging type, developing rubber roller contact development type with a developing speed of 164 mm/sec, tandem type, belt conveyance type, direct transfer type, and blade drum cleaning type and which had a guaranteed life in terms of number of prints of 30,000 sheets at a coverage rate of 5%. A chart having a coverage rate of 1% was continuously printed on 50 sheets.

Actual-Printing Evaluation 2

Two hundred grams of a toner was packed into a cartridge for a 600-dpi machine which was of the nonmagnetic one-component type (employing an organic photoreceptor), roller charging type, developing rubber roller contact development type with a developing speed of 100 mm/sec, tandem type, belt conveyance type, direct transfer type, and blade drum cleaning type and which had a guaranteed life in terms of number of prints of 8,000 sheets at a coverage rate of 5%. A chart having a coverage rate of 5% was continuously printed until the sign indicating "out of toner" was displayed.

<Fouling>

The image obtained after the 50-sheet printing in Actual-Printing Evaluation 1 was visually examined for fouling and rated according to the following criteria.

Excellent: No fouling.

Good: On such a level that the print has been very slightly fouled but is usable.

Fair: The print has been partly fouled slightly.

Poor: Distinct fouling can be partly or entirely observed.

<Residual Image (Ghost)>

A solid image was printed in Actual-Printing Evaluation 2. The image density of a front-end part of the solid image and the image density of the part printed after two turns of the developing roller from the front-end part were measured with X-rite 938 (manufactured By X-Rite Inc.). The ratio (%) of the image density of the part printed after two turns to that of the front-end part was determined.

Excellent: No problem (98% or higher).

Good: On such a level that the print has a very slight difference in image density but is usable (95% or higher, lower than 98%).

Fair: On such a level that a very slight difference in image density can be noticed (85% or higher, lower than 95%).

Poor: On such a level that the image densities clearly differ (lower than 85%).

<Blurring (Suitability for Solid Printing)>

A solid image was printed in Actual-Printing Evaluation 2. The image density of a front-end part of the solid image and the image density of a rear-end part thereof were measured with X-rite 938 (manufactured by X-Rite Inc.). The ratio (%) of the image density of the rear-end part to that of the front-end part was determined.

Excellent: No problem (80% or higher).

Good: On such a level that the rear end is very slightly less dense but the print is usable (70% or higher, lower than 80%).

Poor: On such a level that the rear end is considerably less dense (lower than 70%).

<Removability in Cleaning>

In Actual-Printing Evaluation 2, the image obtained after 8,000-sheet printing was visually examined for fouling to ascertain whether the image had been fouled due to a drum cleaning failure.

Good: No fouling.

Fair: Partly fouled slightly.

Poor: Distinct fouling can be partly or entirely observed.

<Gloss>

A sheet of paper on which a solid image had been printed was set in a given measuring position on a glossmeter (VG2000, manufactured by Nippon Denshoku Kogyo K.K.). Three areas in the solid image were examined for gloss at an incidence angle and a receiving angle both fixed to 75°, and an average value was calculated. A solid image was further printed on another sheet, and the same measurement was made to calculate an average value. An average of these measured values for the two solid images was calculated to thereby obtain a value of gloss.

<Method of Measuring Toner Surface Potential>

A toner was frictionally charged under given conditions used for printing a solid image with the toner on ten sheets. Thereafter, the toner cartridge was rapidly demounted from the image-forming apparatus. Part of the protective cover of the cartridge was removed to expose the OPC drum and the developing roller. The surface of the developing roller was in the state of being wholly coated with the toner. The measuring probe of a surface potential meter (MODEL 344, manufactured by TREK Japan K.K.) was calibrated to adjust the reading to 0 V. Thereafter, the probe was brought close to the developing roller so that the probe was just before contact with the developing roller, and the surface potential of the toner was measured therewith. This measurement was made at three points in total which were located along the axis of the developing roller, i.e., a central part and two end parts. These values were averaged to thereby determine the surface potential of the toner.

Example 1-1

Preparation of Wax/Long-Chain Polymerizable Monomer Dispersion A1

Twenty-seven parts (540 g) of a paraffin wax (HNP-9, manufactured by Nippon Seiro Co., Ltd.: surface tension, 23.5 mN/m: thermal properties; melting point peak temperature, 82° C.; heat of melting, 220 J/g; melting peak half-value width, 8.2° C.; crystallization temperature, 66° C.; crystallization peak half-value width, 13.0° C.), 2.8 parts of stearyl acrylate (manufactured by Tokyo Kasei Co., Ltd.), 1.9 parts of a 20% by mass aqueous solution of sodium dodecylbenzenesulfonate (Neogen S20A, manufactured by Dai-ichi Kogyo Seiyaku Co., Ltd.) (hereinafter abbreviated to "20% aqueous DBS solution"), and 68.3 parts of desalted water were heated to 90° C. and stirred for 10 minutes with a homomixer (Mark II f Model, manufactured by Tokushu Kika Kogyo Co., Ltd.).

Subsequently, the resultant dispersion was heated to 90° C. and subjected to circulating emulsification with a homogenizer (Type 15-M-8PA, manufactured by Gaulin Company) under the high-pressure conditions of 25 MPa. This dispersion operation was conducted while measuring the particle diameter with Nanotrac and continued until the volume-average diameter (Mv) became 250 nm. Thus, a wax/long-chain polymerizable monomer dispersion A1 (emulsion solid concentration=30.2% by mass) was produced.

<Preparation of Primary-Polymer-Particle Dispersion A1>

Into a reaction vessel (capacity, 21 L; inner diameter, 250 mm; height, 420 mm) equipped with a stirrer (three blades), a heating/cooling device, a condenser, and feeders for raw materials/aids were introduced 35.6 parts (712.12 g) of the wax/long-chain polymerizable monomer dispersion A1 and 259 parts of desalted water. The contents were heated to 90° C. with stirring in a nitrogen stream.

Thereafter, while the liquid was being stirred, a mixture of the "polymerizable monomers, etc." and "aqueous emulsifying agent solution" shown below was added thereto over 5 hours. The time at which the mixture began to be added dropwise was taken as "polymerization initiation", and the "aqueous initiator solution" shown below began to be added at 30 minutes after the polymerization initiation and was added over 4.5 hours. Furthermore, the "additional aqueous initiator solution" shown below began to be added at 5 hours after the polymerization initiation and was added over 2 hours. This reaction mixture was held for further 1 hour with continuous stirring while maintaining the internal temperature of 90° C.

[Polymerizable Monomers, etc.]

| | |
|---|---|
| Styrene | 76.8 parts (1,535.0 g) |
| Butyl acrylate | 23.2 parts |
| Acrylic acid | 1.5 parts |
| Hexanediol diacrylate | 0.7 parts |
| Trichlorobromomethane | 1.0 part |

[Aqueous Emulsifying Agent Solution]

| | |
|---|---|
| 20% aqueous DBS solution | 1.0 part |
| Desalted water | 67.1 part |

[Aqueous Initiator Solution]

| | |
|---|---|
| 8% by mass aqueous hydrogen peroxide solution | 15.5 parts |
| 8% by mass aqueous L(+)-ascorbic acid solution | 15.5 parts |

[Additional Aqueous Initiator Solution]

| | |
|---|---|
| 8% by mass aqueous L(+)-ascorbic acid solution | 14.2 parts |

After completion of the polymerization reaction, the reaction mixture was cooled to obtain a primary-polymer-particle dispersion A1, which was milk-white. This dispersion had a volume-average diameter (Mv) as determined with Nanotrac of 280 nm and had a solid concentration of 21.1% by mass.

<Preparation of Primary-Polymer-Particle Dispersion A2>

Into a reaction vessel (capacity, 21 L; inner diameter, 250 mm; height, 420 mm) equipped with a stirrer (three blades), a heating/cooling device, a condenser, and feeders for raw materials/aids were introduced 1.0 part of 20% by mass aqueous DBS solution and 312 parts of desalted water. The contents were heated to 90° C. in a nitrogen stream. While the contents were being stirred, 3.2 parts of 8% by mass aqueous hydrogen peroxide solution and 3.2 parts of 8% by mass aqueous L(+)-ascorbic acid solution were added thereto at a time. The point of time when 5 minutes had passed since the en bloc addition of these ingredients was taken as "polymerization initiation".

A mixture of the "polymerizable monomers, etc." and "aqueous emulsifying agent solution" shown below was added over 5 hours from the polymerization initiation, and the "aqueous initiation solution" shown below was added over 6 hours from the polymerization initiation. Thereafter, the reaction mixture was held for further 1 hour with continuous stirring while maintaining the internal temperature of 90° C.

[Polymerizable Monomers, etc.]

| | |
|---|---|
| Styrene | 92.5 parts (1,850.0 g) |
| Butyl acrylate | 7.5 parts |
| Acrylic acid | 0.5 parts |
| Trichlorobromomethane | 0.5 parts |

[Aqueous Emulsifying Agent Solution]

| | |
|---|---|
| 20% aqueous DBS solution | 1.5 parts |
| Desalted water | 66.0 parts |

[Aqueous Initiator Solution]

| | |
|---|---|
| 8% by mass aqueous hydrogen peroxide solution | 18.9 parts |
| 8% by mass aqueous L(+)-ascorbic acid solution | 18.9 parts |

After completion of the polymerization reaction, the reaction mixture was cooled to obtain a primary-polymer-particle dispersion A2, which was milk-white. This dispersion had a volume-average diameter (Mv) as determined with Nanotrac of 290 nm and had a solid concentration of 19.0% by mass.

<Preparation of Colorant Dispersion A>

Into a vessel having a capacity of 300 L and equipped with a stirrer (propeller blades) were introduced 20 parts (40 μg) of a carbon black produced by the furnace process and having a toluene-extract ultraviolet absorbance of 0.02 and a true density of 1.8 g/cm$^3$ (Mitsubishi Carbon Black MA100S, manufactured by Mitsubishi Chemical Corp.), 1 part of 20% aqueous DBS solution, 4 parts of a nonionic surfactant (Emulgen 120, manufactured by Kao Corp.), and 75 parts of ion-exchanged water having an electrical conductivity of 2 μS/cm. The carbon black was preliminarily dispersed to obtain a pigment premix liquid. In the dispersion obtained through pigment premixing, the carbon black had a volume-average diameter (Mv) as determined with Nanotrac of 90 μm.

The pigment premix liquid was fed as a raw slurry to a wet-type bead mill and subjected to a one-through dispersion process. The mill had a stator inner diameter of 75 mm, a separator diameter of 60 mm, and a separator-to-disk distance of 15 mm, and zirconia beads having a diameter of 100 μm (true density, 6.0 g/cm$^3$) were used as a dispersing medium. The stator had an effective inner volume of 0.5 L, and the medium was packed so as to occupy a volume of 0.35 L. Consequently, the degree of medium packing was 70% by mass. The rotor was rotated at a constant speed (peripheral speed of rotor, 11 m/sec), and the pigment premix liquid was continuously fed through the feed opening with a non-pulsating constant-delivery pump at a feed rate of 50 L/hr and continuously discharged through the discharge opening, whereby a black colorant dispersion A was obtained. This colorant dispersion A had a volume-average diameter (Mv) as determined with Nanotrac of 150 nm and a solid concentration of 24.2% by mass.

<Production of Toner Base Particles A>

The ingredients shown below were used, and the aggregation step (core material aggregation step and shell covering step), rounding step, cleaning step, and drying step shown below were conducted to thereby produce toner base particles A.

Primary-polymer-particle dispersion A1: 95 parts on solid basis (998.2 g in terms of solid amount)

Primary-polymer-particle dispersion A2: 5 parts on solid basis

Colorant dispersion A: 6 parts in terms of colorant solid amount

20% aqueous DBS solution: 0.2 parts on solid basis; used in the core material aggregation step 20% aqueous DBS solution: 6 parts on solid basis; used in the rounding step Core Material Aggregation Step The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the contents were being stirred at 250 rpm at an internal temperature of 7° C., a 5% by mass aqueous solution of ferrous sulfate was added thereto over 5 minutes in an amount of 0.52 parts in terms of $FeSO_4.7H_2O$ amount. Thereafter, the colorant dispersion A was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 54.0° C. while maintaining the rotation speed of 250 rpm, and the particles were grown to a volume-median diameter (Dv50) as determined with Multisizer of 5.32 μm.

Shell Covering Step

Thereafter, the primary-polymer-particle dispersion A2 was added over 3 minutes while maintaining the internal temperature of 54.0° C. and the rotation speed of 250 rpm, and the resultant mixture was held for 60 minutes under these conditions.

Rounding Step

Subsequently, the rotation speed was lowered to 150 rpm (stirring-blade peripheral speed, 1.56 m/sec; stirring speed lower by 40% than the rotation speed used in the aggregation step), and 20% aqueous DBS solution (6 parts on solid basis) was then added over 10 minutes. Thereafter, the mixture was heated to 81° C. over 30 minutes, and heating and stirring were continued under those conditions until the average degree of circularity reached 0.943. This mixture was then cooled to 30° C. over 20 minutes to obtain a slurry.

Cleaning Step

The slurry obtained was discharged and subjected to suction filtration through filter paper 5-shu C (No. 5C, manufactured by Toyo Roshi Kaisha, Ltd.) with an aspirator. The cake remaining on the filter paper was transferred to a stainless-steel vessel having a capacity of 10 L and equipped with a stirrer (propeller blades). Thereto was added 8 μg of ion-exchanged water having an electrical conductivity of 1 μS/cm. The resultant mixture was stirred at 50 rpm to thereby evenly disperse the particles and was then kept being stirred for 30 minutes.

Thereafter, the dispersion was subjected again to suction filtration through filter paper 5-shu C (No. 5C, manufactured by Toyo Roshi Kaisha, Ltd.) with an aspirator. The solid matter remaining on the filter paper was transferred again to a vessel which had a capacity of 10 L and was equipped with a stirrer (propeller blades) and which contained 8 μg of ion-exchanged water having an electrical conductivity of 1 μS/cm, and the resultant mixture was stirred at 50 rpm to thereby evenly disperse the particles and was then kept being stirred for 30 minutes. This step was repeated 5 times. As a result, the electrical conductivity of the filtrate became 2 μS/cm.

Drying Step

The solid matter obtained above was spread in a stainless-steel vat to a height of 20 mm, and dried for 48 hours in an air-blowing drying oven set at 40° C. Thus, toner base particles A were obtained.

<Production of Toner A>

External-Additive Addition Step

To 250 g of the toner base particles A obtained were added 1.55 g of silica H2000, manufactured by Clariant K.K., and 0.62 g of fine titania powder SMT150IB, manufactured by Tayca Corp., as external additives. The ingredients were mixed together by means of a sample mill (manufactured by Kyoritsu Riko Co.) at 6,000 rpm for 1 minute, and the resultant mixture was sieved with a 150-mesh sieve to obtain a toner A.

Analysis Step

The toner A obtained above had a "volume-median diameter (Dv50)" and a "population number % of toner particles having a particle diameter of from 2.00 μm to 3.56 μm (Dns)", both determined with Multisizer, of 5.54 μm and 3.83%, respectively. The toner A further had an average degree of circularity of 0.943 and a coefficient of variation in number of 18.6%.

Example 1-2

Production of Toner Base Particles B

Toner base particles B were obtained by conducting the same procedure as in "Production of Toner Base Particles A" of Example 1-1, except that "Core Material Aggregation Step", "Shell Covering Step", and "Rounding Step", among the aggregation step (core material aggregation step and shell covering step), rounding step, cleaning step, and drying step in "Production of Toner Base Particles A", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the internal temperature was kept at 7° C. and the contents were being stirred at 250 rpm, a 5% by mass aqueous solution of ferrous sulfate was added thereto over 5 minutes in an amount of 0.52 parts in terms of $FeSO_4.7H_2O$ amount. Thereafter, the colorant dispersion A was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 55.0° C. while maintaining the rotation speed of 250 rpm, and the particles were grown to a volume-median diameter (Dv50) as determined with Multisizer of 5.86 μm.

Shell Covering Step

Thereafter, the primary-polymer-particle dispersion A2 was added over 3 minutes while maintaining the internal temperature of 55.0° C. and the rotation speed of 250 rpm, and the resultant mixture was held for 60 minutes under these conditions.

Rounding Step

Subsequently, the rotation speed was lowered to 150 rpm (stirring-blade peripheral speed, 1.56 msec; stirring speed lower by 40% than the rotation speed used in the aggregation step), and 20% aqueous DBS solution (6 parts on solid basis) was then added over 10 minutes. Thereafter, the mixture was heated to 84° C. over 30 minutes, and heating and stirring were continued until the average degree of circularity reached 0.942. This mixture was then cooled to 30° C. over 20 minutes to obtain a slurry.

<Production of Toner B>

Thereafter, the toner base particles B were subjected to the same external-additive addition step as in "Production of Toner A", except that the amount of the silica H2000 as an external additive was changed to 1.41 g and the amount of the fine titania powder SMT150IB as another external additive was changed to 0.56 g. Thus, a toner B was obtained.

Analysis Step

The toner B obtained above had a volume-median diameter (Dv50) and a "population number % of toner particles having a particle diameter of from 2.00 μm to 3.56 μm (Dns)", both determined with Multisizer, of 5.97 μm and 2.53%, respectively. The toner B further had an average degree of circularity of 0.943 and a coefficient of variation in number of 18.4%.

Example 1-3

Production of Toner Base Particles C

Toner base particles C were obtained by conducting the same procedure as in "Production of Toner Base Particles A" of Example 1-1, except that "Core Material Aggregation Step", "Shell Covering Step", and "Rounding Step", among the aggregation step (core material aggregation step and shell covering step), rounding step, cleaning step, and drying step in "Production of Toner Base Particles A", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the internal temperature was kept at 7° C. and the contents were being stirred at 250 rpm, a 5% by mass aqueous solution of ferrous sulfate was added thereto over 5 minutes in an amount of 0.52 parts in terms of $FeSO4.7H_2O$ amount. Thereafter, the colorant dispersion A was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 57.0° C. while maintaining the rotation speed of 250 rpm, and the particles were grown to a volume-median diameter (Dv50) as determined with Multisizer of 6.72 μm.

Shell Covering Step

Thereafter, the primary-polymer-particle dispersion A2 was added over 3 minutes while maintaining the internal temperature of 57.0° C. and the rotation speed of 250 rpm, and the resultant mixture was held for 60 minutes under these conditions.

Rounding Step

Subsequently, the rotation speed was lowered to 150 rpm (stirring-blade peripheral speed, 1.56 m/sec; stirring speed lower by 40% than the rotation speed used in the aggregation step), and 20% aqueous DBS solution (6 parts on solid basis) was then added over 10 minutes. Thereafter, the mixture was heated to 87° C. over 30 minutes, and heating and stirring were continued until the average degree of circularity reached 0.941. This mixture was then cooled to 30° C. over 20 minutes to obtain a slurry.

<Production of Toner C>

Thereafter, the toner base particles C were subjected to the same external-additive addition step as in "Production of Toner A", except that the amount of the silica H2000 as an external additive was changed to 1.25 g and the amount of the fine titania powder SMT150IB as another external additive was changed to 0.50 g. Thus, a toner C was obtained.

Analysis Step

The toner C obtained above had a volume-median diameter (Dv50) and a "population number % of toner particles having a particle diameter of from 2.00 μm to 3.56 μm (Dns)", both determined with Multisizer, of 6.75 μm and 1.83%, respectively. The toner C further had an average degree of circularity of 0.942 and a coefficient of variation in number of 18.7%.

Example 1-4

Production of Toner Base Particles D

Toner base particles D were obtained by conducting the same procedure as in "Production of Toner Base Particles A" of Example 1-1, except that "Core Material Aggregation Step", "Shell Covering Step", and "Rounding Step", among the aggregation step (core material aggregation step and shell covering step), rounding step, cleaning step, and drying step in "Production of Toner Base Particles A", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the internal temperature was kept at 21° C. and the contents were being stirred at 250 rpm, a 5% by mass aqueous solution of ferrous sulfate was added thereto over 5 minutes in an amount of 0.52 parts in terms of $FeSO_4.7H_2O$ amount. Thereafter, the colorant dispersion A was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 54.0° C. while maintaining the rotation speed of 250 rpm, and the particles were grown to a volume-median diameter (Dv50) as determined with Multisizer of 5.34

Shell Covering Step

Thereafter, the primary-polymer-particle dispersion A2 was added over 3 minutes while maintaining the internal temperature of 54.0° C. and the rotation speed of 250 rpm, and the resultant mixture was held for 60 minutes under these conditions.

Rounding Step

Subsequently, the rotation speed was lowered to 220 rpm (stirring-blade peripheral speed, 2.28 m/sec; stirring speed lower by 12% than the rotation speed used in the aggregation step), and 20% aqueous DBS solution (6 parts on solid basis) was then added over 10 minutes. Thereafter, the mixture was heated to 81° C. over 30 minutes, and heating and stirring were continued until the average degree of circularity reached 0.942. This mixture was then cooled to 30° C. over 20 minutes to obtain a slurry.

<Production of Toner D>

Thereafter, the toner base particles D were subjected to the same external-additive addition step as in "Production of Toner A" of Example 1-1. Thus, a toner D was obtained.

Analysis Step

The toner D obtained above had a volume-median diameter (Dv50) and a "population number % of toner particles having a particle diameter of from 2.00 μm to 3.56 μm (Dns)", both determined with Multisizer, of 5.48 μm and 4.51%, respectively. The toner D further had an average degree of circularity of 0.943 and a coefficient of variation in number of 20.4%.

Example 1-5

Production of Toner Base Particles E

Toner base particles E were obtained by conducting the same procedure as in "Production of Toner Base Particles A" of Example 1-1, except that "Core Material Aggregation Step", "Shell Covering Step", and "Rounding Step", among the aggregation step (core material aggregation step and shell covering step), rounding step, cleaning step, and drying step in "Production of Toner Base Particles A", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the internal temperature was kept at 21° C. and the contents were being stirred at 250 rpm, a 5% by mass aqueous solution of ferrous sulfate was added thereto over 5 minutes in an amount of 0.52 parts in terms of $FeSO_4.7H_2O$ amount. Thereafter, the colorant dispersion A was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 55.0° C. while maintaining the rotation speed of 250 rpm, and the particles were grown to a volume-median diameter (Dv50) as determined with Multisizer of 5.86 μm.

Shell Covering Step

Thereafter, the primary-polymer-particle dispersion A2 was added over 3 minutes while maintaining the internal temperature of 55.0° C. and the rotation speed of 250 rpm, and the resultant mixture was held for 60 minutes under these conditions.

Rounding Step

Subsequently, the rotation speed was lowered to 220 rpm (stirring-blade peripheral speed, 2.28 msec; stirring speed lower by 12% than the rotation speed used in the aggregation step), and 20% aqueous DBS solution (6 parts on solid basis) was then added over 10 minutes. Thereafter, the mixture was heated to 84° C. over 30 minutes, and heating and stirring were continued until the average degree of circularity reached 0.941. This mixture was then cooled to 30° C. over 20 minutes to obtain a slurry.

<Production of Toner E>

Thereafter, the toner base particles E were subjected to the same external-additive addition step as in "Production of Toner A", except that the amount of the silica H2000 as an external additive was changed to 1.41 g and the amount of the fine titania powder SMT150IB as another external additive was changed to 0.56 g. Thus, a toner E was obtained.

Analysis Step

The toner E for development obtained above had a volume-median diameter (Dv50) and a "population number % of toner particles having a particle diameter of from 2.00 μm to 3.56 μm (Dns)", both determined with Multisizer, of 5.93 μm and 3.62%, respectively. The toner E further had an average degree of circularity of 0.942 and a coefficient of variation in number of 20.1%.

Example 1-6

Production of Toner Base Particles F

Toner base particles F were obtained by conducting the same procedure as in "Production of Toner Base Particles A" of Example 1-1, except that "Core Material Aggregation Step", "Shell Covering Step", and "Rounding Step", among the aggregation step (core material aggregation step and shell covering step), rounding step, cleaning step, and drying step in "Production of Toner Base Particles A", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the internal temperature was kept at 21° C. and the contents were being stirred at 250 rpm, a 5% by mass aqueous solution of ferrous sulfate was added thereto over 5 minutes in an amount of 0.52 parts in terms of $FeSO_4.7H_2O$ amount. Thereafter, the colorant dispersion A was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 57.0° C. while maintaining the rotation speed of 250 rpm, and the particles were grown to a volume-median diameter (Dv50) as determined with Multisizer of 6.76 μm.

Shell Covering Step

Thereafter, the primary-polymer-particle dispersion A2 was added over 3 minutes while maintaining the internal temperature of 57.0° C. and the rotation speed of 250 rpm, and the resultant mixture was held for 60 minutes under these conditions.

Rounding Step

Subsequently, the rotation speed was lowered to 220 rpm (stirring-blade peripheral speed, 2.28 msec; stirring speed lower by 12% than the rotation speed used in the aggregation step), and 20% aqueous DBS solution (6 parts on solid basis) was then added over 10 minutes. Thereafter, the mixture was heated to 87° C. over 30 minutes, and heating and stirring were continued until the average degree of circularity reached 0.941. This mixture was then cooled to 30° C. over 20 minutes to obtain a slurry.

<Production of Toner F>

Thereafter, the toner base particles F were subjected to the same external-additive addition step as in "Production of Toner A", except that the amount of the silica H2000 as an external additive was changed to 1.25 g and the amount of the fine titania powder SMT1501IB as another external additive was changed to 0.50 g. Thus, a toner F was obtained.

Analysis Step

The toner F obtained above had a volume-median diameter (Dv50) and a "population number % of toner particles having a particle diameter of from 2.00 μm to 3.56 μm (Dns)", both determined with Multisizer, of 6.77 μm and 2.48%, respectively. The toner F further had an average degree of circularity of 0.942 and a coefficient of variation in number of 21.1%.

Comparative Example 1-1

Production of Toner Base Particles G

Toner base particles G were obtained by conducting the same procedure as in "Production of Toner Base Particles A"

of Example 1-1, except that "Core Material Aggregation Step", "Shell Covering Step", and "Rounding Step", among the aggregation step (core material aggregation step and shell covering step), rounding step, cleaning step, and drying step in "Production of Toner Base Particles A", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the internal temperature was kept at 21° C. and the contents were being stirred at 250 rpm, a 5% by mass aqueous solution of ferrous sulfate was added thereto at a time over 5 minutes in an amount of 0.52 parts in terms of $FeSO_4.7H_2O$ amount. Thereafter, the colorant dispersion A was added at a time over 5 minutes, and the contents were evenly mixed at an internal temperature of 7° C. Furthermore, under the same conditions, 0.5% by mass aqueous aluminum sulfate solution was added at a time over 8 seconds (0.10 part in terms of solid amount based on solid resin amount). Thereafter, the internal temperature was elevated to 57.0° C. while maintaining the rotation speed of 250 rpm, and the particles were grown to a volume-median diameter (Dv50) as determined with Multisizer of 6.85 μm.

Shell Covering Step

Thereafter, the primary-polymer-particle dispersion A2 was added at a time over 3 minutes while maintaining the internal temperature of 57.0° C. and the rotation speed of 250 rpm, and the resultant mixture was held for 60 minutes under these conditions.

Rounding Step

Subsequently, the rotation speed was kept unchanged at 250 rpm (stirring-blade peripheral speed, 2.59 m/sec; the same stirring speed as the rotation speed used in the aggregation step), and 20% aqueous DBS solution (6 parts on solid basis) was added over 10 minutes. Thereafter, the mixture was heated to 87° C. over 30 minutes, and heating and stirring were continued under those conditions until the average degree of circularity reached 0.942. This mixture was then cooled to 30° C. over 20 minutes to obtain a slurry.

<Production of Toner G>

Thereafter, the toner base particles G were subjected to the same external-additive addition step as in "Production of Toner A", except that the amount of the silica H2000 as an external additive was changed to 1.25 g and the amount of the fine titania powder SMT150IB as another external additive was changed to 0.50 g. Thus, a toner G was obtained.

Analysis Step

The toner G for development obtained above had a volume-median diameter (Dv50) and a "population number % of toner particles having a particle diameter of from 2.00 μm to 3.56 μm (Dns)", both determined with Multisizer, of 6.79 μm and 4.52%, respectively. The toner G further had an average degree of circularity of 0.943 and a coefficient of variation in number of 24.5%.

The toners A to G were evaluated for "fouling" by the method described hereinabove under "Actual-Printing Evaluation 1". The results thereof are also shown in Table 2.

TABLE 2

| No. | Toner | Rotation speed (stirring-blade peripheral speed) in rounding step | Volume-median diameter (Dv50) (μm) | Average degree of circularity | 0.233exp (17.3/Dv) | Dns (%) | Coefficient of variation in number (%) | Charge amount distribution (standard deviation of charge amount) | Fouling |
|---|---|---|---|---|---|---|---|---|---|
| Example 1-1 | A | 150 rpm | 5.54 | 0.943 | 5.29 | 3.83 | 18.6 | 1.64 | — |
| Example 1-2 | B | (1.56 m/sec) | 5.97 | 0.943 | 4.23 | 2.53 | 18.4 | 1.66 | — |
| Example 1-3 | C | | 6.75 | 0.942 | 3.02 | 1.83 | 18.7 | 1.68 | excellent |
| Example 1-4 | D | 220 rpm | 5.48 | 0.943 | 5.48 | 4.51 | 20.4 | 1.94 | — |
| Example 1-5 | E | (2.28 m/sec) | 5.93 | 0.942 | 4.31 | 3.62 | 20.1 | 1.91 | — |
| Example 1-6 | F | | 6.77 | 0.942 | 3.00 | 2.48 | 21.1 | 1.92 | good |
| Comparative Example 1-1 | G | 250 rpm (2.59 m/sec) | 6.79 | 0.943 | 2.98 | 4.52 | 24.5 | 2.60 | poor |

As apparent from the results given in Table 2, the toners A to F, which satisfy expression (1) or (5), were actually produced by the production processes shown in Examples 1-1 to 1-6. All of the toners A to F, which satisfy expression (1) or (5), had a sufficiently small standard deviation of charge amount and a narrow charge amount distribution. In the actual-printing evaluation also, no fouling was observed or the print was on such a level that the print had been very slightly fouled but was usable (Example 1-3 and Example 1-6).

On the other hand, the toner G, which does not satisfy expression (1) or (5), had a large standard deviation of charge amount and did not have a narrow charge amount distribution. In the actual-printing evaluation also, distinct fouling was able to be entirely observed (Comparative Example 1-1).

Example 2-1

Preparation of Wax/Long-Chain Polymerizable Monomer Dispersion H1

Twenty-seven parts (540 g) of a paraffin wax (HNP-9, manufactured by Nippon Seiro Co., Ltd.: surface tension, 23.5 mN/m: thermal properties; melting point peak temperature, 82° C.; melting peak half-value width, 8.2° C.; crystallization temperature, 66° C.; crystallization peak half-value width, 13.0° C.), 2.8 parts of stearyl acrylate (manufactured by Tokyo Kasei Co., Ltd.), 1.9 parts of 20% aqueous DBS solution, and 68.3 parts of desalted water were heated to 90° C. and stirred for 10 minutes with a homomixer (Mark II f Model, manufactured by Tokushu Kika Kogyo Co., Ltd.).

Subsequently, the resultant dispersion was heated to 90° C. and subjected to circulating emulsification with a homogenizer (Type 15-M-8PA, manufactured by Gaulin Company) under the high-pressure conditions of 25 MPa. This dispersion operation was conducted while measuring the particle diameter with Nanotrac and continued until the volume-average diameter (Mv) became 250 nm. Thus, a wax/long-chain polymerizable monomer dispersion H1 (emulsion solid concentration=30.2% by mass) was produced.

<Preparation of Primary-Polymer-Particle Dispersion H1>

Into a reaction vessel (capacity, 21 L; inner diameter, 250 mm; height, 420 mm) equipped with a stirrer (three blades), a heating/cooling device, and feeders for raw materials/aids were introduced 35.6 parts (712.12 g) of the wax/long-chain polymerizable monomer dispersion H1 and 259 parts of desalted water. The contents were heated to 90° C. with stirring in a nitrogen stream.

Thereafter, while the liquid was being stirred, a mixture of the "polymerizable monomers, etc." and "aqueous emulsifying agent solution" shown below was added thereto over 5 hours. The time at which the mixture began to be added dropwise was taken as "polymerization initiation", and the "aqueous initiator solution" shown below began to be added at 30 minutes after the polymerization initiation and was added over 4.5 hours. Furthermore, the "additional aqueous initiator solution" shown below began to be added at 5 hours after the polymerization initiation and was added over 2 hours. This reaction mixture was held for further 1 hour with continuous stirring while maintaining the internal temperature of 90° C.

[Polymerizable Monomers, etc.]

| | |
|---|---|
| Styrene | 76.8 parts (1,535.0 g) |
| Butyl acrylate | 23.2 parts |
| Acrylic acid | 1.5 parts |
| Hexanediol diacrylate | 0.7 parts |
| Trichlorobromomethane | 1.0 part |

[Aqueous Emulsifying Agent Solution]

| | |
|---|---|
| 20% aqueous DBS solution | 1.0 part |
| Desalted water | 67.1 part |

[Aqueous Initiator Solution]

| | |
|---|---|
| 8% by mass aqueous hydrogen peroxide solution | 15.5 parts |
| 8% by mass aqueous L(+)-ascorbic acid solution | 15.5 parts |

[Additional Aqueous Initiator Solution]

| | |
|---|---|
| 8% by mass aqueous L(+)-ascorbic acid solution | 14.2 parts |

After completion of the polymerization reaction, the reaction mixture was cooled to obtain a primary-polymer-particle dispersion H1, which was milk-white. This dispersion had a volume-average diameter (Mv) as determined with Nanotrac of 265 nm and had a solid concentration of 22.3% by mass.

<Preparation of Silicone Wax Dispersion H2>

Into a 3-L stainless-steel vessel were introduced 27 parts (540 g) of an alkyl-modified silicone wax (thermal properties: melting point peak temperature, 77° C.; heat of melting, 97 J/g; melting peak half-value width, 10.9° C.; crystallization temperature, 61° C.; crystallization peak half-value width, 17.0° C.), 1.9 parts of 20% aqueous DBS solution, and 71.1 part of desalted water. The contents were heated to 90° C. and stirred for 10 minutes with a homomixer (Mark H f Model, manufactured by Tokushu Kika Kogyo Co., Ltd.). Subsequently, the resultant dispersion was heated to 99° C. and subjected to circulating emulsification with a homogenizer (Type 15-M-8PA, manufactured by Gaulin Company) under the high-pressure conditions of 45 MPa. This dispersion operation was conducted while measuring the particle diameter with Nanotrac and continued until the volume-average diameter (Mv) became 240 nm. Thus, a silicone wax dispersion H2 (emulsion solid concentration=27.3%) was produced.

<Preparation of Primary-Polymer-Particle Dispersion H2>

Into a reaction vessel (capacity, 21 L; inner diameter, 250 mm; height, 420 mm) equipped with a stirrer (three blades), a heating/cooling device, and feeders for raw materials/aids were introduced 23.3 parts (466 g) of the silicone wax dispersion H2, 1.0 part of 20% aqueous DBS solution, and 324 parts of desalted water. The contents were heated to 90° C. in a nitrogen stream. While the contents were being stirred, 3.2 parts of 8% aqueous hydrogen peroxide solution and 3.2 parts of 8% aqueous L(+)-ascorbic acid solution were added thereto at a time. The point of time when 5 minutes had passed since the en bloc addition of these ingredients was taken as "polymerization initiation".

A mixture of the "polymerizable monomers, etc." and "aqueous emulsifying agent solution" shown below was added over 5 hours from the polymerization initiation, and the "aqueous initiation solution" shown below was added over 6 hours from the polymerization initiation. Thereafter, the reaction mixture was held for further 1 hour with continuous stirring while maintaining the internal temperature of 90° C.

[Polymerizable Monomers, etc.]

| | |
|---|---|
| Styrene | 92.5 parts (1,850.0 g) |
| Butyl acrylate | 7.5 parts |
| Acrylic acid | 1.5 parts |
| Trichlorobromomethane | 0.6 parts |

[Aqueous Emulsifying Agent Solution]

| | |
|---|---|
| 20% aqueous DBS solution | 1.0 part |
| Desalted water | 67.0 parts |

[Aqueous Initiator Solution]

| | |
|---|---|
| 8% by mass aqueous hydrogen peroxide solution | 18.9 parts |
| 8% by mass aqueous L(+)-ascorbic acid solution | 18.9 parts |

After completion of the polymerization reaction, the reaction mixture was cooled to obtain a primary-polymer-particle dispersion H2, which was milk-white. This dispersion had a volume-average diameter (Mv) as determined with Nanotrac of 290 nm and had a solid concentration of 19.0% by mass.

<Preparation of Colorant Dispersion H>

Into a vessel having a capacity of 300 L and equipped with a stirrer (propeller blades) were introduced 20 parts (40 μg) of a carbon black produced by the furnace process and having a toluene-extract ultraviolet absorbance of 0.02 and a true density of 1.8 g/cm$^3$ (Mitsubishi Carbon Black MA100S, manufactured by Mitsubishi Chemical Corp.), 1 part of 20% aqueous DBS solution, 4 parts of a nonionic surfactant (Emulgen 120, manufactured by Kao Corp.), and 75 parts of ion-exchanged water having an electrical conductivity of 2 μS/cm. The carbon black was preliminarily dispersed to obtain a pigment premix liquid. In the dispersion obtained through pigment premixing, the carbon black had a volume-average diameter (Mv) as determined with Nanotrac of 90 μm.

The pigment premix liquid was fed as a raw slurry to a wet-type bead mill and subjected to a one-through dispersion process. The mill had a stator inner diameter of 75 mm, a separator diameter of 60 mm, and a separator-to-disk distance of 15 mm, and zirconia beads having a diameter of 100 μm (true density, 6.0 g/cm$^3$) were used as a dispersing medium. The stator had an effective inner volume of 0.5 L, and the medium was packed so as to occupy a volume of 0.35 L. Consequently, the degree of medium packing was 70% by mass. The rotor was rotated at a constant speed (peripheral speed of rotor, 11 m/sec), and the pigment premix liquid was continuously fed through the feed opening with a non-pulsating constant-delivery pump at a feed rate of 50 L/hr and continuously discharged through the discharge opening, whereby a black colorant dispersion H was obtained. This colorant dispersion H had a volume-average diameter (Mv) as determined with Nanotrac of 150 nm and a solid concentration of 24.2% by mass.

<Production of Toner Base Particles H>

The ingredients shown below were used, and the aggregation step (core material aggregation step and shell covering step), rounding step, cleaning step, and drying step shown below were conducted to thereby produce toner base particles H.

Primary-polymer-particle dispersion H1: 90 parts on solid basis (958.9 g in terms of solid amount)

Primary-polymer-particle dispersion H2: 10 parts on solid basis

Colorant dispersion H, 4.4 parts in terms of colorant solid amount

20% aqueous DBS solution: 0.15 parts on solid basis; used in the core material aggregation step 20% aqueous DBS solution: 6 parts on solid basis; used in the rounding step Core Material Aggregation Step The primary-polymer-particle dispersion H1 and 20% aqueous DBS solution were introduced into a mixing vessel (capacity, 12 L; inner diameter, 208 mm; height, 355 mm) equipped with a stirrer (double-helical blade), a heating/cooling device, and feeders for raw materials/aids. The contents were evenly mixed for 10 minutes at an internal temperature of 10° C. Subsequently, while the contents were being stirred at 280 rpm at an internal temperature of 10° C., a 5% by mass aqueous solution of potassium sulfate was continuously added thereto over 1 minute in an amount of 0.12 parts in terms of $P_2SO_4$ amount. Thereafter, the colorant dispersion H was continuously added over 5 minutes, and the contents were evenly mixed at an internal temperature of 10° C.

Thereafter, 100 parts of desalted water was continuously added over 30 minutes, and the internal temperature was elevated to 48.0° C. over 67 minutes (0.5° C./min) while maintaining the rotation speed of 280 rpm. Subsequently, the temperature was elevated by 1° C. at intervals of 30 minutes (0.03° C./min), and the dispersion was then held at 54.0° C. While the volume-median diameter (Dv50) of the particles was being determined with Multisizer, the particles were grown to 5.15 μm.

The stirring conditions used in this operation are as follows.

(a) Diameter of the stirring vessel (regarded as general cylinder): 208 mm.

(b) Height of the stirring vessel: 355 mm.

(c) Stirring-blade peripheral speed: 280 rpm, i.e., 2.78 m/sec.

(d) Shape of the stirring blades: double-helical blade (diameter, 190 mm; height, 270 mm; width, 20 mm).

(e) Blade position in the stirring vessel: disposed above the bottom of the vessel at a distance of 5 mm therefrom.

Shell Covering Step

Thereafter, the primary-polymer-particle dispersion H2 was continuously added over 6 minutes while maintaining the internal temperature of 54.0° C. and the rotation speed of 280 rpm, and the resultant mixture was held for 60 minutes under these conditions. In the resultant dispersion, the particles had a Dv50 of 5.34 μm.

Rounding Step

Subsequently, the dispersion was heated to 83° C. while an aqueous solution prepared by mixing 20% aqueous DBS solution (6 parts on solid basis) with 0.04 parts of water was being added thereto over 30 minutes. Thereafter, the mixture was heated to 88° C. by elevating the temperature thereof by 1° C. at intervals of 30 minutes, and heating and stirring were continued under these conditions over 3.5 hours until the average degree of circularity reached 0.939. Thereafter, the mixture was cooled to 20° C. over 10 minutes to obtain a slurry. In this slurry, the particles had a Dv50 of 5.33 μm and an average degree of circularity of 0.937.

Cleaning Step

The slurry obtained was discharged and subjected to suction filtration through filter paper 5-shu C (No. 5C, manufactured by Toyo Roshi Kaisha, Ltd.) with an aspirator. The cake remaining on the filter paper was transferred to a stainless-steel vessel having a capacity of 10 L and equipped with a stirrer (propeller blades). Thereto was added 8 μg of ion-exchanged water having an electrical conductivity of 1 μS/cm. The resultant mixture was stirred at 50 rpm to thereby evenly disperse the particles and was then kept being stirred for 30 minutes.

Thereafter, the dispersion was subjected again to suction filtration through filter paper 5-shu C (No. 5C, manufactured by Toyo Roshi Kaisha, Ltd.) with an aspirator. The solid matter remaining on the filter paper was transferred again to a vessel which had a capacity of 10 L and was equipped with a stirrer (propeller blades) and which contained 8 μg of ion-exchanged water having an electrical conductivity of 1 μS/cm, and the resultant mixture was stirred at 50 rpm to thereby evenly disperse the particles and was then kept being stirred for 30 minutes. This step was repeated 5 times. As a result, the electrical conductivity of the filtrate became 2 μS/cm.

Drying Step

The solid matter obtained above was spread in a stainless-steel vat to a height of 20 mm, and dried for 48 hours in an air-blowing drying oven set at 40° C. Thus, toner base particles H were obtained.

<Production of Toner H>

External-Additive Addition Step

To 500 g of the toner base particles H obtained was added 8.75 g of silica H30TD, manufactured by Clariant K.K., as an external additive. The ingredients were mixed together by means of a 9-L Henschel mixer (manufactured by Mitsui Mining Co., Ltd.) at 3,000 rpm for 30 minutes. Thereafter, 1.4 g of calcium phosphate HAP-05NP, manufactured by Maruo Calcium Co., Ltd., was added thereto, and the ingredients were mixed together at 3,000 rpm for 10 minutes. The resultant mixture was sieved through a 200-mesh sieve to obtain a toner H.

Analysis Step

The toner H obtained above had a "volume-median diameter (Dv50)" and a "population number % of toner particles having a particle diameter of from 2.00 μm to 3.56 μm (Dns)", both determined with Multisizer, of 5.26 μm and 5.87%, respectively. The toner H further had an average degree of circularity of 0.948 and a coefficient of variation in number of 18.0%.

Example 2-2

Production of Toner Base Particles I

Toner base particles I were obtained by conducting the same procedure as in "Production of Toner Base Particles H" of Example 2-1, except that "Core Material Aggregation Step", "Shell Covering Step", and "Rounding Step", among the aggregation step (core material aggregation step and shell covering step), rounding step, cleaning step, and drying step in "Production of Toner Base Particles H", were changed as shown below.

Core Material Aggregation Step

The primary-polymer-particle dispersion H1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 10° C. Subsequently, while the contents were being stirred at 280 rpm at an internal temperature of 10° C., 0.12 parts of a 5% by mass aqueous solution of potassium sulfate was continuously added thereto over 1 minute. Thereafter, the colorant dispersion H was continuously added over 5 minutes, and the contents were evenly mixed at an internal temperature of 10° C. Thereafter, 100 parts of desalted water was continuously added over 26 minutes, and the internal temperature was then elevated to 52.0° C. over 64 minutes (0.5° C./min) while maintaining the rotation speed of 280 rpm. Subsequently, the temperature was elevated by 1° C. over 30 minutes (0.03° C./min), and the dispersion was then held for 110 minutes. While the volume-median diameter (Dv50) of the particles was being determined with Multisizer, the particles were grown to 5.93 μm. The stirring conditions used in this operation were the same as in Example 2-1.

Shell Covering Step

Thereafter, the primary-polymer-particle dispersion H2 was continuously added over 6 minutes while maintaining the internal temperature of 53.0° C. and the rotation speed of 280 rpm, and the resultant mixture was held for 90 minutes under these conditions. In the resultant dispersion, the particles had a Dv50 of 6.23 μm.

Rounding Step

Subsequently, the dispersion was heated to 85° C. while an aqueous solution prepared by mixing 20% aqueous DBS solution (6 parts on solid basis) with 0.04 parts of water was being added thereto over 30 minutes. Thereafter, the mixture was heated to 92° C. over 130 minutes, and heating and stirring were continued under these conditions until the average degree of circularity reached 0.943. Thereafter, the mixture was cooled to 20° C. over 10 minutes to obtain a slurry. In this slurry, the particles had a Dv50 of 6.17 μm and an average degree of circularity of 0.945. Cleaning, drying, and external-additive addition steps were conducted in the same manners as in Example 2-1.

External-Additive Addition Step

To 500 g of the toner base particles I obtained was added 7.5 g of silica H30TD, manufactured by Clariant K.K., as an external additive. The ingredients were mixed together by means of a 9-L Henschel mixer (manufactured by Mitsui Mining Co., Ltd.) at 3,000 rpm for 30 minutes. Thereafter, 1.2 g of calcium phosphate HAP-05NP, manufactured by Maruo Calcium Co., Ltd., was added thereto, and the ingredients were mixed together at 3,000 rpm for 10 minutes. The resultant mixture was sieved through a 200-mesh sieve to obtain a toner I.

Analysis Step

The toner I obtained above had a "volume-median diameter (Dv50)" and a "population number % of toner particles having a particle diameter of from 2.00 μm to 3.56 μm (Dns)", both determined with Multisizer, of 6.16 μm and 2.79%, respectively. The toner I further had an average degree of circularity of 0.946 and a coefficient of variation in number of 19.2%.

Example 2-3

Production of Toner Base Particles J

Toner base particles J were obtained by conducting the same procedure as in "Production of Toner Base Particles H" of Example 2-1, except that "Core Material Aggregation Step", "Shell Covering Step", and "Rounding Step", among the aggregation step (core material aggregation step and shell covering step), rounding step, cleaning step, and drying step in "Production of Toner Base Particles H", were changed as shown below.

Core Material Aggregation Step

The primary-polymer-particle dispersion H1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 10 minutes at an internal temperature of 10° C. Subsequently, while the contents were being stirred at 280 rpm at an internal temperature of 10° C., 0.12 parts of a 5% by mass aqueous solution of potassium sulfate was continuously added thereto over 1 minute. Thereafter, the colorant dispersion H was continuously added over 5 minutes, and the contents were evenly mixed at an internal temperature of 10° C. Thereafter, 0.5 parts of desalted water was continuously added over 26 minutes, and the internal temperature was then elevated to 52.0° C. over 64 minutes (0.5° C./min) while maintaining the rotation speed of 280 rpm. Subsequently, the temperature was elevated by 1° C. over 30 minutes (0.03° C./min), and the dispersion was then held for 130 minutes. While the volume-median diameter (Dv50) of the particles was being determined with Multisizer, the particles were grown to 6.60 μm. The stirring conditions used in this operation were the same as in Example 2-1.

Shell Covering Step

Thereafter, the primary-polymer-particle dispersion H2 was continuously added over 6 minutes while maintaining the internal temperature of 53.0° C. and the rotation speed of 280 rpm, and the resultant mixture was held for 60 minutes under these conditions. In the resultant dispersion, the particles had a Dv50 of 6.93 μm.

Rounding Step

Subsequently, the dispersion was heated to 90° C. while an aqueous solution prepared by mixing 20% aqueous DBS solution (6 parts on solid basis) with 0.04 parts of water was being added thereto over 30 minutes. Thereafter, the mixture was heated to 97° C. over 60 minutes, and heating and stirring were continued under these conditions until the average degree of circularity reached 0.945. Thereafter, the mixture was cooled to 20° C. over 10 minutes to obtain a slurry. In this slurry, the particles had a Dv50 of 6.93 μm and an average degree of circularity of 0.945. Cleaning and drying steps were conducted in the same manners as in Example 2-1.

External-Additive Addition Step

To 500 g of the toner base particles J obtained was added 6.25 g of silica H30TD, manufactured by Clariant K.K., as an external additive. The ingredients were mixed together by means of a 9-L Henschel mixer (manufactured by Mitsui Mining Co., Ltd.) at 3,000 rpm for 30 minutes. Thereafter, 1.0 g of calcium phosphate HAP-05NP, manufactured by Maruo Calcium Co., Ltd., was added thereto, and the ingredients were mixed together at 3,000 rpm for 10 minutes. The resultant mixture was sieved through a 200-mesh sieve to obtain a toner J.

Analysis Step

The toner J obtained above had a "volume-median diameter (Dv50)" and a "population number % of toner particles having a particle diameter of from 2.00 μm to 3.56 μm (Dns)", both determined with Multisizer, of 6.97 μm and 1.85%, respectively. The toner J further had an average degree of circularity of 0.946 and a coefficient of variation in number of 19.5%.

Comparative Example 2-1

Production of Toner Base Particles K

Toner base particles K were obtained by conducting the same procedure as in "Production of Toner Base Particles H" of Example 2-1, except that "Core Material Aggregation Step", "Shell Covering Step", and "Rounding Step", among the aggregation step (core material aggregation step and shell covering step), rounding step, cleaning step, and drying step in "Production of Toner Base Particles H", were changed as shown below.

Core Material Aggregation Step

The primary-polymer-particle dispersion H1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 10 minutes at an internal temperature of 10° C. Subsequently, while the contents were being stirred at 280 rpm at an internal temperature of 10° C., 0.12 parts of a 5% by mass aqueous solution of potassium sulfate was continuously added thereto over 1 minute. Thereafter, the colorant dispersion H was continuously added over 5 minutes, and the contents were evenly mixed at an internal temperature of 10° C. Thereafter, 100 parts of desalted water was continuously added over 30 minutes, and the internal temperature was then elevated to 34.0° C. over 40 minutes (0.6° C./min) while maintaining the rotation speed of 280 rpm. Subsequently, the dispersion was held for 20 minutes. While the volume-median diameter (Dv50) of the particles was being determined with Multisizer, the particles were grown to 3.81 μm.

Shell Covering Step

Thereafter, the primary-polymer-particle dispersion H2 was added over 6 minutes while maintaining the internal temperature of 34.0° C. and the rotation speed of 280 rpm, and the resultant mixture was held for 90 minutes under these conditions.

Rounding Step

Subsequently, 20% aqueous DBS solution (6 parts on solid basis) was added over 10 minutes while maintaining the rotation speed of 280 rpm (the same stirring speed as the rotation speed used in the aggregation step). Thereafter, the mixture was heated to 76° C. over 30 minutes, and heating and stirring were continued until the average degree of circularity reached 0.962. Thereafter, the mixture was cooled to 20° C. over 10 minutes to obtain a slurry.

<Production of Toner K>

Thereafter, 1 part of the toner base particles K were mixed with 100 parts of the toner base particles H obtained in Example 2-1. To 500 g of the resultant toner base particle mixture K was added 8.75 g of silica H30TD, manufactured by Clariant K.K., as an external additive. The ingredients were mixed together by means of a 9-L Henschel mixer (manufactured by Mitsui Mining Co., Ltd.) at 3,000 rpm for 30 minutes. Thereafter, 1.4 g of calcium phosphate HAP-05NP, manufactured by Maruo Calcium Co., Ltd., was added thereto, and the ingredients were mixed together at 3,000 rpm for 10 minutes. The resultant mixture was sieved through a 200-mesh sieve to obtain a toner K.

Analysis Step

The toner K obtained above had a "volume-median diameter (Dv50)" and a "population number % of toner particles having a particle diameter of from 2.00 μm to 3.56 μm (Dns)", both determined with Multisizer, of 5.31 μm and 7.22%, respectively. The toner K further had an average degree of circularity of 0.949 and a coefficient of variation in number of 19.2%.

Comparative Example 2-2

Production of Toner Base Particles L

Toner base particles L were obtained by conducting the same procedure as in "Production of Toner Base Particles H" of Example 2-1, except that "Core Material Aggregation Step", "Shell Covering Step", and "Rounding Step", among the aggregation step (core material aggregation step and shell covering step), rounding step, cleaning step, and drying step in "Production of Toner Base Particles H", were changed as shown below.

Core Material Aggregation Step

The primary-polymer-particle dispersion H1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 10 minutes at an internal temperature of 10° C. Subsequently, while the contents were being stirred at 310 rpm at an internal temperature of 10° C., a 5% by mass aqueous solution of potassium sulfate was continuously added thereto in an amount of 0.12 parts in terms of $P_2SO_4$ amount over 1 minute. Thereafter, the colorant dispersion H was continuously added over 5 minutes, and the contents were evenly mixed at an internal temperature of 10° C.

Thereafter, 100 parts of desalted water was continuously added over 30 minutes, and the internal temperature was then elevated to 48.0° C. over 67 minutes (0.5° C./min) while maintaining the rotation speed of 310 rpm. Subsequently, the temperature was elevated by 1° C. at intervals of 30 minutes (0.03° C./min), and the dispersion was then held at 53.0° C. While the volume-median diameter (Dv50) of the particles was being determined with Multisizer, the particles were grown to 5.08 μm.

The stirring conditions used in this operation were the same as in Example 2-1, except for the following (c).

(c) Stirring-blade peripheral speed: 310 rpm, i.e., 3.08 msec.

Shell Covering Step

Thereafter, the primary-polymer-particle dispersion H2 was continuously added over 6 minutes while maintaining the internal temperature of 54.0° C. and the rotation speed of 310 rpm, and the resultant mixture was held for 60 minutes under these conditions. In the resultant dispersion, the particles had a Dv50 of 5.19 μm.

Rounding Step

Subsequently, the dispersion was heated to 83° C. while an aqueous solution prepared by mixing 20% aqueous DBS solution (6 parts on solid basis) with 0.04 parts of water was being added thereto over 30 minutes. Thereafter, the mixture was heated to 90° C. by elevating the temperature thereof by 1° C. at intervals of 30 minutes, and heating and stiffing were continued under these conditions over 2.5 hours until the average degree of circularity reached 0.939. Thereafter, the mixture was cooled to 20° C. over 10 minutes to obtain a slurry. In this slurry, the particles had a Dv50 of 5.18 μm and an average degree of circularity of 0.940. Cleaning and drying steps were conducted in the same manners as in Example 2-1.

External-Additive Addition Step

To 500 g of the toner base particles L obtained was added 8.75 g of silica H30TD, manufactured by Clariant K.K., as an external additive. The ingredients were mixed together by means of a 9-L Henschel mixer (manufactured by Mitsui Mining Co., Ltd.) at 3,000 rpm for 30 minutes. Thereafter, 1.4 g of calcium phosphate HAP-05NP, manufactured by Maruo Calcium Co., Ltd., was added thereto, and the ingredients were mixed together at 3,000 rpm for 10 minutes. The resultant mixture was sieved through a 200-mesh sieve to obtain a toner L.

Analysis Step

The toner L obtained above had a "volume-median diameter (Dv50)" and a "population number % of toner particles having a particle diameter of from 2.00 μm to 3.56 μm (Dns)", both determined with Multisizer, of 5.18 μm and 9.94%, respectively. The toner L further had an average degree of circularity of 0.940 and a coefficient of variation in number of 20.4%.

Comparative Example 2-3

Production of Toner Base Particles M

Toner base particles M were obtained by conducting the same procedure as in "Production of Toner Base Particles H" of Example 2-1, except that "Core Material Aggregation Step", "Shell Covering Step", and "Rounding Step", among the aggregation step (core material aggregation step and shell covering step), rounding step, cleaning step, and drying step in "Production of Toner Base Particles H", were changed as shown below.

Core Material Aggregation Step

The primary-polymer-particle dispersion H1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 10 minutes at an internal temperature of 10° C. Subsequently, while the contents were being stirred at 310 rpm at an internal temperature of 10° C., a 5% by mass aqueous solution of potassium sulfate was continuously added thereto in an amount of 0.12 parts in terms of $P_2SO_4$ amount over 1 minute. Thereafter, the colorant dispersion H was continuously added over 5 minutes, and the contents were evenly mixed at an internal temperature of 10° C.

Thereafter, 100 parts of desalted water was continuously added over 30 minutes, and the internal temperature was then elevated to 52.0° C. over 56 minutes (0.8° C./min) while maintaining the rotation speed of 310 rpm. Subsequently, the temperature was elevated by 1° C. at intervals of 30 minutes (0.03° C./min), and the dispersion was then held at 54.0° C. While the volume-median diameter (Dv50) of the particles was being determined with Multisizer, the particles were grown to 5.96 μm.

The stirring conditions used in this operation were the same as in Example 2-1, except for the following (c).

(c) Stirring-blade peripheral speed: 310 rpm, i.e., 3.08 msec.

Shell Covering Step

Thereafter, the primary-polymer-particle dispersion H2 was continuously added over 6 minutes while maintaining the internal temperature of 54.0° C. and the rotation speed of 310 rpm, and the resultant mixture was held for 60 minutes under these conditions. In the resultant dispersion, the particles had a Dv50 of 5.94 μm.

Rounding Step

Subsequently, the dispersion was heated to 88° C. while an aqueous solution prepared by mixing 20% aqueous DBS solution (6 parts on solid basis) with 0.04 parts of water was being added thereto over 30 minutes. Thereafter, the mixture was heated to 90° C. by elevating the temperature thereof by 1° C. at intervals of 30 minutes, and heating and stirring were continued under these conditions over 2 hours until the average degree of circularity reached 0.940. Thereafter, the mixture was cooled to 20° C. over 10 minutes to obtain a slurry. In this slurry, the particles had a Dv50 of 5.88 and an average degree of circularity of 0.943. Cleaning and drying steps were conducted in the same manners as in Example 2-1.

External-Additive Addition Step

To 500 g of the toner base particles M obtained was added 7.5 g of silica H30TD, manufactured by Clariant K.K., as an external additive. The ingredients were mixed together by means of a 9-L Henschel mixer (manufactured by Mitsui Mining Co., Ltd.) at 3,000 rpm for 30 minutes. Thereafter, 1.2 g of calcium phosphate HAP-05NP, manufactured by Maruo Calcium Co., Ltd., was added thereto, and the ingredients were mixed together at 3,000 rpm for 10 minutes. The resultant mixture was sieved through a 200-mesh sieve to obtain a toner M.

Analysis Step

The toner M obtained above had a "volume-median diameter (Dv50)" and a "population number % of toner particles having a particle diameter of from 2.00 μm to 3.56 μm (Dns)", both determined with Multisizer, of 5.92 μm and 5.22%, respectively. The toner M further had an average degree of circularity of 0.945 and a coefficient of variation in number of 21.2%.

Comparative Example 2-4

Three parts of the toner base particles K were mixed with 100 parts of the toner base particles J obtained in Example 2-3. To 500 g of the resultant toner base particle mixture was added 6.25 g of silica H30TD, manufactured by Clariant K.K., as an external additive. The ingredients were mixed together by means of a 9-L Henschel mixer (manufactured by Mitsui Mining Co., Ltd.) at 3,000 rpm for 30 minutes. Thereafter, 1.0 g of calcium phosphate HAP-05NP, manufactured by Maruo Calcium Co., Ltd., was added thereto, and the ingredients were mixed together at 3,000 rpm for 10 minutes. The resultant mixture was sieved through a 200-mesh sieve to obtain a toner N.

Analysis Step

The toner N obtained above had a "volume-median diameter (Dv50)" and a "population number % of toner particles having a particle diameter of from 2.00 μm to 3.56 μm (Dns)", both determined with Multisizer, of 6.88 μm and 9.08%, respectively. The toner N further had an average degree of circularity of 0.952 and a coefficient of variation in number of 25.6%.

Toner base particles O were obtained by conducting the same procedure as in "Production of Toner Base Particles H" of Example 2-1, except that "Core Material Aggregation Step", "Shell Covering Step", and "Rounding Step", among the aggregation step (core material aggregation step and shell covering step), rounding step, cleaning step, and drying step in "Production of Toner Base Particles H", were changed as shown below.

Core Material Aggregation Step

The primary-polymer-particle dispersion H1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 10 minutes at an internal temperature of 10° C. Subsequently, while the contents were being stirred at 310 rpm at an internal temperature of 10° C., a 5% by mass aqueous solution of potassium sulfate was continuously added thereto in an amount of 0.12 parts in terms of $K_2SO_4$ amount over 1 minute. Thereafter, the colorant dispersion H was continuously added over 5 minutes, and the contents were evenly mixed at an internal temperature of 10° C.

Thereafter, 100 parts of desalted water was continuously added over 30 minutes, and the internal temperature was then elevated to 52.0° C. over 45 minutes (1.0° C./min) while maintaining the rotation speed of 310 rpm. Subsequently, the temperature was elevated by 1° C. at intervals of 30 minutes (0.03° C./min), and the dispersion was then held at 54.0° C. While the volume-median diameter (Dv50) of the particles was being determined with Multisizer, the particles were grown to 5.20 μm.

Shell Covering Step

Thereafter, the primary-polymer-particle dispersion H2 was continuously added over 6 minutes while maintaining the internal temperature of 54.0° C. and the rotation speed of 310 rpm, and the resultant mixture was held for 60 minutes under these conditions. In the resultant dispersion, the particles had a Dv50 of 5.52 μm.

Rounding Step

Subsequently, the dispersion was heated to 88° C. while an aqueous solution prepared by mixing 20% aqueous DBS solution (6 parts on solid basis) with 0.04 parts of water was being added thereto over 30 minutes. Thereafter, the mixture was heated to 90° C. by elevating the temperature thereof by 1° C. at intervals of 30 minutes, and heating and stirring were continued under these conditions over 2 hours until the average degree of circularity reached 0.940. Thereafter, the mixture was cooled to 20° C. over 10 minutes to obtain a slurry. In this slurry, the particles had a Dv50 of 5.88 μm and an average degree of circularity of 0.943. Cleaning and drying steps were conducted in the same manners as in Example 2-1.

External-Additive Addition Step

To 500 g of the toner base particles O obtained was added 7.5 g of silica H30TD, manufactured by Clariant K.K., as an external additive. The ingredients were mixed together by means of a 9-L Henschel mixer (manufactured by Mitsui Mining Co., Ltd.) at 3,000 rpm for 30 minutes. Thereafter, 1.2 g of calcium phosphate HAP-05NP, manufactured by Maruo Calcium Co., Ltd., was added thereto, and the ingredients were mixed together at 3,000 rpm for 10 minutes. The resultant mixture was sieved through a 200-mesh sieve to obtain a toner O.

Analysis Step

The toner O obtained above had a "volume-median diameter (Dv50)" and a "population number % of toner particles having a particle diameter of from 2.00 μm to 3.56 μm (Dns)", both determined with Multisizer, of 5.40 μm and 4.55%, respectively. The toner O further had an average degree of circularity of 0.947 and a coefficient of variation in number of 24.2%.

The toners H to O were evaluated for "fouling" by the method described hereinabove under "Actual-Printing Evaluation 2". The results thereof are also shown in Table 3.

TABLE 3

| No. | Toner | Volume-median diameter (Dv50) (μm) | Average degree of circularity | 0.233exp (17.3/Dv50) | Dns (%) | Coefficient of variation in number (%) | Residual image (ghost) 8 kp | Blurring (suitability for solid printing) 8 kp | Removability in cleaning 8 kp |
|---|---|---|---|---|---|---|---|---|---|
| Example 2-1 | H | 5.27 | 0.948 | 6.25 | 5.87 | 18.0 | good | good | good |
| Example 2-2 | I | 6.16 | 0.946 | 3.86 | 2.79 | 19.2 | good | good | good |
| Example 2-3 | J | 6.97 | 0.946 | 2.79 | 1.85 | 19.5 | excellent | excellent | good |
| Comparative Example 2-1 | K | 5.31 | 0.949 | 6.06 | 7.22 | 19.2 | poor | poor | poor |
| Comparative Example 2-2 | L | 5.18 | 0.940 | 6.57 | 9.94 | 20.4 | toner spouted from developing vessel (actual printing was impossible) | | |
| Comparative Example 2-3 | M | 5.92 | 0.945 | 4.33 | 5.22 | 21.2 | poor | good | poor |
| Comparative Example 2-4 | N | 6.88 | 0.952 | 2.88 | 9.08 | 24.5 | toner spouted from developing vessel (actual printing was impossible) | | |
| Comparative Example 2-5 | O | 5.40 | 0.947 | 5.74 | 4.55 | 24.2 | poor | poor | poor |

Examples 2-1 to 2-3 each were satisfactory in all of residual image (ghost), blurring (suitability for solid printing), and removability in cleaning. On the other hand, none of Comparative Examples 2-1 to 2-5 was satisfactory in all of residual image (ghost), blurring (suitability for solid printing), and removability in cleaning.

Figure 2:
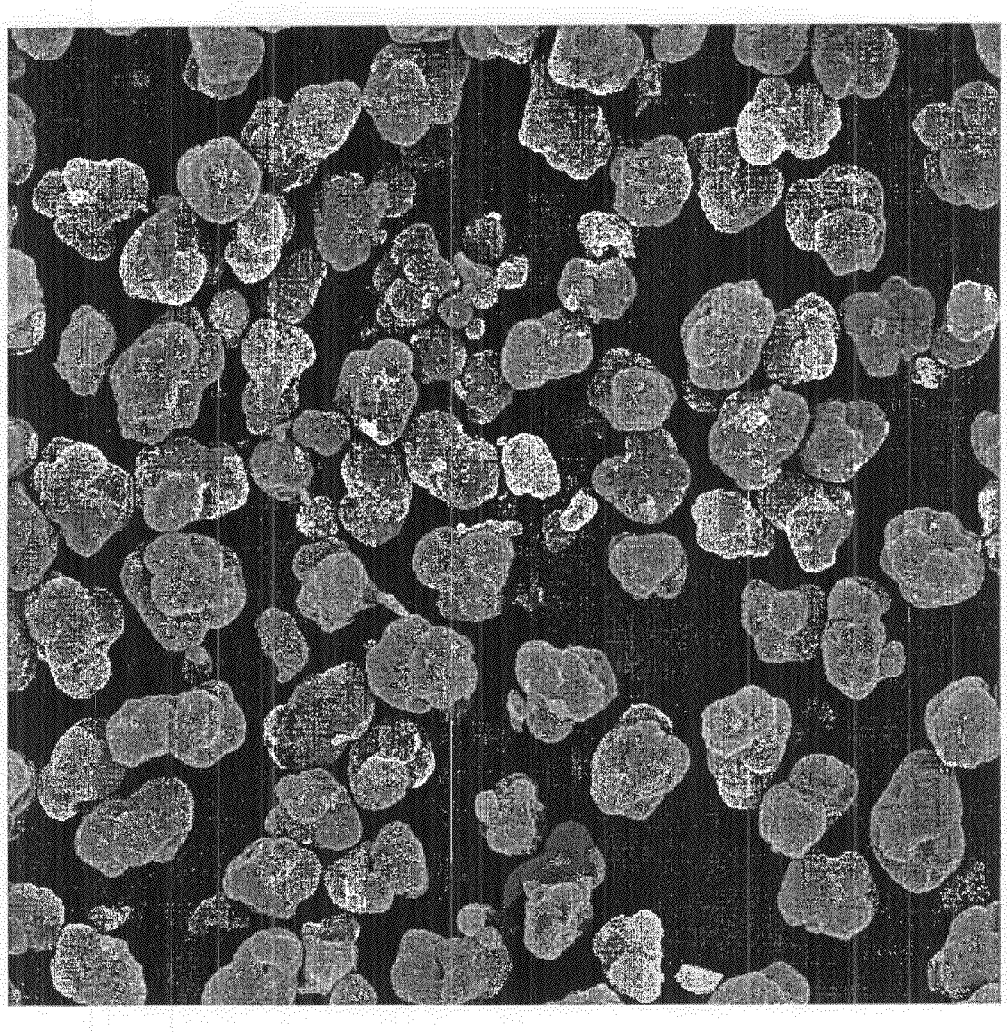
FIG. 2 is an SEM photograph of the toner of Comparative Example 2-1, the magnification of the photograph being 1,000 diameters.
Figure 3:
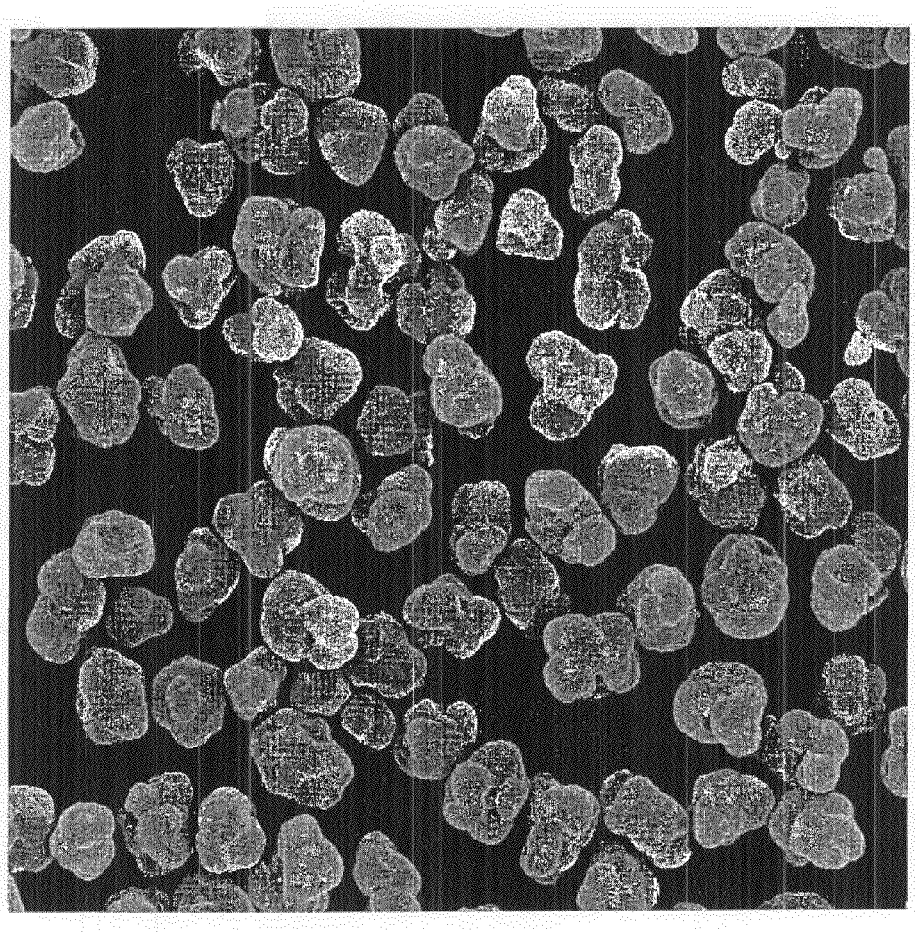
FIG. 3 is an SEM photograph of the toner of Example 2-1, the magnification of the photograph being 1,000 diameters.

FIG. 2 and FIG. 3 are SEM photographs of the toners of Comparative Example 2-1 and Example 2-1, respectively. A comparison between the two photographs revealed that many fine particles not larger than 3.56 μm are present in FIG. 2 (Comparative Example 2-1) than in FIG. 3 (Example 2-1).

FIG. 4 is an SEM photograph showing toner particles adherent to the surface of the cleaning blade after the actual-printing evaluation of the toner of Comparative Example 2-1. It was found that when such a toner containing a large amount of fine particles is used in printing for long, fine particles of 3.56 μm or smaller, which have high adhesion force, accumulate preferentially on the cleaning blade of the image-forming apparatus to form a bank having a high bulk density and thereby inhibit toner conveyance, as shown in FIG. 4. The portion surrounded by the ellipse in FIG. 4 is the bank formed by the accumulation of fine particles of 3.56 μm or smaller.

Figure 5:
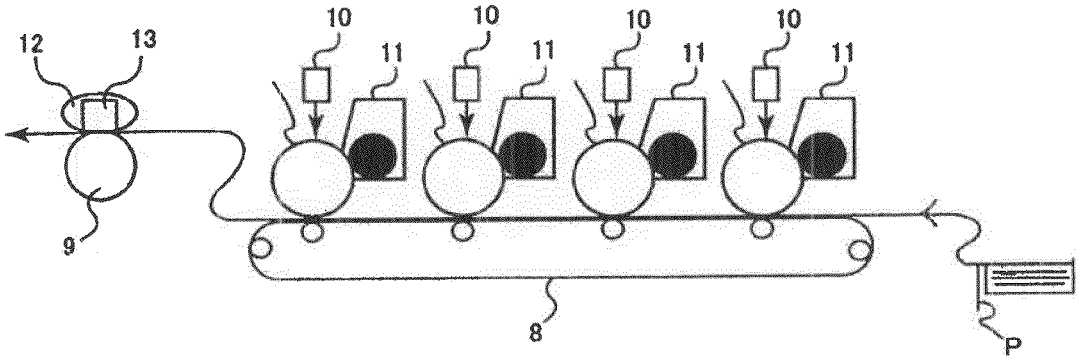
FIG. 5 is a diagrammatic view illustrating one embodiment of image-forming apparatus of the tandem, belt-conveying, direct-transfer type employing a toner of the invention.

FIG. 5 is a view of the image-forming apparatus used in the invention. Of image transfer types, the tandem type is apt to cause color shifting as compared with the 4-cycle type. Furthermore, the tandem direct transfer type involves a contact between each photoreceptor drum and the paper and, hence, the photoreceptor drum surface is apt to come to have fine recesses and protrusions. These recesses and protrusions are apt to influence images because fine toner particles are apt to be caught by the recesses and protrusions. The present invention is especially effective in such an image-forming apparatus, i.e., an image-forming apparatus employing a tandem belt conveyance system. Meanwhile, the direct transfer type attains excellent image reproducibility because one transfer operation suffices. In such an image-forming apparatus, the invention is especially effective.

Example 3-1

Preparation of Charge Control Agent Dispersion α

Ten parts of a powder of charge control agent E-81 (manufactured by Orient Chemical Industries Ltd.), 10 parts of an anionic surfactant (Neogen S-20A, manufactured by Dai-ichi Kogyo Seiyaku Co., Ltd.), and 80 parts of ion-exchanged water having an electrical conductivity of 2 μS/cm were introduced into a 1-L stainless-steel beaker equipped with stirring blades. The ingredients were sufficiently stirred and mixed to preliminarily disperse the charge control agent. Thus, a charge control agent premix liquid was obtained.

This premix liquid was subjected as a raw slurry to a dispersing treatment with a wet-type bead mill (batch-type bench sand mill manufactured by Kansai Paint Co., Ltd.). Zirconia beads having a diameter of 300 μm (true density, 6.0 g/cm3) were used as a dispersing medium. The dispersing medium was mixed with the raw slurry in a raw slurry/medium ratio of 1/5 by weight so that the resultant mixture as a whole amounted to 1,200 g. Four disk-shape stirring blades made of stainless steel and having a diameter of 7 cm and a thickness of 0.6 cm were fixed to the rotating center shaft of the bead mill, and a stainless-steel beaker containing the premix liquid was set so that the blades were wholly immersed in the raw slurry/beads mixture. This beaker was immersed in a thermostatic water bath, and 10° C. cooling water was circulated with a thermostatic cooler when the bead mill was operated. The premix liquid was stirred for about 1 hour at a constant stirring blade rotation speed of 1,490 rpm. A dispersion was obtained at the time when a given particle size was reached.

The beads were completely separated from a filtrate with a 100-mesh sieve made of stainless steel to obtain a charge control agent dispersion. This dispersion was examined with UPA (UPA-150, manufactured by Nikkiso Co., Ltd.) after having been diluted to an appropriate concentration with water containing several microliters of the anionic surfactant dropped thereinto. The particle size distribution of the particles was determined after an examination period of 100 seconds. The particles obtained had a volume-based particle size distribution median diameter of 200 nm.

<Preparation of Colorant Dispersion (Quinacridone)>

Into a vessel having a capacity of 300 L and equipped with a stirrer (propeller blades) were introduced 20 parts (40 kg) of quinacridone (Hostaperm Pink E-WD, manufactured by Clariant Japan K.K.), 1 part of 20% aqueous DBS solution, 4 parts of a nonionic surfactant (Emulgen 120, manufactured by Kao Corp.), and 75 parts of ion-exchanged water having an electrical conductivity of 2 μS/cm. The pigment was preliminarily dispersed to obtain a pigment premix liquid. In the dispersion obtained through pigment premixing, the quinacridone had a volume-average diameter (Mv) as determined with Nanotrac of about 90 μm.

The pigment premix liquid was fed as a raw slurry to a wet-type bead mill and subjected to a circulating dispersion process. The mill had a stator inner diameter of 75 mm, a separator diameter of 60 mm, and a separator-to-disk distance of 15 mm, and zirconia beads having a diameter of 50 μm (true density, 6.0 g/cm$^3$) were used as a dispersing medium. The stator had an effective inner volume of 0.5 L, and the medium was packed so as to occupy a volume of 0.35 L. Consequently, the degree of medium packing was 70% by mass. The rotor was rotated at a constant speed (peripheral speed of rotor, 11 m/sec), and the pigment premix liquid was continuously fed through the feed opening with a non-pulsating constant-delivery pump at a feed rate of 50 L/hr and continuously discharged through the discharge opening. This operation was repeated to circulate the pigment premix liquid, whereby a colorant dispersion (quinacridone) was obtained at the time which a given particle diameter was reached. This colorant dispersion (quinacridone) had a volume-average diameter (Mv) as determined with Nanotrac of 243 nm and a solid concentration of 24.2% by mass.

<Production of Toner Base Particles P>

The ingredients shown below were used, and the aggregation step (core material aggregation step and shell covering step), rounding step, cleaning step, and drying step shown below were conducted to thereby produce toner base particles P.

Primary-polymer-particle dispersion A1: 95 parts on solid basis (998.2 g in terms of solid amount)

Primary-polymer-particle dispersion A2: 5 parts on solid basis

Colorant dispersion (quinacridone): 9 parts in terms of colorant solid amount

20% aqueous DBS solution: 0.2 parts on solid basis; used in the core material aggregation step 20% aqueous DBS solution: 6 parts on solid basis; used in the rounding step Core Material Aggregation Step The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the contents were being stirred at 250 rpm at an internal temperature kept at 7° C., a 5% by mass aqueous solution of ferrous sulfate was added thereto over 5 minutes in an amount of 0.52 parts in terms of $FeSO_4.7H_2O$ amount. Thereafter, the colorant dispersion was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 55.0° C. while maintaining the rotation speed of 250 rpm, and the particles were grown to a volume-median diameter (Dv50) as determined with Multisizer of 7.11 μm.

Shell Covering Step

Thereafter, a liquid mixture of the primary-polymer-particle dispersion A2 and 0.3 parts of the charge control agent dispersion a was added over 3 minutes while maintaining the internal temperature of 55.0° C. and the rotation speed of 250 rpm, and the resultant mixture was held for 60 minutes under these conditions.

Rounding Step

Subsequently, the rotation speed was lowered to 150 rpm (stirring-blade peripheral speed, 1.56 m/sec; stirring speed lower by 40% than the rotation speed used in the aggregation step), and 20% aqueous DBS solution (6 parts on solid basis) was then added over 10 minutes. Thereafter, the mixture was heated to 84° C. over 30 minutes, and heating and stirring were continued until the average degree of circularity reached 0.943. This mixture was then cooled to 30° C. over 20 minutes to obtain a slurry.

Cleaning Step

The slurry obtained was discharged and subjected to suction filtration through filter paper 5-shu C (No. 5C, manufactured by Toyo Roshi Kaisha, Ltd.) with an aspirator. The cake remaining on the filter paper was transferred to a stainless-steel vessel having a capacity of 10 L and equipped with a stirrer (propeller blades). Thereto was added 8 Pg of ion-exchanged water having an electrical conductivity of 1 μS/cm. The resultant mixture was stirred at 50 rpm to thereby evenly disperse the particles and was then kept being stirred for 30 minutes.

Thereafter, the dispersion was subjected again to suction filtration through filter paper 5-shu C (No. 5C, manufactured by Toyo Roshi Kaisha, Ltd.) with an aspirator. The solid matter remaining on the filter paper was transferred again to a vessel which had a capacity of 10 L and was equipped with a stirrer (propeller blades) and which contained 8 μg of ion-exchanged water having an electrical conductivity of 1 μS/cm, and the resultant mixture was stirred at 50 rpm to thereby evenly disperse the particles and was then kept being stirred for 30 minutes. This step was repeated 5 times. As a result, the electrical conductivity of the filtrate became 2 μS/cm.

Drying Step

The solid matter obtained above was spread in a stainless-steel vat to a height of 20 mm, and dried for 48 hours in an air-blowing drying oven set at 40° C. Thus, toner base particles P were obtained.

<Production of Toner P>

External-Additive Addition Step

To 250 g of the toner base particles P obtained were added 1.41 g of silica 112000, manufactured by Clariant K.K., and 0.56 g of fine titania powder SMT150IB, manufactured by Tayca Corp., as external additives. The ingredients were mixed together by means of a sample mill (manufactured by Kyoritsu Riko Co.) at 6,000 rpm for 1 minute, and the resultant mixture was sieved with a 150-mesh sieve to obtain a toner P.

Analysis Step

The toner P obtained above had a volume-median diameter (Dv50) and a "population number % of toner particles having a particle diameter of from 2.00 pin to 3.56 μm (Dns)", both determined with Multisizer, of 7.11 μm and 1.67%, respectively. The toner P further had an average degree of circularity of 0.943 and a coefficient of variation in number of 19.2%. Furthermore, the toner gave a solid image having a gloss value of 26.4, and the toner on the developing roller had a surface potential of −33 V. The toner surface depressions attributable to the charge control agent had a size of 400 nm, and the charge control agent had been present in the range of ±R centering on the toner surface.

Example 3-2

Production of Toner Base Particles Q

Toner base particles Q were obtained by conducting the same procedure as in "Production of Toner Base Particles P" of Example 3-1, except that the colorant quinacridone dispersion among the ingredients for the toner base particles P was used in an amount of 9.0 parts and that "Core Material Aggregation Step", "Shell Covering Step", and "Rounding Step", among the aggregation step (core material aggregation step and shell covering step), rounding step, cleaning step, and drying step in "Production of Toner Base Particles P", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the contents were being stirred at 250 rpm at an internal temperature kept at 7° C., a 5% by mass aqueous solution of ferrous sulfate was added in an amount of 0.52 parts in terms of $FeSO_4.7H_2O$ amount over 5 minutes. Thereafter, the colorant dispersion was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 55.0° C. while maintaining the rotation speed of 250 rpm, and the particles were grown to a volume-median diameter (Dv50) as determined with Multisizer of 7.02 μm.

Shell Covering Step

Thereafter, a liquid mixture of the primary-polymer-particle dispersion A2 and 1.0 part of the charge control agent dispersion a was added over 3 minutes while maintaining the internal temperature of 55.0° C. and the rotation speed of 250 rpm, and the resultant mixture was held for 60 minutes under the same conditions.

Rounding Step

Subsequently, the rotation speed was lowered to 150 rpm (stirring-blade peripheral speed, 1.56 m/sec; stirring speed lower by 40% than the rotation speed used in the aggregation step), and 20% aqueous DBS solution (6 parts on solid basis) was then added over 10 minutes. Thereafter, the mixture was heated to 84° C. over 30 minutes, and heating and stirring were continued until the average degree of circularity reached 0.951. This mixture was then cooled to 30° C. over 20 minutes to obtain a slurry.

<Production of Toner Q>

Thereafter, the toner base particles Q were subjected to the same external-additive addition step as in "Production of Toner P", except that the amount of the silica H2000 as an external additive was changed to 1.41 g and the amount of the fine titania powder SMT150IB as another external additive was changed to 0.56 g. Thus, a toner Q was obtained.

Analysis Step

The toner L obtained above had a volume-median diameter (Dv50) and a "population number % of toner particles having a particle diameter of from 2.00 μm to 3.56 μm (Dns)", both determined with Multisizer, of 7.02 μm and 2.05%, respectively. The toner Q further had an average degree of circularity of 0.951 and a coefficient of variation in number of 21.4%. Furthermore, the toner surface depressions attributable to the charge control agent had a size of 400 nm, and the charge control agent had been present in the range of ±R centering on the toner surface.

Example 3-3

Preparation of Charge Control Agent Dispersion β

Ten parts of a powder of charge control agent TN-105 (manufactured by Hodogaya Chemical Co., Ltd.), 10 parts of an anionic surfactant (Neogen S-20A, manufactured by Daiichi Kogyo Seiyaku Co., Ltd.), and 80 parts of ion-exchanged water having an electrical conductivity of 2 μS/cm were introduced into a 1-L stainless-steel beaker equipped with stirring blades. The ingredients were sufficiently stirred and mixed to preliminarily disperse the charge control agent. Thus, a charge control agent premix liquid was obtained.

This premix liquid was subjected as a raw slurry to a dispersing treatment with a wet-type bead mill (batch-type bench sand mill manufactured by Kansai Paint Co., Ltd.). Zirconia beads having a diameter of 300 μm (true density, 6.0 g/cm3) were used as a dispersing medium. The dispersing medium was mixed with the raw slurry in a raw slurry/medium ratio of 1/5 by weight so that the resultant mixture as a whole amounted to 1,200 g. Four disk-shape stirring blades made of stainless steel and having a diameter of 7 cm and a thickness of 0.6 cm were fixed to the rotating center shaft of the bead mill, and a stainless-steel beaker containing the premix liquid was set so that the blades were wholly immersed in the raw slurry/beads mixture. This beaker was immersed in a thermostatic water bath, and 10° C. cooling water was circulated with a thermostatic cooler when the bead mill was operated. The premix liquid was stirred for about 1 hour at a constant stirring blade rotation speed of 1,490 rpm. A dispersion was obtained at the time when a given particle size was reached.

The beads were completely separated from a filtrate with a 100-mesh sieve made of stainless steel to obtain a charge control agent dispersion. This dispersion was examined with UPA (UPA-150, manufactured by Nikkiso Co., Ltd.) after having been diluted to an appropriate concentration with water containing several microliters of the anionic surfactant dropped thereinto. The particle size distribution of the particles was determined after an examination period of 100 seconds. The particles obtained had a volume-based particle size distribution median diameter of 160 nm.

<Production of Toner Base Particles R>

Toner base particles R were obtained by conducting the same procedure as in "Production of Toner Base Particles P" of Example 3-1, except that the colorant quinacridone dispersion among the ingredients for the toner base particles P was used in an amount of 9.0 parts and that "Core Material Aggregation Step", "Shell Covering Step", and "Rounding Step", among the aggregation step (core material aggregation step and shell covering step), rounding step, cleaning step, and drying step in "Production of Toner Base Particles P", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the contents were being stirred at 250 rpm at an internal temperature kept at 7° C., a 5% by mass aqueous solution of ferrous sulfate was added in an amount of 0.52 parts in terms of $FeSO_4.7H_2O$ amount over 5 minutes. Thereafter, the colorant dispersion was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 55.0° C. while maintaining the rotation speed of 250 rpm, and the particles were grown to a volume-median diameter (Dv50) as determined with Multisizer of 7.25 μm.

Shell Covering Step

Thereafter, a liquid mixture of the primary-polymer-particle dispersion A2 and 0.3 parts of the charge control agent dispersion β was added over 3 minutes while maintaining the internal temperature of 55.0° C. and the rotation speed of 250 rpm, and the resultant mixture was held for 60 minutes under the same conditions.

Rounding Step

Subsequently, the rotation speed was lowered to 150 rpm (stirring-blade peripheral speed, 1.56 m/sec; stirring speed lower by 40% than the rotation speed used in the aggregation step), and 20% aqueous DBS solution (6 parts on solid basis) was then added over 10 minutes. Thereafter, the mixture was heated to 84° C. over 30 minutes, and heating and stirring were continued until the average degree of circularity reached 0.944. This mixture was then cooled to 30° C. over 20 minutes to obtain a slurry.

<Production of Toner R>

Thereafter, the toner base particles R were subjected to the same external-additive addition step as in "Production of Toner P", except that the amount of the silica H2000 as an external additive was changed to 1.41 g and the amount of the fine titania powder SMT150IB as another external additive was changed to 0.56 g. Thus, a toner R was obtained.

Analysis Step

The toner R obtained above had a volume-median diameter (Dv50) and a "population number % of toner particles having a particle diameter of from 2.00 μm to 3.56 μm (Dns)", both determined with Multisizer, of 7.25 μm and 1.99%, respectively. The toner R further had an average degree of circularity of 0.944 and a coefficient of variation in number of 18.9%. Furthermore, the toner gave a solid image having a gloss value of 26.4, and the toner on the developing roller had a surface potential of −35 V.

The toner surface depressions attributable to the charge control agent had a size of 350 nm, and the charge control agent had been present in the range of ±R centering on the toner surface.

Example 3-4

Production of Toner Base Particles S

Toner base particles S were obtained by conducting the same procedure as in "Production of Toner Base Particles P" of Example 3-1, except that the colorant quinacridone dispersion among the ingredients for the toner base particles P was used in an amount of 9.0 parts and that "Core Material Aggregation Step", "Shell Covering Step", and "Rounding Step", among the aggregation step (core material aggregation step and shell covering step), rounding step, cleaning step, and drying step in "Production of Toner Base Particles P", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the contents were being stirred at 250 rpm at an internal temperature kept at 7° C., a 5% by mass aqueous solution of ferrous sulfate was added in an amount of 0.52 parts in terms of $FeSO_4.7H_2O$ amount over 5 minutes. Thereafter, the colorant dispersion was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 55.0° C. while maintaining the rotation speed of 250 rpm, and the particles were grown to a volume-median diameter (Dv50) as determined with Multisizer of 7.05 μm.

Shell Covering Step

Thereafter, a liquid mixture of the primary-polymer-particle dispersion A2 and 0.5 parts of the charge control agent dispersion β was added over 3 minutes while maintaining the internal temperature of 55.0° C. and the rotation speed of 250 rpm, and the resultant mixture was held for 60 minutes under the same conditions.

Rounding Step

Subsequently, the rotation speed was lowered to 150 rpm (stirring-blade peripheral speed, 1.56 msec; stirring speed lower by 40% than the rotation speed used in the aggregation step), and 20% aqueous DBS solution (6 parts on solid basis) was then added over 10 minutes. Thereafter, the mixture was heated to 84° C. over 30 minutes, and heating and stirring were continued until the average degree of circularity reached 0.943. This mixture was then cooled to 30° C. over 20 minutes to obtain a slurry.

<Production of Toner S>

Thereafter, the toner base particles S were subjected to the same external-additive addition step as in "Production of Toner P", except that the amount of the silica H2000 as an external additive was changed to 1.41 g and the amount of the fine titania powder SMT150IB as another external additive was changed to 0.56 g. Thus, a toner S was obtained.

Analysis Step

The toner N obtained above had a volume-median diameter (Dv50) and a "population number % of toner particles having a particle diameter of from 2.00 μm to 3.56 μm (Dns)", both determined with Multisizer, of 7.05 μm and 2.52%, respectively. The toner S further had an average degree of circularity of 0.943 and a coefficient of variation in number of 19.6%. Furthermore, the toner gave a solid image having a gloss value of 29.5, and the toner on the developing roller had a surface potential of −34 V. The toner surface depressions attributable to the charge control agent had a size of 350 nm, and the charge control agent had been present in the range of ±R centering on the toner surface.

Example 3-5

Production of Toner Base Particles T

Toner base particles T were obtained by conducting the same procedure as in "Production of Toner Base Particles P" of Example 3-1, except that the colorant quinacridone dispersion among the ingredients for the toner base particles P was used in an amount of 9.0 parts and that "Core Material Aggregation Step", "Shell Covering Step", and "Rounding Step", among the aggregation step (core material aggregation step and shell covering step), rounding step, cleaning step, and drying step in "Production of Toner Base Particles P", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the contents were being stirred at 250 rpm at an internal temperature kept at 7° C., a 5% by mass aqueous solution of ferrous sulfate was added in an amount of 0.52 parts in terms of $FeSO_4.7H_2O$ amount over 5 minutes. Thereafter, the colorant dispersion was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 55.0° C. while maintaining the rotation speed of 250 rpm, and the particles were grown to a volume-median diameter (Dv50) as determined with Multisizer of 7.08 μm.

Shell Covering Step

Thereafter, a liquid mixture of the primary-polymer-particle dispersion A2 and 1.0 part of the charge control agent dispersion β was added over 3 minutes while maintaining the internal temperature of 55.0° C. and the rotation speed of 250 rpm, and the resultant mixture was held for 60 minutes under the same conditions.

Rounding Step

Subsequently, the rotation speed was lowered to 150 rpm (stirring-blade peripheral speed, 1.56 msec; stirring speed lower by 40% than the rotation speed used in the aggregation step), and 20% aqueous DBS solution (6 parts on solid basis) was then added over 10 minutes. Thereafter, the mixture was heated to 84° C. over 30 minutes, and heating and stirring were continued until the average degree of circularity reached 0.948. This mixture was then cooled to 30° C. over 20 minutes to obtain a slurry.

<Production of Toner T>

Thereafter, the toner base particles T were subjected to the same external-additive addition step as in "Production of Toner P", except that the amount of the silica H2000 as an external additive was changed to 1.41 g and the amount of the fine titania powder SMT150IB as another external additive was changed to 0.56 g. Thus, a toner T was obtained.

Analysis Step

The toner T obtained above had a volume-median diameter (Dv50) and a "population number % of toner particles having a particle diameter of from 2.00 μm to 3.56 μm (Dns)", both determined with Multisizer, of 7.08 μm and 1.82%, respectively. The toner T further had an average degree of circularity of 0.948 and a coefficient of variation in number of 19.1%. Furthermore, the toner surface depressions attributable to the charge control agent had a size of 350 nm, and the charge control agent had been present in the range of ±R centering on the toner surface.

Example 3-6

Preparation of Charge Control Agent Dispersion γ

Ten parts of a powder of charge control agent T-77 (manufactured by Hodogaya Chemical Co., Ltd.), 10 parts of an anionic surfactant (Neogen S-20A, manufactured by Dai-ichi Kogyo Seiyaku Co., Ltd.), and 80 parts of ion-exchanged water having an electrical conductivity of 2 μS/cm were introduced into a 1-L stainless-steel beaker equipped with stirring blades. The ingredients were sufficiently stirred and mixed to preliminarily disperse the charge control agent. Thus, a charge control agent premix liquid was obtained.

This premix liquid was subjected as a raw slurry to a dispersing treatment with a wet-type bead mill (batch-type bench sand mill manufactured by Kansai Paint Co., Ltd.). Zirconia beads having a diameter of 300 μm (true density, 6.0 g/cm$^3$) were used as a dispersing medium. The dispersing medium was mixed with the raw slurry in a raw slurry/medium ratio of 1/5 by weight so that the resultant mixture as a whole amounted to 1,200 g. Four disk-shape stirring blades made of stainless steel and having a diameter of 7 cm and a thickness of 0.6 cm were fixed to the rotating center shaft of the bead mill, and a stainless-steel beaker containing the premix liquid was set so that the blades were wholly immersed in the raw slurry/beads mixture. This beaker was immersed in a thermostatic water bath, and 10° C. cooling water was circulated with a thermostatic cooler when the bead mill was operated. The premix liquid was stirred for about 1 hour at a constant stirring blade rotation speed of 1,490 rpm. A dispersion was obtained at the time when a given particle size was reached.

The beads were completely separated from a filtrate with a 100-mesh sieve made of stainless steel to obtain a charge control agent dispersion. This dispersion was examined with UPA (UPA-150, manufactured by Nikkiso Co., Ltd.) after having been diluted to an appropriate concentration with water containing several microliters of the anionic surfactant dropped thereinto. The particle size distribution of the particles was determined after an examination period of 100 seconds. The particles obtained had a volume-based particle size distribution median diameter of 180 nm.

<Production of Toner Base Particles U>

Toner base particles U were obtained by conducting the same procedure as in "Production of Toner Base Particles P" of Example 3-1, except that the colorant quinacridone dispersion among the ingredients for the toner base particles P was used in an amount of 9.0 parts and that "Core Material Aggregation Step", "Shell Covering Step", and "Rounding Step", among the aggregation step (core material aggregation step and shell covering step), rounding step, cleaning step, and drying step in "Production of Toner Base Particles P", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the contents were being stirred at 250 rpm at an internal temperature kept at 7° C., a 5% by mass aqueous solution of ferrous sulfate was added in an amount of 0.52 parts in terms of $FeSO_4.7H_2O$ amount over 5 minutes. Thereafter, the colorant dispersion was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 55.0° C. while maintaining the rotation speed of 250 rpm, and the particles were grown to a volume-median diameter (Dv50) as determined with Multisizer of 6.91 μm.

Shell Covering Step

Thereafter, a liquid mixture of the primary-polymer-particle dispersion A2 and 1.0 part of the charge control agent dispersion γ was added over 3 minutes while maintaining the internal temperature of 55.0° C. and the rotation speed of 250 rpm, and the resultant mixture was held for 60 minutes under the same conditions.

Rounding Step

Subsequently, the rotation speed was lowered to 150 rpm (stirring-blade peripheral speed, 1.56 m/sec; stirring speed lower by 40% than the rotation speed used in the aggregation step), and 20% aqueous DBS solution (6 parts on solid basis) was then added over 10 minutes. Thereafter, the mixture was heated to 84° C. over 30 minutes, and heating and stirring were continued until the average degree of circularity reached 0.948. This mixture was then cooled to 30° C. over 20 minutes to obtain a slurry.

<Production of Toner U>

Thereafter, the toner base particles U were subjected to the same external-additive addition step as in "Production of Toner P", except that the amount of the silica H2000 as an external additive was changed to 1.41 g and the amount of the fine titania powder SMT15013 as another external additive was changed to 0.56 g. Thus, a toner U was obtained.

Analysis Step

The toner P obtained above had a volume-median diameter (Dv50) and a "population number % of toner particles having a particle diameter of from 2.00 μm to 3.56 μm (Dns)", both determined with Multisizer, of 6.91 μm and 2.57%, respectively. The toner U further had an average degree of circularity of 0.948 and a coefficient of variation in number of 22.3%. Furthermore, the toner gave a solid image having a gloss value of 30.7, and the toner on the developing roller had a surface potential of −30 V. The toner surface depressions attributable to the charge control agent had a size of 400 nm, and the charge control agent had been present in the range of ±R centering on the toner surface.

Comparative Example 3-1

Preparation of Charge Control Agent Dispersion δ

Ten parts of a powder of charge control agent E-84 (manufactured by Orient Chemical Industries Ltd.), 10 parts of an anionic surfactant (Neogen S-20A, manufactured by Dai-ichi Kogyo Seiyaku Co., Ltd.), and 80 parts of ion-exchanged water having an electrical conductivity of 2 μS/cm were introduced into a 1-L stainless-steel beaker equipped with stirring blades. The ingredients were sufficiently stirred and mixed to preliminarily disperse the charge control agent. Thus, a charge control agent premix liquid was obtained.

This premix liquid was subjected as a raw slurry to a dispersing treatment with a wet-type bead mill (batch-type bench sand mill manufactured by Kansai Paint Co., Ltd.). Zirconia beads having a diameter of 300 μm (true density, 6.0 g/cm$^3$) were used as a dispersing medium. The dispersing medium was mixed with the raw slurry in a raw slurry/medium ratio of 1/5 by weight so that the resultant mixture as a whole amounted to 1,200 g. Four disk-shape stirring blades made of stainless steel and having a diameter of 7 cm and a thickness of 0.6 cm were fixed to the rotating center shaft of the bead mill, and a stainless-steel beaker containing the premix liquid was set so that the blades were wholly immersed in the raw slurry/beads mixture. This beaker was immersed in a thermostatic water bath, and 10° C. cooling water was circulated with a thermostatic cooler when the bead mill was operated. The premix liquid was stirred for about 0.5 hours at a constant stirring blade rotation speed of 525 rpm. A dispersion was obtained at the time when a given particle size was reached.

The beads were completely separated from a filtrate with a 100-mesh sieve made of stainless steel to obtain a charge control agent dispersion. This dispersion was examined with UPA (UPA-150, manufactured by Nikkiso Co., Ltd.) after having been diluted to an appropriate concentration with water containing several microliters of the anionic surfactant dropped thereinto. The particle size distribution of the particles was determined after an examination period of 100 seconds. The particles obtained had a volume-based particle size distribution median diameter of 650 nm.

<Production of Toner Base Particles V>

Toner base particles V were obtained by conducting the same procedure as in "Production of Toner Base Particles P" of Example 3-1, except that the colorant quinacridone dispersion among the ingredients for the toner base particles P was used in an amount of 9.0 parts and that "Core Material Aggregation Step", "Shell Covering Step", and "Rounding Step", among the aggregation step (core material aggregation step and shell covering step), rounding step, cleaning step, and drying step in "Production of Toner Base Particles P", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the contents were being stirred at 250 rpm at an internal temperature kept at 7° C., a 5% by mass aqueous solution of ferrous sulfate was added in an amount of 0.52 parts in terms of $FeSO_4.7H_2O$ amount over 5 minutes. Thereafter, the colorant dispersion was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 55.0° C. while maintaining the rotation speed of 250 rpm, and the particles were grown to a volume-median diameter (Dv50) as determined with Multisizer of 6.60 μm.

Shell Covering Step

Thereafter, a liquid mixture of the primary-polymer-particle dispersion A2 and 1.0 part of the charge control agent dispersion 5 was added over 3 minutes while maintaining the internal temperature of 55.0° C. and the rotation speed of 250 rpm, and the resultant mixture was held for 60 minutes under the same conditions.

Rounding Step

Subsequently, the rotation speed was lowered to 150 rpm (stirring-blade peripheral speed, 1.56 m/sec; stirring speed lower by 40% than the rotation speed used in the aggregation step), and 20% aqueous DBS solution (6 parts on solid basis) was then added over 10 minutes. Thereafter, the mixture was heated to 84° C. over 30 minutes, and heating and stirring were continued until the average degree of circularity reached 0.936. This mixture was then cooled to 30° C. over 20 minutes to obtain a slurry.

<Production of Toner V>

Thereafter, the toner base particles V were subjected to the same external-additive addition step as in "Production of Toner P", except that the amount of the silica H2000 as an external additive was changed to 1.41 g and the amount of the fine titania powder SMT15013 as another external additive was changed to 0.56 g. Thus, a toner V was obtained.

Analysis Step

The toner V obtained above had a volume-median diameter (Dv50) and a "population number % of toner particles having a particle diameter of from 2.00 μm to 3.56 μm (Dns)", both determined with Multisizer, of 6.60 μm and 4.01%, respectively. The toner V further had an average degree of circularity of 0.936 and a coefficient of variation in number of 21.8%. Furthermore, the toner gave a solid image having a gloss value of 32.8, and the toner on the developing roller had a surface potential of −28 V. The toner surface depressions attributable to the charge control agent had a size of 1,200 nm, and the charge control agent had been present in the range of ±R centering on the toner surface.

Comparative Example 3-2

Preparation of Charge Control Agent Dispersion ϵ

Ten parts of a powder of charge control agent TN-105 (manufactured by Hodogaya Chemical Co., Ltd.), 10 parts of an anionic surfactant (Neogen S-20A, manufactured by Dai-ichi Kogyo Seiyaku Co., Ltd.), and 80 parts of ion-exchanged water having an electrical conductivity of 2 μS/cm were introduced into a 1-L stainless-steel beaker equipped with stirring blades. The ingredients were sufficiently stirred and mixed to preliminarily disperse the charge control agent. Thus, a charge control agent premix liquid was obtained.

This premix liquid was subjected as a raw slurry to a dispersing treatment with a wet-type bead mill (batch-type bench sand mill manufactured by Kansai Paint Co., Ltd.). Zirconia beads having a diameter of 300 μm (true density, 6.0 g/cm3) were used as a dispersing medium. The dispersing medium was mixed with the raw slurry in a raw slurry/medium ratio of 1/5 by weight so that the resultant mixture as a whole amounted to 1,200 g. Four disk-shape stirring blades made of stainless steel and having a diameter of 7 cm and a thickness of 0.6 cm were fixed to the rotating center shaft of the bead mill, and a stainless-steel beaker containing the premix liquid was set so that the blades were wholly immersed in the raw slurry/beads mixture. This beaker was immersed in a thermostatic water bath, and 10° C. cooling water was circulated with a thermostatic cooler when the bead mill was operated. The premix liquid was stirred for about 0.5 hours at a constant stirring blade rotation speed of 525 rpm. A dispersion was obtained at the time when a given particle size was reached.

The beads were completely separated from a filtrate with a 100-mesh sieve made of stainless steel to obtain a charge control agent dispersion. This dispersion was examined with UPA (UPA-150, manufactured by Nikkiso Co., Ltd.) after having been diluted to an appropriate concentration with water containing several microliters of the anionic surfactant dropped thereinto. The particle size distribution of the particles was determined after an examination period of 100 seconds. The particles obtained had a volume-based particle size distribution median diameter of 550 nm.

<Production of Toner Base Particles W>

Toner base particles W were obtained by conducting the same procedure as in "Production of Toner Base Particles P" of Example 3-1, except that the colorant quinacridone dispersion among the ingredients for the toner base particles P was used in an amount of 9.0 parts and that "Core Material Aggregation Step", "Shell Covering Step", and "Rounding Step", among the aggregation step (core material aggregation step and shell covering step), rounding step, cleaning step, and drying step in "Production of Toner Base Particles P", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the contents were being stirred at 250 rpm at an internal temperature kept at 7° C., a 5% by mass aqueous solution of ferrous sulfate was added in an amount of 0.52 parts in terms of $FeSO_4.7H_2O$ amount over 5 minutes. Thereafter, the colorant dispersion was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 55.0° C. while maintaining the rotation speed of 250 rpm, and the particles were grown to a volume-median diameter (Dv50) as determined with Multisizer of 6.83 μm.

Shell Covering Step

Thereafter, a liquid mixture of the primary-polymer-particle dispersion A2 and 1.0 part of the charge control agent dispersion c was added over 3 minutes while maintaining the internal temperature of 55.0° C. and the rotation speed of 250 rpm, and the resultant mixture was held for 60 minutes under the same conditions.

Rounding Step

Subsequently, the rotation speed was lowered to 150 rpm (stirring-blade peripheral speed, 1.56 msec; stirring speed lower by 40% than the rotation speed used in the aggregation step), and 20% aqueous DBS solution (6 parts on solid basis) was then added over 10 minutes. Thereafter, the mixture was heated to 84° C. over 30 minutes, and heating and stirring were continued until the average degree of circularity reached 0.944. This mixture was then cooled to 30° C. over 20 minutes to obtain a slurry.

<Production of Toner W>

Thereafter, the toner base particles W were subjected to the same external-additive addition step as in "Production of Toner P", except that the amount of the silica H2000 as an external additive was changed to 1.41 g and the amount of the fine titania powder SMT1503 as another external additive was changed to 0.56 g. Thus, a toner W was obtained.

Analysis Step

The toner W obtained above had a volume-median diameter (Dv50) and a "population number % of toner particles having a particle diameter of from 2.00 μm to 3.56 μm (Dns)", both determined with Multisizer, of 6.83 μm and 3.47%, respectively. The toner W further had an average degree of circularity of 0.944 and a coefficient of variation in number of 22.8%. Furthermore, the toner gave a solid image having a gloss value of 32.9, and the toner on the developing roller had a surface potential of −27 V. The toner surface depressions attributable to the charge control agent had a size of 1,200 nm, and the charge control agent had been present in the range of ±R centering on the toner surface.

Comparative Example 3-3

Preparation of Charge Control Resin (CCR) Dispersion ζ

Ten parts of a powder of charge control resin FC2521NJ (manufactured by Fujikura Kasei Co., Ltd.), 10 parts of an anionic surfactant (Neogen S-20A, manufactured by Dai-ichi Kogyo Seiyaku Co., Ltd.), and 80 parts of ion-exchanged water having an electrical conductivity of 2 μS/cm were introduced into a 1-L stainless-steel beaker equipped with stirring blades. The ingredients were sufficiently stirred and mixed to preliminarily disperse the charge control agent. Thus, a charge control agent premix liquid was obtained.

This premix liquid was subjected as a raw slurry to a dispersing treatment with a wet-type bead mill (batch-type bench sand mill manufactured by Kansai Paint Co., Ltd.). Zirconia beads having a diameter of 300 μm (true density, 6.0 $g/cm^3$) were used as a dispersing medium. The dispersing medium was mixed with the raw slurry in a raw slurry/medium ratio of 1/5 by weight so that the resultant mixture as a whole amounted to 1,200 g. Four disk-shape stirring blades made of stainless steel and having a diameter of 7 cm and a thickness of 0.6 cm were fixed to the rotating center shaft of the bead mill, and a stainless-steel beaker containing the premix liquid was set so that the blades were wholly immersed in the raw slurry/beads mixture. This beaker was immersed in a thermostatic water bath, and 10° C. cooling water was circulated with a thermostatic cooler when the bead mill was operated. The premix liquid was stirred for about 2 hours at a constant stirring blade rotation speed of 1,490 rpm. A dispersion was obtained at the time when a given particle size was reached.

The beads were completely separated from a filtrate with a 100-mesh sieve made of stainless steel to obtain a charge control agent dispersion. This dispersion was examined with UPA (UPA-150, manufactured by Nikkiso Co., Ltd.) after having been diluted to an appropriate concentration with water containing several microliters of the anionic surfactant dropped thereinto. The particle size distribution of the particles was determined after an examination period of 100 seconds. The particles obtained had a volume-based particle size distribution median diameter of 66 nm.

<Production of Toner Base Particles X>

Toner base particles X were obtained by conducting the same procedure as in "Production of Toner Base Particles P" of Example 3-1, except that the colorant quinacridone dispersion among the ingredients for the toner base particles P was used in an amount of 9.0 parts and that "Core Material Aggregation Step", "Shell Covering Step", and "Rounding Step", among the aggregation step (core material aggregation step and shell covering step), rounding step, cleaning step, and drying step in "Production of Toner Base Particles P", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the contents were being stirred at 250 rpm at an internal temperature kept at 7° C., a 5% by mass aqueous solution of ferrous sulfate was added in an amount of 0.52 parts in terms of $FeSO_4.7H_2O$ amount over 5 minutes. Thereafter, the colorant dispersion was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 55.0° C. while maintaining the rotation speed of 250 rpm, and the particles were grown to a volume-median diameter (Dv50) as determined with Multisizer of 5.71 μm.

Shell Covering Step

Thereafter, a liquid mixture of the primary-polymer-particle dispersion A2 and 0.5 parts of the charge control agent dispersion E was added over 3 minutes while maintaining the internal temperature of 55.0° C. and the rotation speed of 250 rpm, and the resultant mixture was held for 60 minutes under the same conditions.

Rounding Step

Subsequently, the rotation speed was lowered to 150 rpm (stirring-blade peripheral speed, 1.56 msec; stirring speed lower by 40% than the rotation speed used in the aggregation step), and 20% aqueous DBS solution (6 parts on solid basis) was then added over 10 minutes. Thereafter, the mixture was heated to 84° C. over 30 minutes, and heating and stirring were continued until the average degree of circularity reached 0.958. This mixture was then cooled to 30° C. over 20 minutes to obtain a slurry.

<Production of Toner X>

Thereafter, the toner base particles X were subjected to the same external-additive addition step as in "Production of Toner P", except that the amount of the silica H2000 as an external additive was changed to 1.41 g and the amount of the fine titania powder SMT150IB as another external additive was changed to 0.56 g. Thus, a toner X was obtained.

Analysis Step

The toner X obtained above had a volume-median diameter (Dv50) and a "population number % of toner particles having a particle diameter of from 2.00 μm to 3.56 μm (Dns)", both determined with Multisizer, of 5.71 μm and 1.6%, respectively. The toner X further had an average degree of circularity of 0.958 and a coefficient of variation in number of 22%. Furthermore, the toner surface had no depressions attributable to the charge control agent, and the charge control agent had not been present in the range of ±R centering on the toner surface.

Comparative Example 3-4

Production of Toner Base Particles Y

Toner base particles Y were obtained by conducting the same procedure as in "Production of Toner Base Particles P" of Example 3-1, except that the colorant quinacridone dispersion among the ingredients for the toner base particles P was used in an amount of 9.0 parts and that "Core Material Aggregation Step", "Shell Covering Step", and "Rounding Step", among the aggregation step (core material aggregation step and shell covering step), rounding step, cleaning step, and drying step in "Production of Toner Base Particles P", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the contents were being stirred at 250 rpm at an internal temperature kept at 7° C., a 5% by mass aqueous solution of ferrous sulfate was added in an amount of 0.52 parts in terms of $FeSO_4.7H_2O$ amount over 5 minutes. Thereafter, the colorant dispersion was added over 5 minutes, and 1.0 part of the charge control agent dispersion β was added over 3 minutes. The contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 55.0° C. while maintaining the rotation speed of 250 rpm, and the particles were grown to a volume-median diameter (Dv50) as determined with Multisizer of 7.06 μm.

Shell Covering Step

Thereafter, the primary-polymer-particle dispersion A2 was added over 3 minutes while maintaining the internal temperature of 55.0° C. and the rotation speed of 250 rpm, and the resultant mixture was held for 60 minutes under the same conditions.

Rounding Step

Subsequently, the rotation speed was lowered to 150 rpm (stirring-blade peripheral speed, 1.56 msec; stirring speed lower by 40% than the rotation speed used in the aggregation step), and 20% aqueous DBS solution (6 parts on solid basis) was then added over 10 minutes. Thereafter, the mixture was heated to 84° C. over 30 minutes, and heating and stirring were continued until the average degree of circularity reached 0.948. This mixture was then cooled to 30° C. over 20 minutes to obtain a slurry.

<Production of Toner Y>

Thereafter, the toner base particles Y were subjected to the same external-additive addition step as in "Production of Toner P", except that the amount of the silica H2000 as an external additive was changed to 1.41 g and the amount of the fine titania powder SMT150IB as another external additive was changed to 0.56 g. Thus, a toner Y was obtained.

Analysis Step

The toner Y obtained above had a volume-median diameter (Dv50) and a "population number % of toner particles having a particle diameter of from 2.00 μm to 3.56 μm (Dns)", both determined with Multisizer, of 7.08 μm and 2.03%, respectively. The toner Y further had an average degree of circularity of 0.943 and a coefficient of variation in number of 21.2%. Furthermore, no depressions attributable to the charge control agent were observed in the toner surface. Namely, the depression size was 0 nm

Comparative Example 3-5

Production of Toner Base Particles Z

Toner base particles Z were obtained by conducting the same procedure as in "Production of Toner Base Particles P" of Example 3-1, except that the colorant quinacridone dispersion among the ingredients for the toner base particles P was used in an amount of 9.0 parts and that "Core Material Aggregation Step", "Shell Covering Step", and "Rounding Step", among the aggregation step (core material aggregation step and shell covering step), rounding step, cleaning step, and drying step in "Production of Toner Base Particles P", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the contents were being stirred at 250 rpm at an internal temperature kept at 7° C., a 5% by mass aqueous solution of ferrous sulfate was added in an amount of 0.52 parts in terms of $FeSO_4.7H_2O$ amount over 5 minutes. Thereafter, the colorant dispersion was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 55.0° C. while maintaining the rotation speed of 250 rpm, and the particles were grown to a volume-median diameter (Dv50) as determined with Multisizer of 6.56 μm.

Shell Covering Step

Thereafter, a liquid mixture of the primary-polymer-particle dispersion A2 and 1.0 part of the charge control agent dispersion β was added over 3 minutes while maintaining the internal temperature of 55.0° C. and the rotation speed of 250 rpm, and the resultant mixture was held for 60 minutes under the same conditions.

Rounding Step

Subsequently, the rotation speed was lowered to 150 rpm (stirring-blade peripheral speed, 1.56 msec; stirring speed lower by 40% than the rotation speed used in the aggregation step), and 20% aqueous DBS solution (6 parts on solid basis) was then added over 10 minutes. Thereafter, the mixture was heated to 84° C. over 30 minutes, and heating and stirring were continued until the average degree of circularity reached 0.948. This mixture was then cooled to 30° C. over 20 minutes to obtain a slurry.

<Production of Toner Z>

Thereafter, the toner base particles Z were subjected to the same external-additive addition step as in "Production of Toner P", except that the amount of the silica H2000 as an external additive was changed to 1.41 g and the amount of the fine titania powder SMT150IB as another external additive was changed to 0.56 g. Thus, a toner Z was obtained.

Analysis Step

The toner Z obtained above had a volume-median diameter (Dv50) and a "population number % of toner particles having a particle diameter of from 2.00 μm to 3.56 μm (Dns)", both determined with Multisizer, of 6.56 μm and 3.22%, respectively. The toner Z further had an average degree of circularity of 0.945 and a coefficient of variation in number of 24.4%. Furthermore, the toner gave a solid image having a gloss value of 32.5, and the toner on the developing roller had a surface potential of −29 V. The toner surface depressions attributable to the charge control agent had a size of 350 nm, and the charge control agent had been present in the range of ±R centering on the toner surface.

Example 3-7

Preparation of Colorant Dispersion (Monoazo Yellow

Into a vessel having a capacity of 300 L and equipped with a stirrer (propeller blades) were introduced 20 parts (40 kg) of Monoazo Yellow (5GX01, manufactured by Clariant Japan K.K.), 1 part of 20% aqueous DBS solution, 4 parts of a nonionic surfactant (Emulgen 120, manufactured by Kao Corp.), and 75 parts of ion-exchanged water having an electrical conductivity of 2 μS/cm. The pigment was preliminarily dispersed to obtain a pigment premix liquid. In the dispersion obtained through pigment premixing, the Monoazo Yellow had a volume-average diameter (Mv) as determined with Nanotrac of 100 μm.

The pigment premix liquid was fed as a raw slurry to a wet-type bead mill and subjected to a circulating dispersion process. The mill had a stator inner diameter of 75 mm, a separator diameter of 60 mm, and a separator-to-disk distance of 15 mm, and zirconia beads having a diameter of 50 tun (true density, 6.0 g/cm$^3$) were used as a dispersing medium. The stator had an effective inner volume of 0.5 L, and the medium was packed so as to occupy a volume of 0.35 L. Consequently, the degree of medium packing was 70% by mass. The rotor was rotated at a constant speed (peripheral speed of rotor, 11 m/sec), and the pigment premix liquid was continuously fed through the feed opening with a non-pulsating constant-delivery pump at a feed rate of 50 L/hr and continuously discharged through the discharge opening. This operation was repeated to circulate the pigment premix liquid, whereby a colorant dispersion (Monoazo Yellow) was obtained at the time which a given particle diameter was reached. This colorant dispersion (Monoazo Yellow) had a volume-average diameter (Mv) as determined with Nanotrac of 183 nm and a solid concentration of 24.0% by mass.

<Production of Toner Base Particles AA>

Toner base particles AA were obtained by conducting the same procedure as in "Production of Toner Base Particles P" of Example 3-1, except that the colorant dispersion among the ingredients for the toner base particles P was replaced with 6.0 parts of the colorant Monoazo Yellow dispersion and that "Core Material Aggregation Step", "Shell Covering Step", and "Rounding Step", among the aggregation step (core material aggregation step and shell covering step), rounding step, cleaning step, and drying step in "Production of Toner Base Particles P", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the contents were being stirred at 250 rpm at an internal temperature kept at 7° C., a 5% by mass aqueous solution of ferrous sulfate was added in an amount of 0.52 parts in terms of $FeSO_4.7H_2O$ amount over 5 minutes. Thereafter, the colorant dispersion was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 55.0° C. while maintaining the rotation speed of 250 rpm, and the particles were grown to a volume-median diameter (Dv50) as determined with Multisizer of 5.72 μm.

Shell Covering Step

Thereafter, a liquid mixture of the primary-polymer-particle dispersion A2 and 0.3 parts of the charge control agent dispersion β was added over 3 minutes while maintaining the internal temperature of 55.0° C. and the rotation speed of 250 rpm, and the resultant mixture was held for 60 minutes under the same conditions.

Rounding Step

Subsequently, the rotation speed was lowered to 150 rpm (stirring-blade peripheral speed, 1.56 msec; stirring speed lower by 40% than the rotation speed used in the aggregation step), and 20% aqueous DBS solution (6 parts on solid basis) was then added over 10 minutes. Thereafter, the mixture was heated to 84° C. over 30 minutes, and heating and stirring were continued until the average degree of circularity reached 0.944. This mixture was then cooled to 30° C. over 20 minutes to obtain a slurry.

<Production of Toner AA>

Thereafter, the toner base particles AA were subjected to the same external-additive addition step as in "Production of Toner P", except that the amount of the silica H2000 as an external additive was changed to 1.41 g and the amount of the fine titania powder SMT150IB as another external additive was changed to 0.56 g. Thus, a toner AA was obtained.

Analysis Step

The toner AA obtained above had a volume-median diameter (Dv50) and a "population number % of toner particles having a particle diameter of from 2.00 μm to 3.56 μm (Dns)", both determined with Multisizer, of 5.72 μm and 1.99%, respectively. The toner AA further had an average degree of circularity of 0.944 and a coefficient of variation in number of 18.8%. Furthermore, the toner gave a solid image having a gloss value of 29.6, and the toner on the developing roller had a surface potential of −33 V. The toner surface depressions attributable to the charge control agent had a size of 350 nm, and the charge control agent had been present in the range of ±R centering on the toner surface.

Comparative Example 3-6

Production of Toner Base Particles AB

Toner base particles AB were obtained by conducting the same procedure as in "Production of Toner Base Particles P" of Example 3-1, except that the colorant dispersion among the ingredients for the toner base particles P was replaced with 6.0 parts of the colorant Monoazo Yellow dispersion and that "Core Material Aggregation Step", "Shell Covering Step", and "Rounding Step", among the aggregation step (core material aggregation step and shell covering step), rounding step, cleaning step, and drying step in "Production of Toner Base Particles P", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the contents were being stirred at 250 rpm at an internal temperature kept at 7° C., a 5% by mass aqueous solution of ferrous sulfate was added in an amount of 0.52 parts in terms of $FeSO_4.7H_2O$ amount over 5 minutes. Thereafter, the colorant dispersion was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 55.0° C. while maintaining the rotation speed of 250 rpm, and the particles were grown to a volume-median diameter (Dv50) as determined with Multisizer of 5.94 μm.

Shell Covering Step

Thereafter, the primary-polymer-particle dispersion A2 was added over 3 minutes while maintaining the internal temperature of 55.0° C. and the rotation speed of 250 rpm, and the resultant mixture was held for 60 minutes under the same conditions.

Rounding Step

Subsequently, the rotation speed was lowered to 150 rpm (stirring-blade peripheral speed, 1.56 m/sec; stirring speed lower by 40% than the rotation speed used in the aggregation step), and 20% aqueous DBS solution (6 parts on solid basis) was then added over 10 minutes. Thereafter, the mixture was heated to 84° C. over 30 minutes, and heating and stirring were continued until the average degree of circularity reached 0.944. This mixture was then cooled to 30° C. over 20 minutes to obtain a slurry.

<Production of Toner AB>

Thereafter, the toner base particles AB were subjected to the same external-additive addition step as in "Production of Toner P", except that the amount of the silica H2000 as an external additive was changed to 1.41 g and the amount of the fine titania powder SMT150IB as another external additive was changed to 0.56 g. Thus, a toner AB was obtained.

Analysis Step

The toner AB obtained above had a volume-median diameter (Dv50) and a "population number % of toner particles having a particle diameter of from 2.00 μm to 3.56 μm (Dns)", both determined with Multisizer, of 5.94 μm and 13.09%, respectively. The toner AB further had an average degree of circularity of 0.938 and a coefficient of variation in number of 23.8%. Furthermore, the toner gave a solid image having a gloss value of 32.9, and the toner on the developing roller had a surface potential of −28 V.

Example 3-8

Preparation of Colorant Dispersion (Phthalocyanine Blue)

Into a vessel having a capacity of 300 L and equipped with a stirrer (propeller blades) were introduced 20 parts (40 kg) of Phthalocyanine Blue (Hostaperm Blue B2G, manufactured by Clariant Japan K.K.), 1 part of 20% aqueous DBS solution, 4 parts of a nonionic surfactant (Emulgen 120, manufactured by Kao Corp.), and 75 parts of ion-exchanged water having an electrical conductivity of 2 μS/cm. The pigment was preliminarily dispersed to obtain a pigment premix liquid. In the dispersion obtained through pigment premixing, the Phthalocyanine Blue had a volume-average diameter (Mv) as determined with Nanotrac of about 90 μm.

The pigment premix liquid was fed as a raw slurry to a wet-type bead mill and subjected to a circulating dispersion process. The mill had a stator inner diameter of 75 mm, a separator diameter of 60 mm, and a separator-to-disk distance of 15 mm, and zirconia beads having a diameter of 50 μm (true density, 6.0 g/cm$^3$) were used as a dispersing medium. The stator had an effective inner volume of 0.5 L, and the medium was packed so as to occupy a volume of 0.35 L. Consequently, the degree of medium packing was 70% by mass. The rotor was rotated at a constant speed (peripheral speed of rotor, 11 m/sec), and the pigment premix liquid was continuously fed through the feed opening with a non-pulsating constant-delivery pump at a feed rate of 50 L/hr and continuously discharged through the discharge opening. This operation was repeated to circulate the pigment premix liquid, whereby a colorant dispersion (Phthalocyanine Blue) was obtained at the time which a given particle diameter was reached. This colorant dispersion (Phthalocyanine Blue) had a volume-average diameter (Mv) as determined with Nanotrac of 131 nm and a solid concentration of 24.1% by mass.

<Production of Toner Base Particles AC>

Toner base particles AC were obtained by conducting the same procedure as in "Production of Toner Base Particles P" of Example 3-1, except that the colorant dispersion among the ingredients for the toner base particles P was replaced with 4.4 parts of the colorant Phthalocyanine Blue dispersion and that "Core Material Aggregation Step", "Shell Covering Step", and "Rounding Step", among the aggregation step (core material aggregation step and shell covering step), rounding step, cleaning step, and drying step in "Production of Toner Base Particles P", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the contents were being stirred at 250 rpm at an internal temperature kept at 7° C., a 5% by mass aqueous solution of ferrous sulfate was added in an amount of 0.52 parts in terms of $FeSO_4.7H_2O$ amount over 5 minutes. Thereafter, the colorant dispersion was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 55.0° C. while maintaining the rotation speed of 250 rpm, and the particles were grown to a volume-median diameter (Dv50) as determined with Multisizer of 5.85 μm.

Shell Covering Step

Thereafter, a liquid mixture of the primary-polymer-particle dispersion A2 and 0.3 parts of the charge control agent dispersion β was added over 3 minutes while maintaining the internal temperature of 55.0° C. and the rotation speed of 250 rpm, and the resultant mixture was held for 60 minutes under the same conditions.

Rounding Step

Subsequently, the rotation speed was lowered to 150 rpm (stirring-blade peripheral speed, 1.56 m/sec; stirring speed lower by 40% than the rotation speed used in the aggregation step), and 20% aqueous DBS solution (6 parts on solid basis) was then added over 10 minutes. Thereafter, the mixture was heated to 84° C. over 30 minutes, and heating and stirring were continued until the average degree of circularity reached 0.944. This mixture was then cooled to 30° C. over 20 minutes to obtain a slurry.

<Production of Toner AC>

Thereafter, the toner base particles AC were subjected to the same external-additive addition step as in "Production of Toner P", except that the amount of the silica H2000 as an external additive was changed to 1.41 g and the amount of the fine titania powder SMT150IB as another external additive was changed to 0.56 g. Thus, a toner AC was obtained.

Analysis Step

The toner AC obtained above had a volume-median diameter (Dv50) and a "population number % of toner particles having a particle diameter of from 2.00 μm to 3.56 μm (Dns)", both determined with Multisizer, of 5.85 μm and 2.93%, respectively. The toner AC further had an average degree of circularity of 0.944 and a coefficient of variation in number of 19%. Furthermore, the toner gave a solid image having a gloss value of 28.9, and the toner on the developing roller had a surface potential of −35 V. The toner surface depressions attributable to the charge control agent had a size of 350 nm, and the charge control agent had been present in the range of ±R centering on the toner surface.

Comparative Example 3-7

Production of Toner Base Particles AD

Toner base particles AD were obtained by conducting the same procedure as in "Production of Toner Base Particles P" of Example 3-1, except that the colorant dispersion among the ingredients for the toner base particles P was replaced with 4.4 parts of the colorant Phthalocyanine Blue dispersion and that "Core Material Aggregation Step", "Shell Covering Step", and "Rounding Step", among the aggregation step (core material aggregation step and shell covering step), rounding step, cleaning step, and drying step in "Production of Toner Base Particles P", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the contents were being stirred at 250 rpm at an internal temperature kept at 7° C., a 5% by mass aqueous solution of ferrous sulfate was added in an amount of 0.52 parts in terms of $FeSO_4.7H_2O$ amount over 5 minutes. Thereafter, the colorant dispersion was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 55.0° C. while maintaining the rotation speed of 250 rpm, and the particles were grown to a volume-median diameter (Dv50) as determined with Multisizer of 5.94 μm.

Shell Covering Step

Thereafter, the primary-polymer-particle dispersion A2 was added over 3 minutes while maintaining the internal temperature of 55.0° C. and the rotation speed of 250 rpm, and the resultant mixture was held for 60 minutes under the same conditions.

Rounding Step

Subsequently, the rotation speed was lowered to 150 rpm (stirring-blade peripheral speed, 1.56 msec; stirring speed lower by 40% than the rotation speed used in the aggregation step), and 20% aqueous DBS solution (6 parts on solid basis) was then added over 10 minutes. Thereafter, the mixture was heated to 84° C. over 30 minutes, and heating and stirring were continued until the average degree of circularity reached 0.944. This mixture was then cooled to 30° C. over 20 minutes to obtain a slurry.

<Production of Toner AD>

Thereafter, the toner base particles AD were subjected to the same external-additive addition step as in "Production of Toner P", except that the amount of the silica H2000 as an external additive was changed to 1.41 g and the amount of the fine titania powder SMT150IB as another external additive was changed to 0.56 g. Thus, a toner AD was obtained.

Analysis Step

The toner AD obtained above had a volume-median diameter (Dv50) and a "population number % of toner particles having a particle diameter of from 2.00 μm to 3.56 μm (Dns)", both determined with Multisizer, of 5.26 μm and 7.74%, respectively. The toner AD further had an average degree of circularity of 0.940 and a coefficient of variation in number of 20.8%. Furthermore, the toner gave a solid image having a gloss value of 32.2, and the toner on the developing roller had a surface potential of −27 V.

Comparative Example 3-8

Production of Toner Base Particles AE

Toner base particles AE were obtained by conducting the same procedure as in "Production of Toner Base Particles P" of Example 3-1, except that the colorant dispersion among the ingredients for the toner base particles P was replaced with 4.4 parts of the colorant Phthalocyanine Blue dispersion and that "Core Material Aggregation Step", "Shell Covering Step", and "Rounding Step", among the aggregation step (core material aggregation step and shell covering step), rounding step, cleaning step, and drying step in "Production of Toner Base Particles P", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the contents were being stirred at 250 rpm at an internal temperature kept at 7° C., a 5% by mass aqueous solution of ferrous sulfate was added in an amount of 0.52 parts in terms of $FeSO_4.7H_2O$ amount over 5 minutes. Thereafter, the colorant dispersion was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 55.0° C. while maintaining the rotation speed of 250 rpm, and the particles were grown to a volume-median diameter (Dv50) as determined with Multisizer of 5.19 μm.

Shell Covering Step

Thereafter, the primary-polymer-particle dispersion A2 was added over 3 minutes while maintaining the internal temperature of 55.0° C. and the rotation speed of 250 rpm, and the resultant mixture was held for 60 minutes under the same conditions.

Rounding Step

Subsequently, the rotation speed was lowered to 150 rpm (stirring-blade peripheral speed, 1.56 m/sec; stiffing speed lower by 40% than the rotation speed used in the aggregation step), and 20% aqueous DBS solution (6 parts on solid basis) was then added over 10 minutes. Thereafter, the mixture was heated to 84° C. over 30 minutes, and heating and stirring were continued until the average degree of circularity reached 0.944. This mixture was then cooled to 30° C. over 20 minutes to obtain a slurry.

<Production of Toner AE>

Thereafter, the toner base particles AE were subjected to the same external-additive addition step as in "Production of Toner P", except that the amount of the silica H2000 as an external additive was changed to 1.41 g and the amount of the fine titania powder SMT150IB as another external additive was changed to 0.56 g. Thus, a toner AE was obtained.

Analysis Step

The toner ZZ obtained above had a volume-median diameter (Dv50) and a "population number % of toner particles having a particle diameter of from 2.00 μm to 3.56 μm (Dns)", both determined with Multisizer, of 5.19 μm and 10.32%, respectively. The toner AE further had an average degree of circularity of 0.943 and a coefficient of variation in number of 20.3%. Furthermore, the toner gave a solid image having a gloss value of 32.7, and the toner on the developing roller had a surface potential of −26 V.

Comparative Example 3-9

Production of Toner Base Particles AF

Toner base particles AF were obtained by conducting the same procedure as in "Production of Toner Base Particles P" of Example 3-1, except that the colorant dispersion among the ingredients for the toner base particles P was replaced with 4.4 parts of the colorant Phthalocyanine Blue dispersion and that "Core Material Aggregation Step", "Shell Covering Step", and "Rounding Step", among the aggregation step (core material aggregation step and shell covering step), rounding step, cleaning step, and drying step in "Production of Toner Base Particles P", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the contents were being stirred at 250 rpm at an internal temperature kept at 7° C., a 5% by mass aqueous solution of ferrous sulfate was added in an amount of 0.52 parts in terms of $FeSO_4.7H_2O$ amount over 5 minutes. Thereafter, the colorant dispersion was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 55.0° C. while maintaining the rotation speed of 250 rpm, and the particles were grown to a volume-median diameter (Dv50) as determined with Multisizer of 5.31 μm.

Shell Covering Step

Thereafter, the primary-polymer-particle dispersion A2 was added over 3 minutes while maintaining the internal temperature of 55.0° C. and the rotation speed of 250 rpm, and the resultant mixture was held for 60 minutes under the same conditions.

Rounding Step

Subsequently, the rotation speed was lowered to 150 rpm (stirring-blade peripheral speed, 1.56 msec; stirring speed lower by 40% than the rotation speed used in the aggregation step), and 20% aqueous DBS solution (6 parts on solid basis) was then added over 10 minutes. Thereafter, the mixture was heated to 84° C. over 30 minutes, and heating and stirring were continued until the average degree of circularity reached 0.944. This mixture was then cooled to 30° C. over 20 minutes to obtain a slurry.

<Production of Toner AF>

Thereafter, the toner base particles AF were subjected to the same external-additive addition step as in "Production of Toner P", except that the amount of the silica H2000 as an external additive was changed to 1.41 g and the amount of the fine titania powder SMT150IB as another external additive was changed to 0.56 g. Thus, a toner AF was obtained.

Analysis Step

The toner AF obtained above had a volume-median diameter (Dv50) and a "population number % of toner particles having a particle diameter of from 2.00 μm to 3.56 μm (Dns)", both determined with Multisizer, of 5.31 μm and 6.91%, respectively. The toner AF further had an average degree of circularity of 0.940 and a coefficient of variation in number of 19.5%. Furthermore, the toner gave a solid image having a gloss value of 32.2, and the toner on the developing roller had a surface potential of −29 V.

TABLE 4

| | Charge control agent | | | | Toner | | | | | | |
|---|---|---|---|---|---|---|---|---|---|---|---|
| | Charge control agent No. | Kind | Dispersed-state diameter nm | Concen-tration % | Toner No. | Volume-median diameter (Dv50) μm | Average degree of circu-larity | 0.233exp (17.3/Dv5 | Dns % | Coefficient of variation in number % | Diameter of de-pression nm |
| Example 3-1 | α | E-81 | 200 | 0.3 | P | 7.11 | 0.943 | 2.66 | 1.67 | 19.2 | 400 |
| Example 3-2 | α | E-81 | 200 | 1.0 | Q | 7.02 | 0.951 | 2.74 | 2.05 | 21.4 | 400 |
| Example 3-3 | β | TN-105 | 160 | 0.3 | R | 7.25 | 0.944 | 2.53 | 1.99 | 18.9 | 350 |
| Example 3-4 | β | TN-105 | 160 | 0.5 | S | 7.05 | 0.943 | 2.71 | 2.52 | 19.6 | 350 |
| Example 3-5 | β | TN-105 | 160 | 1.0 | T | 7.08 | 0.948 | 2.68 | 1.82 | 19.1 | 350 |
| Example 3-6 | γ | T-77 | 180 | 1.0 | U | 6.91 | 0.948 | 2.85 | 2.57 | 22.3 | 400 |
| Comparative Example 3-1 | δ | E-84 | 650 | 1.0 | V | 6.6 | 0.936 | 3.20 | 4.01 | 21.8 | 1200 |
| Comparative Example 3-2 | ϵ | TN-105 | 550 | 1.0 | W | 6.83 | 0.944 | 2.93 | 3.47 | 22.8 | 1200 |
| Comparative Example 3-3 | ζ | CCR | 66 | 0.5 | X | 5.71 | 0.958 | 4.82 | 1.6 | 22.0 | — |
| Comparative Example 3-4 | β | TN-105 | 160 | 1.0 | Y | 7.06 | 0.943 | 2.70 | 2.03 | 21.2 | 0 |
| Comparative Example 3-5 | β | TN-105 | 160 | 1.0 | Z | 6.56 | 0.945 | 3.26 | 3.22 | 24.4 | 350 |
| Example 3-7 | β | TN-105 | 160 | 0.3 | AA | 5.72 | 0.944 | 4.80 | 2.86 | 18.8 | 350 |
| Comparative Example 3-6 | — | — | — | — | AB | 5.94 | 0.938 | 4.29 | 13.09 | 23.8 | — |
| Example 3-8 | β | TN-105 | 160 | 0.3 | AC | 5.85 | 0.944 | 4.48 | 2.93 | 19.0 | 350 |
| Comparative Example 3-7 | — | — | — | — | AD | 5.26 | 0.940 | 6.25 | 7.74 | 20.8 | — |
| Comparative Example 3-8 | — | — | — | — | AE | 5.19 | 0.943 | 6.53 | 10.32 | 20.3 | — |
| Comparative Example 3-9 | — | — | — | — | AF | 5.31 | 0.940 | 6.06 | 6.91 | 19.5 | — |

TABLE 5

| | Charge amount | | | Image | |
|---|---|---|---|---|---|
| | Quick electri-fication −μC/g | Surface potential −V | Gloss 75° | Image — | Fouling — |
| Example 3-1 | 30 | 33 | 26.4 | good | good |
| Example 3-2 | 21.3 | | | excellent | good |
| Example 3-3 | 32.7 | 35 | 26.4 | good | good |
| Example 3-4 | 33.6 | 34 | 29.5 | excellent | excellent |
| Example 3-5 | 34.7 | | | excellent | excellent |
| Example 3-6 | 15.2 | 30 | 30.7 | good | good |
| Comparative Example 3-1 | 13.8 | 28 | 32.8 | poor | poor |
| Comparative Example 3-2 | 14.4 | 27 | 32.9 | poor | fair |
| Comparative Example 3-3 | 10.3 | | | poor | poor |
| Comparative Example 3-4 | 9.6 | | | poor | poor |
| Comparative Example 3-5 | 10.1 | 29 | 32.5 | poor | fair |
| Example 3-7 | 46 | 33 | 29.6 | excellent | excellent |
| Comparative Example 3-6 | 43.5 | 28 | 32.9 | fair | fair |
| Example 3-8 | 37.3 | 35 | 28.9 | excellent | excellent |
| Comparative Example 3-7 | 24 | 27 | 32.2 | fair | fair |
| Comparative Example 3-8 | 26.2 | 26 | 32.7 | poor | fair |
| Comparative Example 3-9 | 28 | 29 | 32.2 | fair | good |

In Examples 4-1 to 4-6 and Comparative Examples 4-1 to 4-3, actual-printing evaluation was conducted by the following method.

As an image-forming apparatus for the actual-printing evaluation, use was made of a printer of the developing-rubber-roller contact development type employing a nonmagnetic one-component toner. This printer employed an organic photoreceptor as an electrostatic-image holding member and was of the type including the steps of charging the photoreceptor with a charging roller, forming an electrostatic latent image with a laser light, transferring a toner image from the photoreceptor to a receiving material, e.g., paper, held on a semiconductive belt, and removing an untransferred toner remaining on the photoreceptor with a cleaning blade made of a urethane rubber. This printer had a process speed of 120 mm/sec.

The urethane rubber had a rubber hardness of 70. The printer had a guaranteed life in terms of number of prints of 8,000 sheets at a coverage rate of 5%. The resolution on the electrostatic-image holding member was 600 dpi.

A hundred grams of a toner was packed into a cartridge for the image-forming apparatus, and this apparatus was run (printing was conducted) using a chart having a coverage rate of 5%.

In actual-printing evaluation, an image quality evaluation pattern was printed at the initial stage, i.e., immediately after the packing, and after 500-sheet printing and after 1,000-sheet printing. According to the state of printing, the running was further continued. During the intervals between the printing operations using the image quality evaluation pattern, the apparatus was run using a pattern having a coverage rate of 5%. At the initial stage, after 500th-sheet printing, and after 1,000th-sheet printing, the apparatus was examined also for toner dusting around the developing roller and for the fouling of the charging roller.

Example 4-1

Preparation of Colorant Dispersion B

Into a vessel having a capacity of 300 L and equipped with a stirrer (propeller blades) were introduced 20 parts (40 kg) of a carbon black produced by the furnace process and having a toluene-extract ultraviolet absorbance of 0.02 and a true density of 1.8 g/cm$^3$ (Mitsubishi Carbon Black MA100S, manufactured by Mitsubishi Chemical Corp.), 1 part of 20% aqueous DBS solution, 4 parts of a nonionic surfactant (Emulgen 120, manufactured by Kao Corp.), and 75 parts of ion-exchanged water having an electrical conductivity of 2 μS/cm. The carbon black was preliminarily dispersed to obtain a pigment premix liquid. In the dispersion obtained through pigment premixing, the carbon black had a volume-average diameter (Mv) as determined with Nanotrac of 90 μm.

The pigment premix liquid was fed as a raw slurry to a wet-type bead mill and subjected to a one-through dispersion process. The mill had a stator inner diameter of 75 mm, a separator diameter of 60 mm, and a separator-to-disk distance of 15 mm, and zirconia beads having a diameter of 100 μm (true density, 6.0 g/cm$^3$) were used as a dispersing medium. The stator had an effective inner volume of 0.5 L, and the medium was packed so as to occupy a volume of 0.35 L. Consequently, the degree of medium packing was 70% by mass. The rotor was rotated at a constant speed (peripheral speed of rotor, 11 m/sec), and the pigment premix liquid was continuously fed through the feed opening with a non-pulsating constant-delivery pump at a feed rate of 50 L/hr and continuously discharged through the discharge opening, whereby a black colorant dispersion H was obtained. This colorant dispersion H had a volume-average diameter (Mv) as determined with Nanotrac of 150 nm and a solid concentration of 24.2% by mass.

<Production of Toner Base Particles AG>

The ingredients shown below were used, and the aggregation step (core material aggregation step and shell covering step), rounding step, cleaning step, and drying step shown below were conducted to thereby produce toner base particles AG Primary-polymer-particle dispersion H1: 90 parts on solid basis (958.9 g in terms of solid amount)

Primary-polymer-particle dispersion H2: 10 parts on solid basis

Colorant dispersion B: 4.4 parts in terms of colorant solid amount

20% aqueous DBS solution: 0.15 parts on solid basis; used in the core material aggregation step 20% aqueous DBS solution: 6 parts on solid basis; used in the rounding step Core Material Aggregation Step The primary-polymer-particle dispersion H1 and 20% aqueous DBS solution were introduced into a mixing vessel (capacity, 12 L; inner diameter, 208 mm; height, 355 mm) equipped with a stirrer (double-helical blade), a heating/cooling device, and feeders for raw materials/aids. The contents were evenly mixed for 10 minutes at an internal temperature of 10° C. Subsequently, while the contents were being stirred at 280 rpm at an internal temperature of 10° C., a 5% by mass aqueous solution of potassium sulfate was continuously added thereto over 1 minute in an amount of 0.12 parts in terms of $K_2SO_4$ amount. Thereafter, the colorant dispersion was continuously added over 5 minutes, and the contents were evenly mixed at an internal temperature of 10° C.

Thereafter, 100 parts of desalted water was continuously added over 30 minutes, and the internal temperature was elevated to 48.0° C. over 67 minutes (0.5° C./min) while maintaining the rotation speed of 280 rpm. Subsequently, the temperature was elevated by 1° C. at intervals of 30 minutes (0.03° C./min), and the dispersion was then held at 54.0° C. While the volume-median diameter (Dv50) of the particles was being determined with Multisizer, the particles were grown to 5.15 μm.

The stirring conditions used in this operation are as follows.

(a) Diameter of the stirring vessel (regarded as general cylinder): 208 mm.

(b) Height of the stirring vessel: 355 mm.

(c) Stirring-blade peripheral speed: 280 rpm, i.e., 2.78 msec.

(d) Shape of the stirring blades: double-helical blade (diameter, 190 mm; height, 270 mm; width, 20 mm).

(e) Blade position in the stirring vessel: disposed above the bottom of the vessel at a distance of 5 mm therefrom.

Shell Covering Step

Thereafter, the primary-polymer-particle dispersion H2 was continuously added over 6 minutes while maintaining the internal temperature of 54.0° C. and the rotation speed of 280 rpm, and the resultant mixture was held for 60 minutes under these conditions. In the resultant dispersion, the particles had a Dv50 of 5.34 μm.

Rounding Step

Subsequently, the dispersion was heated to 83° C. while an aqueous solution prepared by mixing 20% aqueous DBS solution (6 parts on solid basis) with 0.04 parts of water was being added thereto over 30 minutes. Thereafter, the mixture was heated to 88° C. by elevating the temperature thereof by 1° C. at intervals of 30 minutes, and heating and stirring were continued under these conditions over 3.5 hours until the average degree of circularity reached 0.939. Thereafter, the mixture was cooled to 20° C. over 10 minutes to obtain a slurry. In this slurry, the particles had a Dv50 of 5.33 μm and an average degree of circularity of 0.937.

Cleaning Step

The slurry obtained was discharged and subjected to suction filtration through filter paper 5-shu C (No. 5C, manufactured by Toyo Roshi Kaisha, Ltd.) with an aspirator. The cake remaining on the filter paper was transferred to a stainless-steel vessel having a capacity of 10 L and equipped with a stirrer (propeller blades). Thereto was added 8 kg of ion-exchanged water having an electrical conductivity of 1 μS/cm. The resultant mixture was stirred at 50 rpm to thereby evenly disperse the particles and was then kept being stirred for 30 minutes.

Thereafter, the dispersion was subjected again to suction filtration through filter paper 5-shu C (No. 5C, manufactured by Toyo Roshi Kaisha, Ltd.) with an aspirator. The solid matter remaining on the filter paper was transferred again to a vessel which had a capacity of 10 L and was equipped with a stirrer (propeller blades) and which contained 8 kg of ion-exchanged water having an electrical conductivity of 1 μS/cm, and the resultant mixture was stirred at 50 rpm to thereby evenly disperse the particles and was then kept being stirred for 30 minutes. This step was repeated 5 times. As a result, the electrical conductivity of the filtrate became 2 μS/cm.

Drying Step

The solid matter obtained above was spread in a stainless-steel vat to a height of 20 mm, and dried for 48 hours in an air-blowing drying oven set at 40° C. Thus, toner base particles AG were obtained.

<Production of Toner AG>

External-Additive Addition Step

To 500 g of the toner base particles AG obtained was added 8.75 g of silica H30TD, manufactured by Clariant K.K., as an external additive. The ingredients were mixed together by means of a 9-L Henschel mixer (Mitsui Henschel Mixer FM10B/I, manufactured by Mitsui Mining Co., Ltd.) employing a Z-shaped upper blade and an A0-type lower blade, at 3,000 rpm for 30 minutes. Thereafter, 1.40 of calcium phosphate HAP-05NP, manufactured by Maruo Calcium Co., Ltd., was added thereto, and the ingredients were mixed together at 3,000 rpm for 10 minutes. The resultant mixture was sieved through a 200-mesh sieve to obtain a toner AG.

Analysis Step

The toner AG obtained above had a "volume-median diameter (Dv50)" and a "population number % of toner particles having a particle diameter of from 2.00 μm to 3.56 μm (Dns)", both determined with Multisizer, of 5.33 μm and 5.81%, respectively. The toner AG further had an average degree of circularity of 0.945 and a coefficient of variation in number of 18.9%.

Actual-Printing Evaluation

The toner AG was tested by the evaluation method described above. The toner AG attained satisfactory image quality at the initial stage, after 500th-sheet printing, and after 1,000th-sheet printing. Neither toner dusting nor charging roller fouling occurred. In the period when the pattern having a coverage rate of 5% was continuously printed during the intervals between image check operations, neither an image failure nor any other defect was especially observed. Removability in cleaning was satisfactory.

Example 4-2

Production of Toner Base Particles AH

The ingredients shown below were used, and the aggregation step (core material aggregation step and shell covering step), rounding step, cleaning step, and drying step shown below were conducted to thereby produce toner base particles I.

Primary-polymer-particle dispersion A1: 95 parts on solid basis (998.2 g in terms of solid amount)

Primary-polymer-particle dispersion A2: 5 parts on solid basis

Colorant dispersion B: 6 parts in terms of colorant solid amount

20% aqueous DBS solution: 0.2 parts on solid basis; used in the core material aggregation step 20% aqueous DBS solution: 6 parts on solid basis; used in the rounding step Core Material Aggregation Step The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the contents were being stirred at 250 rpm at an internal temperature kept at 7° C., a 5% by mass aqueous solution of ferrous sulfate was added in an amount of 0.52 parts in terms of $FeSO_4.7H_2O$ amount over 5 minutes. Thereafter, the colorant dispersion was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 55.0° C. while maintaining the rotation speed of 250 rpm, and the particles were grown to a volume-median diameter (Dv50) as determined with Multisizer of 5.86 μm.

Shell Covering Step

Thereafter, the primary-polymer-particle dispersion A2 was added over 3 minutes while maintaining the internal temperature of 55.0° C. and the rotation speed of 250 rpm, and the resultant mixture was held for 60 minutes under the same conditions.

Rounding Step

Subsequently, the rotation speed was lowered to 150 rpm (stirring-blade peripheral speed, 1.56 m/sec; stirring speed lower by 40% than the rotation speed used in the aggregation step), and 20% aqueous DBS solution (6 parts on solid basis) was then added over 10 minutes. Thereafter, the mixture was heated to 84° C. over 30 minutes, and heating and stirring were continued until the average degree of circularity reached 0.942. This mixture was then cooled to 30° C. over 20 minutes to obtain a slurry.

Cleaning Step

The slurry obtained was discharged and subjected to suction filtration through filter paper 5-shu C (No. 5C, manufactured by Toyo Roshi Kaisha, Ltd.) with an aspirator. The cake remaining on the filter paper was transferred to a stainless-steel vessel having a capacity of 10 L and equipped with a stirrer (propeller blades). Thereto was added 8 kg of ion-exchanged water having an electrical conductivity of 1 μS/cm. The resultant mixture was stirred at 50 rpm to thereby evenly disperse the particles and was then kept being stirred for 30 minutes.

Thereafter, the dispersion was subjected again to suction filtration through filter paper 5-shu C (No. 5C, manufactured by Toyo Roshi Kaisha, Ltd.) with an aspirator. The solid matter remaining on the filter paper was transferred again to a vessel which had a capacity of 10 L and was equipped with a stirrer (propeller blades) and which contained 8 kg of ion-exchanged water having an electrical conductivity of 1 μS/cm, and the resultant mixture was stirred at 50 rpm to thereby evenly disperse the particles and was then kept being stirred for 30 minutes. This step was repeated 5 times. As a result, the electrical conductivity of the filtrate became 2 μS/cm.

Drying Step

The solid matter obtained above was spread in a stainless-steel vat to a height of 20 mm, and dried for 48 hours in an air-blowing drying oven set at 40° C. Thus, toner base particles AH were obtained.

<Production of Toner AH>

External-Additive Addition Step

To 500 g of the toner base particles AH obtained was added 7.70 g of silica H30TD, manufactured by Clariant K.K., as an external additive. The ingredients were mixed together by means of a 9-L Henschel mixer (Mitsui Henschel Mixer FM10B/I, manufactured by Mitsui Mining Co., Ltd.) employing a Z-shaped upper blade and an A0-type lower blade, at 3,000 rpm for 30 minutes. Thereafter, 1.23 of calcium phosphate HAP-05NP, manufactured by Maruo Calcium Co., Ltd., was added thereto, and the ingredients were mixed together at 3,000 rpm for 10 minutes. The resultant mixture was sieved through a 200-mesh sieve to obtain a toner AH.

Analysis Step

The toner A11 obtained above had a "volume-median diameter (Dv50)" and a "population number % of toner particles having a particle diameter of from 2.00 μm to 3.56 μm (Dns)", both determined with Multisizer, of 6.01 μm and 2.57%, respectively. The toner AH further had an average degree of circularity of 0.945 and a coefficient of variation in number of 18.5%.

Actual-Printing Evaluation

The toner AH was tested by the evaluation method described above. The toner AH attained satisfactory image quality at the initial stage, after 500th-sheet printing, and after 1,000th-sheet printing. Neither toner dusting nor charging roller fouling occurred. In the period when the pattern having a coverage rate of 5% was continuously printed during the intervals between image check operations, neither an image failure nor any other defect was especially observed. Removability in cleaning was satisfactory.

Example 4-3

Production of Toner Base Particles AI

Toner base particles AI were obtained by conducting the same procedure as in "Production of Toner Base Particles AH" of Example 4-2, except that "Core Material Aggregation Step", "Shell Covering Step", and "Rounding Step", among the aggregation step (core material aggregation step and shell covering step), rounding step, cleaning step, and drying step in "Production of Toner Base Particles AH", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the contents were being stirred at 250 rpm at an internal temperature kept at 7° C., a 5% by mass aqueous solution of ferrous sulfate was added in an amount of 0.52 parts in terms of $FeSO_4.7H_2O$ amount over 5 minutes. Thereafter, the colorant dispersion was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 57.0° C. while maintaining the rotation speed of 250 rpm, and the particles were grown to a volume-median diameter (Dv50) as determined with Multisizer of 6.72 μm.

Shell Covering Step

Thereafter, the primary-polymer-particle dispersion A2 was added over 3 minutes while maintaining the internal temperature of 57.0° C. and the rotation speed of 250 rpm, and the resultant mixture was held for 60 minutes under the same conditions.

Rounding Step

Subsequently, the rotation speed was lowered to 150 rpm (stirring-blade peripheral speed, 1.56 m/sec; stirring speed lower by 40% than the rotation speed used in the aggregation step), and 20% aqueous DBS solution (6 parts on solid basis) was then added over 10 minutes. Thereafter, the mixture was heated to 87° C. over 30 minutes, and heating and stirring were continued until the average degree of circularity reached 0.941. This mixture was then cooled to 30° C. over 20 minutes to obtain a slurry.

<Production of Toner AI>

External-Additive Addition Step

To 500 g of the toner base particles AI obtained was added 6.25 g of silica H30TD, manufactured by Clariant K.K., as an external additive. The ingredients were mixed together by means of a 9-L Henschel mixer (Mitsui Henschel Mixer FM10B/1, manufactured by Mitsui Mining Co., Ltd.) employing a Z-shaped upper blade and an A0-type lower blade, at 3,000 rpm for 30 minutes. Thereafter, 1.00 of calcium phosphate HAP-05NP, manufactured by Maruo Calcium Co., Ltd., was added thereto, and the ingredients were mixed together at 3,000 rpm for 10 minutes. The resultant mixture was sieved through a 200-mesh sieve to obtain a toner AI.

Analysis Step

The toner AI obtained above had a "volume-median diameter (Dv50)" and a "population number % of toner particles having a particle diameter of from 2.00 μm to 3.56 μm (Dns)", both determined with Multisizer, of 6.84 μm and 1.81%, respectively. The toner AI further had an average degree of circularity of 0.942 and a coefficient of variation in number of 18.2%.

Actual-Printing Evaluation

The toner AI was tested by the evaluation method described above. The toner AI attained satisfactory image quality at the initial stage, after 500th-sheet printing, and after 1,000th-sheet printing. Neither toner dusting nor charging roller fouling occurred. In the period when the pattern having a coverage rate of 5% was continuously printed during the intervals between image check operations, neither an image failure nor any other defect was especially observed. Removability in cleaning was satisfactory.

Comparative Example 4-1

Production of Toner Base Particles AJ

Toner base particles AJ were obtained by conducting the same procedure as in "Production of Toner Base Particles AG" of Example 4-1, except that "Core Material Aggregation Step", "Shell Covering Step", and "Rounding Step", among the aggregation step (core material aggregation step and shell covering step), rounding step, cleaning step, and drying step in "Production of Toner Base Particles AG", were changed as shown below.

Core Material Aggregation Step

The primary-polymer-particle dispersion H1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 10 minutes at an internal temperature of 10° C. Subsequently, while the contents were being stirred at 280 rpm at an internal temperature of 10° C., 0.12 parts of a 5% by mass aqueous solution of potassium sulfate was continuously added thereto over 1 minute. Thereafter, the colorant dispersion was continuously added over 5 minutes, and the contents were evenly mixed at an internal temperature of 10° C. Thereafter, 100 parts of desalted water was continuously added over 30 minutes, and the internal temperature was then elevated to 34.0° C. over 40 minutes (0.6° C./min) while maintaining the rotation speed of 280 rpm. Subsequently, the dispersion was held for 20 minutes. While the volume-median diameter (Dv50) of the particles was being determined with Multisizer, the particles were grown to 3.81 μm.

Shell Covering Step

Thereafter, the primary-polymer-particle dispersion H2 was added over 6 minutes while maintaining the internal temperature of 34.0° C. and the rotation speed of 280 rpm, and the resultant mixture was held for 90 minutes under these conditions.

Rounding Step

Subsequently, 20% aqueous DBS solution (6 parts on solid basis) was added over 10 minutes while maintaining the rotation speed of 280 rpm (the same stirring speed as the rotation speed used in the aggregation step). Thereafter, the mixture was heated to 76° C. over 30 minutes, and heating and stirring were continued until the average degree of circularity reached 0.962. Thereafter, the mixture was cooled to 20° C. over 10 minutes to obtain a slurry.

<Production of Toner AK>

External-Additive Addition Step

Thereafter, 1 part of the toner base particles AJ were mixed with 100 parts of the toner base particles AG obtained in Example 4-1. Five hundred grams of the resultant toner base particle mixture AK was subjected to an external-additive addition treatment in the same manner as in Example 1 to obtain a toner AK.

Analysis Step

The toner AK obtained above had a "volume-median diameter (Dv50)" and a "population number % of toner particles having a particle diameter of from 2.00 μm to 3.56 μm (Dns)", both determined with Multisizer, of 5.24 μm and 6.81%, respectively. The toner AK further had an average degree of circularity of 0.946 and a coefficient of variation in number of 18.3%.

Actual-Printing Evaluation

The toner AK was evaluated in the same manner as in Example 4-1. The toner AK attained satisfactory image quality at the initial stage, after 500th-sheet printing, and after 1,000th-sheet printing. No toner dusting occurred. In the period when the pattern having a coverage rate of 5% was continuously printed during the intervals between image check operations, neither an image failure nor any other defect was especially observed. However, after the 1,000th-sheet printing, fouling of the charging roller caused by the toner and silica was observed. The pattern having a coverage rate of 5% was then continuously printed. As a result, when about the 1,200th sheet was printed, toner fouling occurred in the white background of the printed matter. The toner fouling occurred at intervals equal to the circumference of the charging roller, and is an image failure caused by a charging failure which occurs due to fouling of the charging roller. The evaluation was stopped at that point of time. With respect to removability in cleaning, fine toner particles were adherent to the surface of the cleaning blade and residual toner particles which had passed through the cleaning blade were observed on the photoreceptor. The toner AK showed poor removability in cleaning.

Example 4-4

Production of Toner Base Particles AL

Toner base particles AL were obtained by conducting the same procedure as in "Production of Toner Base Particles AH" of Example 4-2, except that "Core Material Aggregation Step", "Shell Covering Step", and "Rounding Step", among the aggregation step (core material aggregation step and shell covering step), rounding step, cleaning step, and drying step in "Production of Toner Base Particles A11", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the contents were being stirred at 250 rpm at an internal temperature kept at 21° C., a 5% by mass aqueous solution of ferrous sulfate was added in an amount of 0.52 parts in terms of $FeSO_4.7H_2O$ amount over 5 minutes. Thereafter, the colorant dispersion was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 54.0° C. while maintaining the rotation speed of 250 rpm, and the particles were grown to a volume-median diameter (Dv50) as determined with Multisizer of 5.34 μm.

Shell Covering Step

Thereafter, the primary-polymer-particle dispersion A2 was added over 3 minutes while maintaining the internal temperature of 54.0° C. and the rotation speed of 250 rpm, and the resultant mixture was held for 60 minutes under the same conditions.

Rounding Step

Subsequently, the rotation speed was lowered to 220 rpm (stirring-blade peripheral speed, 2.28 msec; stirring speed lower by 12% than the rotation speed used in the aggregation step), and 20% aqueous DBS solution (6 parts on solid basis) was then added over 10 minutes. Thereafter, the mixture was heated to 81° C. over 30 minutes, and heating and stirring were continued until the average degree of circularity reached 0.942. This mixture was then cooled to 30° C. over 20 minutes to obtain a slurry.

<Production of Toner AL>

External-Additive Addition Step

To 500 g of the toner base particles AK obtained was added 8.75 g of silica H30TD, manufactured by Clariant K.K., as an external additive. The ingredients were mixed together by means of a 9-L Henschel mixer (Mitsui Henschel Mixer FM10B/I, manufactured by Mitsui Mining Co., Ltd.) employing a Z-shaped upper blade and an A0-type lower blade, at 3,000 rpm for 30 minutes. Thereafter, 1.40 of calcium phosphate HAP-05NP, manufactured by Maruo Calcium Co., Ltd., was added thereto, and the ingredients were mixed together at 3,000 rpm for 10 minutes. The resultant mixture was sieved through a 200-mesh sieve to obtain a toner L.

Analysis Step

The toner AL obtained above had a "volume-median diameter (Dv50)" and a "population number % of toner particles having a particle diameter of from 2.00 μm to 3.56 μm (Dns)", both determined with Multisizer, of 5.45 μm and 4.60%, respectively. The toner AL further had an average degree of circularity of 0.946 and a coefficient of variation in number of 19.8%.

Actual-Printing Evaluation

The toner AL was tested by the evaluation method described above. The toner AL attained satisfactory image quality at the initial stage, after 500th-sheet printing, and after 1,000th-sheet printing. Neither toner dusting nor charging roller fouling occurred. In the period when the pattern having a coverage rate of 5% was continuously printed during the intervals between image check operations, neither an image failure nor any other defect was especially observed. Removability in cleaning was satisfactory.

Example 4-5

Production of Toner Base Particles AM

Toner base particles AM were obtained by conducting the same procedure as in "Production of Toner Base Particles AH" of Example 4-2, except that "Core Material Aggregation Step", "Shell Covering Step", and "Rounding Step", among the aggregation step (core material aggregation step and shell covering step), rounding step, cleaning step, and drying step in "Production of Toner Base Particles AH", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the contents were being stirred at 250 rpm at an internal temperature kept at 21° C., a 5% by mass aqueous solution of ferrous sulfate was added in an amount of 0.52 parts in terms of $FeSO_4.7H_2O$ amount over 5 minutes. Thereafter, the colorant dispersion was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 55.0° C. while maintaining the rotation speed of 250 rpm, and the particles were grown to a volume-median diameter (Dv50) as determined with Multisizer of 5.86 μm.

Shell Covering Step

Thereafter, the primary-polymer-particle dispersion A2 was added over 3 minutes while maintaining the internal temperature of 55.0° C. and the rotation speed of 250 rpm, and the resultant mixture was held for 60 minutes under the same conditions.

Rounding Step

Subsequently, the rotation speed was lowered to 220 rpm (stirring-blade peripheral speed, 2.28 msec; stirring speed lower by 12% than the rotation speed used in the aggregation step), and 20% aqueous DBS solution (6 parts on solid basis) was then added over 10 minutes. Thereafter, the mixture was heated to 84° C. over 30 minutes, and heating and stirring were continued until the average degree of circularity reached 0.941. This mixture was then cooled to 30° C. over 20 minutes to obtain a slurry.

<Production of Toner AM>

External-Additive Addition Step

To 500 g of the toner base particles AM obtained was added 7.70 g of silica H30TD, manufactured by Clariant K.K., as an external additive. The ingredients were mixed together by means of a 9-L Henschel mixer (Mitsui Henschel Mixer FM10B/I, manufactured by Mitsui Mining Co., Ltd.) employing a Z-shaped upper blade and an A0-type lower blade, at 3,000 rpm for 30 minutes. Thereafter, 1.23 of calcium phosphate HAP-05NP, manufactured by Maruo Calcium Co., Ltd., was added thereto, and the ingredients were mixed together at 3,000 rpm for 10 minutes. The resultant mixture was sieved through a 200-mesh sieve to obtain a toner AM.

Analysis Step

The toner AM obtained above had a "volume-median diameter (Dv50)" and a "population number % of toner particles having a particle diameter of from 2.00 μm to 3.56 μm (Dns)", both determined with Multisizer, of 5.98 μm and 3.98%, respectively. The toner AM further had an average degree of circularity of 0.942 and a coefficient of variation in number of 19.6%.

Actual-Printing Evaluation

The toner AM was tested by the evaluation method described above. The toner AM attained satisfactory image quality at the initial stage, after 500th-sheet printing, and after 1,000th-sheet printing. Neither toner dusting nor charging roller fouling occurred. In the period when the pattern having a coverage rate of 5% was continuously printed during the intervals between image check operations, neither an image failure nor any other defect was especially observed. Removability in cleaning was satisfactory.

Example 4-6

Production of Toner Base Particles AN

Toner base particles AN were obtained by conducting the same procedure as in "Production of Toner Base Particles AH" of Example 4-2, except that "Core Material Aggregation Step", "Shell Covering Step", and "Rounding Step", among the aggregation step (core material aggregation step and shell covering step), rounding step, cleaning step, and drying step in "Production of Toner Base Particles AH", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the contents were being stirred at 250 rpm at an internal temperature kept at 21° C., a 5% by mass aqueous solution of ferrous sulfate was added in an amount of 0.52 parts in terms of $FeSO_4.7H_2O$ amount over 5 minutes. Thereafter, the colorant dispersion was added over 5 minutes, and the contents were evenly mixed at an internal temperature of 7° C. Furthermore, under the same conditions, 0.5% by mass aqueous aluminum sulfate solution was added dropwise over 8 minutes (0.10 part in terms of solid amount based on solid resin amount). Thereafter, the internal temperature was elevated to 57.0° C. while maintaining the rotation speed of 250 rpm, and the particles were grown to a volume-median diameter (Dv50) as determined with Multisizer of 6.76 μm.

Shell Covering Step

Thereafter, the primary-polymer-particle dispersion A2 was added over 3 minutes while maintaining the internal temperature of 57.0° C. and the rotation speed of 250 rpm, and the resultant mixture was held for 60 minutes under the same conditions.

Rounding Step

Subsequently, the rotation speed was lowered to 220 rpm (stirring-blade peripheral speed, 2.28 m/sec; stirring speed lower by 12% than the rotation speed used in the aggregation step), and 20% aqueous DBS solution (6 parts on solid basis) was then added over 10 minutes. Thereafter, the mixture was heated to 87° C. over 30 minutes, and heating and stirring were continued until the average degree of circularity reached 0.941. This mixture was then cooled to 30° C. over 20 minutes to obtain a slurry.

<Production of Toner AN>

External-Additive Addition Step

To 500 g of the toner base particles AN was added 6.25 g of silica H30TD, manufactured by Clariant K.K., as an external additive. The ingredients were mixed together by means of a 9-L Henschel mixer (Mitsui Henschel Mixer FM10B/I, manufactured by Mitsui Mining Co., Ltd.) employing a Z-shaped upper blade and an A0-type lower blade, at 3,000 rpm for 30 minutes. Thereafter, 1.00 g of calcium phosphate HAP-05NP, manufactured by Maruo Calcium Co., Ltd., was added thereto, and the ingredients were mixed together at 3,000 rpm for 10 minutes. The resultant mixture was sieved through a 200-mesh sieve to obtain a toner AN.

Analysis Step

The toner AN obtained above had a "volume-median diameter (Dv50)" and a "population number % of toner particles having a particle diameter of from 2.00 μm to 3.56 μm (Dns)", both determined with Multisizer, of 6.88 μm and 2.54%, respectively. The toner AN further had an average degree of circularity of 0.944 and a coefficient of variation in number of 20.5%.

Actual-Printing Evaluation

The toner AN was tested by the evaluation method described above. The toner AN attained satisfactory image quality at the initial stage, after 500th-sheet printing, and after 1,000th-sheet printing. Neither toner dusting nor charging roller fouling occurred. In the period when the pattern having a coverage rate of 5% was continuously printed during the intervals between image check operations, neither an image failure nor any other defect was especially observed. Removability in cleaning was satisfactory.

Comparative Example 4-2

Production of Toner Base Particles AO

Toner base particles AO were obtained by conducting the same procedure as in "Production of Toner Base Particles AH" of Example 4-2, except that "Core Material Aggregation Step", "Shell Covering Step", and "Rounding Step", among the aggregation step (core material aggregation step and shell covering step), rounding step, cleaning step, and drying step in "Production of Toner Base Particles AH", were changed as shown below.

Core Material Aggregation Step

The primary-polymer-particle dispersion A1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 5 minutes at an internal temperature of 7° C. Subsequently, while the contents were being stirred at 250 rpm at an internal temperature kept at 21° C., a 5% by mass aqueous solution of ferrous sulfate was added at a time over 5 minutes in an amount of 0.52 parts in terms of $FeSO_4.7H_2O$ amount. Thereafter, the colorant dispersion was added at a time over 5 minutes, and the contents were evenly mixed at an internal temperature of 7° C. Furthermore, under the same conditions, 0.5% by mass aqueous aluminum sulfate solution was added at a time over 8 seconds (0.10 part in terms of solid amount based on solid resin amount). Thereafter, the internal temperature was elevated to 57.0° C. while maintaining the rotation speed of 250 rpm, and the particles were grown to a volume-median diameter (Dv50) as determined with Multisizer of 6.85 μm.

Shell Covering Step

Thereafter, the primary-polymer-particle dispersion A2 was added over 3 minutes while maintaining the internal temperature of 57.0° C. and the rotation speed of 250 rpm, and the resultant mixture was held for 60 minutes under the same conditions.

Rounding Step

Subsequently, 20% aqueous DBS solution (6 parts on solid basis) was added over 10 minutes while maintaining the rotation speed of 250 rpm (stirring-blade peripheral speed, 2.59 m/sec; the same stirring speed as the rotation speed used in the aggregation step). Thereafter, the mixture was heated to 87° C. over 30 minutes, and heating and stirring were continued until the average degree of circularity reached 0.942. This mixture was then cooled to 30° C. over 20 minutes to obtain a slurry.

<Production of Toner AO>

External-Additive Addition Step

To 500 g of the toner base particles AO was added 6.25 g of silica H30TD, manufactured by Clariant K.K., as an external additive. The ingredients were mixed together by means of a 9-L Henschel mixer (Mitsui Henschel Mixer FM10B/I, manufactured by Mitsui Mining Co., Ltd.) employing a Z-shaped upper blade and an A0-type lower blade, at 3,000 rpm for 30 minutes. Thereafter, 1.00 g of calcium phosphate HAP-05NP, manufactured by Maruo Calcium Co., Ltd., was added thereto, and the ingredients were mixed together at 3,000 rpm for 10 minutes. The resultant mixture was sieved through a 200-mesh sieve to obtain a toner AO.

Analysis Step

The toner AO obtained above had a "volume-median diameter (Dv50)" and a "population number % of toner particles having a particle diameter of from 2.00 μm to 3.56 μm (Dns)", both determined with Multisizer, of 6.97 μm and 4.64%, respectively. The toner AO further had an average degree of circularity of 0.940 and a coefficient of variation in number of 24.8%.

Actual-Printing Evaluation

An actual-printing test was conducted in the same manner as in Example 4-1. As a result, fouling occurred in part of the rear end of the solid image in the initial check. The printer was opened and investigated. As a result, slight toner adhesion to that portion of the cleaning blade which corresponded to the position of the fouling was observed. The photoreceptor drum was demounted, and the cleaning blade was cleaned. Furthermore, the toner was lightly sprinkled on that part of the blade rubber which came into contact with the photoreceptor drum, and this drum was mounted again to conduct image printing again. The same fouling still occurred in the same part. Printing was conducted on several sheets and, as a result, the fouling came not to occur. The test was hence continued, and no trouble occurred thereafter. At the time of 500th-sheet check, fouling of the charging roller caused by the toner and the external additives was observed.

The test was further continued. As a result, when about the 900th sheet was printed, toner fouling came to occur in the white background of the printed matter. The toner fouling occurred at intervals equal to the circumference of the charging roller, and was an image failure caused by a charging failure occurring due to fouling of the charging roller. The evaluation was stopped at that point of time.

Comparative Example 4-3

Production of Toner Base Particles AP

Toner base particles AP were obtained by conducting the same procedure as in "Production of Toner Base Particles AG" of Example 4-1, except that "Core Material Aggregation Step", "Shell Covering Step", and "Rounding Step", among the aggregation step (core material aggregation step and shell covering step), rounding step, cleaning step, and drying step in "Production of Toner Base Particles AH", were changed as shown below.

Core Material Aggregation Step

The primary-polymer-particle dispersion H1 and 20% aqueous DBS solution were introduced into a mixing vessel (capacity, 12 L; inner diameter, 208 mm; height, 355 mm) equipped with a stirrer (double-helical blade), a heating/cooling device, a condenser, and feeders for raw materials/aids. The contents were evenly mixed for 10 minutes at an internal temperature of 10° C. Subsequently, while the contents were being stirred at 310 rpm at an internal temperature of 10° C., a 5% by mass aqueous solution of potassium sulfate was continuously added thereto over 1 minute in an amount of 0.12 parts in terms of $K_2SO_4$ amount. Thereafter, the colorant dispersion H was continuously added over 5 minutes, and the contents were evenly mixed at an internal temperature of 10° C.

Thereafter, 100 parts of desalted water was continuously added over 30 minutes, and the internal temperature was elevated to 52.0° C. over 45 minutes (1.0° C./min) while maintaining the rotation speed of 310 rpm. Subsequently, the temperature was elevated by 1° C. at intervals of 30 minutes (0.03° C./min), and the dispersion was then held at 54.0° C. While the volume-median diameter (Dv50) of the particles was being determined with Multisizer, the particles were grown to 5.20 μm.

Shell Covering Step

Thereafter, the primary-polymer-particle dispersion H2 was continuously added over 6 minutes while maintaining the internal temperature of 54.0° C. and the rotation speed of 310 rpm, and the resultant mixture was held for 60 minutes under these conditions. In the resultant dispersion, the particles had a Dv50 of 5.52 μm.

Rounding Step

Subsequently, the dispersion was heated to 88° C. while an aqueous solution prepared by mixing 20% aqueous DBS solution (6 parts on solid basis) with 0.04 parts of water was being added thereto over 30 minutes. Thereafter, the mixture was heated to 90° C. by elevating the temperature thereof by 1° C. at intervals of 30 minutes, and heating and stirring were continued under these conditions over 2 hours until the average degree of circularity reached 0.940. Thereafter, the mixture was cooled to 20° C. over 10 minutes to obtain a slurry. In this slurry, the particles had a Dv50 of 5.88 μm and an average degree of circularity of 0.943. Cleaning and drying steps were conducted in the same manners as in Example 4-1.

External-Additive Addition Step

To 500 g of the toner base particles O obtained was added 7.5 g of silica H30TD, manufactured by Clariant K.K., as an external additive. The ingredients were mixed together by means of a 9-L Henschel mixer (manufactured by Mitsui Mining Co., Ltd.) at 3,000 rpm for 30 minutes. Thereafter, 1.2 g of calcium phosphate HAP-05NP, manufactured by Maruo Calcium Co., Ltd., was added thereto, and the ingredients were mixed together at 3,000 rpm for 10 minutes. The resultant mixture was sieved through a 200-mesh sieve to obtain a toner AP.

Analysis Step

The toner AP obtained above had a "volume-median diameter (Dv50)" and a "population number % of toner particles having a particle diameter of from 2.00 μm to 3.56 μm (Dns)", both determined with Multisizer, of 5.40 μm and 4.55%, respectively. The toner AP further had an average degree of circularity of 0.947 and a coefficient of variation in number of 24.2%.

Actual-Printing Evaluation

An actual-printing test was conducted in the same manner as in Example 4-1. As a result, the toner AP attained satisfactory image quality at the initial stage, after 500th-sheet printing, and after 1,000th-sheet printing. No toner dusting occurred. In the period when the pattern having a coverage rate of 5% was continuously printed during the intervals between image check operations, neither an image failure nor any other defect was especially observed. The pattern having a coverage rate of 5% was further continuously printed. As a result, when about the 1,200th sheet was printed, toner fouling occurred in the white background of the printed matter. The toner fouling occurred at intervals equal to the circumference of the charging roller, and is an image failure caused by a charging failure which occurs due to fouling of the charging roller. The evaluation was stopped at that point of time. With respect to removability in cleaning, fine toner particles were adherent to the surface of the cleaning blade and residual toner particles which had passed through the cleaning blade were observed on the photoreceptor. The toner AP showed poor removability in cleaning.

Those results are summarized in Table 6 and Table 7. Table 6 shows the compositions, particle diameter distributions, shapes, and properties of the toners, and Table 7 shows the results of the actual-printing evaluation.

TABLE 6

| | Toner | Volume-median diameter (Dv50) (μm) | Average degree of circularity | 0.233exp (17.3/Dv) | Dns (%) | Coefficient of variation in number (%) |
|---|---|---|---|---|---|---|
| Example 4-1 | AG | 5.33 | 0.945 | 5.98 | 5.81 | 18.9 |
| Example 4-2 | AH | 6.01 | 0.945 | 4.14 | 2.57 | 18.5 |
| Example 4-3 | AI | 6.84 | 0.942 | 2.92 | 1.81 | 18.2 |
| Example 4-4 | AL | 5.45 | 0.946 | 5.57 | 4.6 | 19.8 |
| Example 4-5 | AM | 5.98 | 0.942 | 4.20 | 3.98 | 19.6 |
| Example 4-6 | AN | 6.88 | 0.944 | 2.88 | 2.54 | 20.5 |
| Comparative Example 4-1 | AK | 5.24 | 0.946 | 6.33 | 6.81 | 18.3 |
| Comparative Example 4-2 | AO | 6.97 | 0.940 | 2.79 | 4.64 | 24.8 |
| Comparative Example 4-3 | AP | 5.40 | 0.947 | 5.74 | 4.55 | 24.2 |

TABLE 7

| | Toner | Image fouling | Removability in cleaning | Charging roller fouling |
|---|---|---|---|---|
| Example 4-1 | AG | good | good | good |
| Example 4-2 | AH | good | good | good |
| Example 4-3 | AI | good | good | good |
| Example 4-4 | AL | good | good | good |
| Example 4-5 | AM | good | good | good |
| Example 4-6 | AN | good | good | good |
| Comparative Example 4-1 | AK | poor | poor | fair |
| Comparative Example 4-2 | AO | poor | poor | poor |
| Comparative Example 4-3 | AP | fair | poor | fair |

Examples 5-1 to 5-6 and Comparative Example 5-1

Using the photoreceptor E1 which will be described later, the toners A to G described above were evaluated for "fouling" by the method described hereinabove under "Actual-Printing Evaluation 1". The results thereof are shown in Table 8.

TABLE 8

| No. | Toner | Rotation speed (stirring-blade peripheral speed) in rounding step | Volume-median diameter (Dv50) (μm) | Average degree of circu-larity | 0.233exp (17.3/Dv) | Dns (%) | Coefficient of variation in number (%) | Charge amount distribution (standard deviation of charge amount) | Fouling |
|---|---|---|---|---|---|---|---|---|---|
| Example 5-1 | A | 150 rpm | 5.54 | 0.943 | 5.29 | 3.83 | 18.6 | 1.64 | — |
| Example 5-2 | B | (1.56 m/sec) | 5.97 | 0.943 | 4.23 | 2.53 | 18.4 | 1.66 | — |
| Example 5-3 | C | | 6.75 | 0.942 | 3.02 | 1.83 | 18.7 | 1.68 | excellent |
| Example 5-4 | D | 220 rpm | 5.48 | 0.943 | 5.48 | 4.51 | 20.4 | 1.94 | — |
| Example 5-5 | E | (2.28 m/sec) | 5.93 | 0.942 | 4.31 | 3.62 | 20.1 | 1.91 | — |
| Example 5-6 | F | | 6.77 | 0.942 | 3.00 | 2.48 | 21.1 | 1.92 | good |
| Comparative Example 5-1 | G | 250 rpm (2.59 m/sec) | 6.79 | 0.943 | 2.98 | 4.52 | 24.5 | 2.60 | poor |

As apparent from the results given in Table 8, the toners A to F, which satisfied the expression included in the requirement (1) or (5) according to the invention, were able to be produced by the production processes shown in Examples 1-1 to 1-6. All of the toners A to F, which satisfied the expression included in the requirement (1) or (5) according to the invention, had a sufficiently small standard deviation of charge amount and a narrow charge amount distribution. In Actual-Printing Evaluation 1, in which each toner was used in combination with the photoreceptor E1 which will be described later, no fouling was observed or the print was on such a level that the print had been very slightly fouled but was usable (Example 5-3 and Example 5-6).

On the other hand, the toner G, which did not satisfy the expression (1) or expression (5) according to the invention, had a large standard deviation of charge amount and did not have a narrow charge amount distribution. Also in Actual-Printing Evaluation 1, in which the toner was used in combination with the photoreceptor E1 which will be described later, distinct fouling was able to be entirely observed (Comparative Example 5-1).

Examples 6-1 to 6-3 and Comparative Examples 6-1 to 6-4

Using the photoreceptor E14 which will be described later, the toners H to N described above were subjected to actual-printing evaluation according to Actual-Printing Evaluation 2. The results thereof are shown in Table 9.

In each of Examples 6-1 to 6-3, all of residual image (ghost), blurring (suitability for solid printing), and removability in cleaning were satisfactory. The "selective development" described hereinabove was not observed. On the other hand, none of Comparative Examples 6-1 to 6-4 was excellent in all of residual image (ghost), blurring (suitability for solid printing), and removability in cleaning. It was found that the toners H, I, and J have excellent suitability for actual printing when used in combination with the photoreceptor E14 which will be described later, whereas the toners K, L, M, and N have poor suitability for actual printing even when used in combination with the photoreceptor E14 which will be described later.

Examples 7-1 to 7-3 and Comparative Examples 7-1 to 7-4

Using the photoreceptor E12 which will be described later, the toners H to N described above were subjected to actual-printing evaluation according to Actual-Printing Evaluation 2. The results thereof are shown in Table 10.

TABLE 9

| Photoreceptor E14 | | | | | | | | | |
|---|---|---|---|---|---|---|---|---|---|
| No. | Toner | Volume-median diameter (Dv50) (μm) | Average degree of circu-larity | 0.233exp (17.3/Dv50) | Dns (%) | Coefficient of variation in number (%) | Residual image (ghost) 8 kp | Blurring (suitability for solid printing) 8 kp | Remov-ability in cleaning 8 kp |
| Example 6-1 | H | 5.26 | 0.948 | 6.25 | 5.87 | 18.0 | good | good | good |
| Example 6-2 | I | 6.16 | 0.946 | 3.86 | 2.79 | 19.2 | good | good | good |
| Example 6-3 | J | 6.97 | 0.946 | 2.79 | 1.85 | 19.5 | excellent | excellent | good |
| Comparative Example 6-1 | K | 5.31 | 0.949 | 6.06 | 7.22 | 19.2 | poor | poor | poor |
| Comparative Example 6-2 | L | 5.18 | 0.940 | 6.57 | 9.94 | 20.4 | toner spouted from developing vessel (actual printing was impossible) | | |
| Comparative Example 6-3 | M | 5.92 | 0.945 | 4.33 | 5.22 | 21.2 | poor | good | poor |
| Comparative Example 6-4 | N | 6.88 | 0.952 | 2.88 | 9.08 | 25.6 | toner spouted from developing vessel (actual printing was impossible) | | |

TABLE 10

| Photoreceptor E12 | | | | | | | | | |
|---|---|---|---|---|---|---|---|---|---|
| No. | Toner | Volume-median diameter (Dv50) (μm) | Average degree of circu-larity | 0.233exp (17.3/Dv50) | Dns (%) | Coefficient of variation in number (%) | Residual image (ghost) 8 kp | Blurring (suitability for solid printing) 8 kp | Remov-ability in cleaning 8 kp |
| Example 7-1 | H | 5.26 | 0.948 | 6.25 | 5.87 | 18.0 | good | good | good |
| Example 7-2 | I | 6.16 | 0.946 | 3.86 | 2.79 | 19.2 | good | good | good |
| Example 7-3 | J | 6.97 | 0.946 | 2.79 | 1.85 | 19.5 | excellent | excellent | good |
| Comparative Example 7-1 | K | 5.31 | 0.949 | 6.06 | 7.22 | 19.2 | poor | poor | poor |
| Comparative Example 7-2 | L | 5.18 | 0.940 | 6.57 | 9.94 | 20.4 | toner spouted from developing vessel (actual printing was impossible) | | |
| Comparative Example 7-3 | M | 5.92 | 0.945 | 4.33 | 5.22 | 21.2 | poor | good | poor |
| Comparative Example 7-4 | N | 6.88 | 0.952 | 2.88 | 9.08 | 25.6 | toner spouted from developing vessel (actual printing was impossible) | | |

In each of Examples 7-1 to 7-3, all of residual image (ghost), blurring (suitability for solid printing), and removability in cleaning were satisfactory. On the other hand, none of Comparative Examples 7-1 to 7-4 was excellent in all of residual image (ghost), blurring (suitability for solid printing), and removability in cleaning. It was found that the toners H, I, and J have excellent suitability for actual printing when used in combination with the photoreceptor E12 which will be described later, whereas the toners K, L, M, and N have poor suitability for actual printing even when used in combination with the photoreceptor E12 which will be described later.

Examples 8-1 to 8-3 and Comparative Examples 8-1 to 8-4

Using the photoreceptor E16 which will be described later, the toners H to N described above were subjected to actual-printing evaluation according to Actual-Printing Evaluation 2. The results thereof are shown in Table 11.

TABLE 11

| Photoreceptor E16 | | | | | | | | | |
|---|---|---|---|---|---|---|---|---|---|
| No. | Toner | Volume-median diameter (Dv50) (μm) | Average degree of circu-larity | 0.233exp (17.3/Dv50) | Dns (%) | Coefficient of variation in number (%) | Residual image (ghost) 8 kp | Blurring (suitability for solid printing) 8 kp | Remov-ability in cleaning 8 kp |
| Example 8-1 | H | 5.26 | 0.948 | 6.25 | 5.87 | 18.0 | good | good | good |
| Example 8-2 | I | 6.16 | 0.946 | 3.86 | 2.79 | 19.2 | good | good | good |
| Example 8-3 | J | 6.97 | 0.946 | 2.79 | 1.85 | 19.5 | excellent | excellent | good |
| Comparative Example 8-1 | K | 5.31 | 0.949 | 6.06 | 7.22 | 19.2 | poor | poor | poor |
| Comparative Example 8-2 | L | 5.18 | 0.940 | 6.57 | 9.94 | 20.4 | toner spouted from developing vessel (actual printing was impossible) | | |
| Comparative Example 8-3 | M | 5.92 | 0.945 | 4.33 | 5.22 | 21.2 | poor | good | poor |
| Comparative Example 8-4 | N | 6.88 | 0.952 | 2.88 | 9.08 | 25.6 | toner spouted from developing vessel (actual printing was impossible) | | |

In each of Examples 8-1 to 8-3, all of residual image (ghost), blurring (suitability for solid printing), and removability in cleaning were satisfactory. The "selective development" described hereinabove was not observed. On the other hand, none of Comparative Examples 8-1 to 8-4 was excellent in all of residual image (ghost), blurring (suitability for solid printing), and removability in cleaning. It was found that the toners H, I, and J have excellent suitability for actual printing when used in combination with the photoreceptor E16 which will be described later, whereas the toners K, L, M, and N have poor suitability for actual printing even when used in combination with the photoreceptor E16 which will be described later.

Photoreceptor Production Examples

CG Production Example 1

Production of CG1

The procedures described in the "Crude-TiOPc Production Example" and "Example 1" given in JP-A-10-007925 were conducted in this order to thereby prepare β-form oxytitanium phthalocyanine. Eighteen parts of the oxytitanium phthalocyanine obtained was added to 720 parts of 95% concentrated sulfuric acid cooled to −10° C. or lower. This addition was gradually performed so that the internal temperature of the resultant sulfuric acid solution did not exceed −5° C.

After completion of the addition, the solution in concentration sulfuric acid was stirred for 2 hours at −5° C. or lower. After the stirring, the solution in concentrated sulfuric acid was filtered through a glass filter to remove insoluble matter, and the solution in concentrated sulfuric acid was discharged into 10,800 parts of ice water to thereby precipitate an oxytitanium phthalocyanine. After the discharge, the ice water was stirred for 1 hour. After the stirring, the solution was removed by filtration, and the wet cake obtained was added again to 900 parts of water, washed therein for 1 hour, and recovered by filtration. This washing operation was repeated until the ionic conductivity of the filtrate became 0.5 mS/m, whereby a wet cake of a lowly crystalline oxytitanium phthalocyanine was obtained in an amount of 185 parts (oxytitanium phthalocyanine content, 9.5%).

To 190 parts of water was added 93 parts of the wet cake of a lowly crystalline oxytitanium phthalocyanine obtained. The resultant mixture was stirred at room temperature for 30 minutes. Thereafter, 39 parts of o-dichlorobenzene was added thereto and this mixture was stirred at room temperature for further 1 hour. After the stirring, the water was separated, and 134 parts of MeOH was added to the residue. The resultant mixture was stirred at room temperature for 1 hour to wash the solid matter. After the washing, the solid matter was recovered by filtration and washed again by adding 134 parts of MeOH thereto and stirring the mixture for 1 hour. The solid matter was then recovered by filtration and heated/dried with a vacuum dryer. Thus, 7.8 parts of an oxytitanium phthalocyanine having main diffraction peaks at Bragg angles (2θ±0.2° of 9.5°, 24.1°, and 27.2° when examined with a CuKα characteristic X-ray (wavelength, 1.541 Å) (hereinafter sometimes referred to as "CG1") was obtained. The content of chlorooxytitanium phthalocyanine in the oxytitanium phthalocyanine obtained was examined by the technique described in JP-A-2001-115054 (mass spectrometry). As a result, it was ascertained that the intensity ratio thereof to the oxytitanium phthalocyanine was 0.003 or lower.

CG Production Example 2

Production of CG2

The same procedure as in Production Example 7 was conducted, except that 50 parts of the wet cake of a lowly crystalline oxytitanium phthalocyanine obtained in CG Production Example 1 was dispersed in 500 parts of tetrahydrofuran (hereinafter sometimes abbreviated to THF) and the resultant mixture was stirred at room temperature for 1 hour. Thus, 3 parts of an oxytitanium phthalocyanine having main diffraction peaks at Bragg angles)(2θ±0.2° of 9.5°, 24.1°, and 27.2° when examined with a CuKα characteristic X-ray (wavelength, 1.541 Å) (hereinafter sometimes referred to as "CG2") was obtained. The content of chlorooxytitanium phthalocyanine in the oxytitanium phthalocyanine obtained was examined by the technique described in JP-A-2001-115054 (mass spectrometry). As a result, it was ascertained that the intensity ratio thereof to the oxytitanium phthalocyanine was 0.003 or lower.

CG Production Example 3

Production of CG3

The same procedure as in CG Production Example 1 was conducted, except that β-form oxytitanium phthalocyanine produced by the method described in the Example 1 given in JP-A-2001-115054 was used. Thus, 3 parts of an oxytitanium phthalocyanine having main diffraction peaks at Bragg angles)(2θ±0.2° of 9.5°, 24.1°, and 27.2° when examined with a CuKα characteristic X-ray (wavelength, 1.541 Å) (hereinafter sometimes referred to as "CG3") was obtained. The content of chlorooxytitanium phthalocyanine in the oxytitanium phthalocyanine obtained was examined by the technique described in JP-A-2001-115054 (mass spectrometry). As a result, it was ascertained that the intensity ratio thereof to the oxytitanium phthalocyanine was 0.05.

CG Production Example 4

Production of CG4

Thirty parts of 1,3-diiminoisoindoline and 9.1 part of gallium trichloride were added to 230 parts of quinoline and reacted at 200° C. for 4 hours. Thereafter, the product obtained was taken out by filtration and washed with N,N-dimethylformamide and methanol. Subsequently, the wet cake was dried to thereby obtain 28 parts of crystals of a chlorogallium phthalocyanine.

Three parts of the chlorogallium phthalocyanine obtained was dissolved in 90 parts of concentrated sulfuric acid. This solution was dropped into a mixture of 180 parts of 25% ammonia water and 60 parts of distilled water to precipitate crystals. The hydroxygallium phthalocyanine precipitated was sufficiently washed with distilled water and dried. Thus, 2.6 parts of a hydroxygallium phthalocyanine was obtained.

Two parts of the hydroxygallium phthalocyanine obtained was subjected to 24-hour wet pulverization with a ball mill together with 38 parts of N,N-dimethylformamide. Subsequently, 40 parts of the hydroxygallium phthalocyanine slurry resulting from the wet pulverization was washed with ion-exchanged water. The solid matter was recovered by filtration and dried with a vacuum dryer at 60° C. for 48 hours to thereby obtain 1.9 parts of hydroxygallium phthalocyanine crystals (hereinafter sometimes referred to as "CG4").

CG Production Example 5

Production of CG5

Ten parts of 3-hydroxynaphthalic anhydride and 5.7 parts of 3,4-diaminotoluene were dissolved in a mixed solvent composed of 23 parts of glacial acetic acid and 115 parts of nitrobenzene. This solution was stirred at the boiling point of the acetic acid to react the reactants for 2 hours. After the reaction, the reaction mixture was cooled to room temperature. The crystals precipitated were taken out by filtration, washed with 20 parts of methanol, and then dried.

Three parts of the solid matter obtained was dissolved in 300 parts of N-methylpyrrolidone. Subsequently, a liquid mixture of 2.1 part of the borofluoric acid salt of the tetrazonium of 2-(m-aminophenyl)-5-(p-aminophenyl)-1,3,4-oxadiazole and 30 parts of N-methylpyrrolidone was added dropwise to that solution, and the resultant mixture was stirred for 30 minutes. Subsequently, 7 parts of saturated aqueous sodium acetate solution was gradually added dropwise thereto at the same temperature to cause coupling reaction to proceed. After completion of the dropwise addition, the mixture was continuously stirred at the same temperature for 2 hours. After completion, the solid matter was taken out by filtration, washed with water, N-methylpyrrolidone, and methanol, and then dried. As a result, a composition composed of the following eight compounds was obtained (hereinafter sometimes referred to as "CG5").

[Chem. 20]

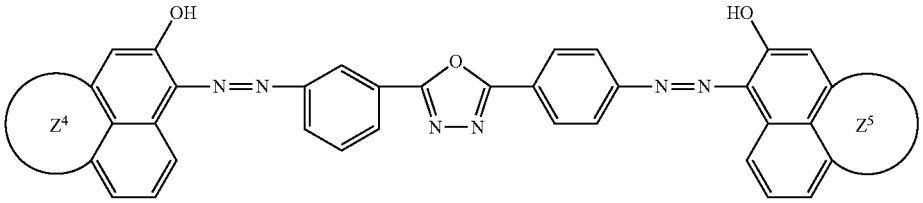

$Z^4$ represents any of the following.

[Chem. 21]

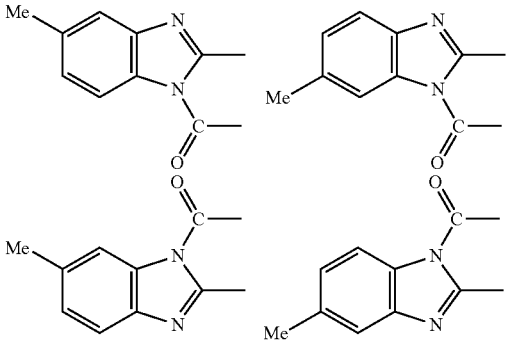

$Z^5$ represents any of the following.

[Chem. 22]

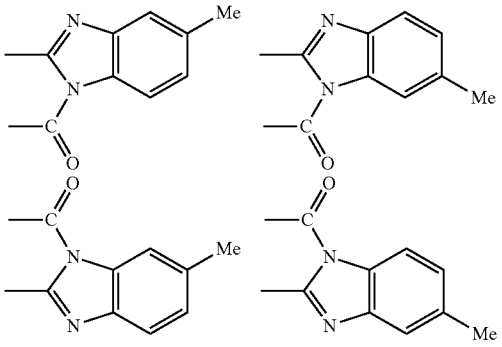

CG Production Example 6

Production of CG6

Ten parts of 3-hydroxynaphthalic anhydride and 5.7 parts of o-phenylenediamine were dissolved in a mixed solvent composed of 23 parts of glacial acetic acid and 115 parts of nitrobenzene. This solution was stirred at the boiling point of the acetic acid to react the reactants for 2 hours. After the reaction, the reaction mixture was cooled to room temperature. The crystals precipitated were taken out by filtration, washed with 20 parts of methanol, and then dried.

Two parts of the solid matter obtained and 1 part of 3-hydroxy-2-naphthanilide were dissolved in 300 parts of N-methylpyrrolidone. Subsequently, a liquid mixture of 2.1 part of the borofluoric acid salt of the tetrazonium of 2,5-bis(p-aminophenyl)-1,3,4-oxadiazole and 30 parts of N-methylpyrrolidone was added dropwise to that solution, and the resultant mixture was stirred for 30 minutes. Subsequently, 7 parts of saturated aqueous sodium acetate solution was gradually added dropwise thereto at the same temperature to cause coupling reaction to proceed. After completion of the dropwise addition, the mixture was continuously stirred at the same temperature for 2 hours. After completion, the solid matter was taken out by filtration, washed with water, N-methylpyrrolidone, and methanol, and then dried. As a result, a composition composed of the following compounds was obtained (hereinafter sometimes referred to as "CG6").

[Chem. 24]

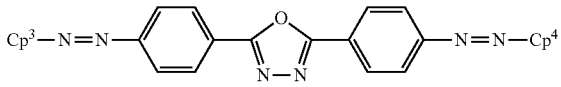

$Cp^3$ and $Cp^4$ represent the following structures.

[Chem. 24]

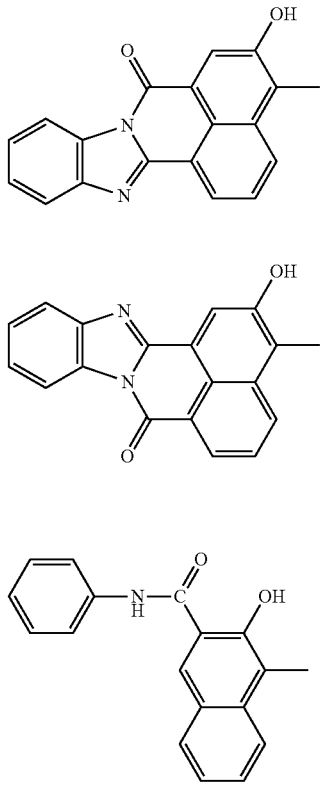

PHOTORECEPTOR PRODUCTION EXAMPLES

Photoreceptor Production Example 1

Coating Fluid for Undercoat Layer

Fifty parts of a surface-treated titanium oxide obtained by mixing rutile-form titanium oxide having an average primary-particle diameter of 40 nm ("TTO55N" manufactured by Ishihara Sangyo Kaisha, Ltd.) with 3% by weight methyldimethoxysilane ("TSL8117" manufactured by Toshiba Silicone Co., Ltd.) based on the titanium oxide by means of a Henschel mixer was mixed with 120 parts of methanol. One kilogram of the resultant raw-material slurry was subjected to a 1-hour dispersing treatment with Ultra Apex Mill (UAM Type 015) having a capacity of about 0.15 L, manufactured by Kotobuki Industries Co., Ltd., using zirconia beads having a diameter of about 100 μm (YTZ, manufactured by Nikkato Corp.) as a dispersing medium at a peripheral speed of the rotor of 10 msec while circulating the liquid at a liquid flow rate of 10 kg/hr. Thus, a titanium oxide dispersion T1 was produced.

The titanium oxide dispersion was mixed with a methanol/l-propanoUtoluene mixed solvent and with pellets of a copolyamide composed of ϵ-caprolactam [compound represented by the following formula (A)]/bis(4-amino-3-methylcyclohexyl)methane [compound represented by the following formula (B)]/hexamethylenediamine [compound represented by the following formula (C)/decamethylenedicarboxylic acid [compound represented by the following formula (D)]/octadecamethylenedicarboxylic acid [compound represented by the following formula (E)] in a molar ratio of 60%/15%/5%/15%/5%, with stirring and heating. After the polyamide pellets were dissolved, this mixture was subjected to a 1-hour ultrasonic dispersing treatment with an ultrasonic oscillator having an output of 1,200 W. Furthermore, the mixture was filtered through a membrane filter made of PTFE and having a pore diameter of 5 μm (Mitex LC, manufactured by Advantech Co., Ltd.). Thus, a dispersion for undercoat layer formation A1 was obtained which contained the surface-treated titanium oxide and the copolyamide in a ratio of 3/1 by weight, had a methanol/l-propanoUtoluene ratio in the mixed solvent of 7/1/2 by weight, and had a solid concentration of 18.0% by weight.

[Chem. 25]

A

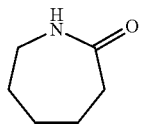

-continued

B

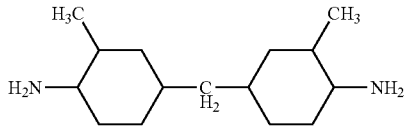

C

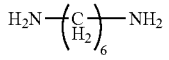

D

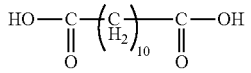

E

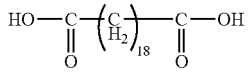

This dispersion for undercoat layer formation A1 was applied by dip coating to an aluminum cylinder which had not been anodized (outer diameter, 30 mm; wall thickness, 1.0 mm; surface roughness Ra=0.02 μm). The dispersion applied was dried with heating to form an undercoat layer having a thickness of 1.5 μm on a dry basis.

Subsequently, 20 parts of the oxytitanium phthalocyanine (chlorine content: 0.1% or lower in terms of elemental-analysis value) produced in CG Production Example 1 was mixed as a charge-generating substance with 280 parts of 1,2-dimethoxyethane. This mixture was treated with a sand grinding mill for 2 hours to pulverize the phthalocyanine. Thus, a pulverization/dispersion treatment was conducted. Subsequently, a binder resin solution obtained by mixing 10 parts of poly(vinyl butyral) (trade name "Denka Butyral" #6000 C, manufactured by Denki Kagaku Kogyo K.K.), 253 parts of 1,2-dimethoxyethane, and 85 parts of 4-methoxy-4-methyl-2-pentanone was mixed with the liquid obtained above by the pulverization treatment and with 230 parts of 1,2-dimethoxyethane. Thus, a dispersion (charge-generating material) was prepared.

The aluminum cylinder on which the undercoat layer had been formed was dip-coated with the dispersion (charge-generating material) to form a charge-generating layer in a thickness of 0.3 μm (0.3 g/m$^2$) on a dry basis.

Subsequently, a coating fluid for charge-transporting-layer formation obtained by dissolving 60 parts of the following compound CT-1 (ionization potential=5.24 eV; αcal=56 (Å$^3$); Pcal=1.4 (D)) as a charge-transporting substance, 0.5 parts of electron-accepting compound AC-1 (LUMO energy level=−1.52 eV), 100 parts of a polycarbonate having the following structure as a repeating unit (B-1: viscosity-average molecular weight, about 30,000; m/n=1/1) as a binder resin,

[Chem. 26]

CT-1

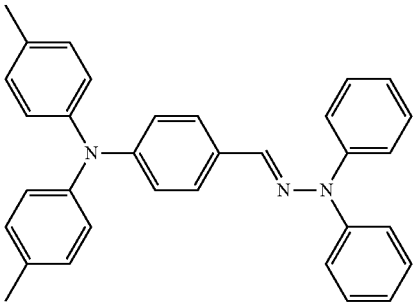

AC-1

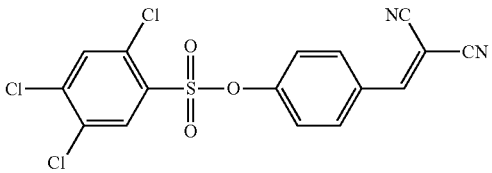

B-1

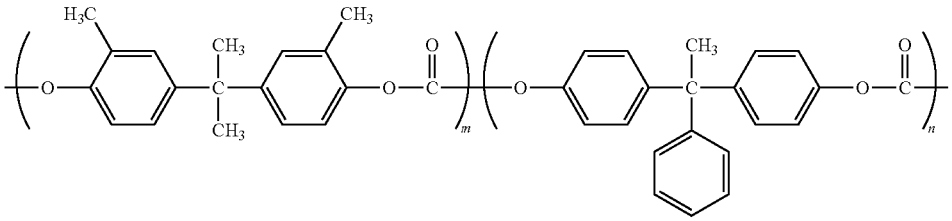

8 parts of the antioxidant having the following structure,

[Chem. 27]

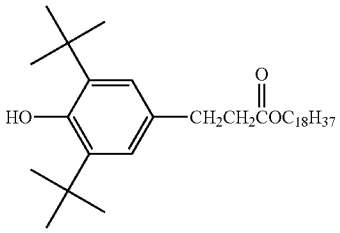

and 0.05 parts of a silicone oil (trade name KF96, manufactured by Shin-Etsu Chemical Co., Ltd.) as a leveling agent in 640 parts of a tetrahydrofuran/toluene (8/2) mixed solvent was applied by dip coating to the charge-generating layer in a thickness of 18 μm on a dry basis. Thus, a photoreceptor drum E1 having a multilayered photosensitive layer was obtained. The surface properties (surface free energy) of the drum obtained were determined by the method described hereinabove. The results thereof are shown in Table 12, which will be given later, together with the results for photoreceptor drums E2 to E7. In the following Examples, etc., "electrophotographic photoreceptor" is often referred to simply as "photoreceptor". There also are cases where drum-form photoreceptors are suitably referred to especially as "photoreceptor drums".

Photoreceptor Production Example 2

A photoreceptor E2 was produced in the same manner as in Photoreceptor Production Example 2, except that 35 parts of the following compound CT-2 (ionization potential, 5.19 eV; $\alpha cal=105$ ($Å^3$); Pcal=1.8 (D)) was used in place of the CT-1 used in Photoreceptor Production Example 1.

[Chem. 28]

CT-2

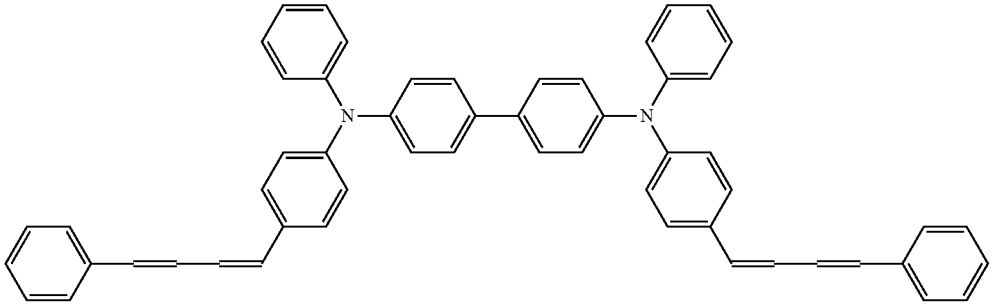

Photoreceptor Production Example 3

A photoreceptor E3 was produced in the same manner as in Photoreceptor Production Example 2, except that 55 parts of CT-2 was used in place of 35 parts of CT-2 and that a polyarylate having the following structure as a repeating unit and produced by the method described in JP-A-2006-053549 (B-2: viscosity-average molecular weight, about 40,000) was used as a binder resin in place of the B-1.

[Chem. 29]

B-2

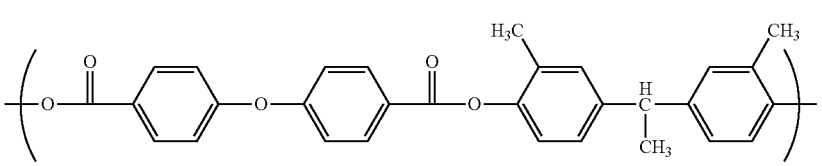

Photoreceptor Production Example 4

A photoreceptor E4 was produced in the same manner as in Photoreceptor Production Example 1, except that 40 parts of the following compound CT-3 (ionization potential, 5.37 eV; $\alpha$cal=52 ($Å^3$); Pcal=0.6 (D)) and 10 parts of the following compound CT-4 (ionization potential, 5.09 eV; $\alpha$cal=86 ($Å^3$); Pcal=2.1 (D)) were used in place of the CT-1 and that 100 parts of a polycarbonate having the following structure as a repeating unit (B-3: viscosity-average molecular weight, about 40,000) was used as a binder resin in place of the B-1.

[Chem. 30]

CT-3

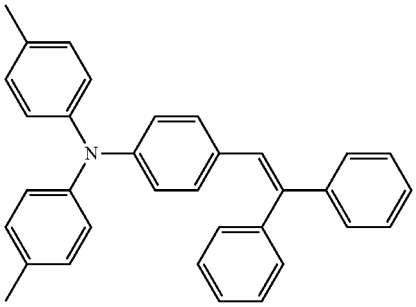

-continued

CT-4

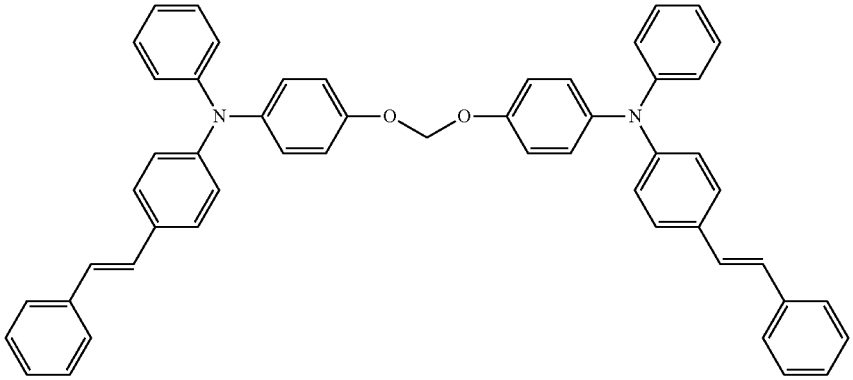

[Chem. 31]

B-3

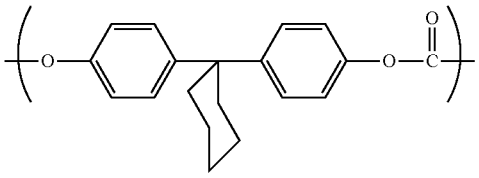

Photoreceptor Production Example 5

A photoreceptor E5 was produced in the same manner as in Photoreceptor Production Example 1, except that 0.03 parts of Megafac (F-482; containing perfluoroalkyl group), manufactured by Dainippon Ink & Chemicals, Inc., was added to the coating fluid for charge-transporting-layer formation used in Photoreceptor Production Example 1.

Photoreceptor Production Example 6

A photoreceptor E6 was produced in the same manner as in Photoreceptor Production Example 2, except that 0.3 parts of Megafac (F-482; containing perfluoroalkyl group), manufactured by Dainippon Ink & Chemicals, Inc., was added to the coating fluid for charge-transporting-layer formation used in Photoreceptor Production Example 2.

Photoreceptor Production Example 7

At room temperature, 180 g of methyltrimethoxysilane and 30 g of a 3% aqueous acetic acid solution of 2-propanol were stirred for 24 hours to produce a solution of a silane compound oligomer. To this solution were added 60 g of N,N-bis (4-hydroxymethylphenyl)-p-toluidine, 1 g of the hindered phenol having the following structure, and 3 g of aluminum trisacetylacetonate. The resultant mixture was stirred for 2 hours and filtered through a glass filter to produce a coating fluid for protective-layer formation. This fluid was applied by spray coating to the photoreceptor E2 to form a layer having a thickness of 1 μm and then dried with heating to produce a photoreceptor E7.

[Chem. 32]

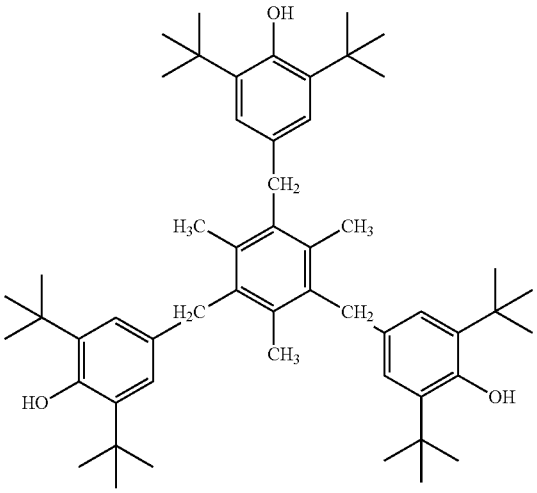

TABLE 12

| Photoreceptor | Surface free energy (mN/m) |
|---|---|
| E1 | 48 |
| E2 | 49 |
| E3 | 46 |
| E4 | 45 |
| E5 | 41 |

TABLE 12-continued

| Photoreceptor | Surface free energy (mN/m) |
|---|---|
| E6 | 35 |
| E7 | 37 |

Photoreceptor Production Example 8

A photoreceptor E8 was produced in the same manner as in Photoreceptor Production Example 1, except that 40 parts of the following compound CT-5 (ionization potential, 5.19 eV; αcal=58 (Å$^3$); Pcal=1.3 (D)) was used in place of the CT-1, AC-2 (LUMO energy level=−1.36 eV) was used in place of the AC-1, and B-4 (viscosity-average molecular weight, about 50,000; m/n=9/1) was used in place of the B-1.

[Chem. 33]

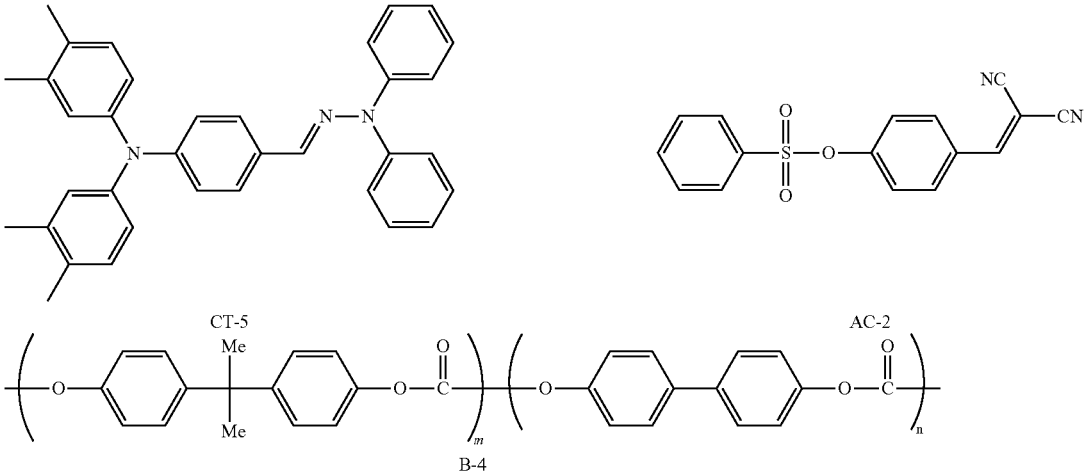

Photoreceptor Production Example 9

A photoreceptor E9 was produced in the same manner as in Photoreceptor Production Example 1, except that 60 parts of the following compound CT-6 (ionization potential, 5.27 eV; αcal=70 (Å$^3$); Pcal=1.4 (D)) was used in place of the CT-1 and that 0.5 parts of AC-3 (LUMO energy level=−2.41 eV) was used in place of the AC-1.

[Chem. 34]

CT-6

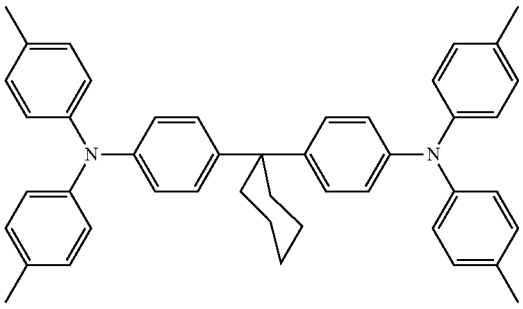

-continued

AC-3

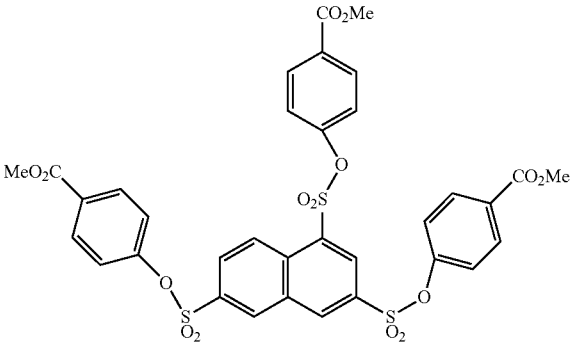

Photoreceptor Production Example 10

A photoreceptor E10 was produced in the same manner as in Photoreceptor Production Example 1, except that 45 parts of the following compound CT-7 was used in place of the CT-1, 0.5 parts of AC-3 (LUMO energy level=−1.80 eV; αcal=63 (Å$^3$); Pcal=2.6 (D)) was used in place of the AC-1, and 80 parts of B-4 and 20 parts of B-5 (terephthalic acid component/isophthalic acid component=1/1) were used in place of the B-1.

[Chem. 35]

CT-7

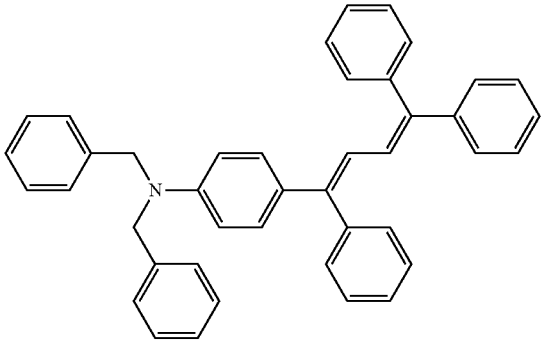

AC-3

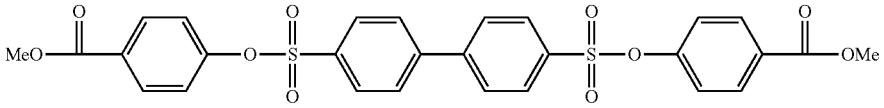

B-5

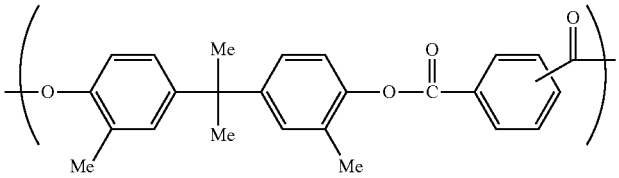

Photoreceptor Production Example 11

A photoreceptor E11 was produced in the same manner as in Photoreceptor Production Example 1, except that 40 parts of the following compound CT-8 and 20 parts of the following compound CT-9 (IP=5.18 eV; αcal=66 (Å$^3$); Pcal=1.4 (D)) were used in place of the CT-1, 0.5 parts of AC-4 (LUNO energy level=−2.06 eV) was used in place of the AC-1, and 50 parts of B-4 and 50 parts of B-6 (Mv=40,000) were used in place of the B-1.

[Chem. 36]

CT-8

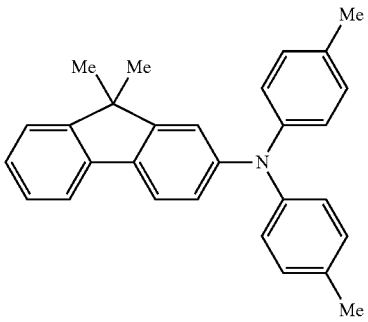

-continued

CT-9

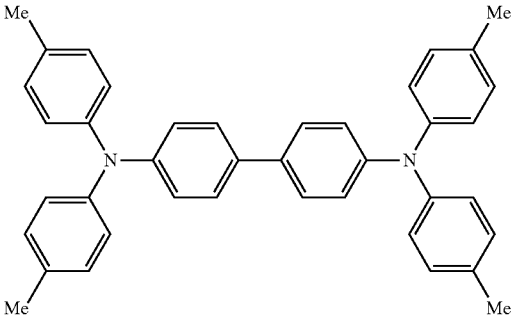

[Chem. 37]

B-6

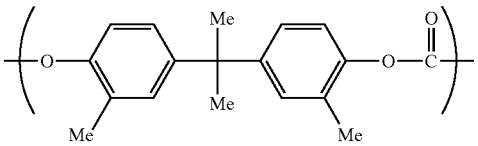

AC-4

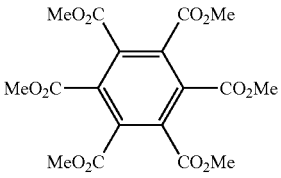

Photoreceptor Production Example 12

A photoreceptor E12 was produced in the same manner as in Photoreceptor Production Example 1, except that the phthalocyanine produced in CG Production Example 2 was used in place of the phthalocyanine produced in CG Production Example 1.

Photoreceptor Production Example 13

A photoreceptor E13 was produced in the same manner as in Photoreceptor Production Example 1, except that the phthalocyanine produced in CG Production Example 3 was used in place of the phthalocyanine produced in CG Production Example 1.

Photoreceptor Production Example 14

A photoreceptor E14 was produced in the same manner as in Photoreceptor Production Example 1, except that the phthalocyanine produced in CG Production Example 4 was used in place of the phthalocyanine produced in CG Production Example 1.

Photoreceptor Production Example 15

A photoreceptor E15 was produced in the same manner as in Photoreceptor Production Example 2, except that the following dispersion was used in place of the dispersion (charge-generating material) used in Photoreceptor Production Example 2.

(Dispersion)

Twenty parts of the oxytitanium phthalocyanine (chlorine content: 0.1% or lower in terms of elemental-analysis value) produced in CG Production Example 1 was mixed as a charge-generating substance with 280 parts of 1,2-dimethoxyethane. This mixture was treated with a sand grinding mill for 2 hours to pulverize the phthalocyanine. Thus, a pulverization/dispersion treatment was conducted. Subsequently, a binder resin solution obtained by mixing 10 parts of poly(vinyl butyral) (trade name "Denka Butyral" #6000 C, manufactured by Denki Kagaku Kogyo K.K.), 253 parts of 1,2-dimethoxyethane, and 85 parts of 4-methoxy-4-methyl-2-pentanone was mixed with the liquid obtained above by the pulverization treatment and with 20 parts of CT-2 and 230 parts of 1,2-dimethoxyethane. Thus, a dispersion (charge-generating material) was prepared.

Photoreceptor Production Example 16

Fifty parts of a titanium oxide powder coated with tin oxide containing 10% antimony oxide, 25 parts of a resol-type phenolic resin, 20 parts of methyl Cellosolve, 5 parts of methanol, and 0.002 parts of a silicone oil (polydimethylsiloxane/polyoxyalkylene copolymer; average molecular weight, 3,000) were dispersed for 2 hours with a sand mill employing glass beads having a diameter of 1 mm to prepare a coating fluid for conductive-layer formation. The coating fluid for conductive-layer formation was applied to an aluminum cylinder (diameter, 30 mm) by dipping and dried at 150° C. for 30 minutes to form a conductive layer having a thickness of 12.5 μm. A solution obtained by dissolving 40.0 parts of a polyamide (same as the polyamide used in Photoreceptor Production Example 1) in a mixed solvent composed of 412 parts of methyl alcohol and 206 parts of n-butyl alcohol was applied to the conductive layer by dipping and dried at 100° C. for 10 minutes to form an interlayer having a thickness of 0.65 μm.

Subsequently, 3.5 parts of hydroxygallium phthalocyanine crystals having distinct peaks at Bragg angles 2θ±0.2° of 7.4° and 28.2° in CuKα characteristic X-ray diffractometry (CG4 produced in CG Production Example 4) were mixed with a resin solution obtained by dissolving 1 part of (trade name, Denka Butyral #6000 C), manufactured by Denki Kagaku Kogyo K.K., in 19 parts of cyclohexanone. This mixture was treated for 3 hours with a sand mill employing glass beads having a diameter of 1 mm to disperse the phthalocyanine and thereby produce a dispersion. This dispersion was diluted with 69 parts of cyclohexanone and 132 parts of ethyl acetate to prepare a coating fluid. This coating fluid was used to form a charge-generating layer having a thickness of 0.3 μm.

Subsequently, 9 parts of 2-(di-4-tolyl)amino-9,9-dimethylfluorene, 1 part of 5-(aminobenzylidene)-5H-dibenzo[a,d] cyclopentene, and 10 parts of a polyarylate (B-5: viscosity-average molecular weight, 96,000) were dissolved in a mixed solvent composed of 50 parts of monochlorobenzene and 50 parts of dichloromethane to prepare a coating fluid. This coating fluid was applied to the charge-generating layer by dipping and dried at 120° C. for 2 hours to form a charge-transporting layer having a thickness of 15 μm. Thus, a photoreceptor E16 was produced.

Photoreceptor Production Example 17

A photoreceptor E17 was produced in the same manner as in Photoreceptor Production Example 1, except that 10 parts of the azo composition produced in CG Production Example 5 was used in Photoreceptor Production Example 9 in place of the phthalocyanine produced in CG Production Example 1.

Photoreceptor Production Example 18

A photoreceptor E18 was produced in the same manner as in Photoreceptor Production Example 1, except that 10 parts of the azo composition produced in CG Production Example 6 was used in Photoreceptor Production Example 9 in place of the phthalocyanine produced in CG Production Example 1.

Photoreceptor Production Example 19

A photoreceptor E19 was produced in the same manner as in Photoreceptor Production Example 1, except that a phthalocyanine produced according to a Production Example given in Japanese Patent No. 3451751 was used in Photoreceptor Production Example 1 in place of the phthalocyanine produced in CG Production Example 1.

Photoreceptor Production Example 20

A photoreceptor E20 was produced in the same manner as in Photoreceptor Production Example 4, except that the phthalocyanine produced according to a Production Example given in Japanese Patent No. 3451751 was used in Photoreceptor Production Example 4 in place of the phthalocyanine produced in CG Production Example 1.

Comparative Photoreceptor Production Example 1

A photoreceptor P3 was produced in the same manner as in Photoreceptor Production Example 1, except that a porphyrin pigment produced according to a Production Example given in JP-A-3-194560 was used in Photoreceptor Production Example 1 in place of the phthalocyanine produced in CG Production Example 1.

The surface free energies of the photoreceptors E1 to E7 and P1 are shown in the following Table 13.

TABLE 13

| Photoreceptor | Surface free energy (mN/m) |
|---|---|
| E1 | 48 |
| E2 | 49 |
| E3 | 46 |
| E4 | 45 |
| E5 | 41 |
| E6 | 35 |
| E7 | 37 |
| P1 | 51 |

Examples 9-1 to 9-23 and Comparative Examples 9-1 and 9-2

Actual-Printing Evaluation 3-1

Each of photoreceptors produced in the same manners as for the photoreceptors E1 to E16, P1, and P2 except that the overall length of the aluminum cylinder used in each photoreceptor was changed to an overall length fitted to commercial tandem LED color printer MICROLINE Pro 9800PS-E (manufactured by Oki Data Corp.), which was capable of A3 printing, and a toner were incorporated respectively into a black drum cartridge and a black toner cartridge both for the printer, and these cartridges were mounted on the printer. Since the photoreceptors used here are the same as the photoreceptors E1 to E16, P1, and P2 except for the overall length, the photoreceptors used are referred to as E1 to E16, P1, and P2, respectively, like the photoreceptors described above.

Specifications of MICROLINE Pro 9800PS-E:

Four-cartridge tandem; color, 36 ppm; monochrome, 40 ppm 600 dpi to 1,200 dpi

Contact roller charging (DC voltage application)

LED exposure

With erase light

This image-forming apparatus was used to print a gradation image (a test chart provided by The Imaging Society of Japan) on 1,000 sheets. Thereafter, a white-background image and a gradation image (a test chart provided by The Imaging Society of Japan) were printed, and the white-background image and the gradation image were evaluated for fogging and dot skipping, respectively. The results thereof are shown in the following Table 14.

The value of "fogging" was determined in the following manner. A whiteness meter was regulated so that a standard sample had a whiteness of 94.4. This whiteness meter was used to measure the whiteness of a sheet of paper which had not been printed. Signals for printing in white throughout were inputted to the laser printer to thereby print the same paper. Thereafter, this paper was examined for whiteness again to determine the difference in whiteness between the unprinted state and the printed state and thereby determine the value of fogging. When the value of fogging is large, this means that the printed paper has many black microdots and is blackish, i.e., the printed paper has poor image quality.

The gradation image was evaluated in terms of the minimum standard density at which printing was possible without causing dot skipping. The lowest standard density at which printing was possible without causing dot skipping is referred to as "usable density". The smaller the value of usable density, the better the image is and the lower the density of image areas which were capable of being formed.

At the time when the 1,000-sheet printing was completed, "thin-line reproducibility" was evaluated subsequently to the evaluation of fogging. First, exposure was conducted so as to form a latent image having a line width of 0.10 mm and a fixed image was obtained therefrom as a test sample. With respect to positions where line widths were to be measured, since the thin-line toner image had an outline rugged in the width direction, the width of a mean image obtained by leveling the rugged outline was measured. Thin-line reproducibility was evaluated by calculating the ratio of the measured value of line width to the line width of the latent image (0.10 mm) (line width ratio).

Criteria for evaluating thin-line reproducibility are shown below.

The ratio of the measured value of line width to the line width of the latent image (line width ratio) is A: below 1.1, B: 1.1-1.2, excluding 1.2, C: 1.2-1.3, excluding 1.3, D: 1.3 or higher.

Furthermore, the number of color microdots observed in an area 1.6 cm square in a gray image was counted.

TABLE 14

| No. | Toner | Photo-receptor | Fog-ging | Usable density | Line reproduc-ibility | Formula microdots |
|---|---|---|---|---|---|---|
| Example 9-1 | A | E1 | 1.2 | 0.08 | A | 12 |
| Example 9-2 | B | E1 | 1.3 | 0.08 | B | 13 |
| Example 9-3 | C | E1 | 1.2 | 0.08 | A | 15 |
| Example 9-4 | D | E1 | 1.3 | 0.09 | C | 13 |
| Example 9-5 | E | E1 | 1.3 | 0.08 | A | 15 |
| Example 9-6 | F | E1 | 1.3 | 0.09 | A | 9 |
| Comparative Example 9-1 | G | E1 | 1.7 | 0.13 | D | 49 |
| Comparative Example 9-2 | G | E2 | 1.9 | 0.16 | D | 54 |
| Example 9-7 | A | E2 | 1.1 | 0.09 | A | 19 |
| Example 9-8 | A | E3 | 1.2 | 0.10 | A | 12 |
| Example 9-9 | A | E4 | 1.4 | 0.13 | A | 18 |
| Example 9-10 | A | E5 | 1.4 | 0.11 | B | 20 |
| Example 9-11 | A | E6 | 1.3 | 0.09 | B | 21 |
| Example 9-12 | A | E7 | 1.3 | 0.08 | A | 14 |
| Example 9-13 | A | E8 | 1.3 | 0.08 | B | 15 |
| Example 9-14 | A | E9 | 1.3 | 0.11 | A | 10 |
| Example 9-15 | A | E10 | 1.4 | 0.11 | B | 20 |
| Example 9-16 | A | E11 | 1.3 | 0.09 | B | 17 |
| Example 9-17 | A | E12 | 1.3 | 0.12 | B | 13 |
| Example 9-18 | C | E13 | 1.2 | 0.09 | A | 21 |
| Example 9-19 | B | E14 | 1.4 | 0.10 | B | 19 |
| Example 9-20 | A | E15 | 1.3 | 0.10 | B | 20 |
| Example 9-21 | A | E16 | 1.4 | 0.10 | B | 11 |
| Example 9-22 | A | P1 | 1.5 | 0.16 | B | 52 |
| Example 9-23 | A | P2 | 1.7 | 0.17 | C | 58 |

Examples 9-1 to 9-23 each gave satisfactory results concerning fogging, usable density (dot skipping), thin-line reproducibility, and formula microdots. These Examples were inhibited from undergoing the "selective development" described above. In contrast, Comparative Examples 9-1 and 9-2 each gave poor results concerning fogging, usable density (dot skipping), thin-line reproducibility, and formula microdots. Furthermore, in Example 9-22, leakage occurred after the test chart printing on 1,000 sheets. In Example 9-23, a moiré fringe was observed in the gray zone.

Examples 10-1 to 10-17 and Comparative Example 10-1

Actual-Printing Evaluation 3-2

Each of the toners produced in Toner Production Examples and a Comparative Toner Production Example given above and each of the photoreceptors produced in Photoreceptor Production Examples and a Comparative Photoreceptor Production Example given above were incorporated respectively into a black drum cartridge and a black toner cartridge both for commercial tandem LED color printer MICROLINE Pro 9800PS-E (manufactured by Oki Data Corp.), which was capable of A3 printing, and these cartridges were mounted on the printer.

Specifications of MICROLINE Pro 9800P S-E:

Four-cartridge tandem; color, 36 ppm; monochrome, 40 ppm 600-1,200 dpi

Contact roller charging (DC voltage application)

With erase light

<Image Evaluation>

In Actual-Printing Evaluation 3 with this image-forming apparatus, a gradation image (a test chart provided by The Imaging Society of Japan) was printed on 1,000 sheets. Thereafter, a white-background image and a gradation image (a test chart provided by The Imaging Society of Japan) were printed, and the white-background image and the gradation image were evaluated for fogging and dot skipping, respectively. The results thereof are shown in the following Table 15.

[[Method of Evaluating Fogging]]

Fogging was determined in the following manner. A whiteness meter was regulated so that a standard sample had a whiteness of 94.4. This whiteness meter was used to measure the whiteness of a sheet of paper which had not been printed. Signals for printing in white throughout were inputted to the laser printer to thereby print the same paper. Thereafter, this paper was examined for whiteness again to determine the difference in whiteness between the unprinted state and the printed state and thereby determine the value of fogging. When the value of fogging is large, this means that the printed paper has many black microdots and is blackish, i.e., the printed paper has poor image quality.

[[Method of Evaluating Usable Density (Dot Skipping)]]

With respect to dot skipping, the gradation image was evaluated in terms of the minimum standard density at which printing was possible without causing dot skipping. The lowest standard density at which printing was possible without causing dot skipping is referred to as "usable density". The smaller the value of "usable density", the better the image is and the lower the density of image areas which were capable of being formed.

The results thereof are shown in the following Table 15.

TABLE 15

| No. | Toner | Photoreceptor | Fogging | Usable density |
|---|---|---|---|---|
| Example 10-1 | A | E1 | 1.2 | 0.08 |
| Example 10-2 | B | E1 | 1.3 | 0.08 |
| Example 10-3 | C | E1 | 1.2 | 0.08 |
| Example 10-4 | D | E1 | 1.3 | 0.09 |
| Example 10-5 | E | E1 | 1.3 | 0.08 |
| Example 10-6 | F | E1 | 1.3 | 0.09 |
| Comparative Example 10-1 | G | E1 | 1.7 | 0.13 |
| Example 10-7 | A | E2 | 1.1 | 0.09 |
| Example 10-8 | A | E3 | 1.2 | 0.10 |
| Example 10-9 | A | E4 | 1.4 | 0.13 |
| Example 10-10 | A | E5 | 1.3 | 0.09 |
| Example 10-11 | A | E6 | 1.3 | 0.12 |
| Example 10-12 | A | E7 | 1.4 | 0.13 |
| Example 10-13 | A | E8 | 1.2 | 0.08 |
| Example 10-14 | A | E9 | 1.2 | 0.08 |
| Example 10-15 | A | E10 | 1.3 | 0.12 |
| Example 10-16 | A | E11 | 1.1 | 0.09 |
| Example 10-17 | A | P1 | 1.6 | 0.15 |

Examples 11-1 TO 11-23 and Comparative Example 11-1

Actual-Printing Evaluation 3-3

Each of photoreceptors produced in the same manners as for the photoreceptors E1 to E20 and P3 except that the overall length of the aluminum cylinder used in each photoreceptor was changed to an overall length fitted to commercial tandem LED color printer MICROLINE Pro 9800PS-E (manufactured by Oki Data Corp.), which was capable of A3 printing, and a toner were incorporated respectively into a black drum cartridge and a black toner cartridge both for the printer, and these cartridges were mounted on the printer. Since the photoreceptors used here are the same as the photoreceptors E1 to E20 and P3 except for the overall length, the photoreceptors used are referred to as E1 to E16, P1, and P2, respectively, like the photoreceptors described above.

Specifications of MICROLINE Pro 9800PS-E:

Four-cartridge tandem; color, 36 ppm; monochrome, 40 ppm 600 dpi to 1,200 dpi

Contact roller charging (DC voltage application)

With erase light

This image-forming apparatus was used to print a gradation image (a test chart provided by The Imaging Society of Japan) on 1,000 sheets. Thereafter, a white-background image and a gradation image (a test chart provided by The Imaging Society of Japan) were printed, and the white-background image and the gradation image were evaluated for fogging and dot skipping, respectively. The results thereof are shown in the following Table 16.

The value of "fogging" was determined in the following manner. A whiteness meter was regulated so that a standard sample had a whiteness of 94.4. This whiteness meter was used to measure the whiteness of a sheet of paper which had not been printed. Signals for printing in white throughout were inputted to the laser printer to thereby print the same paper. Thereafter, this paper was examined for whiteness again to determine the difference in whiteness between the unprinted state and the printed state and thereby determine the value of fogging. When the value of fogging is large, this means that the printed paper has many black microdots and is blackish, i.e., the printed paper has poor image quality.

The gradation image was evaluated in terms of the minimum standard density at which printing was possible without causing dot skipping. The lowest standard density at which printing was possible without causing dot skipping is referred to as "usable density". The smaller the value of usable density, the better the image is and the lower the density of image areas which were capable of being formed.

At the time when the 1,000-sheet printing was completed, thin-line reproducibility was evaluated subsequently to the evaluation of fogging and toner dusting. First, exposure was conducted so as to form a latent image having a line width of 0.20 mm and a fixed image was obtained therefrom as a test sample. With respect to positions where line widths were to be measured, since the thin-line toner image had an outline rugged in the width direction, the width of a mean image obtained by leveling the rugged outline was measured. Thin-line reproducibility was evaluated by calculating the ratio of the measured value of line width to the line width of the latent image (0.20 mm) (line width ratio).

Criteria for evaluating thin-line reproducibility are shown below.

The ratio of the measured value of line width to the line width of the latent image (line width ratio) is A: below 1.1, B: 1.1-1.2, excluding 1.2, C: 1.2-1.3, excluding 1.3, D: 1.3 or higher.

TABLE 16

| No. | Toner | Photo-receptor | Fog-ging | Usable density | Line reproduc-ibility |
|---|---|---|---|---|---|
| Example 11-1 | A | E1 | 1.2 | 0.08 | A |
| Example 11-2 | B | E1 | 1.3 | 0.08 | B |
| Example 11-3 | C | E1 | 1.2 | 0.08 | A |
| Example 11-4 | D | E1 | 1.3 | 0.09 | C |
| Example 11-5 | E | E1 | 1.3 | 0.08 | A |
| Example 11-6 | F | E1 | 1.3 | 0.09 | A |
| Comparative Example 11-1 | G | E1 | 1.7 | 0.13 | D |
| Example 11-7 | A | E2 | 1.1 | 0.09 | A |
| Example 11-8 | A | E3 | 1.2 | 0.10 | A |
| Example 11-9 | A | E4 | 1.4 | 0.13 | A |
| Example 11-10 | A | E5 | 1.3 | 0.09 | A |
| Example 11-11 | A | E6 | 1.3 | 0.12 | A |
| Example 11-12 | A | E7 | 1.4 | 0.13 | B |
| Example 11-13 | A | E8 | 1.2 | 0.08 | A |
| Example 11-14 | A | E9 | 1.2 | 0.08 | A |
| Example 11-15 | A | E10 | 1.3 | 0.12 | B |
| Example 11-16 | A | E11 | 1.1 | 0.09 | A |
| Example 11-17 | A | E12 | 1.1 | 0.09 | A |
| Example 11-18 | B | E13 | 1.1 | 0.09 | B |
| Example 11-19 | A | E14 | 1.4 | 0.10 | A |
| Example 11-20 | A | E15 | 1.3 | 0.08 | A |
| Example 11-21 | A | E16 | 1.2 | 0.10 | B |
| Example 11-22 | A | E19 | 1.5 | 0.14 | B |
| Example 11-23 | A | E20 | 1.7 | 0.17 | C |

Example 12-1 and Comparative Example 12-1

Actual-Printing Evaluation 4

The toner A or G, which was produced in a Toner Production Example or a Comparative Toner Production Example, and the photoreceptor E1 were incorporated respectively into a black drum cartridge and a black toner cartridge both for commercial tandem LED color printer MICROLINE Pro 9800PS-E (manufactured by Oki Data Corp.), which was capable of A3 printing, and these cartridges were mounted on the printer. The cleaning blade of this apparatus was removed. Thereafter, image evaluation was conducted in the same manner as in Actual-Printing Evaluation 3-1. As a result, use of the toner A gave results which were not substantially different from those obtained in Actual-Printing Evaluation 3-1. However, when the toner G was used, considerable image deterioration was observed.

TABLE 17

| No. | Toner | Photoreceptor | Fogging | Usable density |
|---|---|---|---|---|
| Example 12-1 | A | E1 | 1.3 | 0.08 |
| Comparative Example 12-1 | G | E1 | 1.9 | 0.16 |

Example 13-1 and Comparative Example 13-1

Actual-Printing Evaluation 5

The toner A obtained was packed into a cartridge for a 600-dpi machine which was of the nonmagnetic one-component type (employing the photoreceptor E1), developing rubber roller contact development type with a developing speed of 164 mm/s, and belt transfer type and which had a guaranteed life in terms of number of prints of 30,000 sheets at a coverage rate of 5%. A chart having a coverage rate of 1% was continuously printed on 50 sheets and the images were visually examined for fouling. As a result, no clear fouling was observed with the naked eye.

As apparent from the results given above, all of the toners A to F, which satisfied all the requirements according to the invention, had a sufficiently small standard deviation of charge amount and a narrow charge amount distribution. Also in the actual-printing evaluation using the electrophotographic photoreceptor having an interlayer, no fouling was observed or the print was on such a level that the print had been very slightly fouled but was usable. The "selective development" also was inhibited.

On the other hand, in the image-forming apparatus employing the toner which did not satisfy the requirements according to the invention, the "selective development" was observed because the toner G had a large standard deviation of charge amount and did not have a narrow charge amount distribution. As apparent from those results, the synergistic effect of use of the electrophotographic photoreceptor for use in the image-forming apparatus of the invention was able to be ascertained also in the actual-printing evaluation.

Examples 14-1 to 14-3

Actual-Printing Evaluation 6

The exposure part of MICROLINE Pro 9800PS-E (manufactured by Oki Data Corp.), which was capable of A3 printing, was modified so that a small spot irradiation type blue LED (B3MP-8; 470 nm) manufactured by Nissin Electronic Co., Ltd. was disposed so as to be capable of illuminating the photoreceptor. The toner C and the photoreceptor drum E16, E17, or E18 were incorporated into this modified apparatus, and lines were drawn therewith. As a result, each combination gave satisfactory images.

Furthermore, a stroboscopic-illumination power supply LPS-203KS was connected to the small spot irradiation type blue LED, and the apparatus was used to print dots. As a result, dot images having a diameter of 8 mm were able to be obtained with each photoreceptor.

Examples 15-1 and 15-2

Actual-Printing Evaluation 7

The photoreceptor E14 or photoreceptor E16 was incorporated into a machine obtained by modifying HP-4600, manufactured by Hewlet-Packard Co. The toner B produced was incorporated as a developer to conduct printing. As a result, satisfactory images were obtained with each photoreceptor.

In Actual-Printing Evaluation 1 to Actual-Printing Evaluation 7, in which various machines were used under various actual-printing conditions, the combinations of a toner having the specific particle diameter distribution according to the invention with a photoreceptor having the specific photosensitive layer each produced the synergistic effect thereof and showed satisfactory actual-printing characteristics. Meanwhile, the combinations in which either the toner or the photoreceptor did not satisfy the requirements according to the invention did not show satisfactory actual-printing characteristics.

While the invention has been described in detail and with reference to specific embodiments thereof, it will be apparent to one skilled in the art that various changes and modifications can be made therein without departing from the spirit and scope thereof. This application is based on a Japanese patent application filed on Sep. 20, 2007 (Application No. 2007-244285), Japanese patent application filed on Sep. 26, 2007 (Application No. 2007-249894), Japanese patent application filed on Sep. 27, 2007 (Application No. 2007-252620), Japanese patent application filed on Sep. 27, 2007 (Application No. 2007-252621), Japanese patent application filed on Oct. 3, 2007 (Application No. 2007-259495), Japanese patent application filed on Oct. 3, 2007 (Application No. 2007-259539), and Japanese patent application filed on Oct. 3, 2007 (Application No. 2007-259620), the contents thereof being herein incorporated by reference.

INDUSTRIAL APPLICABILITY

The toners for use in the image-forming apparatus of the invention have especially satisfactory removability in cleaning and are less apt to cause fouling of the white background, a residual image (ghost), blurring (suitability for solid printing), etc. The toners have a narrow charge amount distribution and, hence, attain excellent image stability. The toners have a narrow particle diameter distribution and have a low fine-powder content even when reduced in toner particle diameter. The toners hence have an improved bulk density and satisfactory fixability. Consequently, the toners of the invention are not only usable in general printers, copiers, and the like but also extensively usable in image-forming apparatus which have been developed recently and have a high resolution, long life, and high printing speed.

The image-forming apparatus of the invention is excellent in image stability during long-term use, and in the effect of inhibiting selective development, etc. Consequently, the image-forming apparatus is not only usable as general printers, copiers, or the like but also extensively usable in methods of image formation which have been developed recently and attain a high resolution, long life, and high printing speed.

The invention claimed is:

1. A toner for electrostatic-image development satisfying all of the following (1) to (4):

(1) a volume-median diameter (Dv50) is from 4.0 μm to 7.5 μm;

(2) an average degree of circularity is 0.93 or higher;

(3) a volume-median diameter (Dv50) of the toner and population number % of toner particles having a particle diameter of from 2.00 vim to 3.56 μm (Dns) in the toner satisfy the relationship Dns≤0.233EXP(17.3/Dv50); and (4) a coefficient of variation in number is 24.0% or lower.

2. The toner for electrostatic-image development according to claim 1, wherein the volume-median diameter (Dv50) of the toner and population number % of toner particles having a particle diameter of from 2.00 μm to 3.56 μm (Dns) in the toner satisfy the relationship Dns≤0.11EXP(19.9/Dv50).

3. The toner for electrostatic-image development according to claim 1, wherein the volume-median diameter (Dv50) of the toner and population number % of toner particles having a particle diameter of from 2.00 μm to 3.56 μm (Dns) in the toner satisfy the relationship 0.0517EXP(22.4/Dv50) ≤Dns.

4. The toner for electrostatic-image development according to claim 1, wherein the volume-median diameter (Dv50) of the toner is from 5.0 μm to 7.5 μm.

5. The toner for electrostatic-image development according to claim 1, wherein the population number % of toner particles having a particle diameter of from 2.00 μm to 3.56 μm (Dns) is 6% by number or lower.

6. The toner for electrostatic-image development according to claim 1, which is a toner obtained by forming particles in an aqueous medium.

7. The toner for electrostatic-image development according to claim 1, which is a toner produced by an emulsion polymerization agglutination method.

8. The toner for electrostatic-image development according to claim 1, which comprises core particles and fine resin particles bonded or adhered to the core particles.

9. The toner for electrostatic-image development according to claim 8, wherein the fine resin particles contain a wax.

10. The toner for electrostatic-image development according to claim 8 or 9, wherein the core particles each are constituted at least of primary polymer particles, and the total proportion of polar monomers in 100% by mass of all polymerizable monomers constituting a binder resin as the fine resin particles is lower than the total proportion of polar monomers in 100% by mass of all polymerizable monomers constituting a binder resin as the primary polymer particles constituting the core particles.

11. The toner for electrostatic-image development according to claim 1, which comprises a wax in an amount of 4 to 20 parts by weight per 100 parts by weight of the toner for electrostatic-image development.

12. The toner for electrostatic-image development according to claim 1, which is a color toner.

13. The toner for electrostatic-image development according to claim 12, which has a surface potential of −30 V or lower.

14. The toner for electrostatic-image development according to claim 12 or 13, where a solid print image has a gloss value of 32 or lower.

15. The toner for electrostatic-image development according to claim 1, which is obtained without via a step for removing particles not larger than the volume-median diameter (Dv50) of the toner.

16. The toner for electrostatic-image development according to claim 1, which has a standard deviation of charge amount of from 1.0 to 2.0.

* * * * *